US010354489B2

(12) United States Patent
Mio et al.

(10) Patent No.: US 10,354,489 B2
(45) Date of Patent: Jul. 16, 2019

(54) GAMING MACHINE PROVIDING BENEFIT ACCORDING TO GAME PLAY COUNT

(71) Applicants: Universal Entertainment Corporation, Tokyo (JP); Aruze Gaming America, Inc., Las Vegas, NV (US)

(72) Inventors: Susumu Mio, Tokyo (JP); Yuji Miyagawa, Tokyo (JP); Takehisa Itagaki, Tokyo (JP); Yukihiro Kawakami, Tokyo (JP); Takeshi Narita, Tokyo (JP); Yoichi Kato, Tokyo (JP); Bungo Matsumura, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 645 days.

(21) Appl. No.: 15/080,737

(22) Filed: Mar. 25, 2016

(65) Prior Publication Data

US 2016/0284167 A1 Sep. 29, 2016

(30) Foreign Application Priority Data

Mar. 26, 2015 (JP) ..... 2015-064556
Mar. 26, 2015 (JP) ..... 2015-064571
Mar. 26, 2015 (JP) ..... 2015-064616
Mar. 26, 2015 (JP) ..... 2015-064626

(51) Int. Cl.
*G07F 17/32* (2006.01)
*G07F 17/34* (2006.01)

(52) U.S. Cl.
CPC ..... *G07F 17/3255* (2013.01); *G07F 17/3267* (2013.01); *G07F 17/34* (2013.01)

(58) Field of Classification Search
CPC ..... G07F 17/34
See application file for complete search history.

(56) References Cited

U.S. PATENT DOCUMENTS 5,910,048 A 6/1999 Feinberg
2010/0124979 A1* 5/2010 Acres ..... G07F 17/32 463/20
2010/0178975 A1* 7/2010 Acres ..... G07F 17/3227 463/20

FOREIGN PATENT DOCUMENTS

JP 2008-229017 10/2008

* cited by examiner

*Primary Examiner* — Robert T Clarke, Jr.
(74) *Attorney, Agent, or Firm* — Lex IP Meister, PLLC

(57) ABSTRACT

It is an object to provide a gaming machine configured to yield a rescue award according to the number of result determination areas on which the player has placed a bet, when games without any benefit are continued. To this end, a slot machine 1 executes a process of receiving a selection of ways bet through a control Panel 30, incrementing the game play count on a counter corresponding to the ways bet selected, upon start of the normal game, determining whether the game play count on the counter has reached the threshold game play count, and awarding the benefit when the game play count is determined as to have reached the threshold game play count.

3 Claims, 100 Drawing Sheets

(TOTAL COUNTER)

| WAYS BET | TOTAL COUNTER |
|---|---|
| WAYS BET1 (3WAYS) | 430 |
| WAYS BET2 (9WAYS) | 395 |
| WAYS BET3 (27WAYS) | 300 |
| WAYS BET4 (81WAYS) | 350 |
| WAYS BET5 (243WAYS) | 220 |
| WAYS BET5 (3WAYS) + FEATURE BOOST | 90 |

EXAMPLE WINNING DETERMINATION

FIG.8

SYMBOL ARRAYS ON VIDEO REELS FOR NORMAL GAME

| | REEL 1 | REEL 2 | REEL 3 | REEL 4 | REEL 5 |
|---|---|---|---|---|---|
| 0 | FEATURE | NINE | FEATURE | NINE | FEATURE |
| 1 | QUEEN | JACK | ACE | JACK | QUEEN |
| 2 | NINE | WILD | MAN | WILD | ACE |
| 3 | FISH | NINE | QUEEN | NINE | FISH |
| 4 | ACE | TEN | FISH | JACK | JACK |
| 5 | KING | MAN | NINE | DRAGON | ACE |
| 6 | TURTLE | QUEEN | GOURD | KING | NINE |
| 7 | TEN | FISH | KING | MAN | DRAGON |
| 8 | JACK | ACE | FEATURE | TEN | TEN |
| 9 | MAN | TURTLE | ACE | FISH | ACE |
| 10 | ACE | NINE | FISH | NINE | GOURD |
| 11 | DRAGON | GOURD | TEN | GOURD | NINE |
| 12 | QUEEN | TEN | TURTLE | ACE | ACE |
| 13 | NINE | NINE | JACK | FEATURE | TURTLE |
| 14 | MAN | FEATURE | FEATURE | QUEEN | TEN |
| 15 | ACE | QUEEN | ACE | TURTLE | FISH |
| 16 | TEN | TEN | TURTLE | TEN | ACE |
| 17 | GOURD | FISH | KING | DRAGON | KING |
| 18 | QUEEN | ACE | TEN | NINE | DRAGON |
| 19 | NINE | QUEEN | DRAGON | KING | ACE |
| 20 | FISH | MAN | JACK | TURTLE | MAN |
| 21 | TEN | KING | NINE | ACE | KING |
| 22 | KING | FEATURE | MAN | JACK | FISH |
| 23 | GOURD | JACK | QUEEN | FEATURE | QUEEN |
| 24 | ACE | DRAGON | TEN | TEN | ACE |
| 25 | TEN | KING | WILD | GOURD | GOURD |
| 26 | MAN | GOURD | QUEEN | KING | JACK |
| 27 | KING | ACE | TEN | | NINE |
| 28 | TEN | FISH | | | DRAGON |
| 29 | | | | | TEN |
| 30 | | | | | NINE |
| 31 | | | | | GOURD |
| 32 | | | | | JACK |
| 33 | | | | | NINE |
| 34 | | | | | |

FIG.9

SYMBOL ARRAYS ON VIDEO REELS FOR FREE GAME

| | REEL 1 | REEL 2 | REEL 3 | REEL 4 | REEL 5 |
|---|---|---|---|---|---|
| 0 | FEATURE | NINE | FEATURE | NINE | FEATURE |
| 1 | QUEEN | JACK | ACE | QUEEN | QUEEN |
| 2 | NINE | DRAGON | DRAGON | DRAGON | ACE |
| 3 | FISH | NINE | JACK | NINE | DRAGON |
| 4 | ACE | JACK | FISH | QUEEN | JACK |
| 5 | KING | MAN | NINE | MAN | ACE |
| 6 | TURTLE | QUEEN | GOURD | KING | NINE |
| 7 | TEN | FISH | JACK | FISH | TURTLE |
| 8 | KING | ACE | TURTLE | JACK | TEN |
| 9 | MAN | TURTLE | QUEEN | MAN | ACE |
| 10 | ACE | NINE | FISH | TEN | GOURD |
| 11 | DRAGON | GOURD | TEN | GOURD | QUEEN |
| 12 | TEN | KING | TURTLE | KING | ACE |
| 13 | KING | NINE | QUEEN | FEATURE | TURTLE |
| 14 | MAN | GOURD | GOURD | JACK | NINE |
| 15 | ACE | QUEEN | NINE | FISH | FISH |
| 16 | TEN | TEN | TURTLE | TEN | ACE |
| 17 | GOURD | FISH | KING | DRAGON | KING |
| 18 | JACK | ACE | TEN | NINE | DRAGON |
| 19 | TEN | QUEEN | DRAGON | KING | ACE |
| 20 | FISH | MAN | QUEEN | TURTLE | MAN |
| 21 | KING | KING | NINE | ACE | JACK |
| 22 | TEN | FEATURE | MAN | JACK | TEN |
| 23 | DRAGON | JACK | JACK | FEATURE | TURTLE |
| 24 | ACE | DRAGON | TEN | TEN | ACE |
| 25 | TEN | KING | DRAGON | GOURD | KING |
| 26 | DRAGON | GOURD | JACK | KING | |
| 27 | KING | ACE | TEN | | |
| 28 | TEN | DRAGON | | | |
| 29 | | | | | |

FIG.11

SYMBOL COMBINATION TABLE

| SYMBOL | GRAPHICS | 1 | 2 | 3 | 4 | 5 |
|---|---|---|---|---|---|---|
| WILD | INGOT | 0 | 0 | 0 | 0 | 0 |
| MAN | WEALTH GOD | 0 | 0 | 50 | 100 | 500 |
| DRAGON | DRAGON | 0 | 0 | 35 | 100 | 400 |
| FISH | FISH | 0 | 0 | 30 | 100 | 400 |
| TURTLE | TURTLE | 0 | 0 | 20 | 50 | 300 |
| GOURD | GOURD | 0 | 0 | 15 | 35 | 300 |
| ACE | A | 0 | 0 | 10 | 30 | 200 |
| KING | K | 0 | 0 | 10 | 30 | 200 |
| QUEEN | Q | 0 | 0 | 5 | 10 | 100 |
| JACK | J | 0 | 0 | 5 | 10 | 100 |
| TEN | 10 | 0 | 0 | 5 | 10 | 100 |
| NINE | 9 | 0 | 0 | 5 | 10 | 100 |
| FEATURE※ | MONEY | 0 | 0 | 5 | 10 | 50 |

(TOTAL COUNTER)

| WAYS BET | TOTAL COUNTER |
|---|---|
| WAYS BET1 (3WAYS) | 430 |
| WAYS BET2 (9WAYS) | 395 |
| WAYS BET3 (27WAYS) | 300 |
| WAYS BET4 (81WAYS) | 350 |
| WAYS BET5 (243WAYS) | 220 |
| WAYS BET5 (3WAYS) + FEATURE BOOST | 90 |

(TOTAL COUNTER OF WAYS BET5)

| WAYS BET | TOTAL COUNTER |
|---|---|
| WAYS BET5 (243WAYS) | 450 |

DETAILS OF CREDIT TYPES BET ON 450 GAMES (CREDIT TYPE COUNTER OF WAYS BET5)

| ID | CREDIT TYPE? | CREDIT TYPE COUNTER |
|---|---|---|
| 0 | 1BET | 370 |
| 1 | 2BET | 48 |
| 2 | 3BET | 20 |
| 3 | 4BET | 4 |
| 4 | 5BET | 8 |
| | TOTAL | 450 |

FIG.14

(SPECIAL GAME BASIC PAYOUT TABLE DETERMINATION TABLE)

| JEWEL TYPE | WAYS BET1 (3WAYS) | WAYS BET2 (9WAYS) | WAYS BET3 (27WAYS) | WAYS BET4 (81WAYS) | WAYS BET5 (243WAYS) | WAYS BET5 +FEATURE BOOST |
|---|---|---|---|---|---|---|
| RED JEWEL | 100 | 500 | 1000 | 2000 | 3000 | 4000 |
| BLUE JEWEL | 75 | 250 | 500 | 1250 | 2000 | 2500 |
| GREEN JEWEL | 30 | 200 | 400 | 750 | 1000 | 1500 |
| AMBER JEWEL | 20 | 150 | 300 | 550 | 800 | 1000 |
| PURPLE JEWEL | 15 | 100 | 200 | 350 | 500 | 750 |

FIG.15

(PAYOUT RATE RANDOM DETERMINATION TABLE)

| ID | LEVEL (PAYOUT RATE) | PAYOUT RATE RANDOM DETERMINATION TABLE 1BET | PAYOUT RATE RANDOM DETERMINATION TABLE 2BET | PAYOUT RATE RANDOM DETERMINATION TABLE 3BET | PAYOUT RATE RANDOM DETERMINATION TABLE 5BET | PAYOUT RATE RANDOM DETERMINATION TABLE 10BET |
|---|---|---|---|---|---|---|
| 0 | LVI (PAYOUT RATE: X1) | 29968/30000 | 1/30000 | 1/30000 | 1/30000 | 1/30000 |
| 1 | LV2 (PAYOUT RATE: X2) | 1/30000 | 29420/30000 | 1/30000 | 1/30000 | 1/30000 |
| 2 | LV3 (PAYOUT RATE: X3) | 1/30000 | 548/30000 | 28854/30000 | 1/30000 | 1/30000 |
| 3 | LV4 (PAYOUT RATE: X4) | 1/30000 | 1/30000 | 1114/30000 | 1/30000 | 1/30000 |
| 4 | LV5 (PAYOUT RATE: X5) | 1/30000 | 1/30000 | 1/30000 | 29526/30000 | 1/30000 |
| 5 | LV6 (PAYOUT RATE: X10) | 1/30000 | 1/30000 | 1/30000 | 438/30000 | 29459/30000 |
| 6 | V7 (PAYOUT RATE: X20) | 27/30000 | 28/30000 | 28/30000 | 32/30000 | 536/30000 |
| 7 | TOTAL | 30000/30000 | 30000/30000 | 30000/30000 | 30000/30000 | 30000/30000 |

FIG.16

(PAYOUT RATE RANDOM DETERMINATION TABLE DETERMINATION TABLE)

| PAYOUT RATE RANDOM DETERMINATION TABLE | PROBABILITY OF BEING RANDOMLY SELECTED |
|---|---|
| PAYOUT RATE RANDOM DETERMINATION TABLE 1BET | 370/450 |
| PAYOUT RATE RANDOM DETERMINATION TABLE 2BET | 48/450 |
| PAYOUT RATE RANDOM DETERMINATION TABLE 3BET | 20/450 |
| PAYOUT RATE RANDOM DETERMINATION TABLE 5BET | 4/450 |
| PAYOUT RATE RANDOM DETERMINATION TABLE 10BET | 8/450 |
| TOTAL | 450/450 |

FIG.17

(MYSTERY FEATURE WINNING TABLE)

| ID | | WEIGHT |
|---|---|---|
| 0 | LOSE | 29999/30000 |
| 1 | WIN | 1/30000 |
| | TOTAL | 30000/30000 |

■ COEXISTENCE WITH REEL SKIP FUNCTION

FIG.65
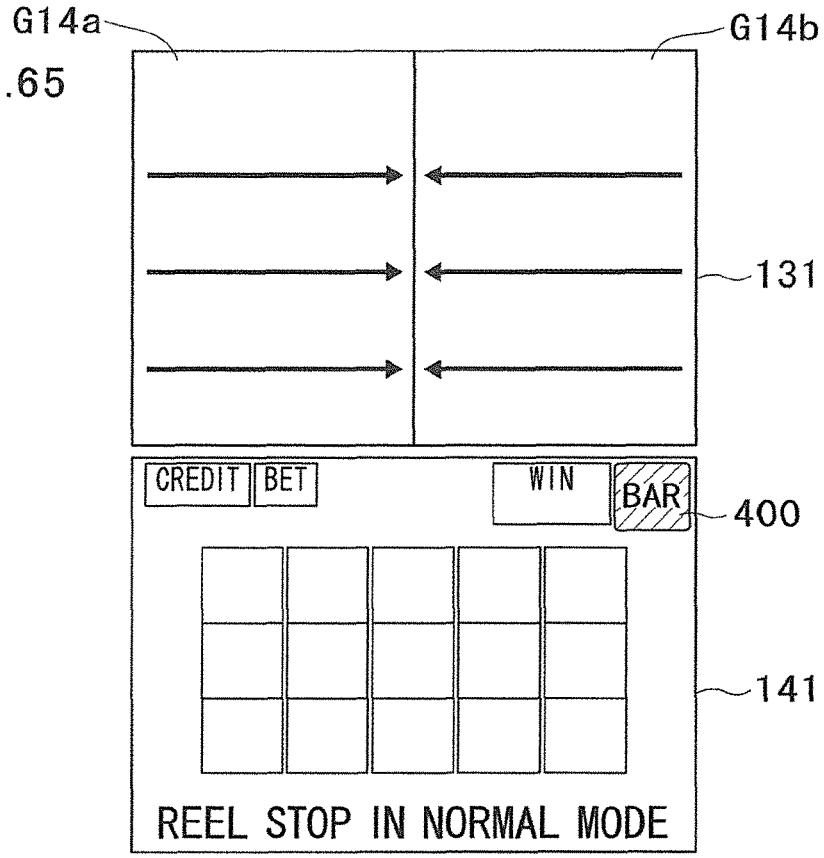
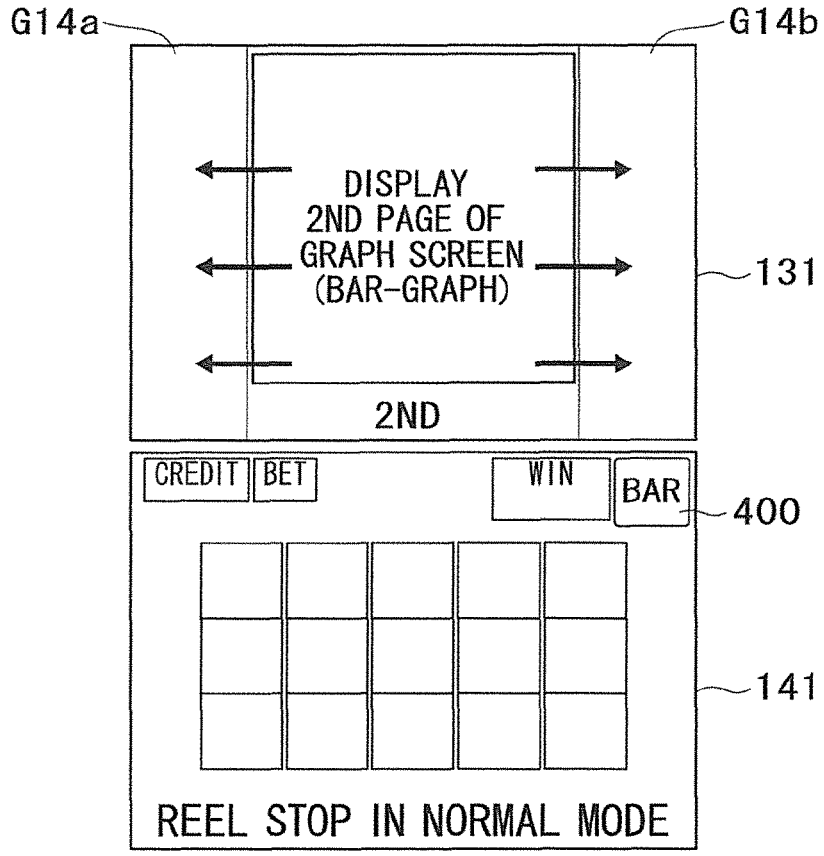

FIG.66
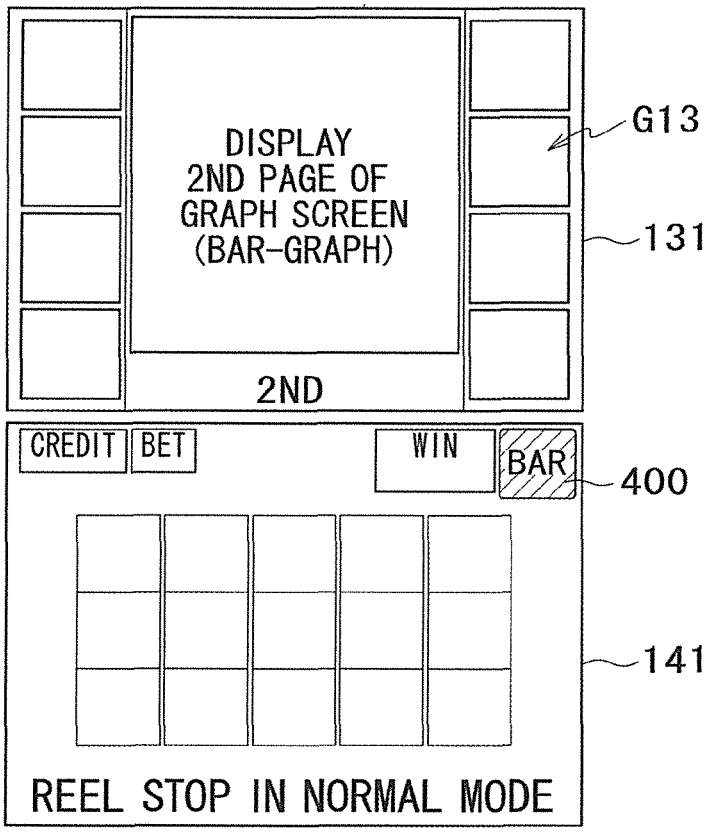
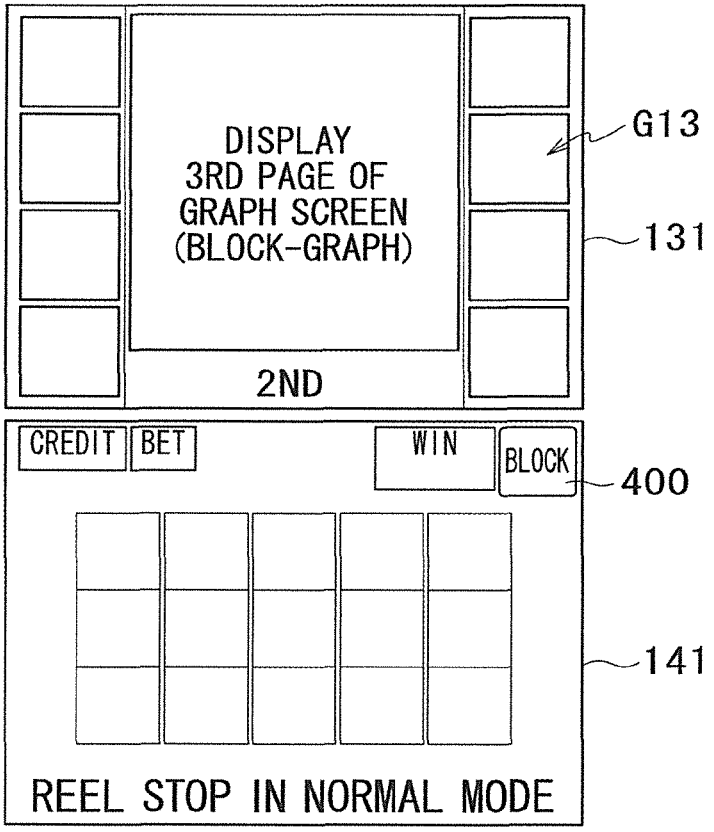

FIG.67
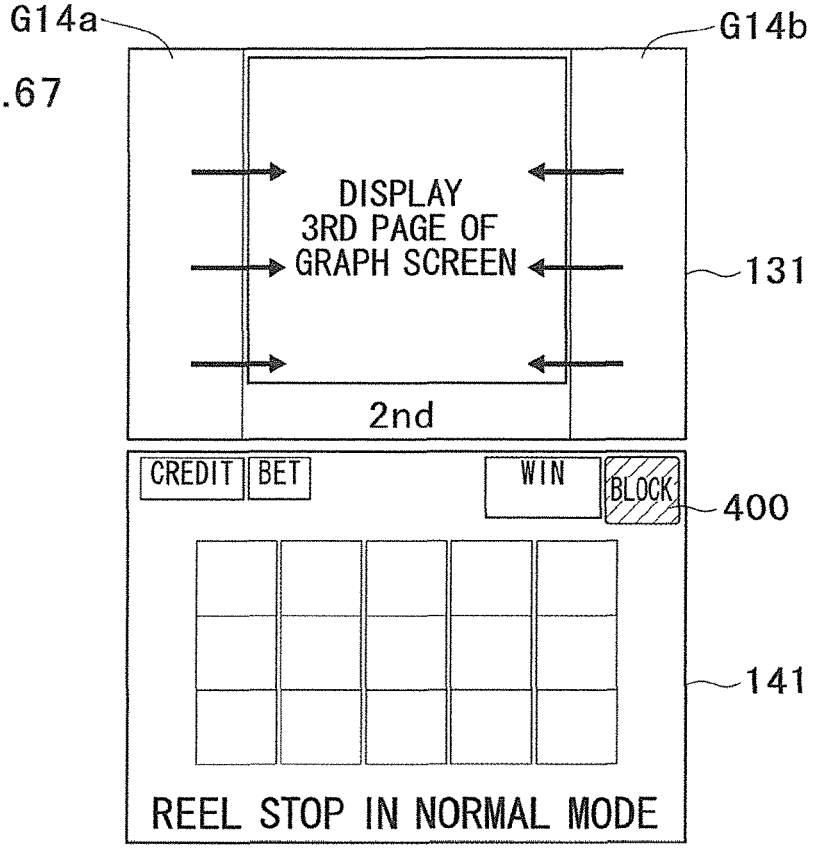
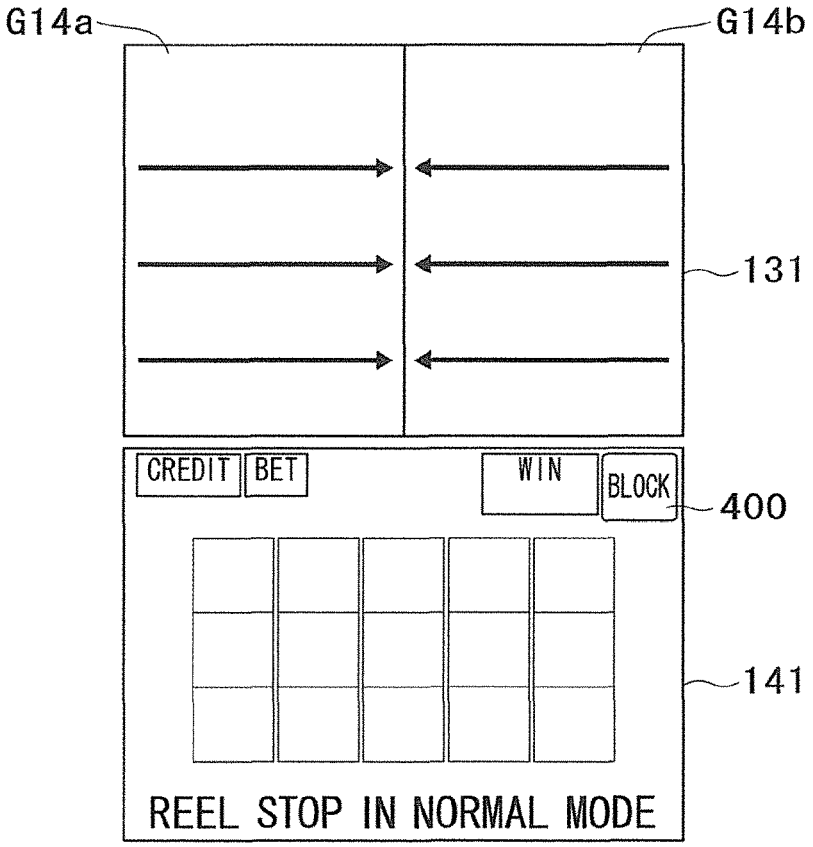

FIG.83

AUDIT->SETTING->SOFTWARE SETTING

| Setting Name | Setting Data |
|---|---|
| DEMO MODE | |
| TOPPER ILLUMINATION PATTERN | |
| LED BRIGHTNESS | |
| LANGUAGE SELECT BUTTON | |
| LINE GRAPH | DISABLED<br>ENABLED [DEFAULT]<br>CANCEL |
| BAR GRAPH | DISABLED<br>ENABLED [DEFAULT]<br>CANCEL |
| BLOCK GRAPH | DISABLED<br>ENABLED [DEFAULT]<br>CANCEL |

FIG.94

| | GAMBLE ON | GAMBLE ON |
|---|---|---|
| CASH OUT | TAKE WIN | TAKE WIN |
| GAMBLE | GAMBLE START | — |
| MAX BET | INVALID | GAMBLE START |
| SPIN | TO NORMAL GAME | TO NORMAL GAME |

FIG.98

| NO | SCREEN | CONTROL PANEL | OPERATION |
|---|---|---|---|
| 1 | EXIT | HELP | SHIFT TO NORMAL SCREEN |
| 2 | PREV. | BET ×1 | SHIFT TO PREVIOUS PAGE |
| 3 | NEXT | BET ×2 | SHIFT TO NEXT PAGE |

FIG.101

| BUTTON TYPE | WHILE IDLING | DURING GAME | WHILE ERROR TAKES PLACE | DURING AUDIT | TAKE WIN OR GAMBLE |
|---|---|---|---|---|---|
| HELP | TURNED ON | TURNED OFF | TURNED OFF | TURNED OFF | TURNED ON |
| LANGUAGE SWITCH | TURNED ON | TURNED OFF | TURNED OFF | TURNED OFF | TURNED OFF |
| VOLUME | TURNED ON | TURNED ON | TURNED OFF | TURNED OFF | TURNED ON |
| NUMBER OF LINES | TURNED ON (WHEN SELECTABLE) | TURNED OFF | TURNED OFF | TURNED OFF | TURNED OFF |
| BET AMOUNT | TURNED ON | TURNED OFF | TURNED OFF | TURNED OFF | TURNED OFF |
| PAY TABLE | TURNED ON | TURNED OFF | TURNED OFF | TURNED OFF | TURNED ON |

GAMING MACHINE PROVIDING BENEFIT ACCORDING TO GAME PLAY COUNT

CROSS REFERENCE TO RELATED APPLICATION

The present application claims priority from Japanese Patent Applications No. 2015-064616 filed on Mar. 26, 2015, No. 2015-064626 filed on Mar. 26, 2015, No. 2015-064556 filed on Mar. 26, 2015, and No. 2015-064571 filed on Mar. 26, 2015, the disclosures of which are herein incorporated by reference in its entirety.

TECHNICAL FIELD

The present invention relates to a gaming machine that yields a rescue award, when a game continues without awarding of any benefit.

BACKGROUND ART

Traditionally, in a facility where gaming machines such as slot machines and the like are set up, games are played by betting various types of gaming medium such as a credit and the like in the slot machines. In each slot machine are set a plurality of result determination areas (areas for which determination of win or loss is carried out) on which a bet is placeable, and a benefit (payout) is awarded based on the number of result determination areas on which a bet is placed, the number of bet credits, and the game result (see for example, Japanese Unexamined Patent Publication No. 2008-229017; hereinafter PTL 1).

Further, amongst the slot machines are those configured to perform an awarding (rescue) to the player, when the number of plays resulting no benefit reaches a predetermined number (see for example Specification of Publication of U.S. Pat. No. 5,910,048; hereinafter, PTL 2). For example, a constant amount of payout is awarded when the number of plays of the game resulting in no benefit reaches a predetermined value (so-called ceiling number).

SUMMARY OF THE INVENTION

Technical Problem

It however may lead to unfairness if the rescue is conducted in the same manner, no matter the bets are placed only on a few result determination areas or on many result determination areas.

In view of the above, it is an object of the present invention to provide a gaming machine configured to yield a rescue award according to the number of result determination areas on which the player has placed a bet, when games without any benefit are continued.

Technical Solution (P14-0822)

An aspect of the present invention is a gaming machine, comprising: an input device that allows selection of any one or more result determination areas out of a plurality of result determination areas;

a display device configured to indicate a game result by rearranging a plurality of symbols in the one or more selected result determination areas;

a storage unit configured to store a counter that keeps track of the game play count which is incremented upon start of the game, for each of the plurality of result determination areas, and further stores a threshold game play count for awarding of a benefit; and a controller programmed to perform the following steps of (1a) to (1c), which are (1a) receiving a selection of the result determination areas through the input device, (1b) incrementing the game play count on the counter corresponding to the result determination area selected in the step (1a), upon start of the game, and (1c) determining whether the game play count on the counter has reached the threshold game play count, and awards the benefit when the game play count is determined as to have reached the threshold game play count.

In the structure, the game play count on the counter corresponding to the selected result determination area is incremented upon start of the game, and a benefit is awarded when the game play count on the counter reaches the threshold game play count. With the counter which keeps track of the game play count provided independently of the other counters, for each of the plurality of result determination areas, variation is given to the result determination areas to be selected by the player.

Another aspect of the present invention is the gaming machine of the above aspect, adapted so that the controller is programmed to further execute the processes of:

(1d) resetting only the game play count on the counter corresponding to the result determination area in which the game play count has reached to the threshold game play count, after the step (1c).

In the structure, when the game play count reaches the threshold game play count, a benefit is awarded and only the game play count on the counter corresponding to the result determination area in which the game play count has reached the threshold game play count is reset. Game play counts on counters corresponding to result determination areas having not yet reached their threshold game play counts are maintained.

This induces the player to select any of the result determination areas in which their game play counts have not yet reached their threshold game play counts.

Further, another aspect of the present invention is the gaming machine of the above aspect, adapted so that the above game runs a normal game and a free game to which transition may occur from the normal game, the controller is programmed to further execute the processes of:

(1e) resetting only the game play count on the counter corresponding to the result determination area selected in the step (1a), when a free game trigger, which allows transition to the free game, during the normal game.

In the structure, when the free game trigger, which allows transition to the free game, occurs during the normal game, the free game is run and only the game play count on the counter corresponding to the selected result determination area is reset while game play counts on the counters of the other result determination areas are maintained.

This induces the player to select any of the result determination areas in which their game play counts have not yet reached their threshold game play counts.

Further, another aspect of the present invention is a method of controlling a game in a gaming machine comprising: an input device that allows selection of any one or more result determination areas out of a plurality of result determination areas;

a display device configured to indicate a game result by rearranging a plurality of symbols in the one or more selected result determination areas;

a storage unit configured to store a counter that keeps track of the game play count which is incremented upon start of the game, for each of the plurality of result determination areas, and further stores a threshold game play count for awarding of a benefit; and a controller, the method comprising the controller-executed steps of:

(1a) receiving a selection of the result determination areas through the input device, (1b) incrementing the game play count on the counter corresponding to the result determination area selected in the step (1a), upon start of the game, and (1c) determining whether the game play count on the counter has reached the threshold game play count, and awards the benefit when the game play count is determined as to have reached the threshold game play count.

In the method, the game play count on the counter corresponding to the selected result determination area is incremented upon start of the game, and a benefit is awarded when the game play count on the counter reaches the threshold game play count. With the counter which keeps track of the game play count provided independently of the other counters, for each of the plurality of result determination areas, variation is given to the result determination areas to be selected by the player.

The above structures provide a gaming machine configured to yield a rescue award according to the number of result determination areas on which the player has placed a bet, when games without any benefit are continued.

(P14-0823)

Another aspect of the present invention is a gaming machine, comprising: an input device that allows selection of any one or more result determination areas out of a plurality of result determination areas;

a display device configured to indicate a game result by rearranging a plurality of symbols in the one or more selected result determination areas;

a storage unit configured to store a counter that keeps track of the game play count which is incremented upon start of the game, for each of the plurality of result determination areas, store a threshold game play count for a special game awarding a payout, for each of the plurality of result determination areas, and store a special game basic payout table determination table in which the plurality of result determination areas are associated with a plurality of special game basic payout tables; and a controller programmed to execute the processes of:

(1a) receiving a selection of the result determination areas through the input device, (1b) incrementing the game play count on the counter corresponding to the result determination area selected in the step (1a), upon start of the game, and (1c) determining whether the game play count on the counter has reached the threshold game play count, and awards a special game trigger when the game play count is determined as to have reached the threshold game play count, (1d) determining a special game basic payout table to be referred to in the special game, based on the result determination area corresponding to the counter whose value has reached to the threshold game play count in the step (1c) and the special game basic payout table determination table, and (1e) when the special game is run, awarding a payout based on the special game basic payout table determined in the step (1d).

In the structure, the plurality of result determination areas are associated with the plurality of special game basic payout tables in the special game basic payout table determination table. Therefore, it is possible to adjust an expectation value for the payout by the relation between each of the result determination areas to be selected by the player and the special game basic payout table to be the reference for the payout in the special game. As such, it is possible to set the expectation value for the payout of the special game according to the result determination areas selected by the player, and ensure the fairness of the payouts in the special game.

The above aspect of the present invention may be adapted so that in the game, transition to the special game occurs when a predetermined condition is satisfied, and the controller is configured to perform the following steps of:

(1f) running the game, and when the predetermined condition is satisfied as the result of the game, determines the special game basic payout table to be referred to in the special game, based on the result determination area selected in the step (1a) and the special game basic payout table determination table, and (1g) when the predetermined condition is satisfied and transition to the special game occurs, awarding a payout based on the special game basic payout table determined in the step (1f).

With the structure, it is possible to use the special game basic payout table determination table as a table for determining the special game basic payout table used in the special game having been transited as the result of satisfying the predetermined condition in the game, and as a table for determining the special game basic payout table used in the special game transited when the game play count on the counter reaches the threshold game play count.

Another aspect of the present invention is a gaming machine, comprising a result determination area input device that allows selection of any one or more result determination areas out of a plurality of result determination areas;

a display device configured to indicate a game result by rearranging a plurality of symbols in the one or more selected result determination areas;

a credit type input device that enables betting of any of a plurality of credit types of different number of credits;

a storage unit configured to store a total counter that keeps track of the game play count which is incremented upon start of the game, for each of the plurality of result determination areas, stores a credit type counter for each credit type, which keeps track of the game play count incremented upon start of the game for each result determination area, store a threshold game play count for the special game trigger of a special game awarding a payout, for each of the plurality of result determination areas, and store a plurality of payout rate random determination tables each of which is for determining the payout rate; and a controller configured to award a benefit based on the credit amount bet and the combination of a plurality of symbols rearranged in the selected result determination area, and to execute the following processes of:

(2a) receiving a selection of the result determination areas through the result determination area input device and receiving a bet of any of the credit types through the credit type input device;

(2b) incrementing the game play count on the total counter corresponding to the result determination area selected in the step (2a), upon start of the game, (2c) incrementing the game play count on the credit type counter corresponding to the result determination area selected in the step (2a) and to the credit type of the bet placed, upon start of the game, (2d) determining whether the game play count on the total counter has reached the threshold game play count, and when the game play count is determined as to have reached the threshold game play count, calculating random determination probabilities, based on the percentage of the credit types in the threshold game play count, and creates a payout rate random determination table determination table in which the calculated random determination probabilities are associated with the plurality of payout rate random determination tables;

(2e) executing a payout rate random determination table random determination for determining the payout rate random determination table, based on the payout rate random determination table determination table created in the step (2d);

(2f) executing payout rate random determination for determining the payout rate based on the payout rate random determination table determined in the step (2e); and (2g) referring to the payout rate determined in the step (2f), at a time of awarding a payout in the special game.

With the above structure, the payout rate random determination table determination table is created according to the usage counts of each of the credit types at a time the value of the total counter reaches the threshold game play count. Then, based on the payout rate random determination table determination table created, the payout rate random determination table is determined, and random determination is executed for determining the payout rate in the special game based on the payout rate random determination having been determined. In this payout rate random determination, there is executed a random determination corresponding to the usage counts of each of the credit types at a time the game play count reaches the threshold game play count. That is, the usage count of each credit type at a time the value of the total counter reaches the threshold game play count affects determination of the payout rate in the special game. Therefore, each bet placed until the value of the total counter reaches the threshold game play count is not wasted, which ensures the fairness in the special game.

Another aspect of the present invention is a method of controlling a gaming machine comprising: an input device that allows selection of any one or more result determination areas out of a plurality of result determination areas;

a display device configured to indicate a game result by rearranging a plurality of symbols in the one or more selected result determination areas;

a storage unit configured to store a counter that keeps track of the game play count which is incremented upon start of the game, for each of the plurality of result determination areas, store a threshold game play count for a special game awarding a payout, for each of the plurality of result determination areas, and store a special game basic payout table determination table in which the plurality of result determination areas are associated with a plurality of special game basic payout tables; and a controller, the method comprising the controller-executed steps of:

(1a) receiving a selection of the result determination areas through the input device, (1b) incrementing the game play count on the counter corresponding to the result determination area selected in the step (1a), upon start of the game, and (1c) determining whether the game play count on the counter has reached the threshold game play count, and awards a special game trigger when the game play count is determined as to have reached the threshold game play count, (1d) determining a special game basic payout table to be referred to in the special game, based on the result determination area corresponding to the counter whose value has reached to the threshold game play count in the step (1c) and the special game basic payout table determination table, and (1e) when the special game is run, awarding a payout based on the special game basic payout table determined in the step (1d).

In the method, the plurality of result determination areas are associated with the plurality of special game basic payout tables in the special game basic payout table determination table. Therefore, it is possible to adjust an expectation value for the payout by the relation between each of the result determination areas to be selected by the player and the special game basic payout table to be the reference for the payout in the special game. As such, it is possible to set the expectation value for the payout of the special game according to the result determination areas selected by the player, and ensure the fairness of the payouts in the special game.

The above structures provide a gaming machine configured to yield a rescue award according to the number of result determination areas on which the player has placed a bet, when games without any benefit are continued.

(P14-0826)

Another aspect of the present invention is a gaming machine, comprising: a display device configured to display a game result by rearranging a plurality of types of symbols aligned on a plurality of video reels;

a storage unit configured to store a payout table in which a plurality of symbol combinations and a plurality of payouts are associated;

a controller programmed to execute the processes of:

(1A) running a game and rearrange the plurality of symbols aligned on a plurality of video reels on the display device;

(1B) determining and awarding a payout, referring to a combination of the symbols rearranged on the display device and the payout table;

(1C) determining whether or not the symbols rearranged include a predetermined type of symbol, and if the symbols include the predetermined type of symbol, fixing the predetermined type of symbol on the display device until the predetermined number of plays of the game are consumed;

(1D) running the game again and rearrange the plurality of symbols aligned on the plurality of video reels on the display device;

(1E) determining and awarding a payout, referring to a combination of the symbols rearranged on the display device in the step (1D) and the symbol fixed in the step (1C), and the payout table;

(1F) if the symbol fixed in the step (1C) and a symbol rearranged in the step (1D) in the position of the symbol fixed in the step (1C) overlap with each other in the combination of symbols for which the payout is to be awarded as the result of the step (1E), displaying and subjecting to awarding of a payout both a combination of symbols including the symbol fixed in the step (1C) and a combination of symbols including the symbol overlapped with the symbol fixed in the step (1C); and (1G) repeating the step (1C) to (1F) until the predetermined number of plays of the game are consumed.

With the above structure, a predetermined type of symbol is accumulatively fixed, while a predetermined number of plays of a game are run. This facilitates formation of a combination including the predetermined type of symbol. Further, although the predetermined type of symbol is fixed, a symbol to be rearranged in the first place in the position where the predetermined type of symbol is fixed, as the result of rearranging a plurality of types of symbols aligned on the plurality of video reels, will be regarded as a symbol forming a combination of symbols subjected to awarding of a payout.

The gaming machine of the above aspect of the present invention may be adapted so that, in the step (1F), if a combination of symbols including the symbol fixed in the step (1C) is not a combination for which a payout is to be awarded and if a combination of symbols including a symbol to be rearranged in the step (1D) in the position of the symbol fixed in the step (1C) is a combination for which a payout is to be awarded, the controller displays the symbol to be rearranged in the step (1D) in the position of the symbol fixed in the step (1C) in front of the symbol fixed in the step (1C).

The above structure most preferentially displays on the display device a combination of symbols for which a payout is to be awarded.

The gaming machine of the above aspect of the present invention may be adapted so that, in the step (1F), if a combination of symbols including the symbol fixed in the step (1C) is a combination for which a payout is to be awarded, and if a combination of symbols including a symbol to be rearranged in the step (1D) in the position of the symbol fixed in the step (1C) is a combination for which a payout is to be awarded, the controller alternately displays on the display device the combination of symbols including the symbol fixed in the step (1C), and a combination of symbols including the symbol to be rearranged in the step (1D) in the position of the symbol fixed in the step (1C).

In the above structure, if a combination of symbols including the symbol fixed in the step (1C) is a combination for which a payout is to be awarded, and if a combination of symbols including a symbol to be rearranged in the step (1D) in the position of the symbol fixed in the step (1C) is a combination for which a payout is to be awarded, both of symbol combinations are displayed.

The gaming machine of the above aspect of the present invention may be adapted so that, in the step (1F), a symbol rearranged behind the symbol fixed is partially visible.

Traditionally, when a symbol is fixed, a symbol that is supposed to be stopped in the position of the fixed symbol will be excluded in the subsequent unit games. In this structure, the player may miss a chance of winning a payout that could have been won if there was not the fixed symbol. This could lessen the player's expectation for winning of a payout.

Further, if a symbol is fixed and a part of symbol rearranged behind the fixed symbol is visible, it could further disappoint the player.

To address this, if a symbol rearranged behind the fixed symbol is partially visible, that partially visible symbol rearranged behind the fixed symbol will be regarded as a symbol forming a combination of symbols subjected to awarding of a payout.

Another aspect of the present invention is a method of controlling a gaming machine which comprises a display device configured to display a game result by rearranging a plurality of types of symbols aligned on a plurality of video reels;

a storage unit configured to store a payout table in which a plurality of symbol combinations and a plurality of payouts are associated;

a controller, the method comprising the controller-executed steps of:

(1A) running a game and rearrange the plurality of symbols aligned on a plurality of video reels on the display device;

(1B) determining and awarding a payout, referring to a combination of the symbols rearranged on the display device and the payout table;

(1C) determining whether or not the symbols rearranged include a predetermined type of symbol, and if the symbols include the predetermined type of symbol, fixing the predetermined type of symbol on the display device until a predetermined number of plays of the game are consumed;

(1D) running a game and rearrange the plurality of symbols aligned on a plurality of video reels on the display device;

(1E) determining and awarding a payout, referring to a combination of the symbols rearranged on the display device in the step (1D) and the symbol fixed in the step (1C), and the payout table;

(1F) if the symbol fixed in the step (1C) and a symbol rearranged in the step (1D) in the position of the symbol fixed in the step (1C) overlap with each other in the combination of symbols for which the payout is to be awarded as the result of the step (1E), displaying and subjecting to awarding of a payout both a combination of symbols including the symbol fixed in the step (1C) and a combination of symbols including the symbol overlapped with the symbol fixed in the step (1C); and (1G) repeating the step (1C) to (1F) until the predetermined number of plays of the game are consumed.

With the above method, a predetermined type of symbol is accumulatively fixed, while a predetermined number of plays of a game are run. This facilitates formation of a combination including the predetermined type of symbol. Further, although the predetermined type of symbol is fixed, a symbol to be rearranged in the first place in the position where the predetermined type of symbol is fixed, as the result of rearranging a plurality of types of symbols aligned on the plurality of video reels, will be regarded as a symbol forming a combination of symbols subjected to awarding of a payout.

Further, there is provided a gaming machine in which a symbol to be rearranged in the first place in the position where the predetermined type of symbol is fixed is regarded as a symbol forming a combination of symbols subjected to awarding of a payout.

(P14-0827)

Another aspect of the present invention is a gaming machine, comprising a display device configured to display a game result of a normal game and a game result of a free game to which transition occurs from the normal game, by rearranging a plurality of types of symbols aligned on a plurality of video reels;

a storage unit configured to store a payout table in which a plurality of symbol combinations and a plurality of payouts are associated;

a controller programmed to execute the processes of:

(1A) when a predetermined condition is satisfied as a result of the normal game, awarding a predetermined number of plays of a free game;

(1B) selecting any one or more symbols out of the plurality of types of symbols by means of random selection;

(1C) running the free game and rearrange the plurality of symbols aligned on a plurality of video reels on the display device;

(1D) determining and awarding a payout, referring to a combination of the symbols rearranged on the display device and the payout table;

(1E) determining whether or not the symbols rearranged include the one or more symbols selected in the step (1B), and if the symbols include the one or more symbols selected, fixing each of the one or more symbols selected on the display device until a predetermined number of plays of the game are consumed;

(1F) running again the free game and rearrange the plurality of symbols aligned on the plurality of video reels on the display device;

(1G) determining and awarding a payout, referring to a combination of the symbols rearranged on the display device in the step (1D) and the symbol fixed in the step (1E), and the payout table; and (1H) repeating the steps (1E) to (1G) until the free game is run a predetermined number of times.

With the above structure, the one or more symbols randomly selected are accumulatively fixed, while predetermined number of plays of a game are run. This facilitates formation of a combination including the one or more randomly selected symbols.

The gaming machine of the above aspect of the present invention may further comprise: an input device that allows selection of any one or more result determination areas out of a plurality of result determination areas, wherein the controller executes a process of receiving a selection of a result determination area out of the result determination areas through the input device during the normal game, in the step (1E), executes a process of determining whether or not the selected result determination area includes the one or more symbols selected in the step (1B), and if the selected result determination area includes the one or more symbols selected, fixing the one or more symbols selected in the selected result determination area until a predetermined number of plays of the free game are consumed; and in the step (1G), executing a process of determining and awarding a payout, referring to a combination of the symbols including symbols rearranged in the selected result determination area and symbols fixed in the result determination area, and the payout table.

With the above structure, the one or more symbols randomly selected are accumulatively fixed only in the selected result determination area. This facilitates, according to the result determination area selected, formation of a combination including the one or more randomly selected symbols. Further, the one or more randomly selected symbols are not fixed in the non-selected result determination areas, which makes it possible to avoid giving an unnecessary expectation feeling to the player.

The gaming machine of the above aspect of the present invention may further comprise:

an additional bet device configured to enable placement of an additional bet which leads to awarding of a further play of the free game in addition to the predetermined number of plays of the free game, if a predetermined condition is satisfied as the result of the normal game.

wherein the controller further executes a process of receiving an additional bet through the additional bet device during the normal game, and executes in the step (1A) a process of awarding the predetermined number of free games in addition to the foregoing predetermined number of free games, if the predetermined condition is satisfied as the result of the normal game.

In the above structure, placing an additional bet by using the additional bet device may lead to an increased number of plays of the free game awarded when the predetermined condition is satisfied as the result of the normal game. With the above structure, the one or more symbols randomly selected are accumulatively fixed, while the increased number of plays of the game are run. This further facilitates formation of a combination including the one or more randomly selected symbols.

Another aspect of the present invention is a method of controlling a gaming machine which comprises a display device configured to display a game result of a normal game and a game result of a free game to which transition occurs from the normal game, by rearranging a plurality of types of symbols aligned on a plurality of video reels;

a storage unit configured to store a payout table in which a plurality of symbol combinations and a plurality of payouts are associated; and a controller, the method comprising the controller-executed steps of:

(1A) awarding a predetermined number of plays of a free game when a predetermined condition is satisfied as a result of the normal game;

(1B) selecting any one or more symbols out of the plurality of types of symbols by means of random selection;

(1C) running a free game and rearranging the plurality of symbols aligned on a plurality of video reels on the display device;

(1D) determining and awarding a payout, referring to a combination of the symbols rearranged on the display device and the payout table;

(1E) determining whether or not the symbols rearranged include the one or more symbols selected in the step (1B), and if the symbols include the one or more symbols selected, fixing each of the one or more symbols selected on the display device until a predetermined number of plays of the free game are consumed;

(1F) running the game again and rearrange the plurality of symbols aligned on the plurality of video reels on the display device;

(1G) determining and awarding a payout, referring to a combination of the symbols rearranged on the display device in the step (1D) and the symbol fixed in the step (1E), and the payout table; and (1H) repeating the steps (1E) to (1G) until a predetermined number of plays of the free game are consumed.

With the above method, the one or more symbols randomly selected are accumulatively fixed, while a predetermined number of plays of a game are run. This facilitates formation of a combination including the one or more randomly selected symbols.

There is provided a gaming machine configured to fix-display a predetermined symbol on the display and provide sufficient period for formation of a combination of symbols including the predetermined symbol, thereby enhancing the player's expectation for winning of a payout.

BRIEF DESCRIPTION OF THE DRAWINGS

FIG. 8 shows symbol arrays on normal game video reels of the slot machine related to the embodiment of the present invention.

FIG. 9 shows symbol arrays on free game video reels of the slot machine related to the embodiment of the present invention.

FIG. 11 shows a symbol combination table of the slot machine related to the embodiment of the present invention.

FIG. 14 is an explanatory diagram of a special game basic payout table determination table of the slot machine related to the embodiment of the present invention.

FIG. 15 is an explanatory diagram of a payout rate random determination table of the slot machine related to the embodiment of the present invention.

FIG. 16 is an explanatory diagram of a payout rate random determination table determination table of the slot machine related to the embodiment of the present invention.

FIG. 17 is an explanatory diagram of a mystery feature win table of the slot machine related to the embodiment of the present invention.

FIG. 65 is an explanatory diagram of a displayed screen when a graph-switch button is operated.

FIG. 66 is an explanatory diagram of a displayed screen when a graph-switch button is operated.

FIG. 67 is an explanatory diagram of a displayed screen when a graph-switch button is operated.

FIG. 83 is an explanatory diagram of the specification of switching an active and inactive states of the graph screen based on an AUDIT setting.

FIG. 94 shows RESIDUAL GAMBLE of the slot machine related to the embodiment of the present invention.

FIG. 98 shows HELP specification of the slot machine related to the embodiment of the present invention.

FIG. 101 shows arrangement of screen touch buttons of the slot machine related to the embodiment of the present invention.

DESCRIPTION OF EMBODIMENTS

Embodiment Overview

Figure 1:
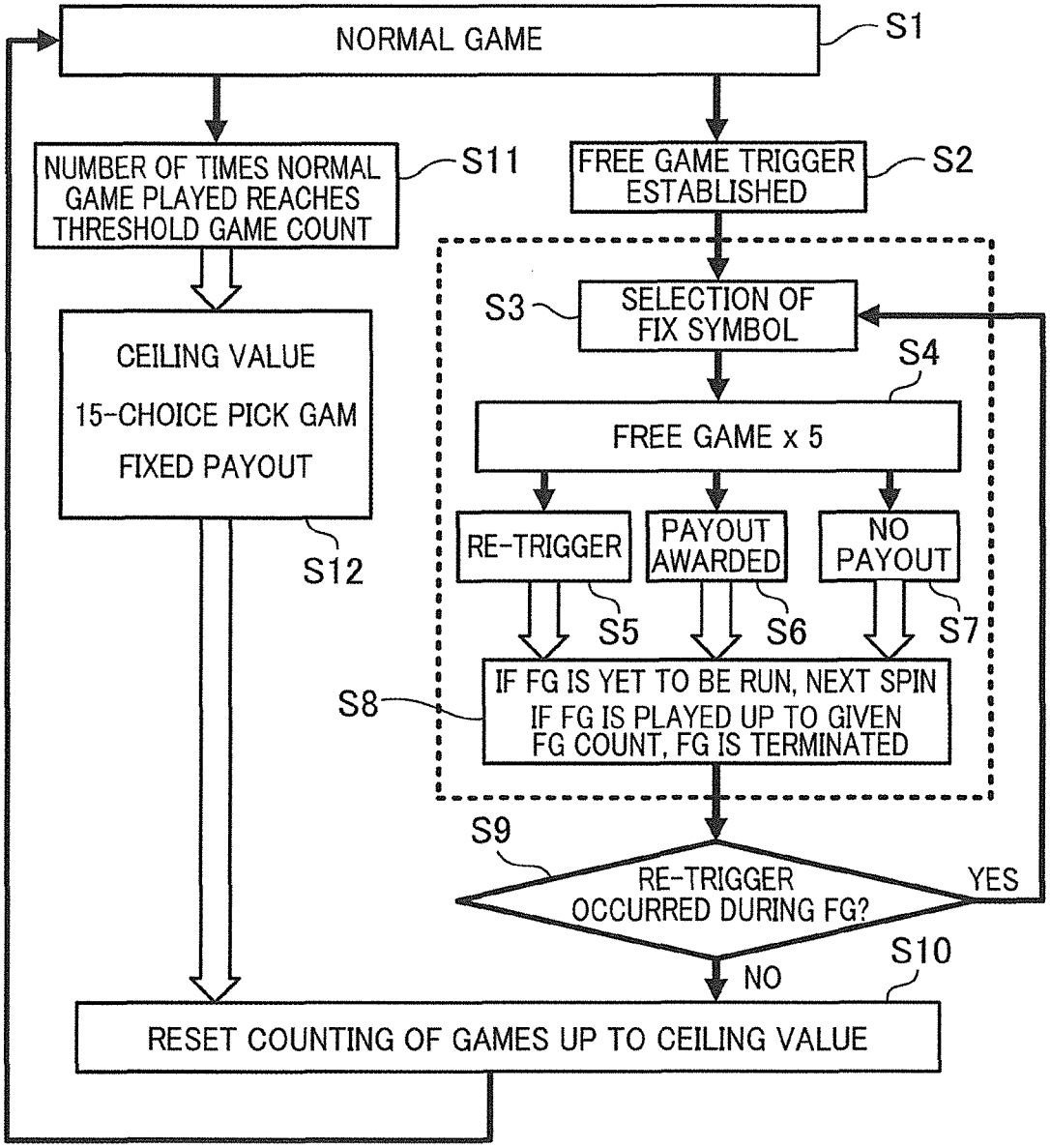
FIG. 1 shows the outline of game content of a slot machine according to an embodiment of the present invention.

The following will describe a gaming machine of the present invention with reference to figures. FIG. 1 shows the outline of games run in a slot machine related to the embodiment of the present invention.

The present embodiment deals with an example where the gaming machine is a slot machine configured to run a game which awards a benefit based on a combination of a plurality of symbols rearranged in a result determination area selected.

Specifically, the slot machine includes: an input device (control panel 30 and the like) which enables selection of any result determination area out of a plurality of result determination areas (WAYS BET1, WAYS BET2, WAYS BET3, WAYS BET4, WAYS BET5), a storage unit (RAM 73) configured to store a total counter that keeps track of the game play count which is incremented upon start of the game, for each of the plurality of result determination areas, and further store a threshold game play count for a special game awarding a benefit (15-choice pick game as a special game), for each of the plurality of result determination areas, and a controller (main CPU 71, ROM 72, RAM 73 and the like) programmed to perform the following steps.

The steps are specifically as follows. Namely, a selection of a result determination area is received via the input device of the slot machine, and a normal game is run which awards a benefit based on a combination of a plurality of symbols rearranged in a result determination area selected (S1). When a free game trigger is established in the normal game (S2), one or more fix symbols which or each of which is a symbol to be fixed in the result determination area in the free game is selected (randomly selected) (S3). Then, in the free game, the fix symbols are accumulatively fixed in the result determination area in which the first fix symbol is fixed (S4). When the free game results in a re-trigger (S5), awarding of a payout (S6), or no-payout (S7), and if the free game is yet to be repeated, the free game is run again. When the free game is repeated up to a given number of times, the free game is terminated (S8). Then, whether or not a re-trigger has occurred during the free game is determined (S9). If a re-trigger has occurred, the fix symbols are again selected (S3).

Further, as the result of the normal game, if the number of plays of the normal game reaches a threshold game play count (ceiling number) (S11), a 15-choice pick game (corresponding to a special game) is run, and a fixed payout is awarded (S12).

Then, in S9, if there is no re-trigger, or after the 15-choice pick game in S12, the number of times the normal game is played is reset (S10). Then, the state returns to the normal game (S1).

Definition

The slot machine is a type of a gaming machine. While the present embodiment deals with the slot machine as an example of the gaming machine, the slot machine may be a different type of machine on condition that a normal game can be individually run by the machine and a free game developing from the normal game can be run by the machine.

A normal game of the present embodiment is run by the slot machine. The normal game is a slot game of rearranging symbols.

The symbols encompasses "MAN", "DRAGON", "FISH", "TURTLE", "GOURD", "ACE", "KING", "QUEEN", "JACK", "TEN", "NINE", "WILD", and "FEATURE".

A coin, paper money, or electrically valuable information corresponding to these is used as a game value. Note that the gaming value in the present invention is not particularly limited. Examples of the gaming value include game media such as medals, tokens, cyber money, tickets, and the like. A ticket is not particularly limited, and a later-mentioned barcoded ticket may be adopted for example.

The free game of the present embodiment may be any type of game on condition that the gaming state thereof is different from that of the normal game. The free game is a game which is executable with a smaller amount of game values bet than in the normal game. Note that "bet of fewer amounts of gaming values" encompasses a bet of zero gaming value. The "free game" therefore may be a game runnable without a bet of a gaming value, which free game awards an amount of gaming values based on symbols rearranged. In other words, the "free game" may be a game which is started without consumption of a gaming value. To the contrary, the "normal game" is a game runnable on condition that a gaming value is bet, which normal game awards an amount of gaming value based on the symbols rearranged. In other words, the "normal game" is a game which starts with consumption of a gaming value. Further, the "free game" is a game to which transition occurs when a predetermined condition (free game trigger) is satisfied in the normal game.

The term "rearrangement" indicates that the symbols are rearranged after the arrangement of the symbols is dismissed. The term "arrangement" indicates a state in which the symbols are visually recognizable by an external player.

[Explanation of Function Flow Diagram]

Figure 2:
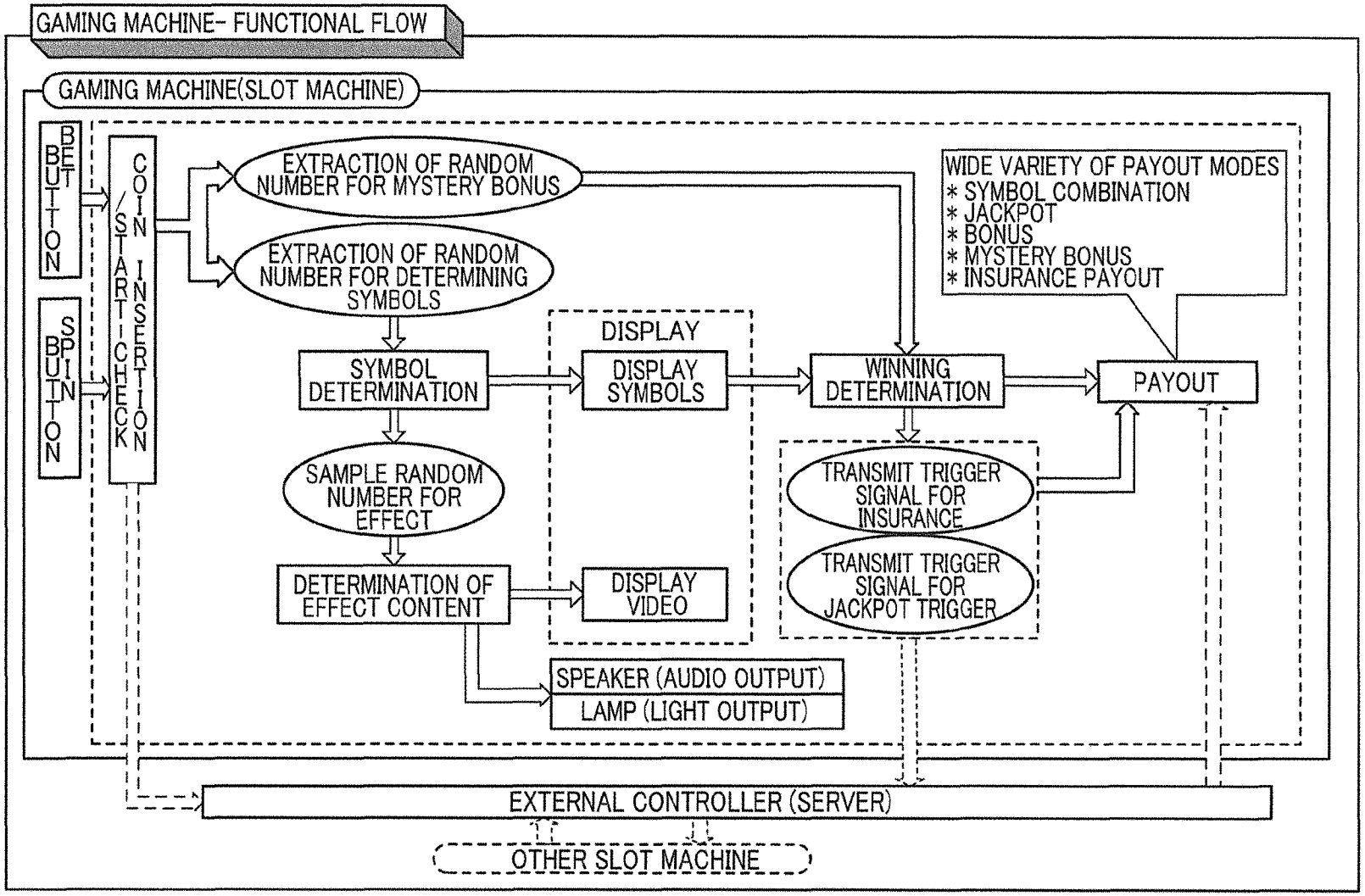
FIG. 2 shows a functional flow of the slot machine of the embodiment of the present invention.

The following describes basic functions of the slot machine related to the embodiment of the present invention, with reference to FIG. 2. FIG. 2 is a diagram showing functional flow of the slot machine related to the embodiment of the present invention.

(Start-Check)

First, the slot machine checks whether or not a BET button has been pressed by a player, and subsequently checks whether or not a spin button has been pressed by the player.

<Symbol Determination>

Next, when a spin button has been pressed by the player, the slot machine extracts a random number for symbol determination, and determines symbols to be displayed for the player at the time of stopping the scroll of the symbol array, for respective video reels displayed on a display.

<Symbol Display>

Then the slot machine starts the scroll of the symbol array of each video reel, and stops the scroll so that the determined symbols are displayed for the player.

<Win Determination>

Subsequently, as the rotation of the symbol array of each video reel is stopped, the slot machine determines whether the combination of the symbols displayed for the player is a combination related to win.

<Payout>

When the combination of the symbols displayed for the player is a combination related to win, the slot machine offers, to the player, benefit according to the combination. For example, when a combination of symbols related to a payout of coins has been displayed, the slot machine pays out coins of the number corresponding to the combination of symbols to the player.

When a combination of symbols associated with a free game trigger is displayed, the slot machine starts the free game. In the embodiment of the present invention, as the free game, a game (free game) which executes the random determination of the symbols to be stopped a predetermined number of times without consumption of coins.

When a combination of symbols associated with a jackpot trigger is displayed, the slot machine may pay out coins corresponding to a jackpot amount to the player. As the jackpot, at least one of the coins consumed by the player at each slot machine is accumulated as a jackpot amount, and when the jackpot trigger is established at a slot machine, coins corresponding to the accumulated jackpot amount is paid out to that slot machine. In the present case, the slot machine calculates an amount (accumulative amount) accumulated to the jackpot amount each time the game is played, and sends the calculation result to an external controller. The external controller adds the accumulative amount sent from each slot machine to the jackpot amount.

In addition to the above, the slot machine may have other benefits such as mystery bonus, in addition to the benefit above. In the mystery bonus, a predetermined number of coins are paid out when a win is achieved in dedicated random determination. When a spin button is pressed, the slot machine samples a random number for the mystery bonus, and whether a mystery bonus trigger is established is randomly determined.

A rescue function built in the present embodiment is a function for rescuing the player from a situation of not being able to play the free game for a long period of time (a function of awarding a return (rescue) to a player, if a predetermined benefit is not awarded in a predetermined number of plays of a game). In the embodiment of the present invention, the administrator of the slot machine is able to select whether rescue is active or inactive. When the rescue is activated, the slot machine starts to count the number of plays of the game played. When the counted number of plays of the game played reaches a predetermined number without awarding of a large amount of payout in the free game and the like, the slot machine awards a predetermined benefit.

<Determination of Effect>

The slot machine produces an effect by displaying an image on a display, outputting light from a lamp, and outputting sound from a speaker. The slot machine samples an effect-use random number and determines the content of an effect based on randomly determined symbols or the like.

[Overall Structure of Game System]

Figure 3:
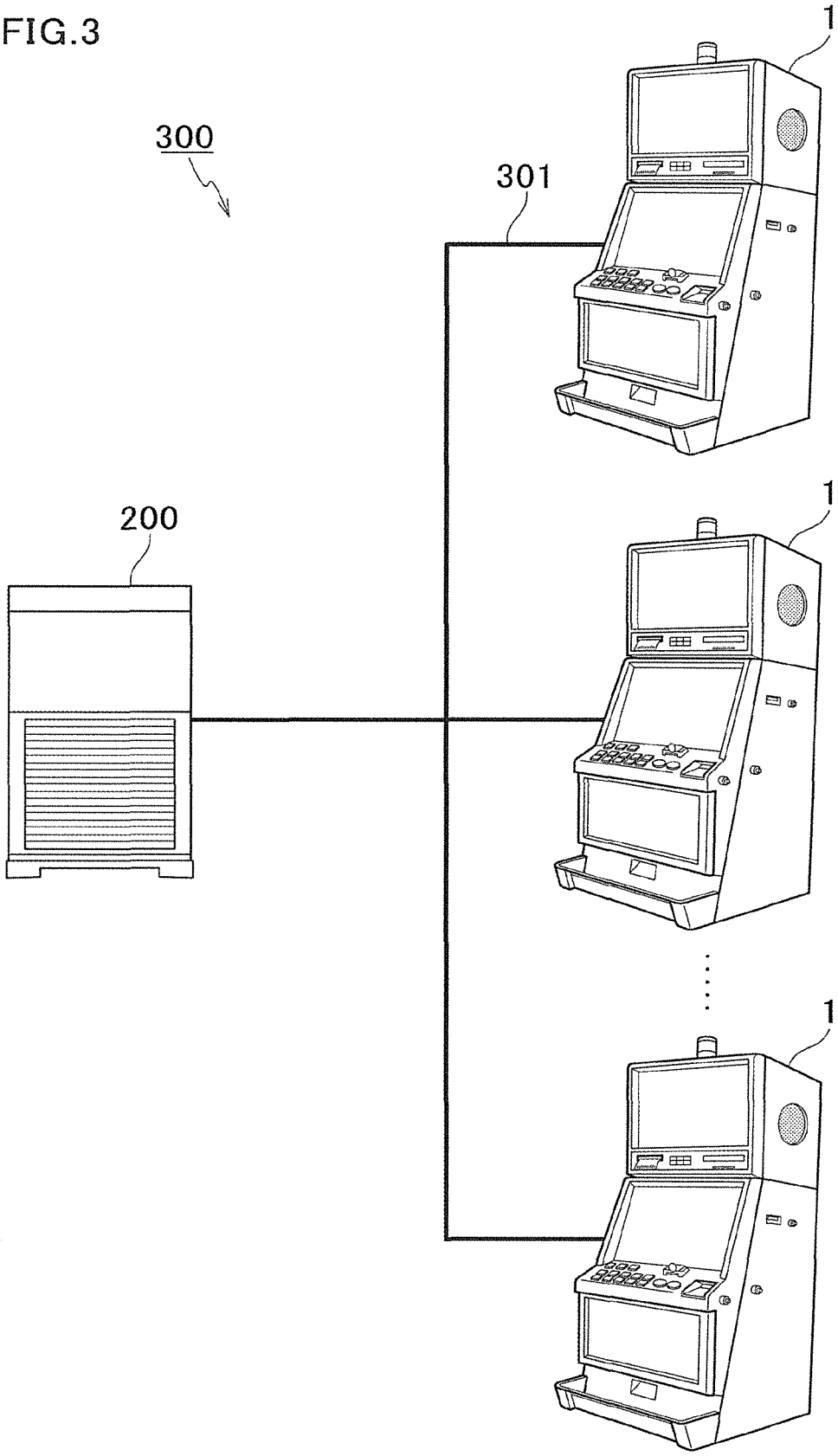
FIG. 3 shows a game system including the slot machine of the embodiment of the present invention.

The basic functions of the slot machine have been described as above. Now, referring to FIG. 3, a game system including the slot machine will be described. FIG. 3 shows the game system including the slot machine of the embodiment of the present invention.

A game system 300 includes a plurality of slot machines 1 and an external controller 200 connected with the slot machines 1 via a communication line 301.

The external controller 200 is for controlling the plurality of slot machines 1. In the present embodiment, the external controller 200 is a so-called hall server installed in a game arcade where the plurality of slot machines 1 are provided. Each of the slot machines 1 has a unique identification number, and the external controller 200 identifies which one of the slot machines 1 transmitted data, by referring to the identification number. Further, the external controller 200 determines transmission target of data with the identification number when transmitting data to a slot machine 1.

It is to be noted that the game system 300 may be constructed within a single gaming facility where various games can be performed, such as a casino, or may be constructed among a plurality of gaming facilities. Further, when the game system 350 is constructed in a single gaming facility, the gaming system may be constructed in each floor or section of the gaming facility. The communication line 301 may be a wired or wireless line, and can adopt a dedicated line, an exchange line or the like.

[Overall Structure of Slot Machine]

Figure 4:
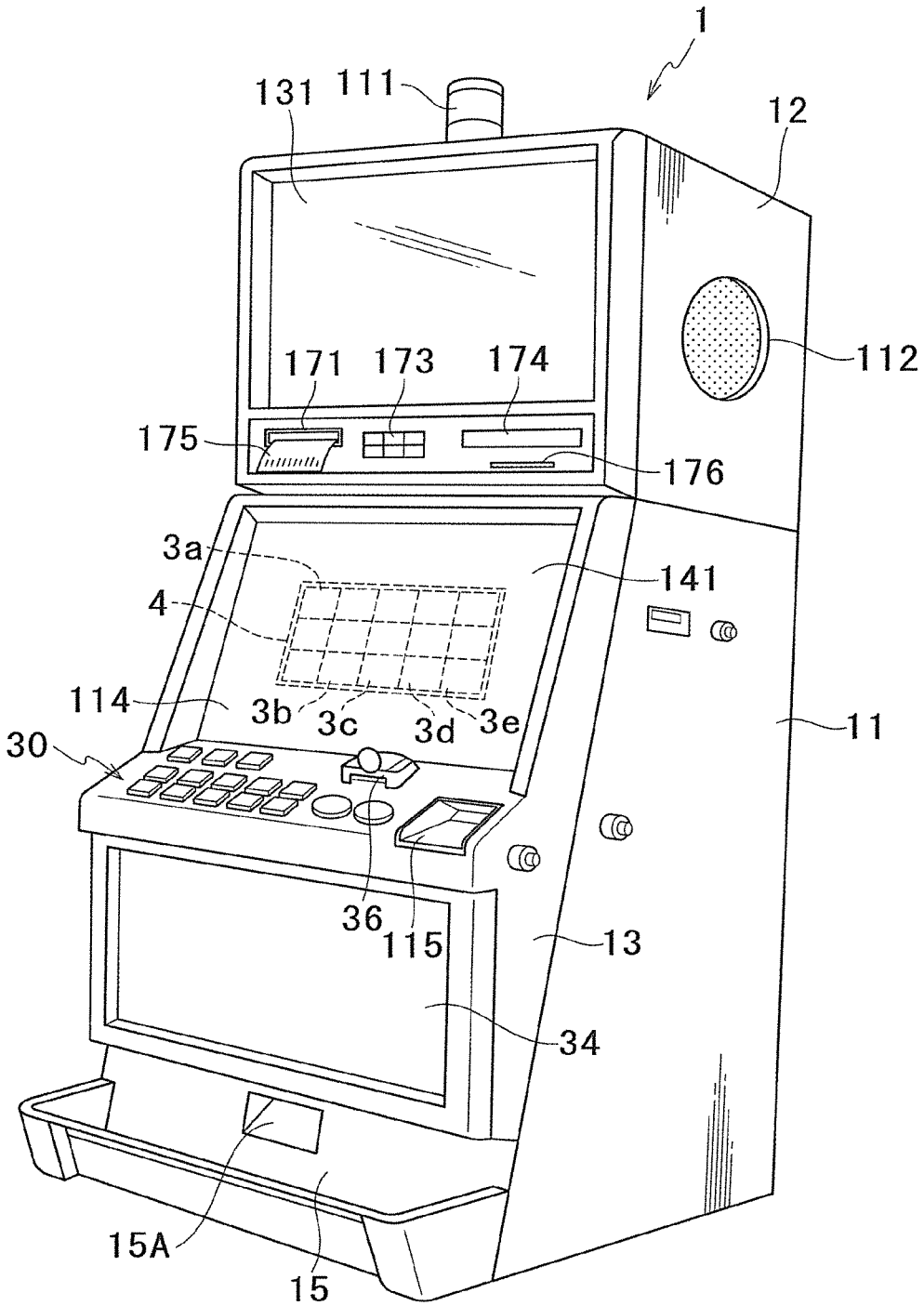
FIG. 4 shows the overall structure of the slot machine of the embodiment of the present invention.

Now, referring to FIG. 4, the overall structure of the slot machine 1 will be described. FIG. 4 shows the entire structure of the slot machine of the embodiment of the present invention.

A coin, a paper money, or electrically valuable information corresponding to these is used as a game medium in the slot machine 1. In the embodiment of the present invention, furthermore, a later-described ticket with barcode is also used. It is to be noted that the game medium is not limited to these, and for example a medal, a token, cyber money or the like can be adopted.

The slot machine 1 includes a cabinet 11, a top box 12 installed on the upper side of the cabinet 11, and a main door 13 provided at the front surface of the cabinet 11.

Figure 6:
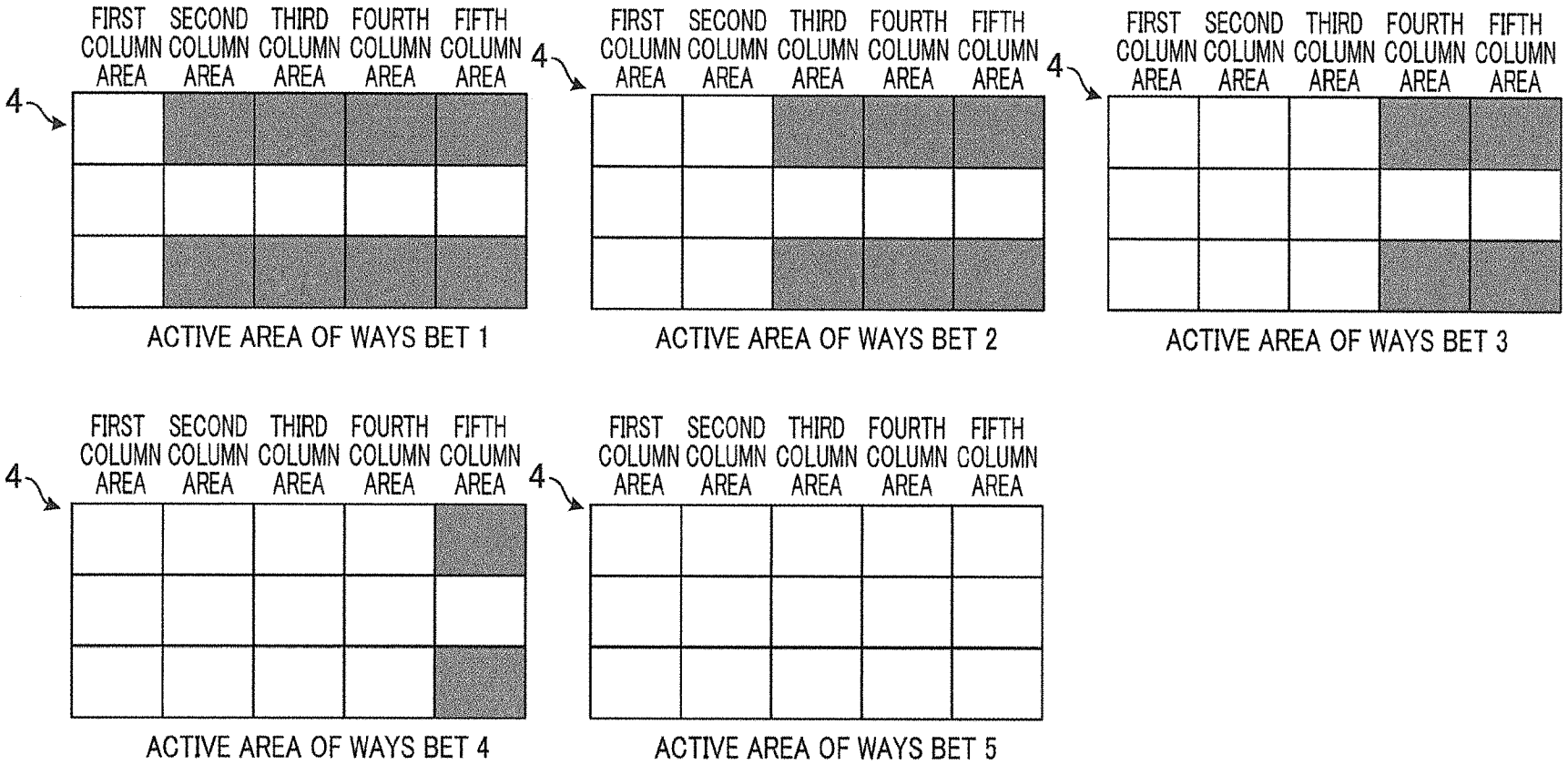
FIG. 6 illustrates active areas of "WAYS BET" in the slot machine of the embodiment of the present invention.
Figure 7:
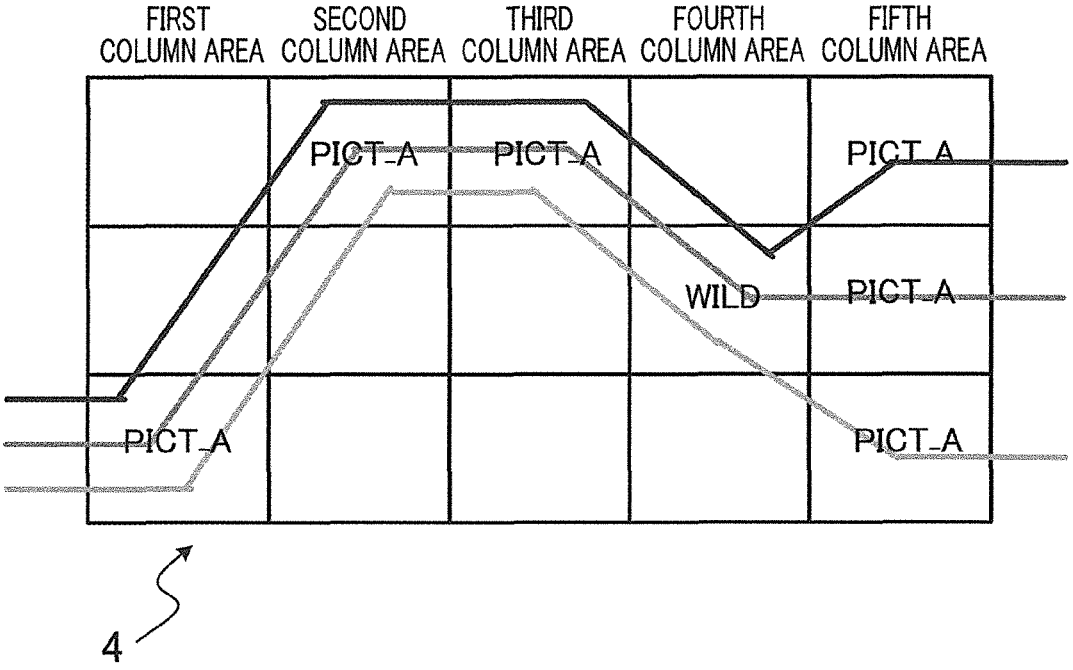
FIG. 7 is an explanatory diagram of active areas of "WAYS BET" in the slot machine related to the embodiment of the present invention.

At the center of the main door 13, a lower image display panel 141 is provided. The lower image display panel 141 is a liquid crystal panel and constitute a display. The lower image display panel 141 has a symbol display area 4. The symbol display area 4 includes 5 column areas (1st column area to 5th column area) each of which is divided into three areas: the upper stage, the middle stage, and the lower stage, as shown in FIG. 6 and FIG. 7. In the 1st column area to 5th column area, five video reels 3 (3*a*, 3*b*, 3*c*, 3*d*, and 3*e*) are displayed, respectively. In the embodiment of the present invention, the video reels are for expressing in the form of a video rotation and stop of symbols depicted on the circumferential surfaces of mechanical reels. To each of the video reels 3 is allocated a symbol array including predetermined symbols (see, e.g., FIG. 8 and FIG. 9 which will be described later).

In the symbol display area 4, the symbol array allocated to each video reel 3 (3*a*, 3*b*, 3*c*, 3*d*, 3*e*) scrolls and stops after elapse of a predetermined time. As a result, parts of the respective symbol arrays (three successive symbols in the embodiment of the present invention) are displayed for the player. In each of the 1st column area to the 5th column area of the symbol display area 4, one symbol is displayed in each of the three areas of the column area, i.e., the upper stage, the middle stage, and the lower stage, according to the corresponding video reel 3. To put it differently, 15 symbols forming a 5 by 3 matrix are displayed in the symbol display area 4.

In the embodiment of the present invention, "LEFT TO RIGHT" type is adopted for determining the win. That is, by selecting one of five stages of WAYS BET (WAYS BET1, WAYS BET2, WAYS BET3, WAYS BET4, and WAYS BET5), there are determined result determination areas to be subjected to result determination, out of 15 areas (the 5 by 3 matrix) of the symbol display area 4. Then a winning occurs when a predetermined number of symbols stopped in the result determination areas of 1st column area to 5th column area, which areas are subjected to result determination, are linked (see FIG. 7).

Specifically, as shown in FIG. 6, when "WAYS BET1" is selected, the areas out of the symbol display area 4 subjected to result determination (areas activated) are: the upper stage, the middle stage, and the lower stage of the 1st column area; the middle stage of the 2nd column area; the middle stage of the 3rd column area; the middle stage of the 4th column area; and the middle stage of the 5th column area. Further, when "WAYS BET2" is selected, the areas out of the symbol display area 4 subjected to result determination (areas activated) are: the upper stage, the middle stage, and the lower stage of the 1st column area; the upper stage, the middle stage, and the lower stage of the 2nd column area; the middle stage of the 3rd column area; the middle stage of the 4th column area; and the middle stage of the 5th column area. Further, when "WAYS BET3" is selected, the areas out of the symbol display area 4 subjected to result determination (areas activated) are: the upper stage, the middle stage, and the lower stage of the 1st column area; the upper stage, the middle stage, and the lower stage of the 2nd column area; the upper stage, the middle stage, and the lower stage of the 3rd column area; the middle stage of the 4th column area; and the middle stage of the 5th column area. Further, when "WAYS BET4" is selected, the areas out of the symbol display area 4 subjected to result determination (areas activated) are: the upper stage, the middle stage, and the lower stage of the 1st column area; the upper stage, the middle stage, and the lower stage of the 2nd column area; the upper stage, the middle stage, and the lower stage of the 3rd column area; the upper stage, the middle stage, and the lower stage of the 4th column area; and the middle stage of the 5th column area. Further, when "WAYS BET5" is selected, the areas out of the symbol display area 4 subjected to result determination (areas activated) are: the upper stage, the middle stage, and the lower stage of the 1st column area; the upper stage, the middle stage, and the lower stage of the 2nd column area; the upper stage, the middle stage, and the lower stage of the 3rd column area; the upper stage, the middle stage, and the lower stage of the 4th column area; and the upper stage, the middle stage, and the lower stage of the 5th column area.

For example, as shown in FIG. 7, when the "WAYS BET5" is selected, all the areas out of the symbol display area 4 are subjected to result determination (activated). As shown in FIG. 7, when a certain symbol (PICT_A, encompassing WILD symbol) occurs in the lower stage of the 1st column area, the upper stage of the 2nd column area, the upper stage of the 3rd column area, the middle stage of the 4th column area, and the upper stage, the middle stage, and the lower stage of the 5th column area, there are 3 wins in which the symbol occurs in five linked positions from the 1st column area to the 5th column area (LEFT TO RIGHT). In the "LEFT TO RIGHT" type, the symbols may appear to be scattered in the first sight; however, if they are linked throughout the 1st column area to the 5th column area, it is determined as a win. Although the present embodiment adopts the "LEFT TO RIGHT" type, it is possible to adopt a line type which regards as a winning line a line connecting any of three areas out of each symbol array of the video reel.

The lower image display panel 141 includes a touch panel 114. The player is allowed to input instructions by touching the lower image display panel 141.

Figure 5:
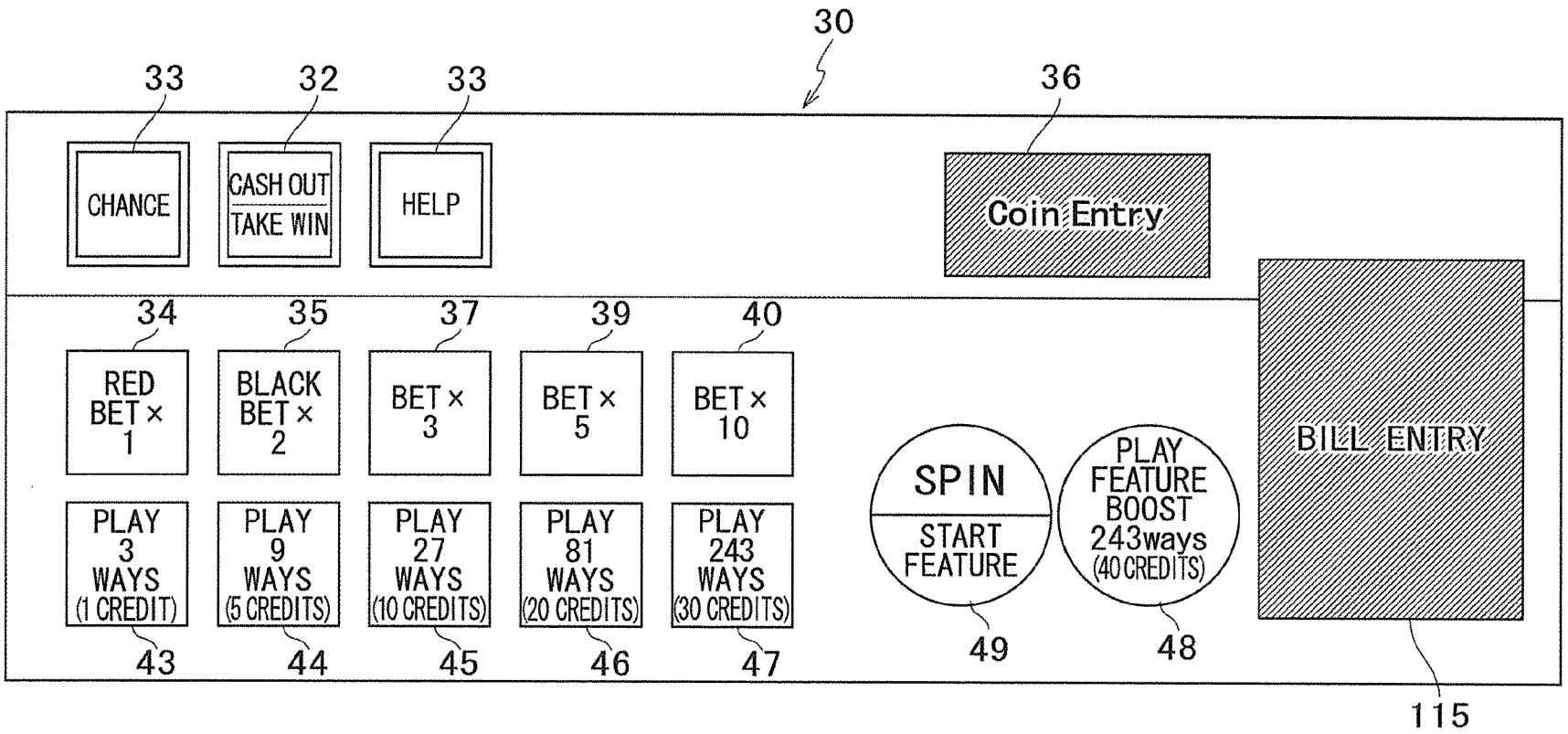
FIG. 5 shows a control panel of the slot machine of the embodiment of the present invention.

As shown in FIG. 4 and FIG. 5, below the lower image display panel 141 are provided various buttons on the control panel 30 (input device), a coin entry 36 which guides coins into the cabinet 11, and a bill entry 115.

The control panel 30 shown in FIG. 5 includes: a change button 31, a cashout/take win button 32, and a help button 33 arranged in the left side area of the upper stage; a 1-bet button 34, a 2-bet button 35, a 3-bet button 37, a 5-bet button 39, a 10-bet button 40, a ways bet1 button 43, a ways bet2 button 44, a ways bet3 button 45, a ways bet4 button 46, and a ways bet5 button 47 in the left side area of the lower stage. Further, a coin entry 36 and a bill entry 115 for accepting a bar code-attached ticket, paper money or the like are arranged in the right side area of the upper stage, and a spin button 49 and a feature boost button 48 (corresponding to additional bet device) are arranged in the right side area of the lower stage.

The change button 31 is an operation button to be used when temporarily leaving the seat, or when requesting a staff person of the gaming facility for an exchange. The cashout/take win button 32 is an operation button to be used for cashing out coins (credits) stored in the slot machine 10. The help button 33 is pressed when the operating method of a game is unclear. When the help button 33 is pressed, various types of help information are displayed on the upper image display panel 131 and the lower image display panel 141.

The ways bet1 button 43, the ways bet2 button 44, the ways bet3 button 45, the ways bet4 button 46, and ways bet5 button 47 are buttons for determined result determination areas to be subjected to result determination (to be activated), out of 15 areas (the 5 by 3 matrix) of the symbol display area 4. To determine the areas to be subjected to result determination by the ways bet1 button 43, 1 credit is required. To determine the areas to be subjected to result determination by the WAYS BET2 button 44, 5 credits are required. To determine the areas to be subjected to result determination by the WAYS BET3 button 45, 10 credits are required. To determine the areas to be subjected to result determination by the WAYS BET4 button 46, 20 credits are required. To determine the areas to be subjected to result determination by the WAYS BET5 button 47, 30 credits are required.

The feature boost button 48 is a button to turn on a feature boost function. Specifically, when the feature boost button 48 is pressed, the upper stages, the middle stages, and the lower stages of the 1st column area, the 2nd column area, the 3rd column area, the 4th column area, and the 5th column area of the symbol display area 4 are all subjected to the result determination (activated), as in a case of pressing the ways bet5 button 47, and the feature boost function is turned on. In the present embodiment, when the free game trigger is established in the normal game while the feature boost function is in the off state, there will be awarded five plays of free game. This number of plays of the free game awarded will be increased by one and six plays of the free game in total will be awarded, when the free game trigger is established in the normal game, while the feature boost function is in the on state. To determine the areas to be subjected to result determination by the feature boost button 48 and turn on the feature boost function, 40 credits are required.

The 1-BET button 34 is a button to determine ×1 as the multiplying factor relative to the payout (1BET). The 2-BET button 35 is a button to determine ×2 as the multiplying factor relative to the payout (2BET). The 3-BET button 37 is a button to determine ×3 as the multiplying factor relative to the payout (3BET). The 5-BET button 39 is a button to determine ×5 as the multiplying factor relative to the payout (5BET). The 10-BET button 40 is a button to determine ×10 as the multiplying factor relative to the payout (10BET). As described above, five credit types are selectable (corresponding to credit type input device).

In the present embodiment, the credit amount to be placed as a bet is determined by means of selecting any of the foregoing five stages of WAYS BET (i.e., WAYS BET, WAYS BET2, WAYS BET3, WAYS BET4, WAYS BET5) and any of the foregoing five types of BET buttons (i.e., 1-BET Button 34, 2-BET button 35, 3-BET button 37, 5-BET button 39, 10-BET button 40), and a unit game is started thereafter.

Specifically, the credit amount bet for starting the unit game is a product resulting from multiplication of the number of credits required by the selected ways bet by the credit value corresponding to the selected bet button. The number of credits required for the ways bet is 1 credit for ways bet1, 5 credits for ways bet2, 10 credits for ways bet3, 20 credits for ways bet4, 30 credits for ways bet5, and 40 credits are required for a feature boost button 48. For example, when the WAYS BET1 and 2-BET button 35 are selected, 2 credits, which is a product of 1×2, are placed as the bet. Further, when the WAYS BET3 and 3-BET button 37 are selected, 30 credits, which is a product of 10×3, are placed as the bet. Further, when the WAYS BET5 and 10-BET button 40 are selected, 300 credits, which is a product of 30×10, are placed as the bet.

The spin button 49 is a button for starting scroll of the video reels 3 (3*a*, 3*b*, 3*c*, 3*d*, and 3*e*). The spin button 49 also serves as a button for use in selection making in relation to the progress of the game.

The coin entry 36 is used for receiving coins into the cabinet 11. The bill entry 115 validates paper money, and accepts genuine paper money and a barcode attached ticket 175 into the cabinet 11.

An upper image display panel 131 is provided at the front face of the top box 12. The upper image display panel 131 includes a liquid crystal panel, and forms the display. The upper image display panel 131 displays images related to effects and images showing introduction of the game contents and explanation of the game rules. Further, the top box 12 is provided with a speaker 112 and a lamp 111. The slot machine 1 produces effects by displaying images, outputting sounds, and outputting the light.

A ticket printer 171, a card slot 176, a data display 174, and a keypad 173 are provided on the lower side of the upper image display panel 131.

The ticket printer 171 prints on a ticket a barcode representing encoded data of the credit amount, date and time, the identification number of the slot machine 1, and the like, and then outputs the ticket as the ticket 175 with a barcode. The player is able to play games by causing the slot machine to read the ticket 175 with the barcode and to exchange the ticket 175 with the barcode for paper money or the like at a predetermined location in the gaming facility (e.g., a counter in the casino).

The card slot 176 is provided to insert a card storing predetermined data thereto. The card stores, for example, data for identifying the player and data regarding the playing history of the player. From and to the card inserted into the card slot 176, data is read and written by a later-described card reader 172. The card may store data equivalent to coins, paper money, or credits.

The data display 174 is constituted by a fluorescent display, LEDs and the like, and displays the data read by the card reader 172 and the data inputted by the player via the keypad 173, for example. The keypad 173 is provided to input instructions and data regarding the issuance of a ticket or the like.

[Symbol Arrays on Video Reels]

Next, with reference to FIG. 8 to FIG. 9, the following describes a configuration of the symbol arrays on the video reels 3 of the slot machine 1.

As shown in FIG. 8, to a 1st video reel ("Reel 1") 3*a*, a 2nd video reel ("Reel2") 3*b*, a 3rd video reel ("Reel3") 3*c*, a 4th video reel ("Reel4") 3*d*, a 5th video reel ("Reel5") 3*e* of the normal game video reel 3, symbol arrays each constituted by corresponding to code numbers "0" to "33" are allocated, respectively.

As shown in FIG. 9, to a 1st video reel ("Reel 1") 3*a*, a 2nd video reel ("Reel2") 3*b*, a 3rd video reel ("Reel3") 3*c*, a 4th video reel ("Reel4") 3*d*, a 5th video reel ("Reel5") 3*e* of the free game video reel 3, symbol arrays each constituted by symbols corresponding to code numbers "0" to "28" are allocated, respectively.

Further, as shown in FIG. 8 and FIG. 9, the types of symbols arrayed on each video reel 3 include: normal symbols, a wild symbol which is an almighty symbol that could substitute for any other symbol, and a feature symbol that constitutes a condition for a winning (feature win) which awards the right to play the free game. The normal symbols are for example "MAN", "DRAGON", "FISH", "TURTLE", "GOURD", "ACE", "KING", "QUEEN", "JACK", "TEN", or "NINE".

[Structures of Circuits Provided to Slot Machine]

Figure 10:
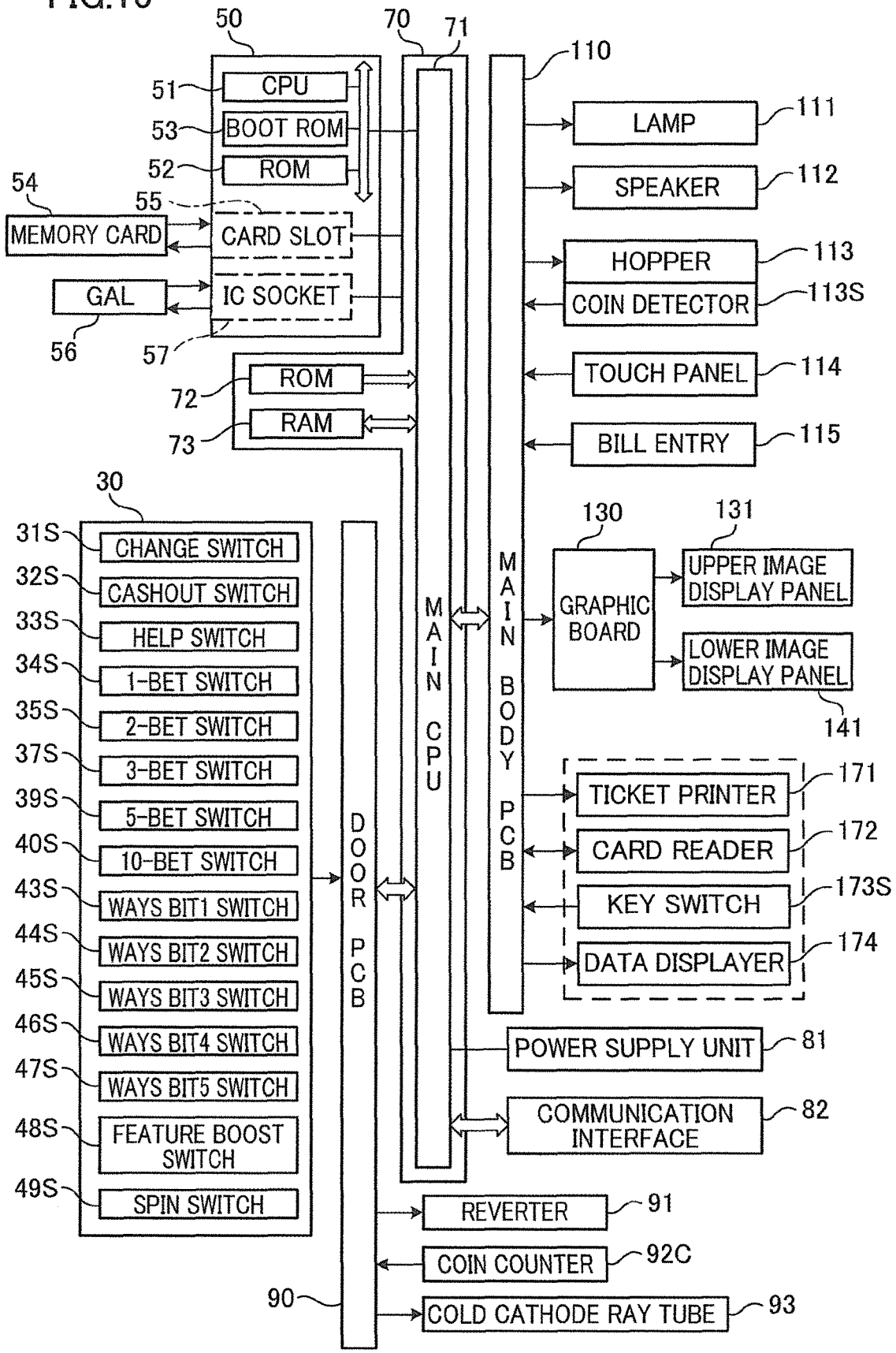
FIG. 10 is a block diagram showing an internal structure of the slot machine related to the embodiment of the present invention.

Now, referring to FIG. 10, the configuration of a circuit in the slot machine 1 will be described. FIG. 10 is a block diagram showing an internal structure of the slot machine of the embodiment of the present invention.

A gaming board 50 is provided with a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a nonvolatile memory, and stores a game program and a game system program. The game program includes a program related to game progression, a random determination program, and a program for producing effects by images and sounds (see e.g., FIG. 19 to FIG. 22 described later). Furthermore, the game program includes data (see FIG. 8 and FIG. 9) defining the arrangement of the symbol array allocated to each video reel 3.

The random determination program is a program for randomly determining to-be stopped symbol on the video reels 3. The to-be stopped symbol is data for determining three symbols to be displayed to the symbol display area 4 out of plural symbols forming each symbol array. The slot machine 1 of the embodiment of the present invention determines, as the symbols to be stopped, the symbols to be displayed in a predetermined area (e.g. the uppermost stage) out of the three areas provided for each of the video reels 151-155 of the symbol display area 4. This way symbols to be displayed in the three areas (the upper stage area, the middle stage area, and the lower stage area) corresponding to each video reel 3 of the symbol display area 4.

The aforementioned random determination program includes symbol determination data. The symbol determination data is data that specifies random numbers so that each of the symbols forming the symbol array is determined at an equal probability for each of the video reels 3. For example, for the 1st video reel ("Reel 1") 3*a* of the normal game video reel 3 shown in FIG. 8, the data specifies the random numbers such that 29 symbols (with the code numbers "0" to "28") constituting the symbol array are determined at the same probability (i.e., 1/29). However, because the number of the symbols in 29 symbols is different between the types, the probability of the selection is different between the types of the symbols (i.e., the types are differently weighted). For example, in FIG. 8, the symbol array of the 1st video reel 3*a* ("Reel 1") of the normal game video reel 3 includes four "ACE" symbols and 1 "DRAGON" symbol. Therefore the former is selected at the probability of "4/29" whereas the latter is selected at the probability of "1/29".

While in the embodiment of the present invention the data is arranged to differentiate the number of symbols constituting the symbol array between the video reels 3 (29 symbols for the video reel 3*a,* 29 symbols for the video reel 3*b,* 28 symbols for the video reel 3*c,* 27 symbols for video reel 3*d*, and 34 symbols for the video reel 3*e*), the number of symbols constituting the symbol column may be identical between the video reels 3. For example, each of all symbol arrays of the video reels 3*a* to 3*e* of the video reels 3 may be constituted by 50 symbols. This arrangement increases the degree of freedom in setting the probabilities of the selection of the symbols of different types in each video reel 3.

Further, the card slot 55 is configured so that the memory card 54 can be inserted thereinto and removed therefrom, and is connected to a motherboard 70 by an IDE bus.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents and settings of the game to be played on the slot machine 1 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like. The authentication program is a program (falsification check program) for authenticating the game program and the game system program. The preliminary authentication program is a program for authenticating the aforementioned authentication program. The authentication program and the pre-authentication program are written along a procedure (authentication procedure) for proving that the program to be the subject has not been falsified.

The motherboard 70 is provided with a main CPU 71, a ROM 72, a RAM 73, and a communication interface 82. The ROM 72 and the RAM 73 correspond to the storage unit.

The ROM 72 includes a memory device such as a flash memory, and stores a program such as BIOS to be executed by the main CPU 71, and permanent data. When the BIOS is executed by the main CPU 71, processing for initializing predetermined peripheral devices is conducted. Further, through the gaming board 50, a process of loading the game program and the game system program stored in the memory card 54 is started.

The processor of the present invention includes the main CPU 71, the ROM 72, and the RAM 73 above and the memory card 54 storing the game program and the game system program, and controls the slot machine by causing the CPU 71 to execute the game program and the game system program. Needless to say, the processor may alternatively store the game program and the game system program in the ROM 72 instead of the memory card 54.

The RAM 73 stores data and programs which are used in operation of the main CPU 71. For example, when the process of loading the aforementioned game program, game system program or authentication program is executed, the RAM 73 can store the program. The RAM 73 is provided with working areas used for operations when these programs are executed. Examples of the areas include: an area that stores counters for the number of games, the bet amount, the payout amount, the credit amount and the like; and an area that stores symbols (code numbers) randomly determined.

The communication interface 82 is for communicating with the external controller 200 such as a server, through the communication line 301. Further, the motherboard 70 is connected with a later-described door PCB (Printed Circuit Board) 90 and a main body PCB 110 by respective USBs. The motherboard 70 is also connected with a power supply unit 81. When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the main body PCB 110 are connected with input devices such as a switch and a sensor, and peripheral devices the operations of which are controlled by the main CPU 71. The door PCB 90 is connected with a control panel 30, a reverter 91, a coin counter 92C and a cold cathode tube 93.

For each of the buttons, the control panel 30 includes: a change switch 31S, a cashout switch 32S, a help switch 33S, a 1-bet switch 34S, a 2-bet switch 35S, a 3-bet switch 37S, a 5-bet switch 39S, a 10-bet switch 40S, a ways bet1 switch 43S, a ways bet2 switch 44*s*, a ways bet3 switch 45*s*, a ways bet4 switch 46*s*, a ways bet5 switch 47*s*, a feature boost switch 48*s*, and a spin switch 49*s*. Each of the switches outputs a signal to the main CPU 71 upon detection of the pressing of the button corresponding thereto by the player.

The coin counter 92C checks whether a coin inserted into the coin receiving slot 36 is genuine in terms of the material, shape, or the like. When determining that the coin is genuine, the coin counter 92C outputs a signal to the main CPU 71. Non-genuine coins are ejected through a coin payout exit 15A.

The reverter 91 operates based on a control signal output from the main CPU 71, and distributes valid coins validated by the coin counter 92C into a hopper 113 or a cash box (not illustrated). That is, coins are distributed into the hopper 113 when the hopper 113 is not filled with coins, while coins are distributed into the cash box when the hopper 113 is filled with coins.

The cold cathode tube 93 functions as a backlight installed on the rear face side of the upper image display panel 131 and the lower image display panel 141, and turns on based on a control signal outputted from the main CPU 71.

To the main body PCB 110 are connected the lamp 111, the speaker 112, a hopper 113, a coin detection unit 113S, the touch panel 114, the bill entry 115, a graphic board 130, a ticket printer 171, a card reader 172, a key switch 173S and the data display 174.

The lamp 111 turns on based on a control signal outputted from the main CPU 71. The speakers 112 output BGM sound or the like in accordance with a control signal output from the main CPU 71.

The hopper 113 operates based on a control signal outputted from the main CPU 71, and pays out a designated number of coins from the coin payout exit 15A to the coin tray 15. The coin detector 113S outputs a signal to the main CPU 71 upon detection of coins paid out by the hopper 113.

The touch panel 114 detects a place on the lower image display panel touched by the player's finger or the like, and outputs to the main CPU 71 a signal corresponding to the detected place. Upon acceptance of a valid bill, the bill entry 115 outputs to the main CPU 71 a signal corresponding to the face amount of the paper money.

The graphic board 130 controls image display executed by the respective upper image display panel 131 and lower image display panel 141, based on a control signal outputted from the main CPU 71. The symbol display area 4 of the lower image display panel 141 displays the five video reels 3 by which the scrolling and stop motions of the symbol arrays included in the respective video reels 3 are displayed. The graphic board 130 is provided with a VDP generating image data, a video RAM temporarily storing the image data generated by the VDP, and the like.

The graphic board 130 is provided with the VDP (Video Display Processor) generating image data based on a control signal outputted from the main CPU 71, the video RAM temporarily storing the image data generated by the VDP, and the like. It is to be noted that the image data used for generating image data by the VDP is included in the game program that has been read from the memory card 54 and stored into the RAM 73.

Based on a control signal outputted from the main CPU 71, the ticket printer 171 prints on a ticket a barcode representing encoded data of the credit amount stored in the RAM 73, date and time, the identification number of the slot machine 1, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

[Arrangement of Symbol Combination Table]

Now, symbol combination tables will be described with reference to FIG. 11. FIG. 11 shows a symbol combination table of the slot machine of the embodiment of the present invention.

The symbol combination tables of the present embodiment define the combinations of symbols (the number of symbols) with which a win is achieved and payout amounts. In the slot machine 1, a win is achieved when the scroll of the symbol array of each video reel 3 is stopped and symbols displayed in the symbol display area 4 forms a line which goes through the 1st column area to the 5th column area within the result determination area set to be the subject of the result determination by the WAYS BET. In accordance with the type of win, a benefit such as the payout of coins is awarded to the player.

Basically, a win is achieved when a predetermined number of symbols of a single kind are arranged linked to one another, as in a 3-of-a-kind, 4-of-a-kind, or a 5-of-a-kind combination, through the 1st column area to the 5th column area, within the result determination area set as the subject to result determination, by the WAYS BET button. The above symbols of a single kind may be "MAN", "DRAGON", "FISH", "TURTLE", "GOURD", "ACE", "KING", "QUEEN", "JACK", "TEN", or "NINE". The symbol of "WILD" is substituted by any of the above symbols: "MAN", "DRAGON", "FISH", "TURTLE", "GOURD", "ACE", "KING", "QUEEN", "JACK", "TEN", or "NINE". Regarding the "FEATURE" symbol, a payout and the right to play the free game are awarded if "FEATURE" symbol occurs in three or more consecutive positions through the 1st column area to the 5th column area (when 3 or more-of-a-kind combination of the "FEATURE" is formed), irrespective of the area turned active by the ways bet button.

For example, when the "WAYS BET5" is selected, all the areas out of the symbol display area 4 are subjected to result determination (activated). When the scroll of the symbol arrays on the video reels 3 is stopped and the "DRAGON" symbol occurs in the lower stage of the 1st column area, the upper stage of the 2nd column area, the upper stage of the 3rd column area, the middle stage of the 4th column area, and the lower stage of the 5th column area, there is a win in which the symbol occurs in five linked positions from the 1st column area to the 5th column area (5-of-a-kind combination of "DRAGON" is formed). In this case, the symbol combination table shown in FIG. 11 is referred to, and a payout of "400" is determined. Based on the determined payout amount, coins are paid out. The coins are paid out in the form of: actual output of coins from the coin payout exit 15A; adding the number of coins to the credits; or issuance of a barcode ticket.

Further, for a win related to "MAN", "DRAGON", "FISH", "TURTLE", "GOURD", "ACE", "KING", "QUEEN", "JACK", "TEN", or "NINE", a product of the value associated with the credit type of the unit game multiplied by the value defined in the symbol combination table is paid out. For example, when a win related to three "DRAGON" symbols is achieved (when 3-of-a-kind combination of "DRAGON" is formed in a unit game where 10 bet is placed by the 10-BET button 40, the awarded credits will be 35×10=350. Further, for a win related to "FEATURE", a product of all the bet amount in the unit game multiplied by the value defined in the symbol combination table is paid out. For example, when a win related to three "FEATURE" symbols occurs in a case where a result determination area to be subjected to result determination is set by the ways bet5 button 47 (which requires 30 credits) and 10 credits are placed as a bet by the 10-bet button 40, 1500 credits (30×10×5=1500) and the right to play the free game are awarded.

(Total Counter Capable of Counting Plays of Game for Each WAYS BET)

Figure 12:
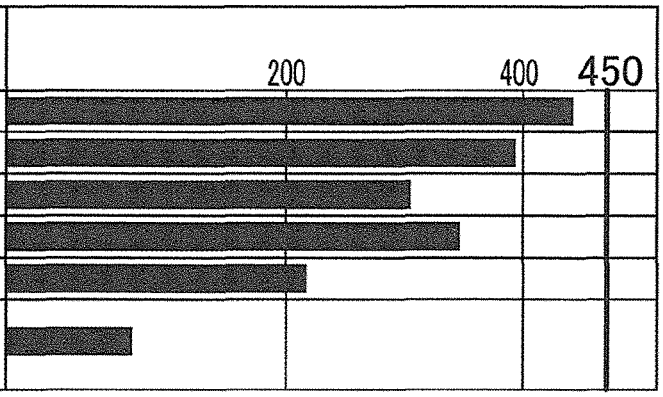
FIG. 12 is an explanatory diagram of a total counter of the slot machine related to the embodiment of the present invention.

As shown in FIG. 12, in the present embodiment, a total counter is set for each of 6 types of WAYS BET different result determination areas, i.e., WAYS BET1, WAYS BET2, WAYS BET3, WAYS BET4, WAYS BET5, and WAYS BET5+FEATURE BOOST in the present embodiment. The total counter counts plays of the normal game, at start of every play. For example, as shown in FIG. 12, suppose that the threshold game play count is set to 450 in the total counter corresponding to the ways bet1, and that the counter indicates that the current play of the normal game is 430th. In this case, the game play count on the total counter corresponding to the ways bet1 is counted up by 1 to 431, upon placing a bet by the ways bet1 button 43 to start the normal game. Similarly, suppose the threshold game play count is set to 450 in the total counter corresponding to the WAYS BET5. If the counter indicates that the current play is 220th, the game play count on the total counter corresponding to the WAYS BET5 is counted up by 1 to 221, upon placing a bet by the WAYS BET5 button 43 to start the normal game. As described, in the present embodiment, there are 6 total counters set in the RAM 73: i.e., a total counter for ways bet1, a total counter for WAYS BET2, a total counter for ways bet3, a total counter for ways bet4, a total counter for ways bet5, and a total counter for ways bet5+feature boost. These total counters are each counting the play of the game independently of the other.

As described, the game play count on the total counter corresponding to the selected WAYS BET (6 types of WAYS BET with different result determination areas, which are ways bet1, ways bet2, ways bet3, ways bet4, ways bet5, and ways bet5+feature boost, in the present embodiment) is incremented upon start of the normal game, and a benefit is awarded when the game play count on the total counter reaches the threshold game play count. With the total counter which keeps track of the game play count provided independently of the other counters, for each of the plurality of result determination areas, variation is given to the WAYS BET (result determination areas) to be selected by the player.

(Credit Type Counter Configured to Perform Counting for Each Credit Type)

Figure 13:
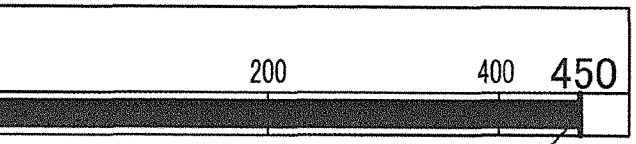
FIG. 13 is an explanatory diagram of a credit type counter of the slot machine related to the embodiment of the present invention.
Figure 18:
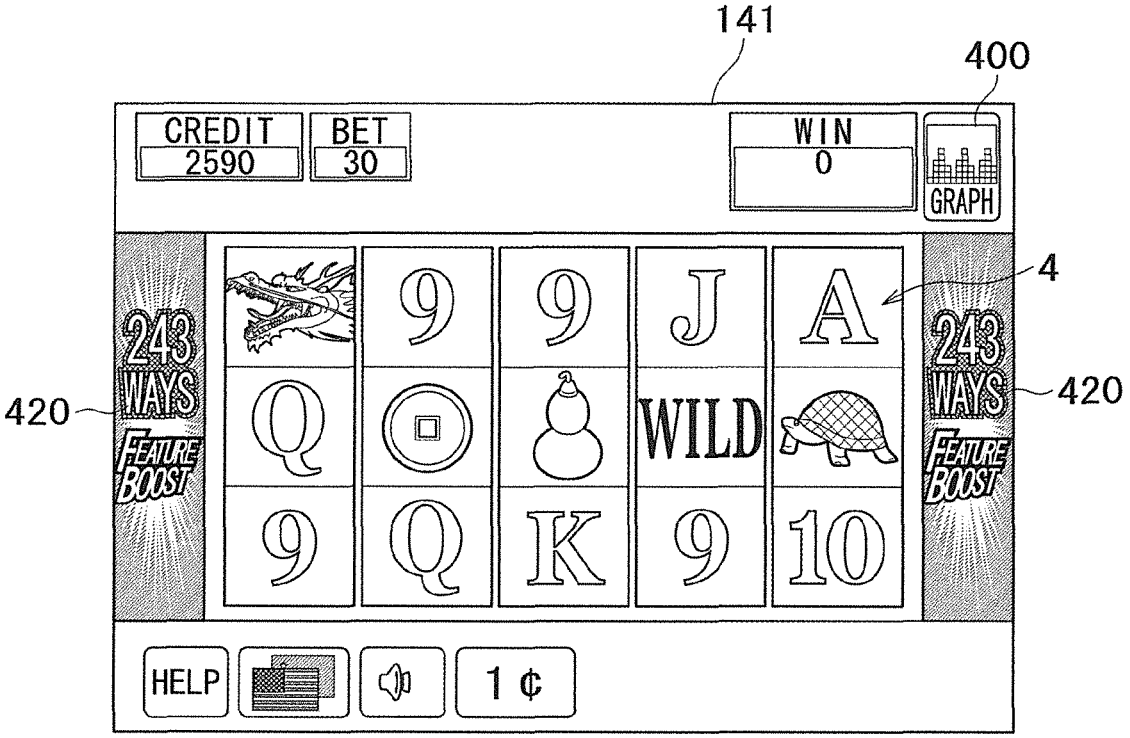
FIG. 18 is an explanatory diagram of a lower image display panel of the slot machine related to the embodiment of the present invention.

In the present embodiment, a credit type counter is set in the RAM 73, which keep track of game play count counted by the total counter set for each WAYS BET, for each of the credit types (5 types of credit types with different credit values, which are 1BET, 2BET, 3BET, 5BET, and 10BET). Specifically, for each of the 6 types of ways bet associated with different result determination areas, i.e., ways bet1, ways bet2, ways bet3, ways bet4, ways bet5, and ways bet5+feature boost, there are 5 types of credit type counters corresponding to the 5 types of credit types: i.e., 1bet, 2bet, 3bet, 5bet, and 10bet. For example, as shown in the credit type counters of WAYS BET5 shown in FIG. 13, there are 5 credit type counters associated with the credit types of 1BET, 2BET, 3BET, 5BET, and 10BET, respectively, for the WAYS BET5. As shown in FIG. 13, for example, when the value of the total counter of the WAYS BET5 (game play count) reaches 450, it means that the game is played 450 times with the WAYS BET5. The credit type counters each counts how many times a bet of the associated credit type took place within the 450 plays of the game (In the example of FIG. 13, the counted values are: 370 on the 1BET credit type counter, 48 on the 2BET credit type counter, 20 on the 3BET credit type counter, 4 on the 5BET credit type counter, and 8 on the 10BET credit type counter).

(Special Game Basic Payout Table Determination Table)

With reference to FIG. 14, the following describes a special game basic payout table determination table. In the special game basic payout table determination table, the types of jewel obtainable in a later-described 15-choice pick game are associated with amounts of payout for each type of WAYS BET which is awarded when the count of the associated total counter reaches the threshold game play count. It should be noted that the special game basic payout table determination table is also used as a table in which the types of jewel obtainable in a later-described 15-choice pick game are associated with an amount of payout for the selected type of WAYS BET, which is awarded when a win occurs in a later-described mystery feature.

In a special game basic payout table corresponding to WAYS BET1 as shown in FIG. 14 for example, if WAYS BET1 is selected and 3 red jewels are obtained in the later-described 15-choice pick game, 100 credits are paid out as the basic payout. Further, when 3 blue jewels are obtained in the 15-choice pick game, 75 credits are paid out as the basic payout. Further, when 3 green jewels are obtained in the 15-choice pick game, 30 credits are paid out as the basic payout. Further, when 3 amber jewels are obtained in the 15-choice pick game, 20 credits are paid out as the basic payout. Further, when 3 purple jewels are obtained in the 15-choice pick game, 15 credits are paid out as the basic payout. Similarly, as shown in FIG. 14, the type of jewels obtained in the 15-choice pick game and the amounts of payout are associated in relation to: ways bet2, ways bet3, ways bet4, ways bet5, ways bet5+feature boost each of which corresponds to a separate special game basic payout table.

It is possible to use the special game basic payout table determination table described above as: a table to determine the special game basic payout table to be used in the 15-choice pick game taking place when a mystery feature is won in the normal game; and a table for determining the special game basic payout table used in the 15-choice pick game taking place when the value of the total counter reaches the threshold game play count.

(Payout Rate Random Determination Table)

The following describes payout rate random determination tables with reference to FIG. 15. Each of the payout rate random determination tables is a table to be referred to in a later-described pick game payout rate determination process. There are five payout rate random determination tables for 1BET, 2BET, 3BET, 5BET, and 10BET, and one of them is selected with reference to the payout rate random determination table determination table. Each payout rate random determination table defines the probability at which a level (payout rate) is randomly selected.

As shown in FIG. 15, in the payout rate random determination table for 1BET for example, a probability of 29968/30000 is associated with the level 1 (Payout rate: ×1), a probability of 1/30000 is associated with the level 2 (Payout rate: ×2), a probability of 1/30000 is associated with the level 3 (Payout rate: ×3), a probability of 1/30000 is associated with the level 4 (Payout rate: ×4), a probability of 1/30000 is associated with the level 5 (Payout rate: ×5), a probability of 1/30000 is associated with the level 10 (Payout rate: ×10), and a probability of 27/30000 is associated with the level 20 (Payout rate: ×20). Similarly, as shown in FIG. 15, the probabilities at which each of the levels (payout rate) is randomly selected are defined for the payout rate random determination tables for 2BET, 3BET, 5BET, and 10BET.

(Payout Rate Random Determination Table Determination Table)

The following describes a payout rate random determination table determination table with reference to FIG. 16. The payout rate random determination table determination table is a table created in the later-described pick game payout rate determination process. The payout rate random determination table determination table defines the probability of each payout rate random determination table being randomly selected out of the five payout rate random determination tables for 1BET, 2BET, 3BET, 5BET, and 10BET. Each probability of being randomly selected, which is in the payout rate random determination table determination table, is calculated by dividing the value on the corresponding credit type counter by the threshold game play count, which value is the value indicated on the corresponding credit type counter when the game play count on the corresponding total counter (see FIG. 12) reaches the threshold game play count, the total counter being capable of counting plays of the game of the related WAYS BET. The probabilities thus calculated and the payout rate random determination tables (five types of them, i.e., 1BET, 2BET, 3BET, 5BET, 10BET) are associated with each other in the payout rate random determination table determination table.

As shown in FIG. 13, for example, when the value on the total counter for the WAYS BET5 reaches 450 which is the threshold game play count, the credit type counters of the WAYS BET5 are referred to. At this point, the credit type counters corresponding to the credit types of 1BET, 2BET, 3BET, 5BET, and 10BET each indicates in how many plays out of the threshold game play count of 450 plays, the corresponding credit type has been used as a bet. For example, in the example of FIG. 13, the credit type counter for 1BET indicates a value of 370, which means that the credit type of 1BET was used 370 times in WAYS BET5. Further, the credit type counter for 2BET indicates a value of 48, which means that the credit type of 2BET was used 48 times in WAYS BET5. Further, the credit type counter for 3BET indicates a value of 20, which means that the credit type of 3BET was used 20 times in WAYS BET5. Further, the credit type counter for 5BET indicates a value of 4, which means that the credit type of 5BET was used 4 times in WAYS BET5. Further, the credit type counter for 10BET indicates a value of 8, which means that the credit type of 10BET was used 8 times in WAYS BET5. Each of the above values on the counters is divided by the threshold game count of 450 to derive the following probabilities: 370/450, 48/450, 20/450, 4/450, and 8/450. The probabilities thus calculated and the payout rate random determination tables (five types of them, i.e., 1BET, 2BET, 3BET, 5BET, 10BET) are associated with each other in the payout rate random determination table determination table, as shown in FIG. 16.

(Mystery Feature Win Table)

The following describes a mystery feature win table with reference to FIG. 17. The mystery feature win table is stored in the RAM 73, and is read out in a later-described mystery feature random determination process.

The mystery feature win table is a table for use in determining whether or not the mystery feature is won. As shown in FIG. 17, "not-win" is associated with a probability of 29999/30000, and "win" is associated with 1/30000.

[Contents of Program]

Now, the program to be executed by the slot machine 1 is described with reference to FIG. 19 to FIG. 22.

(Main Control Process)

Figure 19:
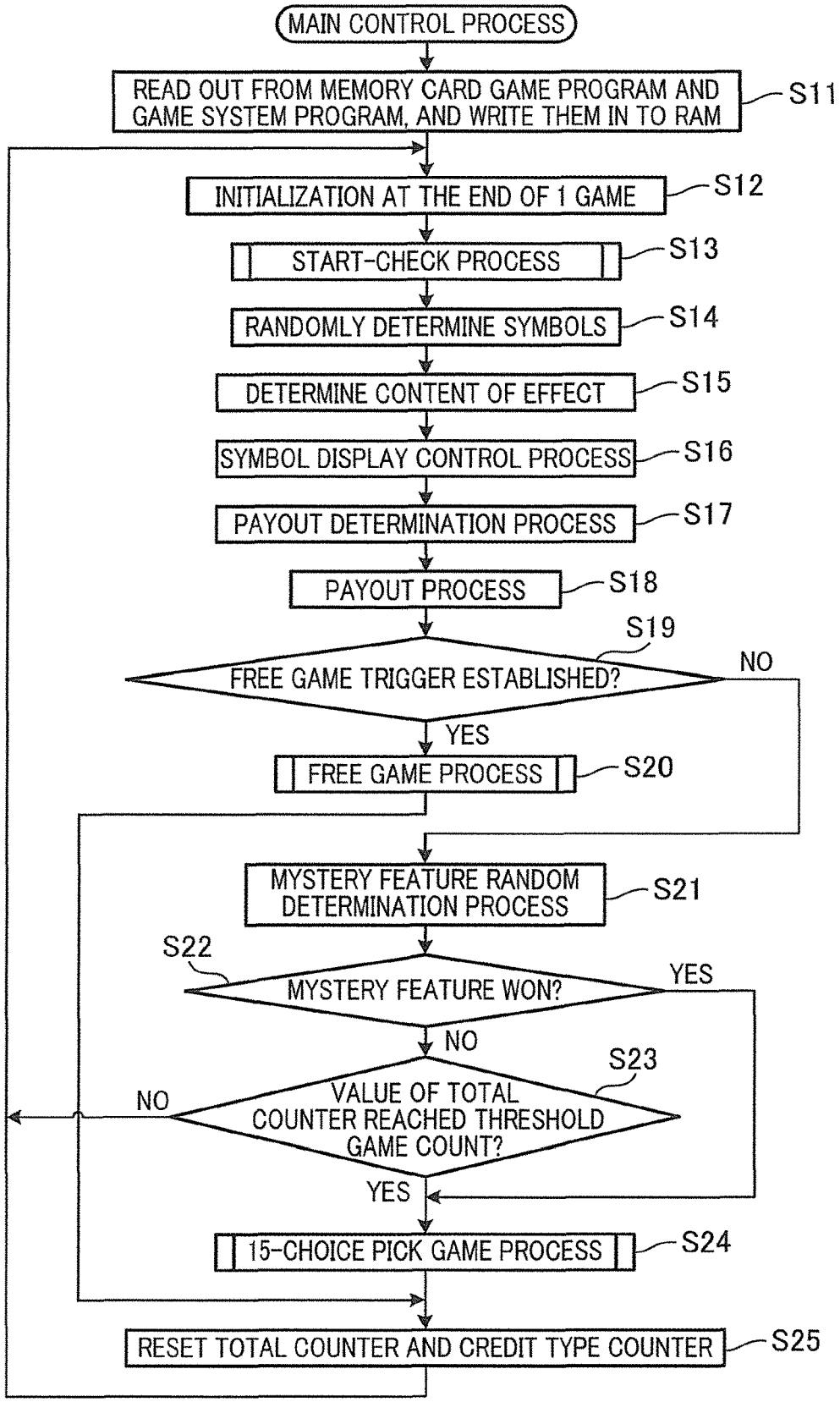
FIG. 19 is a flowchart of a main control process in the slot machine of the embodiment of the present invention.

First, with reference to FIG. 19, a main control process is described. It should be noted that the normal game is run in the main control process.

First, when the slot machine 1 is powered on, the main CPU 71 reads an authenticated game program and a game system program from a memory card 54 via a gaming board 50, and then write them in the RAM 73 (Step S11).

Next, the main CPU 71 executes an initializing process at the end of each round of the game (Step S12). This process clears data in a working area of the RAM 73, which becomes unnecessary at the end of each round of game, e.g., the amount of bet, symbols randomly determined, and the like.

Next, the main CPU 71 executes a start-check process described later with reference to FIG. 20 (step S13). In this process is carried out input checking and the like, to: the 1-bet switch 34S, the 2-bet switch 35S, the 3-bet switch 37S, the 5-bet switch 39S, 10-bet switch 40S, the ways bet1 switch 43S, the ways bet2 switch 44S, the ways bet3 switch 45S, the ways bet4 switch 46S, the ways bet5 switch 47S, the feature boost switch 48S, the spin switch 49S, and the like Next, the main CPU 71 executes a symbol random determination process (S14). In this process, symbols to be stopped are determined based on random numbers for symbol determination.

Specifically, the main CPU 71 first samples random numbers for symbol determination. The main CPU 71 then randomly determines symbols to be stopped on the video reels 3 (3*a*, 3*b*, 3*c*, 3*d*, 3*e*). The main CPU 71 executes random determination for each of the video reels 3 (3*a*, 3*b*, 3*c*, 3*d*, 3*e*), and determines any one of the symbols as the symbols to be stopped. The symbols are determined at equal probabilities. The main CPU 71 stores the symbols determined as to stop on each video reel 3 in a symbol storing area in the RAM 73.

The main CPU 71 then executes an effect contents determination process (S15). The main CPU 71 samples an effect-use random number and randomly determines any of a plurality of predetermined contents of effect.

Next, the main CPU 71 executes a symbol display control process (step S16). In the process, the scroll of the symbol array on each video reel 3 is started, and the symbols determined as the symbols to stop in the symbol random determination process of S14 are stopped at a predetermined positions (e.g. the upper area in the symbol display area 4). That is, 15 symbols including the symbols to be stopped are displayed in the symbol display area 4. For example, the symbol with the code number "10" is to be stopped in the middle stage area, the symbols with the code numbers "9" and "11" are displayed in the upper stage and the lower stage of the symbol display area 4, respectively.

Next, the main CPU 71 executes a payout amount determination process (step S17). In this process, a symbol combination table (see FIG. 11) stored in the RAM 73 is referred to, to determine whether the symbols stopped in the symbol display area 4 include symbols linked to one another through the 1st column area to the 5th column area in the WAYS BET set as the subject of the result determination area, thus achieving a win. In accordance with the type of win and the credit type used in betting, a benefit such as the payout or the right to play the free game is awarded to the player. The payout awarded is stored in a payout storage area of the RAM 73.

Next, the S18 executes a payout process (step S18). The main CPU 71 adds a value stored in the payout storage area to a value stored in the credit counter stored in the credit amount storage area provided in the RAM 73.

Next, the main CPU 71 determines whether or not a free game trigger is met (S19). In the present embodiment, the trigger for transition to the free game is the "FEATURE" symbol occurs in three or more consecutive positions through the 1st column area to the 5th column area, irrespective of the area activated by a ways bet button. The main CPU 71, when determining that the free game trigger has been established (S19: Yes), executes a later described free game process (step S20)

Next, the main CPU 71, when determining that the free game trigger is not established in the step S19 (S19: NO), executes the mystery feature random determination process (S21). In the mystery feature random determination process, a random number is sampled to determine whether or not the mystery feature results in the win or not win, based on the mystery feature random determination table (see FIG. 17) stored in RAM 73.

Next, the main CPU 71 determines whether or not the mystery feature is won (S22). If the mystery feature is won (S22: YES), the later-described 15-choice pick game process is executed (S24).

On the other hand if the mystery feature is not won (S22: NO), whether or not the value on the total counter counted in the game play count process (later-described S49) in the start-check process has reached the threshold game play count of 450 (S23). If the value on the total counter has not yet reached the threshold game play count of 450 (S23: NO), the process transits to S12.

On the other hand, when the value of the total counter has reached the threshold game play count of 450 (S23: YES), the lather-described 15-choice pick game process is executed (S24).

Next, after the free game process of S20 or after the 15-choice pick game process of S24, the values of the total counter and the values on the credit type counters are reset (bring them back to "0") (S25).

For example, after the free game process of S20, or if the 15-choice pick game process is executed by the mystery feature resulting in the win, the resetting is done only for the total counter of WAYS BET for which a bet has placed in the start-check process of S13. For example, if a bet is placed for ways bet5 in the start-check process of s13, the total counter corresponding to the ways bet5 is reset, and the other total counters for ways bet1, ways bet2, ways bet3, ways bet4, and ways bet5+feature boost are maintained. At the same time, the credit type counters corresponding to the WAYS BET for which a bet has been placed in the start-check process of S13 are reset.

Further, if the 15-choice pick game process is executed after the value of the total counter for ways bet5 has been determined as to reached the threshold game play count in S23, only the total counter corresponding to the WAYS BET5 is reset, and the other total counters for ways bet1, ways bet2, ways bet3, ways bet4, and ways bet5+feature boost are maintained. At the same time, the credit type counters corresponding to the WAYS BET whose total counter's value has reached the threshold game play count are reset.

As described, when the value of the total counter (game play count) reaches the threshold game play count, a benefit is awarded. At the same time, while the total counter of the particular WAYS BET (result determination area) whose value has reached the threshold game play count is reset, the other total counters of the other WAYS BET (result determination area) whose value has not yet reached the threshold game play count are maintained. This induces the player to select the WAYS BET in which the value of the total counter has not yet reached the threshold game play counts.

Further, if the free game trigger occurs in the normal game, the free game is run and only the value of the total counter corresponding to the selected WAYS BET (result determination area) is reset, while the values of the other total counters of the other WAYS BET are maintained. This induces the player to select the WAYS BET in which the value of the total counter has not yet reached the threshold game play counts.

After S25, the process transits to the step S12.

(Start-Check Process)

Figure 20:
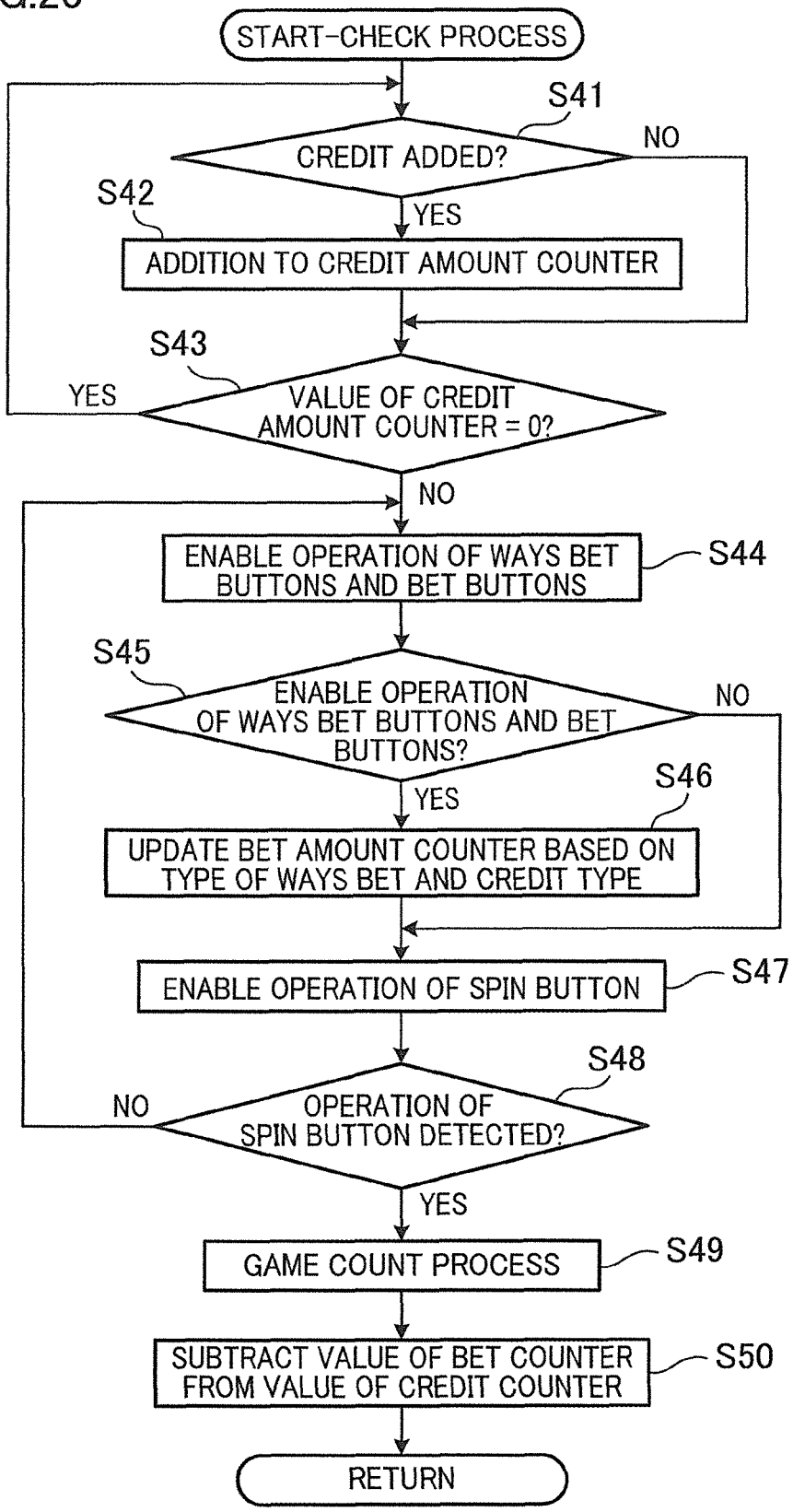
FIG. 20 is a flowchart of a start-check process of the slot machine related to the embodiment of the present invention.

Next, the start-check process is described reference to FIG. 20.

First, the main CPU 71 reads a barcode attached ticket 175 through the bill entry 115, and determines if there is an addition of a credit (step S41). When determining that there is addition of a credit (S41: YES), the main CPU 71 adds the specified amount of credits to the value stored in the credit counter stored in the credit amount storage area of the RAM 73 (step S42). It should be noted that the subject to be read by the bill entry 115 includes paper money, an IC card and the like, in addition to the barcode attached ticket 175.

After the step S42 or when determining in the step S41 that there is no addition of credits (S41: NO), the main CPU 71 determines whether or not the value stored in the credit counter stored in the credit amount storage area is 0 (step S43). The process then transits to the step S41, if the value stored in the credit counter stored in the credit amount storage area is 0 (S43: YES).

On the other hand, when the main CPU 71 determines that the value stored in the credit counter stored in the credit amount storage area is not 0 (S43: NO), the main CPU 71 enables operation of the ways bet buttons (ways bet1 button 43, ways bet2 button 44, ways bet3 button 45, ways bet4 button 46, ways bet5 button 47, feature boost button 48) and the bet buttons (1-bet button 34, 2-bet button 35, 3-bet button 37, 5-bet button 39, 10-bet button 40) (step S44). By selecting any of the five stages of ways bet buttons, a result determination area to be subjected to result determination is selected out of 15 areas of the 5 by 3 matrix of the symbol display area 4 (see FIG. 6).

Next, the main CPU 71 determines if an operation of the ways bet button or the bet button is detected (step S45). When the main CPU 71 detects pressing of the ways bet button by the player through the ways bet switch (ways bet1 switch 43S, ways bet2 switch 44*s*, ways bet3 switch 45*s*, ways bet4 switch 46*s*, ways bet5 switch 47*s*, feature boost switch 48*s*) and detects pressing of the bet button by the player through the bet switch (1-bet switch 34S, 2-bet switch 35S, 3-bet switch 37S, 5-bet switch 39S, 10-bet switch 40S), the main CPU 71 updates the value of the bet counter stored in the bet amount storage area provided in the RAM 73, based on the product of the amount of credit necessary for the selected ways bet (1 credit for ways bet1, 5 credits for ways bet2, 10 credits for ways bet3, 20 credits for ways bet 4, 30 credits for ways bet5, and 40 credits for ways bet5+feature boost) multiplied by the amount of credit corresponding to the bet button operated (step S46).

After step S46 or when no operation of the ways bet button or the bet button is detected in step S45 (S45: NO), the main CPU 71 enables operation of the spin button 49 (S47).

After the step S47, the main CPU 71 determines whether or not an operation of the spin button 49 is detected (step S48). When the main CPU 71 determines that an operation of the spin button 49 is not detected (S48: NO), the process moves to the step S44.

On the other hand, when the main CPU 71 determines that the operation of the spin button 49 has been detected (S48: YES), the game play count process is executed (step S49). In the game play count process, the game play count on the total counter (see FIG. 12) corresponding to the ways bet determined as to be operated in the step S45 is incremented by 1. For example, as shown in FIG. 12, suppose that the threshold game play count is set to 450 in the total counter corresponding to the ways bet1, and that the counter indicates that the current play of the normal game is 430th. In this case, the game play count on the total counter corresponding to the ways bet1 is counted up by 1 to 431, upon placing a bet by the ways bet1 button 43 in the step S45.

Further, in the game play count process, the game play count on the credit type counter corresponding to the credit type and the ways bet determined as to be operated in the step S45 is incremented by 1. For example, suppose an operations on the ways bet5 and the credit type of 3BET are detected in S45, and that the value on the credit type counter of the 3BET of the ways bet5 is 20 (see FIG. 13), this game play count is incremented by 1 to update the value of the credit type counter of the 3BET of the ways bet5 to 21.

After the step S49, the main CPU 71 subtract the value on the bet counter calculated in the step S46, from the value stored in the credit counter stored in the credit amount storage area (step S50). Then, the start-check process is terminated.

(Free Game Process)

Figure 21:
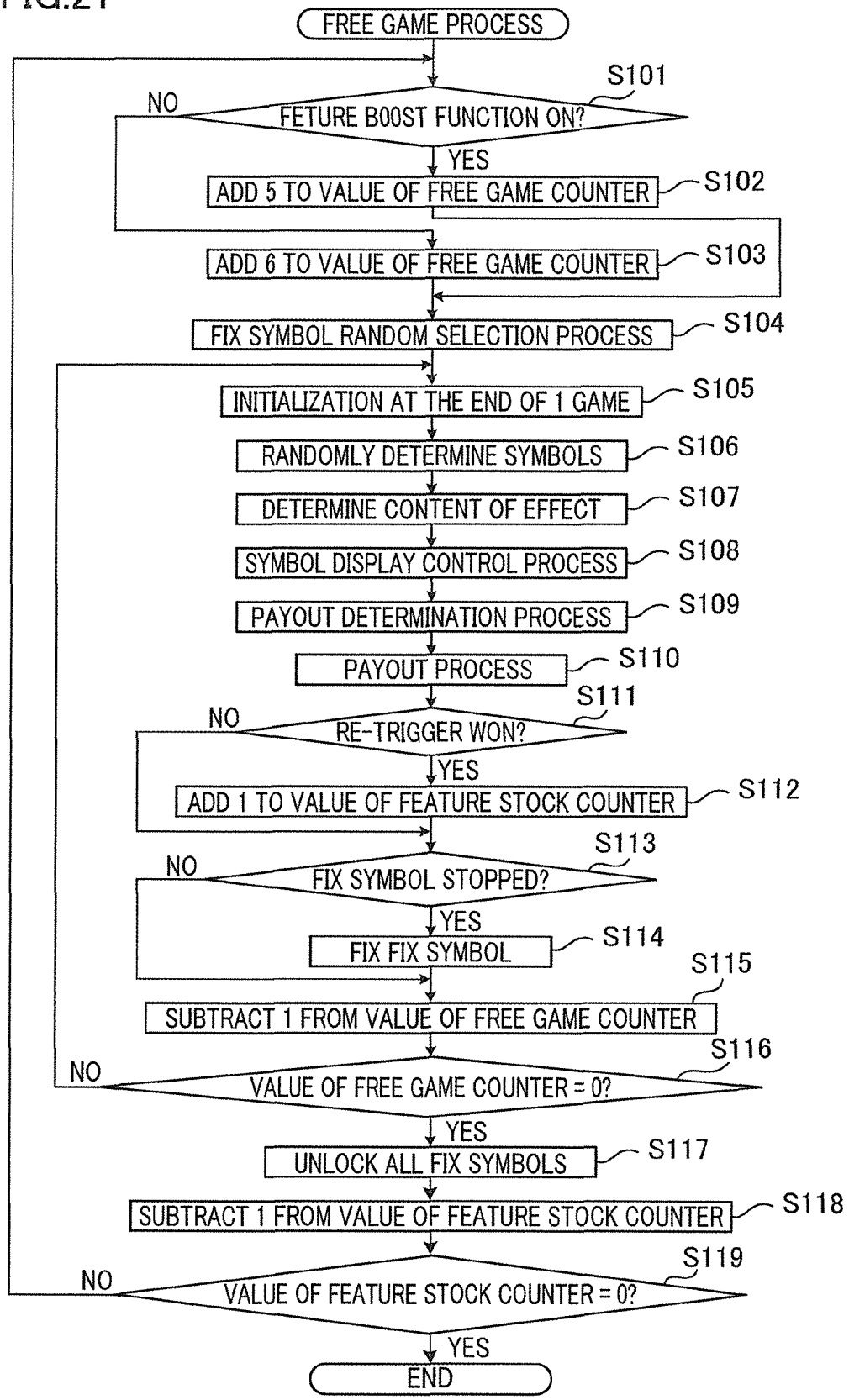
FIG. 21 is a flowchart of a free game process of the slot machine related to the embodiment of the present invention.

The following describes a free game process with reference to FIG. 21. FIG. 21 is a flowchart of a free game process of the slot machine of the embodiment of the present invention.

First, the main CPU 71 determines whether or not the feature boost function is in the on state (S101). Specifically, in the step is determined whether or not the feature boost function is turned on by operating the feature boost button 48 in the start-check process of the step S45.

If the feature boost function is not in the on state (in the off state: S101: NO), a value of 5 is added to a free game play counter stored in the RAM 73 (S102). If the feature boost function is in the on state (S101: YES), a value of 6 is added to the free game play counter of RAM 73 (S103). As described, if the feature boost function is in the off state, there will be awarded five plays of the free game. This number of plays of the free game awarded will be increased by one and six plays of the free game in total will be awarded, if the feature boost function is in the on state.

Figure 35:
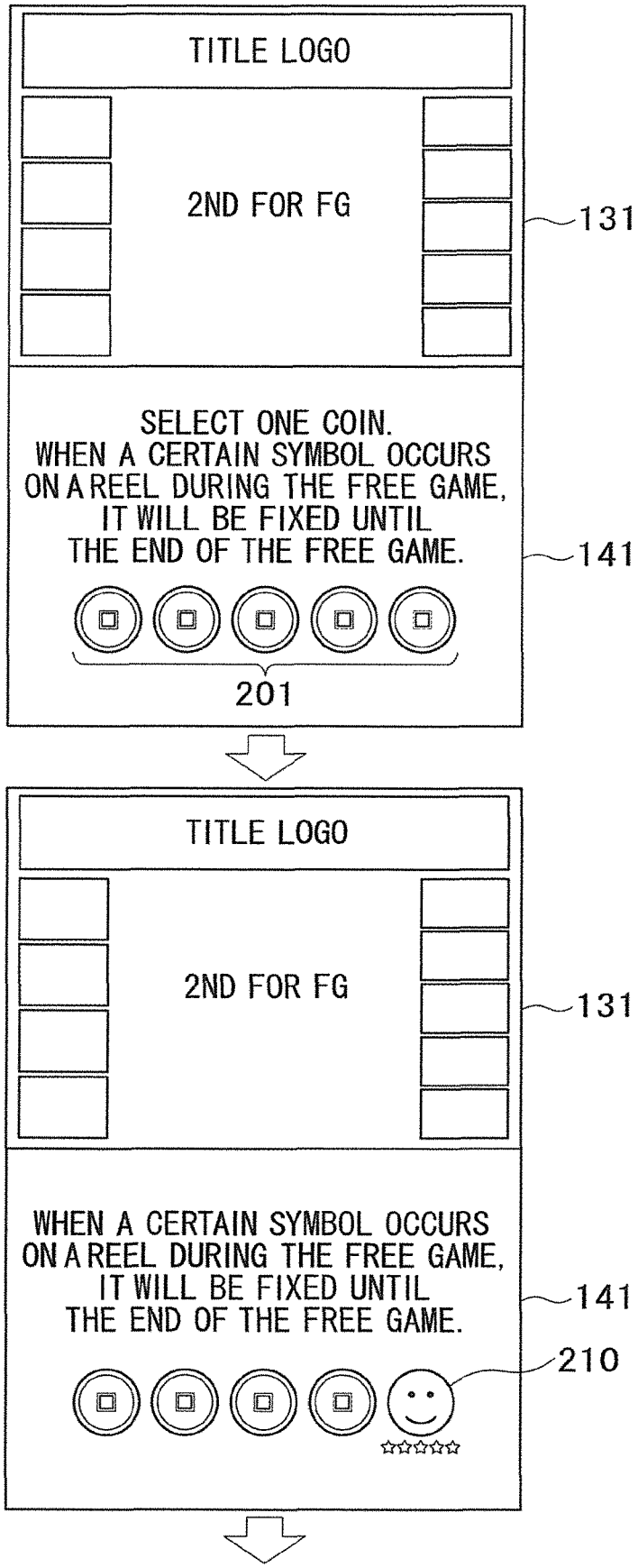
FIG. 35 shows a free game introduction effect in the slot machine related to the embodiment of the present invention.

After the step S102 or S103, the main CPU 71 executes a fix symbol random selection process (S104). Specifically, in the fix symbol random selection process, there will be five coins 201 displayed on the lower image display panel 141 as shown in FIG. 35. The coins are each randomly associated with any of the following symbols: "MAN", "DRAGON", "FISH", "TURTLE", and "GOURD". Then, the player is prompted to select one of the five coins (201), and the symbol associated with the selected coin 201 is set as a fix symbol 210 (see FIG. 35).

Next, the main CPU 71 executes the at-one-game-end initialization process (S105) in the same manner as the step S12. Next, the main CPU 71 executes a symbol random determination process (S106) in the same manner as the step S14.

The main CPU 71 then executes the effect contents determination process (S107) in the same manner as the step S15. Next, the main CPU 71 executes the symbol display control process (S108) in the same manner as the step S16. The main CPU 71 then executes the payout determination process (S109) in the same manner as in the step S17.

Subsequently, the main CPU 71 executes a payout process (step S110). In this payout process, the main CPU 71 adds the value stored in a payout counter in the payout determination process of the step S109 to the value stored in a free game payout counter. The free game payout counter is an area where the total payout amount determined during the free game is stored. When the free game process ends, the main CPU 71 adds the value stored in the free game payout counter to a credit amount counter provided in the RAM 73. In other words, the total payout amount determined in the free game is awarded at once. The payout may be awarded by ejecting coins from the coin payout exit 15A or by issuing a ticket with a barcode.

It should be noted that in the free game, the ways bet and the credit type in the normal game in which the right to play the free game is awarded is inherited.

Next, the main CPU 71 determines whether or not a re-trigger occurred (S111). In the present embodiment, the re-trigger occurs when the symbol of "FEATURE" occurs in three or more consecutive positions through the 1st column area to the 5th column area, irrespective of the result determination area activated by the ways bet. When it is determined that the re-trigger occurred (S111: Yes), the main CPU 71 adds 1 to a value of a feature stock counter in the RAM 73 and updates the value of the same (S112).

Next, when it is determined that the re-trigger did not occur (S111: NO) or after the step S112, the main CPU 71 determines whether or not a fix symbol 210 determined in the fix symbol random selection process of S104 stopped in the result determination area activated by the ways bet button includes (S113).

If the fix symbol 210 is stopped (S113: YES), the fix symbol 210 is fixed in the result determination area where it is stopped (the state where the fix symbol is stopped is maintained. see FIG. 38) (S114).

Next, if it is determined that the fix symbol 210 is not stopped in the step S113, or after the step S114, the main CPU 71 subtract 1 from the value stored in the free game play counter (S115).

The main CPU 71 then determines whether the value on the free game play counter is 0 (S116). When determining that the value on the free game play counter is not 0 (S116: NO), the main CPU 71 proceeds to the step S105.

In the meanwhile, when the value on the free game play counter is 0 (S116: YES), all the fix symbols 210 fixed in the result determination area are unfixed (S117). Subsequently, the main CPU 71 subtracts 1 from the number on the feature stock counter (step S118).

The main CPU 71 then determines whether the value on the feature stock counter is 0 (step S119). When determining that the value on the feature stock counter is not 0 (S119: NO), the main CPU 71 proceeds to the step S101. In the meanwhile, when the value on the feature stock counter is 0 (S119: YES), the free game process is terminated.

With the above structure, the fix symbol 210 is accumulatively fixed, while the free game is run 5 times or 6 times. This facilitates formation of a combination including the fix symbol 210. Further, although the fix symbol 210 is fixed, a symbol 211 to be rearranged in the first place in the position where the fix symbol 210 is fixed, as the result of rearranging a plurality of types of symbols aligned on the plurality of video reels 3, will be regarded as a symbol forming a combination of symbols subjected to awarding of a payout.

With the above structure, the one or more fix symbols 210 randomly selected are accumulatively fixed only in the selected ways bet (result determination area). This facilitates, according to the ways bet (result determination area) selected, formation of a combination including the one or more randomly selected fix symbols 210. Further, the fix symbols 210 randomly selected by the fix symbol random selection process are not fixed in the non-selected ways bet, which makes it possible to avoid giving an unnecessary expectation feeling to the player.

Turning on the feature boost function (placing an additional bet) may increase (from the 5 plays in the normal occasion to 6 plays) the number of plays of the free game awarded when the free game trigger occurs as the result of the normal game. With the above structure, the one or more fix symbols 210 randomly selected in the fix symbol random selection process are accumulatively fixed, while the increased number of plays of the game are run. This further facilitates formation of a combination including the one or more randomly selected fix symbols 210.

(15-Choice Pick Game Process)

Figure 22:
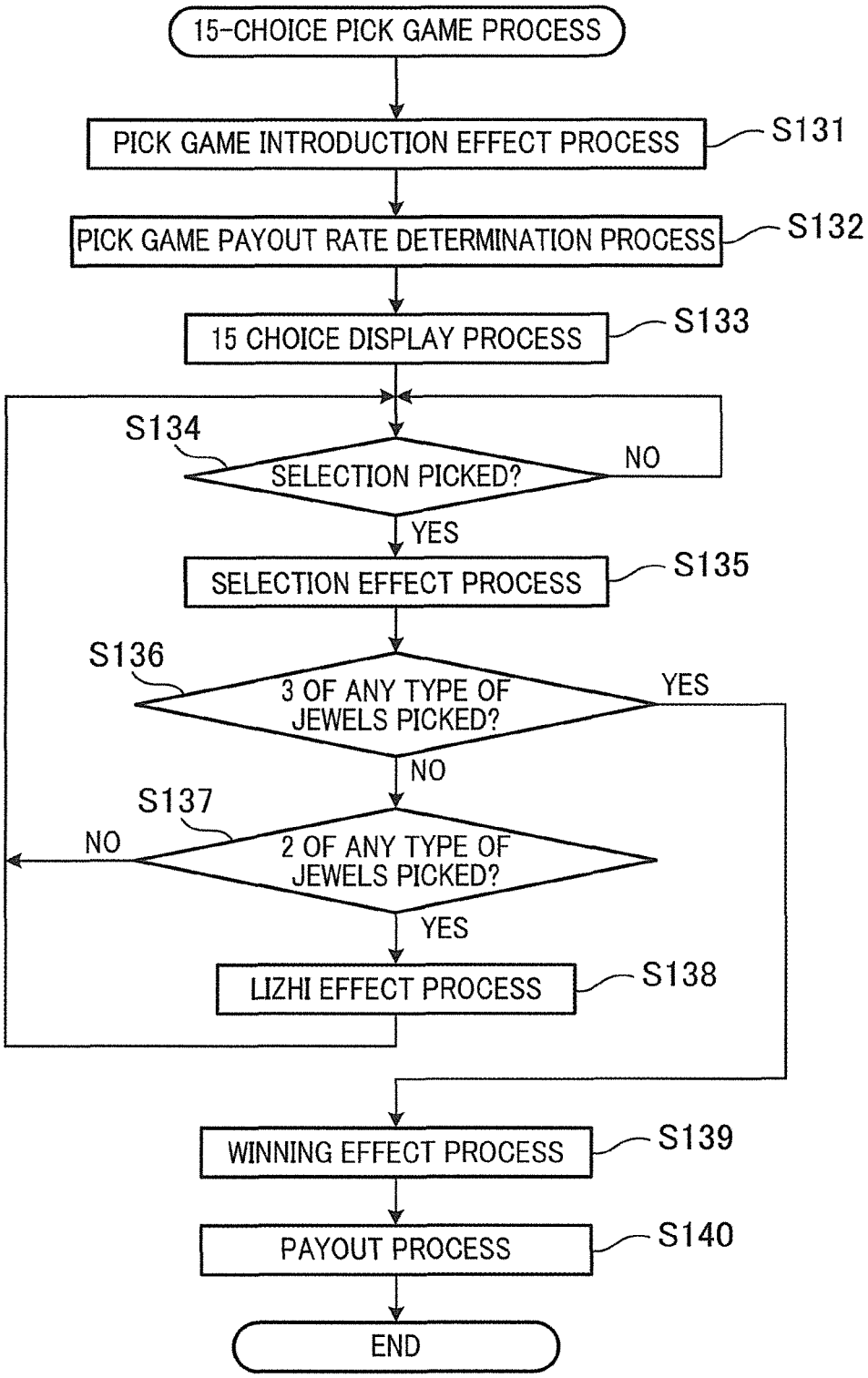
FIG. 22 is a flowchart of a 15-choice pick game process of the slot machine of the embodiment of the present invention.

Now, referring to FIG. 22, a 15-choice pick game process is described.

Figure 51:
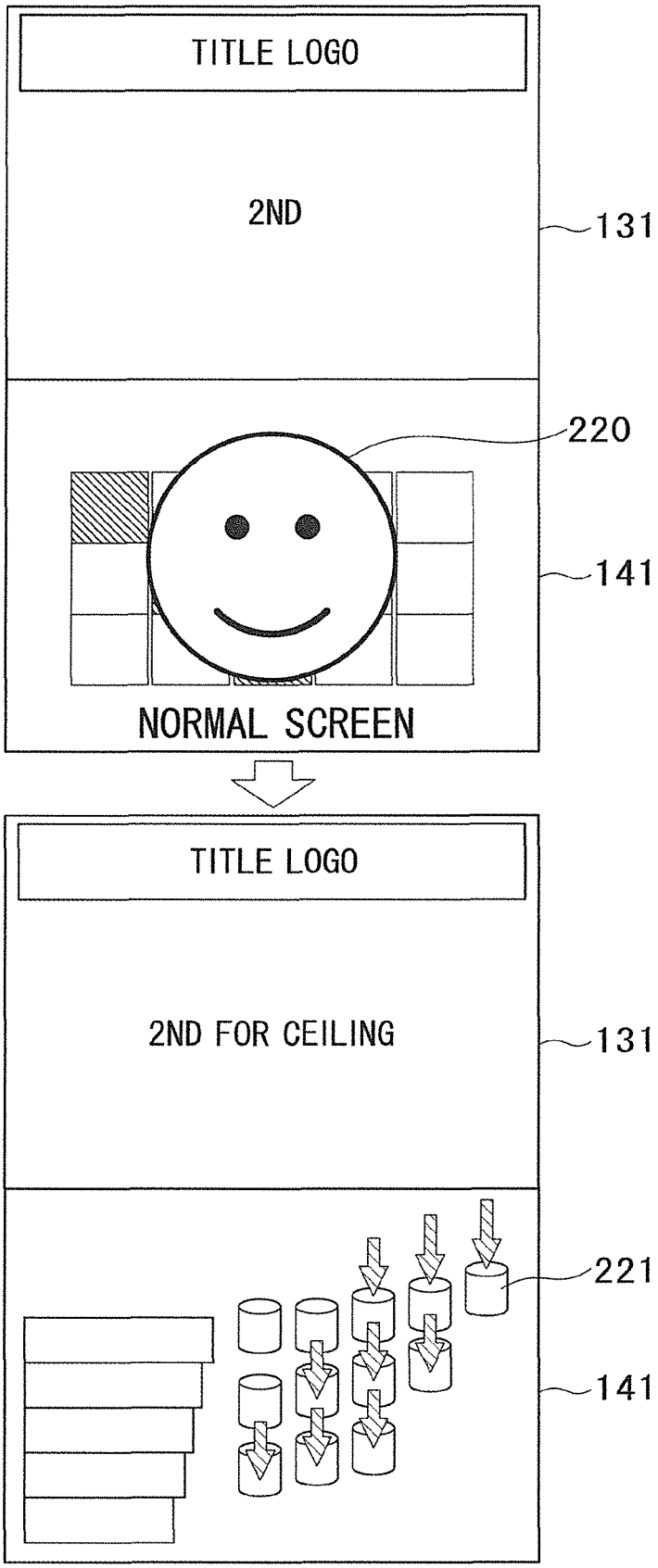
FIG. 51 is an explanatory diagram of a pick game introduction effect of the slot machine related to the embodiment of the present invention.

First, the main CPU 71 executes a pick game introduction effect process (S131). In this pick game introduction effect, as shown in FIG. 51, a game character 220 appears on the lower image display panel 141 and an animation of laughing motion is played. Then, a signboard appears to show that transition to the 15-choice pick game has occurred.

Next, the main CPU 71 executes a later described pick game payout rate determination process (S132).

Specifically, if the transition to the 15-choice pick game process occurred after the value on the total counter reaches the threshold game play count of 450 in the process of S23, the payout rate random determination table determination table is created (see FIG. 16). Each probability of being randomly selected, which is in the payout rate random determination table determination table, is calculated by dividing the value on the corresponding credit type counter by the threshold game play count, which value is the value indicated on the corresponding credit type counter when the game play count on the corresponding total counter (see FIG. 12) reaches the threshold game play count, the total counter being capable of counting plays of the game of the related ways bet. The probabilities thus calculated and the payout rate random determination tables (five types of them, i.e., 1bet, 2bet, 3bet, 5bet, 10BET) are associated with each other in the payout rate random determination table determination table. The payout rate random determination table determination table created is stored in the RAM 73.

As shown in FIG. 13, for example, when the value on the total counter for the ways bet5 reaches 450 which is the threshold game play count, the credit type counters of the ways bet5 are referred to. At this point, the credit type counters corresponding to the credit types of 1bet, 2bet, 3bet, 5bet, and 10bet each indicates in how many plays out of the threshold game play count of 450 plays, the corresponding credit type has been used as a bet. For example, in the example of FIG. 13, when the credit type counter for 1bet indicates a value of 370, it means that the credit type of 1bet was used 370 times in ways bet5. Further, when the credit type counter for 2bet indicates a value of 48, it means that the credit type of 2bet was used 48 times in ways bet5. Further, when the credit type counter for 3bet indicates a value of 20, it means that the credit type of 3bet was used 20 times in ways bet5. Further, when the credit type counter for 5bet indicates a value of 4, it means that the credit type of 5bet was used 4 times in ways bet5. Further, when the credit type counter for 10bet indicates a value of 8, it means that the credit type of 10bet was used 8 times in ways bet5. Each of the above values on the counters are divided by the threshold game count of 450 to derive the following probabilities: 370/450, 48/450, 20/450, 4/450, and 8/450. The probabilities thus calculated and the payout rate random determination tables (five types of them, i.e., 1bet, 2bet, 3bet, 5bet, 10bet) are associated with each other in the payout rate random determination table determination table, as shown in FIG. 16.

Subsequently executed is the payout rate random determination table random determination, which determines the payout rate random determination table, based on the payout rate random determination table determination table after it is created. In this process, one payout rate random determination table is selected out of the payout rate random determination table 1bet, the payout rate random determination table 2bet, the payout rate random determination table 3bet, the payout rate random determination table 5bet, the payout rate random determination table 10bet, based on the probability of being randomly selected in the payout rate random determination table determination table (see FIG. 16).

Next, a payout rate random determination for determining the payout rate is executed, based on the payout rate random determination table determined through the random determination of the payout rate random determination table. In this process, a level (payout rate) is determined based on the payout rate random determination table shown in FIG. 15. For example, when the payout rate random determination table 1bet is determined as the result of random determination of the payout rate random determination table, a level1 (payout rate: ×1) is determined at a probability of 29968/30000, a level2 (payout rate: ×2) is determined at a probability of 1/30000, a level3 (payout rate: ×3) is determined at a probability of 1/30000, a level4 (payout rate: ×4) is determined at a probability of 1/30000, a level5 (payout rate: ×5) is determined at a probability of 1/30000, a level6 (payout rate: ×10) is determined at a probability of 1/30000, and a level7 (payout rate: ×20) is determined at a probability of 27/30000.

Next, each amount of payout in the special game basic payout table determination table shown in FIG. 14 is multiplied by the payout rate determined by the random determination of the payout rate to create a payout table referred to in the 15-choice pick game process that takes place after the value of the total counter reaches the threshold game play count of 450 in the step S23. For example, in a case where: the payout rate determined by the random determination of the payout rate is ×1000; the total counter whose value has reached the threshold game play count corresponds to ways bet1; and 3 red jewels are obtained in the 15-choice pick game, the basic payout awarded will be 100×10=1000 credits. Further, when 3 blue jewels are obtained in the 15-choice pick game, the basic payout awarded will be 75×10=750 credits. Further, when 3 green jewels are obtained in the 15-choice pick game, the basic payout awarded will be 30×10=300 credits. Further, when 3 amber jewels are obtained in the 15-choice pick game, the basic payout awarded will be 20×10=200 credits. Further, when 3 purple jewels are obtained in the 15-choice pick game, the basic payout awarded will be 15×10=150 credits.

It should be noted that, when the transition to the 15-choice pick game occurs after the mystery feature is won in the step S22, the payout rate random determination table corresponding to the credit type used for placing a bet at the time of winning the mystery feature is automatically selected. For example, if the credit type used in the bet is 1bet, the payout rate random determination table 1bet is selected. If the credit type used in the bet is 2bet, the payout rate random determination table 2bet is selected. If the credit type used in the bet is 3bet, the payout rate random determination table 3bet is selected. If the credit type used in the bet is 5bet, the payout rate random determination table 5bet is selected. If the credit type used in the bet is 10bet, the payout rate random determination table 10bet is selected.

Then, based on the selected payout rate random determination table (see FIG. 15), a payout rate random determination is executed to determine the payout rate, and each amount of payout in the special game basic payout table determination table shown in FIG. 14 is multiplied by the payout rate determined, thereby creating a payout table to be referred to in the 15-choice pick game process taking place after the mystery feature is won in the step S22. For example, in a case where: the payout rate determined by the random determination of the payout rate is ×1000; the selected ways bet at the time of winning the mystery feature is ways bet1; and 3 red jewels are obtained in the 15-choice pick game, the basic payout awarded will be 100×10=1000 credits. Further, when 3 blue jewels are obtained in the 15-choice pick game, the basic payout awarded will be 75×10=750 credits. Further, when 3 green jewels are obtained in the 15-choice pick game, the basic payout awarded will be 30×10=300 credits. Further, when 3 amber jewels are obtained in the 15-choice pick game, the basic payout awarded will be 20×10=200 credits. Further, when 3 purple jewels are obtained in the 15-choice pick game, the basic payout awarded will be 15×10=150 credits.

In the above, the pick game payout rate determination process of the step S132 is described. Following the pick game payout rate determination process of the step S132, a 15-choice display process is executed (S133).

Figure 52:
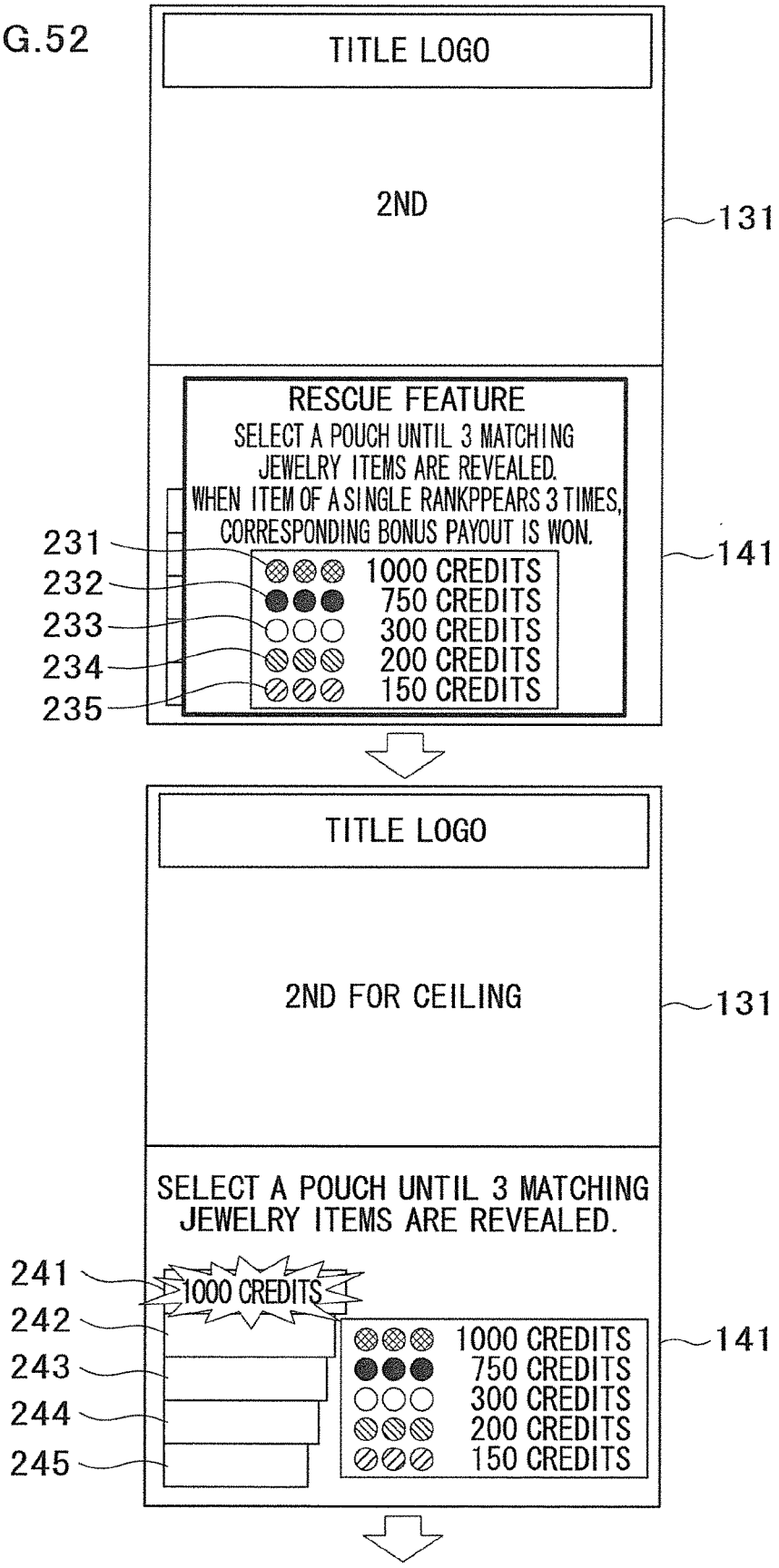
FIG. 52 is an explanatory diagram of a pick game introduction effect of the slot machine related to the embodiment of the present invention.

As shown in FIG. 51, in the 15-choice display process, 15 pouches 221 (choices) are displayed on the lower image display panel 141. The 15 pouches 221 are randomly associated with any of 15 jewels which include: 3 red jewels 231, 3 blue jewels 232, 3 green jewels 233, 3 amber jewels 234, and 3 purple jewels 235. Further, as shown in FIG. 52, the lower image display panel 141 displays a signboard prompting the player to select a pouch 221.

Next, the main CPU 71 determines whether or not any of the 15 pouches 221 displayed on the lower image display panel 141 is selected (S134). If no pouches are selected (S134: NO), an input of a selection is waited.

Figure 54:
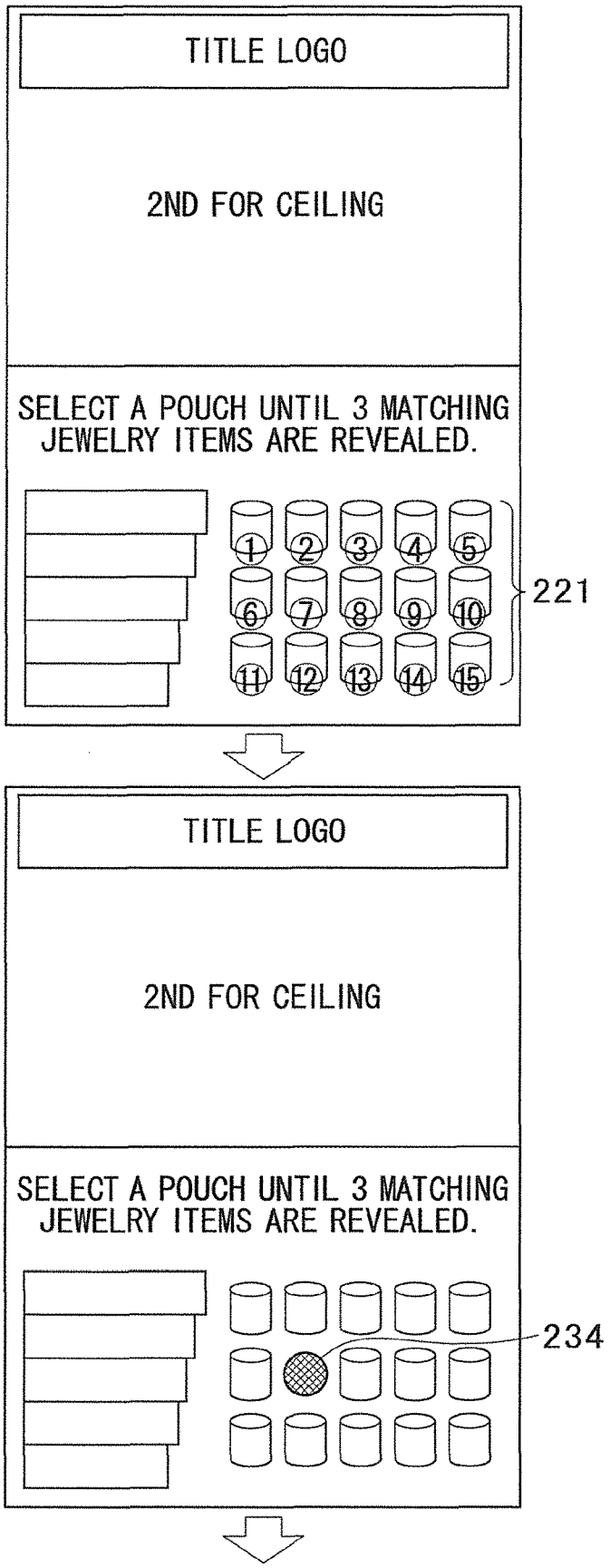
FIG. 54 is an explanatory diagram of a pick game introduction effect of the slot machine related to the embodiment of the present invention.
Figure 55:
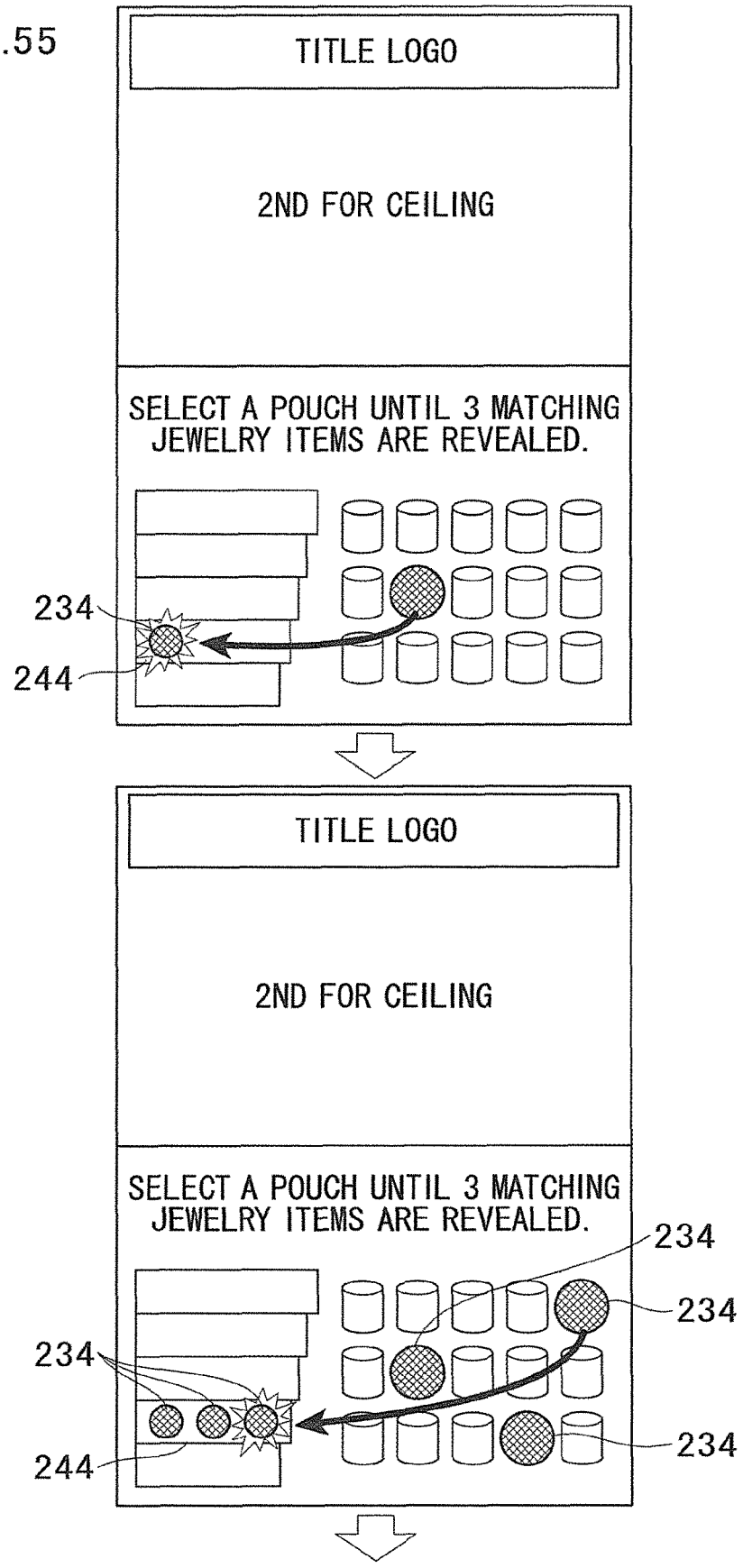
FIG. 55 is an explanatory diagram of a pick game introduction effect of the slot machine related to the embodiment of the present invention.

On the other hand, when any of the 15 pouches 221 is selected (S134: YES), a selection effect process (S135) is executed. Through the selection effect process, a jewel associated with the selected one of the 15 pouches 221 is displayed. For example, as shown in FIG. 54, when a pouch 221 with a number 7 is selected by the player, the amber jewel 234 associated with the number 7 pouch 221 is displayed. Then, as shown in FIG. 55, there will be a display effect such that the displayed amber jewel 234 is moved to an amber indicator 244. It should be noted that the same kind of jewels are accumulated up to a total of 3 on the corresponding indicator, as shown in FIG. 55.

Next, the main CPU 71 determines whether or not the player has selected 3 red jewels 231, 3 blue jewels 232, 3 green jewels 233, 3 amber jewels 234, or 3 purple jewels 235 (S136).

Figure 56:
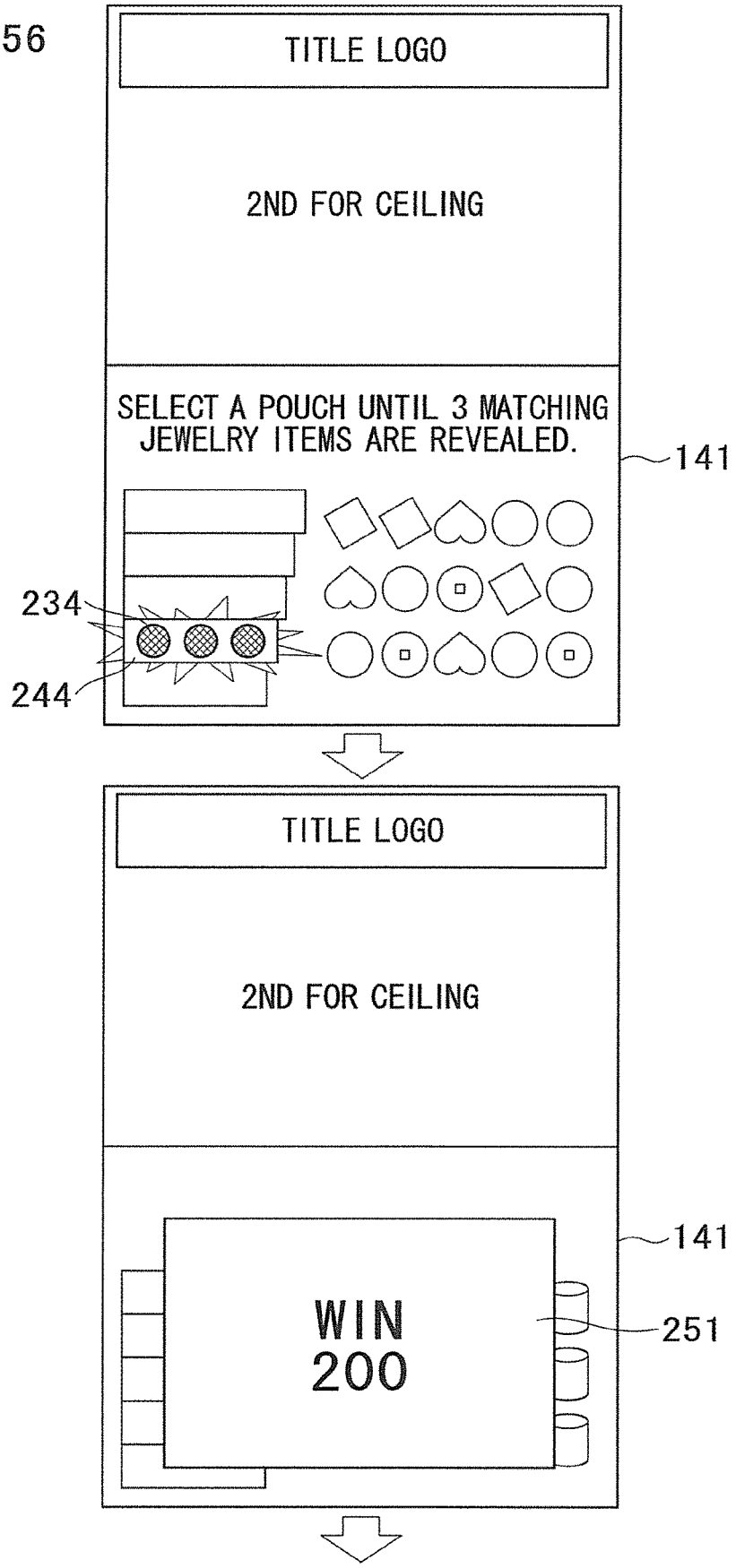
FIG. 56 is an explanatory diagram of a pick game introduction effect of the slot machine related to the embodiment of the present invention.

If 3 of the same type of the jewels are selected (S136: Yes), a win effect process is executed (S139). In this win effect process, the indicator corresponding to the type of jewels, 3 of which have been selected by the player, is lighted to emphasize the jewel type having been obtained. For example, as shown in FIG. 56, when 3 amber jewels 234 are selected, the amber indicator 244 is lighted to emphasize that the amber jewels 234 are obtained. Further, after a few seconds after the lighting of the indicator, the jewels associated with non-selected pouches 221 are displayed. Then, as shown in FIG. 56, the win signboard 251 is displayed on the lower image display panel 141.

On the other hand, none of the types of jewels are selected up to 3 (S136: NO), the main CPU 71 determines if any 2 of the same type of jewels, 2 of the red jewels 231, 2 of the blue jewels 232, 2 of the green jewels 233, 2 of the amber jewels 234, 2 of the purple jewels 235 are selected (S137)

If 2 of the same type of the jewels are selected (S137: Yes), a Lizhi effect process is executed (S138). In the Lizhi effect process, there will be an effect that informs the player that there will be one to go before selecting 3 of the same type of jewels (Lizhi state). Specifically, in the effect, the tempo of the music (BGM) played during the 15-choice pick game process is played in a faster tempo.

If none of the types are selected up to 2 (S137: NO), or after the step S138, the process transits to S134.

Next, after the step S139, the main CPU 71 executes a payout process (S140). In this payout process, the payout amount is determined, based on the payout table created in the step S132 and the type of jewels, all 3 of which have been selected by the player in the above process. For example, in a case where: the payout rate determined by the random determination of the payout rate is ×10; the total counter whose value has reached the threshold game play count corresponds to ways bet1; and 3 amber jewels are obtained in the 15-choice pick game, the basic payout awarded will be 20×10=200 credits.

After the above process, the 15-choice pick game process is terminated.

In the structure, the plurality of types of ways bet (result determination areas) are associated with the plurality of special game basic payout tables in the special game basic payout table determination table. Therefore, it is possible to adjust an expectation value for the payout by the relation between each type of ways bet to be selected by the player and the special game basic payout table to be the reference for the payout in the 15-choice pick game. As such, it is possible to set the expectation value for the payout of the 15-choice pick game according to the ways bet selected by the player, and ensure the fairness of the payouts in the 15-choice pick game.

With the above structure, the payout rate random determination table determination table is created according to the usage counts of each of the credit types at a time the value of the total counter reaches the threshold game play count. Then, based on the payout rate random determination table determination table created, the payout rate random determination table is determined, and random determination is executed for determining the payout rate in the 15-choice pick game based on the payout rate random determination having been determined. In this payout rate random determination, there is executed a random determination corresponding to the usage counts of each of the credit types at a time the game play count reaches the threshold game play count. That is, the usage count of each credit type at a time the value of the total counter reaches the threshold game play count affects determination of the payout rate in the 15-choice pick game. Therefore, each bet placed until the value of the total counter reaches the threshold game play count is not wasted, which ensures the fairness in the 15-choice pick game.

[Screen Display Specification]

Now, the screen display specification of the slot machine 1 will be described with reference to FIG. 23 and FIG. 24.

<Screen Display Specification in Normal State>

To begin with, screen display specification in the normal game will be described with reference to FIG. 23. FIG. 23 shows the screen display specification in the normal game in the slot machine of the embodiment of the present invention.

Figure 23:
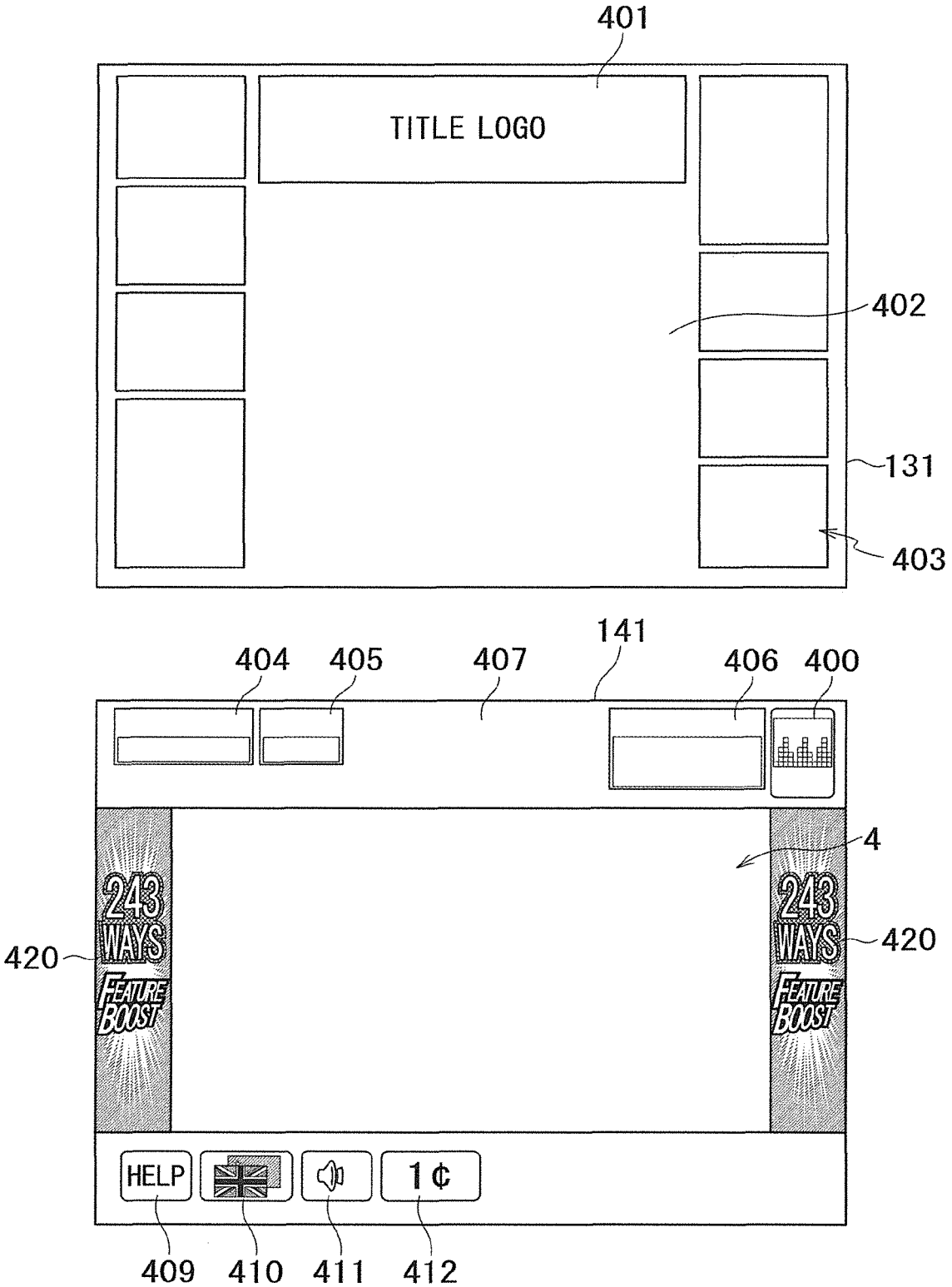
FIG. 23 shows the screen display specification in the normal game in the slot machine related to the embodiment of the present invention.

As shown in FIG. 23, the upper image display panel 131 in the normal game is provided with a title logo area 401, an image area 402, and an information area 403. In the title logo area 401 is displayed a game title logo. During the free game, the display is switched to displaying of the free game name, and during the 15-choice pick game, the display is switched to display of the name of the pick game. When the display language is switched to English or Chinese, the title is displayed in that language. In the image area 402 is displayed a main image of the game. In the information area 403 are displayed a simple explanation of game rules and payout amount and the like in relation to the symbols.

On the lower image display panel 141 in the normal game, in addition to the above-described symbol display area 4, a credit meter 404, a bet meter 405, a win meter 406, a display area 407 for ways bet information, bet information and the game state, a graph-switch button 400, a feature boost display area 420, a help touch button 409, a language switching touch button 410, a sound volume switching touch button 411, and a denomination indicator 412. In the credit meter 404 is displayed a remaining credit amount. The default value is 0. In other words, a credit amount stored in the RAM 73 is displayed. The bet meter 405 displays the total bet amount of the current game (or the final game). The win meter 406 displays the total credit amount of win and the detail of the win. The feature boost display area 420 displays a red-flamed logo of "FEATURE BOOST", when the feature boost function is turned on (when the feature boost function is in the off state, the logo is displayed with a blue flame).

The display area 407 for the ways bet information, bet information and the game state displays the ways bet information and the bet information of the currently played game (or the final play of the game). Specifically, the area displays which type of the 5 staged ways bet (i.e., ways bet1, ways bet2, ways bet3, ways bet4, and ways bet5) is currently selected. Further, the display area 407 displays the state of the currently played game. The area is hidden while the current play of the game is played. When the current game state is game over, "GAME OVER" is displayed. When the current game state is waiting for gamble, "PLAY ON, GAMBLE or TAKE WIN" is displayed.

The graph-switch button 400 sequentially changes the display every time it is touched by the player, in the order of a normal screen (title logo screen)→a line-graph G1, →a bar-graph G2, →a block-graph G3, →and back to the normal screen (title logo screen).

When the player touches the help touch button 409, the first page of the help screen is displayed on the lower image display panel 141. The help touch button 409 is darkened when it is inactive, e.g., during the rotation of the video reels 3.

As the language switching touch button 410 is touched by the player, the language is switched to English or Chinese. The language switching touch button 410 is activated only during the advertisement, and is darkened when it is inactive, e.g., during the rotation of the video reels 3. Furthermore, on the language switching touch button 410, the displayed national flags are changed to "U.K./Chine" or "U.S.A./China" in accordance with the setting of the AUDIT. When the language switching is set at "DISABLE", the language switching touch button 410 is changed to a paytable button with which a payout table is displayed on the help screen.

The sound volume switching touch button 411 is used for switching the game sound volume in three stages. Each time the sound volume switching touch button 411 is touched by the player, the game sound volume is switched such that, for example, from low to middle to high to small to middle. The denomination indicator 412 displays current denomination.

<HELP Screen Display Specification>

Figure 24:
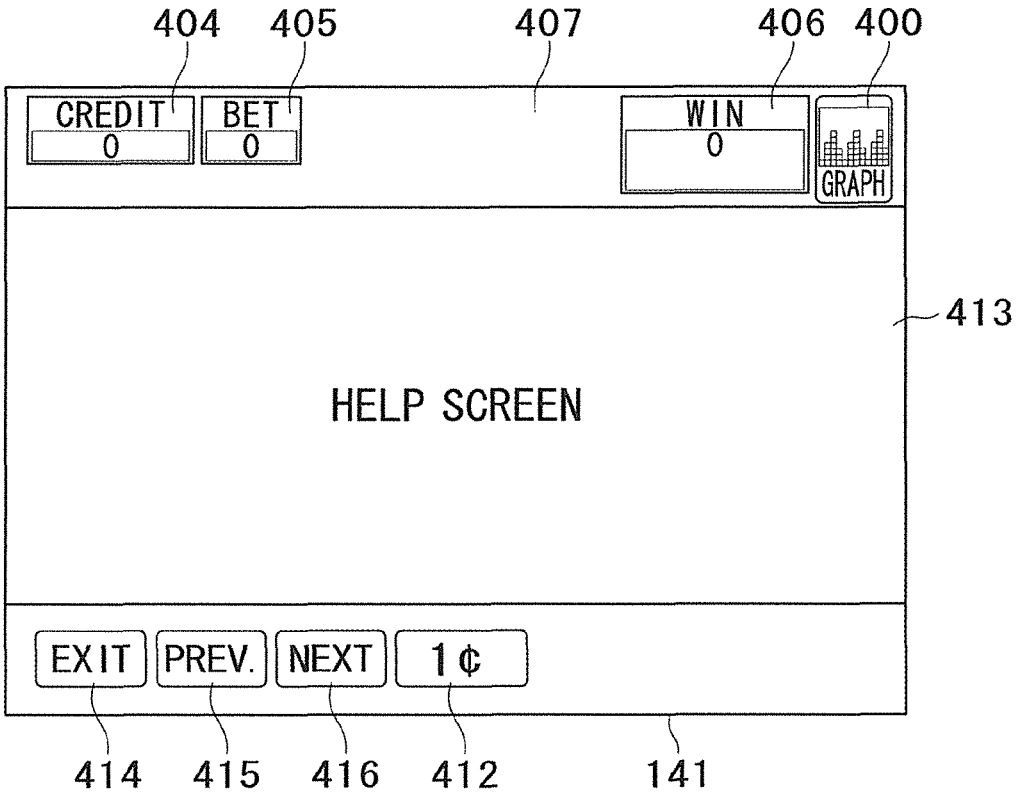
FIG. 24 shows HELP screen display specification on the slot machine of the embodiment of the present invention in the normal state.

Next, the following describes HELP screen display specification, with reference to FIG. 24.

As the lower image display panel 141 shown in FIG. 24, the HELP screen display specification is such that: the credit meter 404, the bet meter 405, the win meter 406, the display area 407 for the ways bet information, bet information, and the game state, and the graph-switch button 400 are displayed. Further, the lower image display panel 141, while ensuring the HELP screen 413, displays an exit touch button 414, a PREV. touch button 415, a NEXT touch button 416, and a denomination indicator 412.

When the player touches the exit touch button 414, the HELP screen 413 disappears from the lower image display panel 141 and a normal game screen (see FIG. 23) comes back. When the player touches the PREV. touch button 415, the directly preceding page is displayed on the HELP screen 413. When the player touches the NEXT touch button 416, the next page is displayed on the HELP screen 413.

[Win Effect]

Now, a win effect in the slot machine 1 will be described with reference to FIG. 25 to FIG. 29.

The win effect is an effect executed when a win is achieved in the normal game or the free game. In other words, the effect is executed when symbols stopped in the result determination area subjected to result determination by operating the ways bet button forms a combination of a predetermined number of symbols which are linked within the 1st column area to the 5th column area in the symbol display area 4, the combination matching with a symbol combination on the symbol combination table (see FIG. 11).

<Flow of Win Effect>

Figure 25:
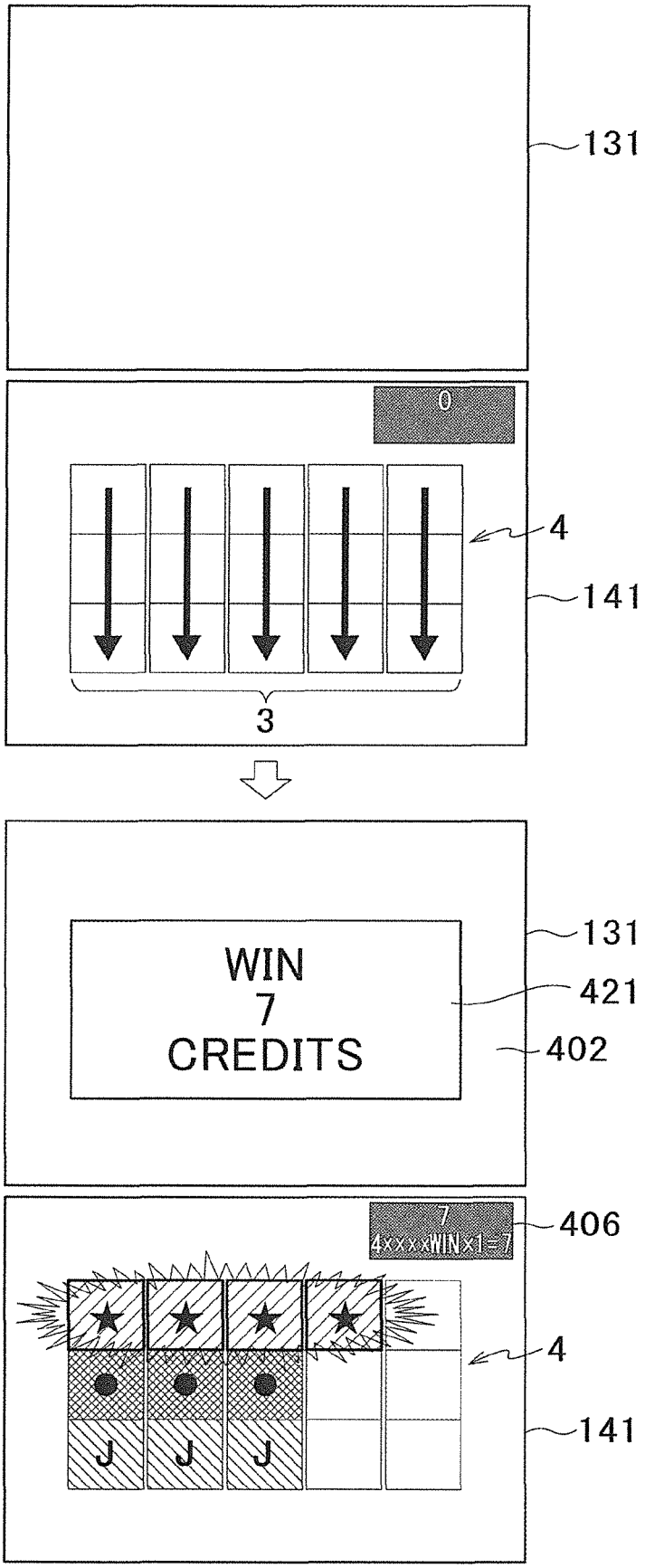
FIG. 25 shows the flow of a win effect of the slot machine related to the embodiment of the present invention.

To begin with, as shown in FIG. 25, all video reels 3 in the symbol display area 4 on the lower image display panel 141 stop. When all video reels 3 stop, as shown in FIG. 25, a win signboard 421 is displayed in the image area 402 of the upper image display panel 131. In the win signboard 421, an obtained credit is displayed in an increment manner. The increment display of the obtained credit on the win signboard 421 is linked to the image display on the win meter 406 of the lower image display panel 141.

On the lower image display panel 141, the win effect is performed for the achieved win. The win effect is provided when the feature symbol occurs to three or more consecutive positions through the 1st column area to the 5th column area, followed by a win effect associated with a win related to the other symbols are executed. In this regard, for symbols for each of which a win animation is prepared, an animation effect is carried out. The symbols which do not relate to any win are darkened to be less noticeable.

Figure 26:
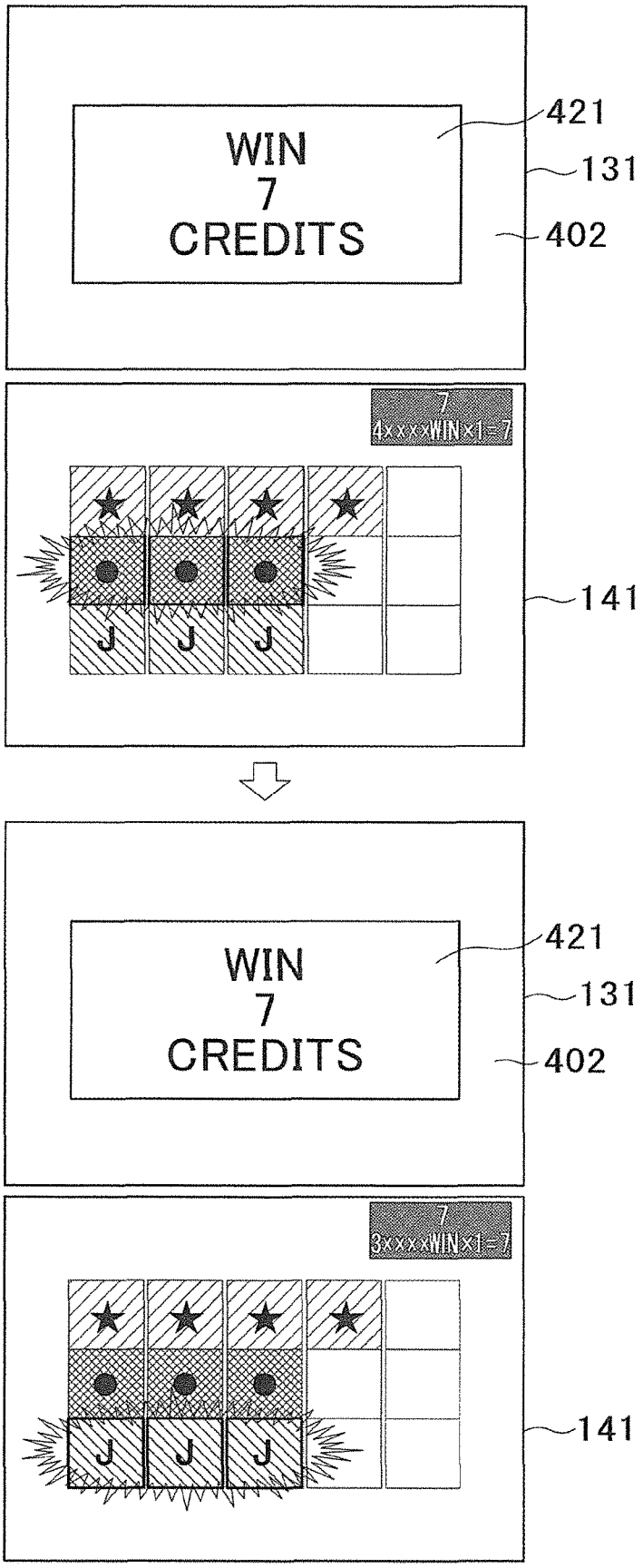
FIG. 26 shows the flow of a win effect of the slot machine related to the embodiment of the present invention.

For example, as shown in FIG. 25, a win effect is provided (light is turned on) for star symbols. Subsequently, as shown in FIG. 26, on the win signboard 421 displayed on the image area 402 of the upper image display panel 131, the increment display of the obtained credit is continued. On the lower image display panel 141, the display of the win effect proceeds to next. In this case, the display of the win effect proceeds from the star symbols to the black circle symbols. When win animations are prepared for both the star symbols and black circle symbols, animation effects are performed. In the meanwhile, the "J" symbols are kept in the stop state because the time to display the win effect has not come and no win animation is prepared therefor. In this case, the display of the win effect (turning on of the lights) proceeds from the black circle symbols to the J symbols, as shown in FIG. 26.

Figure 27:
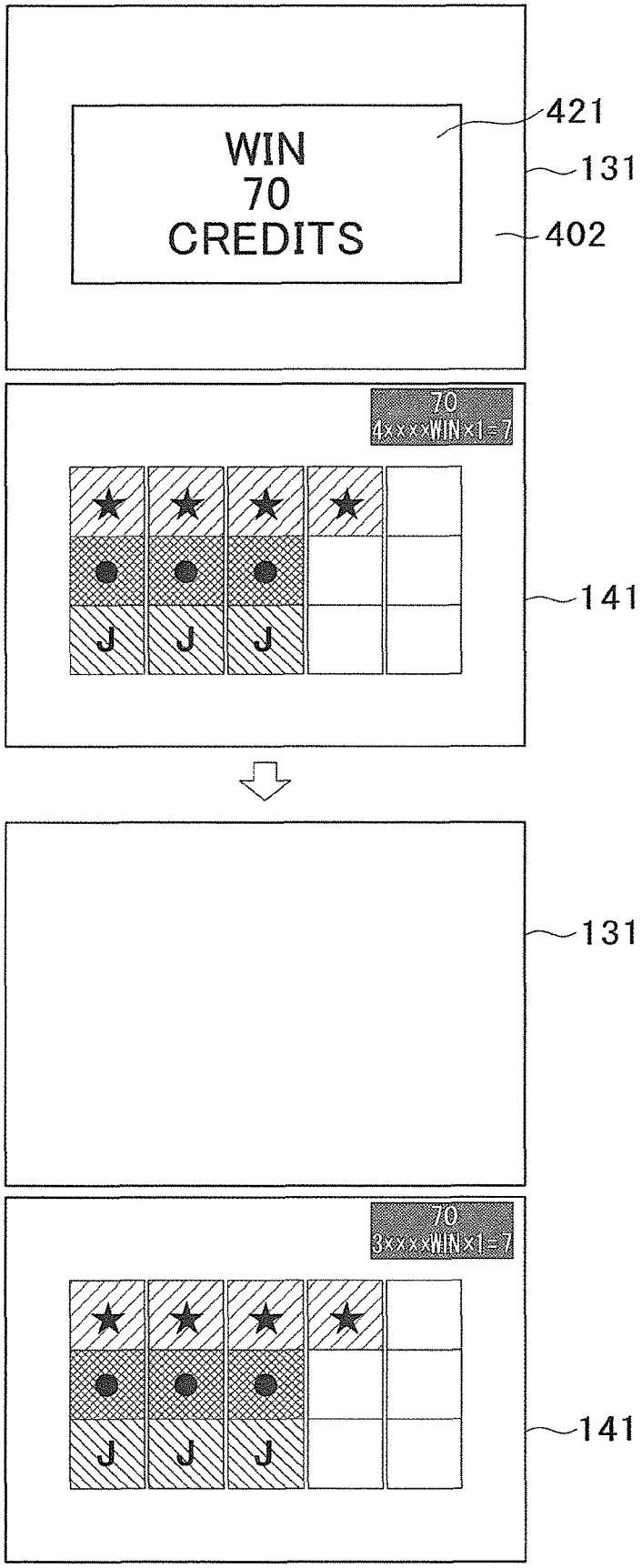
FIG. 27 shows the flow of a win effect of the slot machine related to the embodiment of the present invention.

Subsequently, as shown in FIG. 27, the total win is displayed on the win signboard 421 displayed in the image area 402 of the upper image display panel 131. The increment display of the obtained credit is terminated. On the lower image display panel 141, as all of the winning symbols are displayed for once, the win signboard 421 is hidden, and the symbols are displayed in a looped manner in a descending order of the payout, as shown in FIG. 27.

Figure 28:
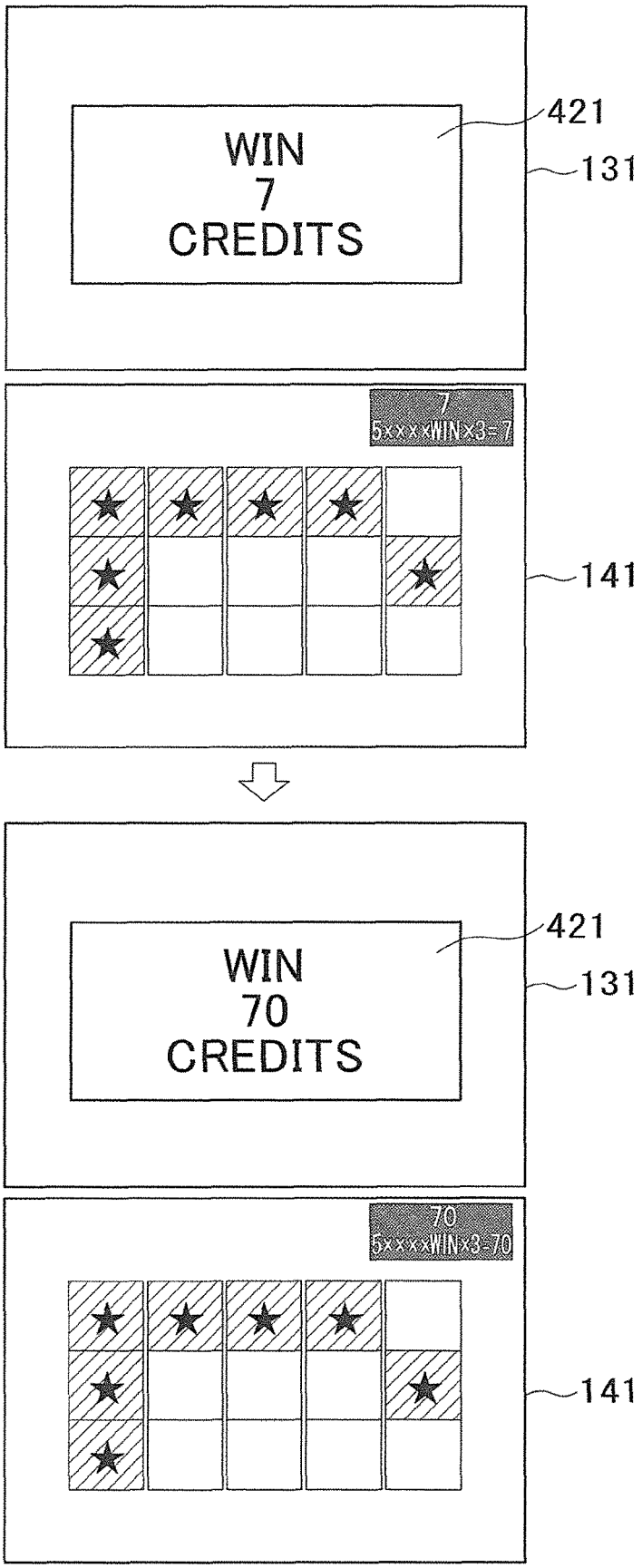
FIG. 28 shows the flow of a win effect of the slot machine related to the embodiment of the present invention.
Figure 29:
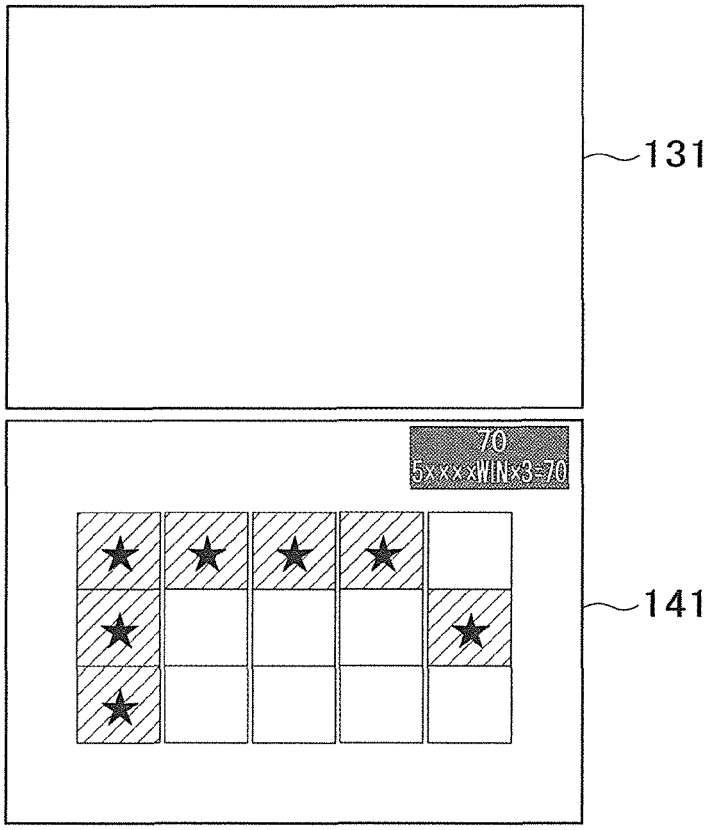
FIG. 29 shows the flow of a win effect of the slot machine related to the embodiment of the present invention.

When one kind of symbols successively appear, as shown in FIG. 28 and FIG. 29, animation effect is performed for all of the symbols. The symbols which do not relate to any win are darkened to be less noticeable.

<Win Signboard>

Figure 30:
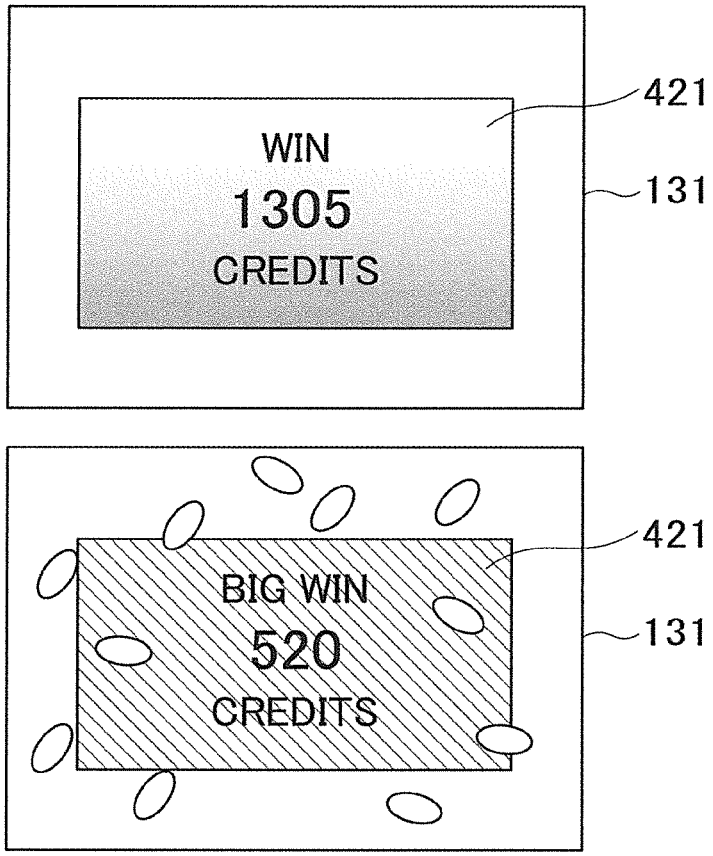
FIG. 30 shows a win signboard of the slot machine of the embodiment of the present invention.
Figure 31:
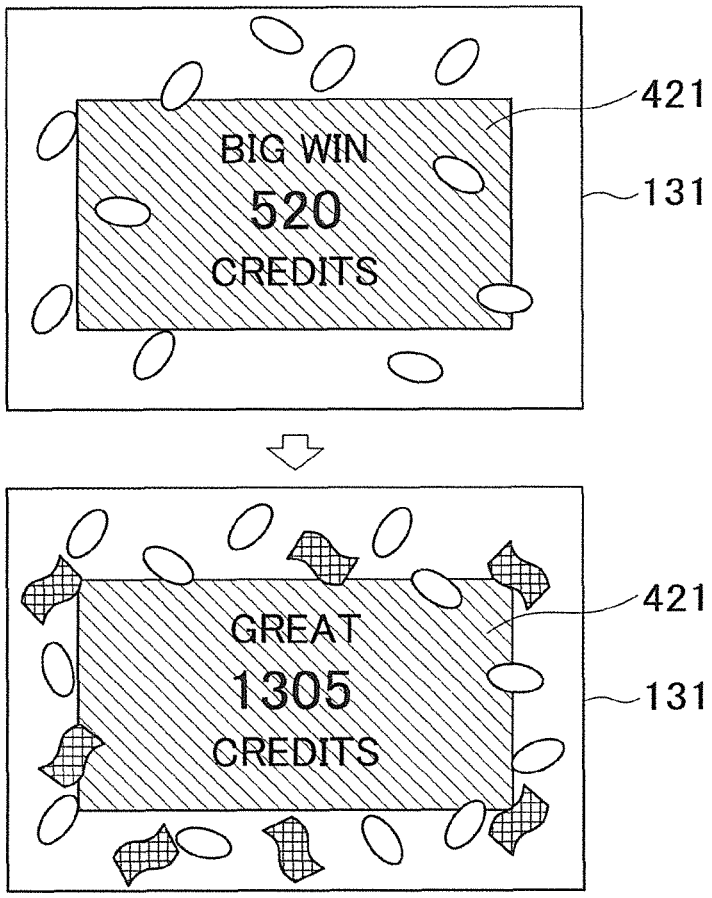
FIG. 31 shows a win signboard of the slot machine of the embodiment of the present invention.

Now, the win signboard will be described with reference to FIG. 30 and FIG. 31. FIG. 30 and FIG. 31 show a win signboard of the slot machine of the embodiment of the present invention.

The total win amount as a result of the current play of the game is displayed on a silver signboard 421 shown in FIG. 30 on the upper image display panel 131, when the total win is less than 15 times as much as the bet amount. On the gold signboard 421, an effect of falling coins is performed.

On the other hand, when the increment amount becomes more than 50 times as much as the bet amount, the gold signboard 421 shown in the upper part of FIG. 31 is changed to a gold signboard 421 shown in the lower part of FIG. 31, on the upper image display panel 131. On the gold signboard 421 on the lower part of the figure, effect of falling coins and paper money is performed. In other words, on the upper image display panel 131, the effect of falling coins 431 is performed first by the gold signboard 421. Subsequently, in sync with the increment display on the win meter 406, the obtained credit is incremented with the gold signboard 421. When the increment amount becomes more than 50 times as much as the bet amount, the gold signboard 421 shown in the upper part of FIG. 31 is replaced with the gold signboard 421 shown in the lower part of FIG. 31.

<Effect Sound when Three or More "FEATURE" Symbols Appear>

Figure 32:
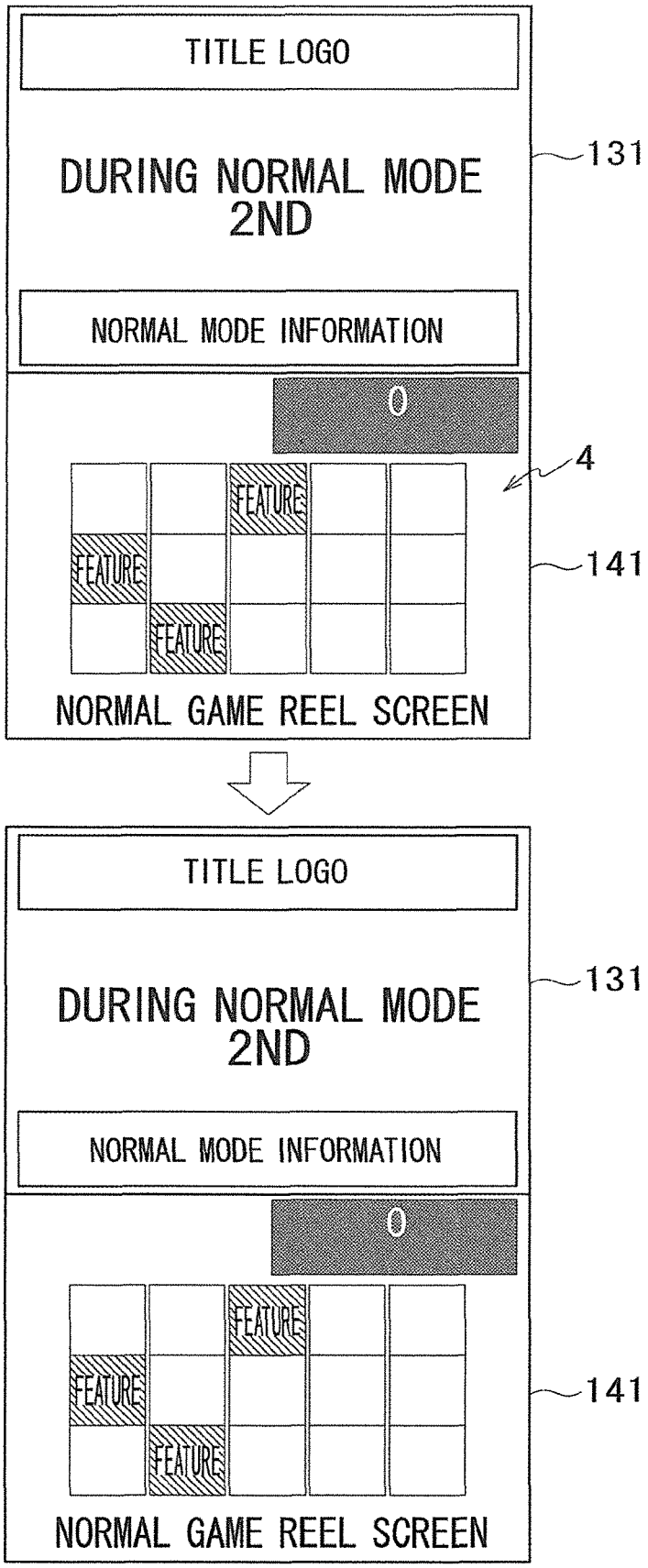
FIG. 32 explains an effect sound output when three feature symbols appear on the slot machine related to the embodiment of the present invention.
Figure 33:
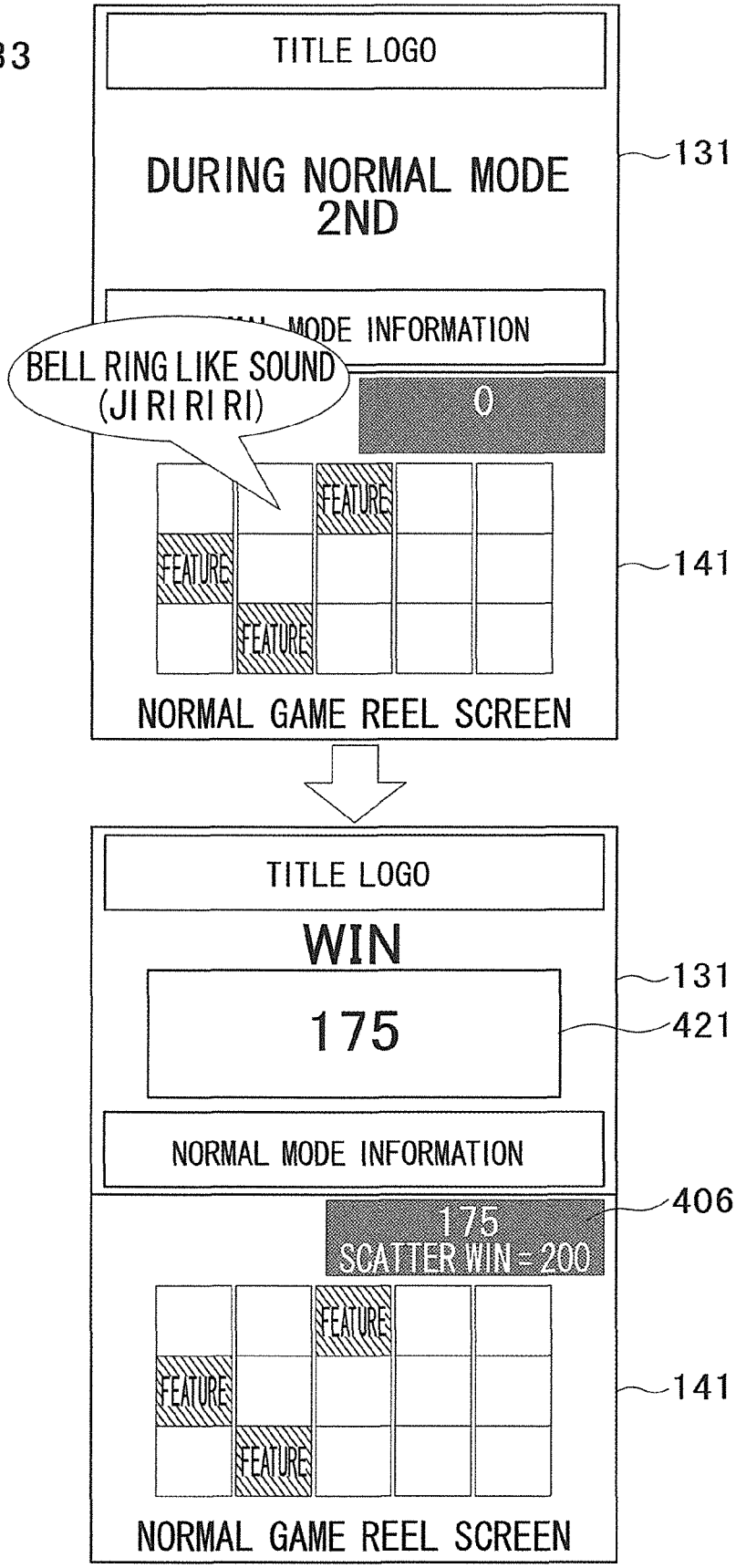
FIG. 33 explains an effect sound output when three feature symbols appear on the slot machine related to the embodiment of the present invention.

Now, effect sound when three or more "FEATURE" symbols appear will be described with reference to FIG. 32 and FIG. 33. FIG. 32 and FIG. 33 show the effect sound of the slot machine of the embodiment of the present invention when three or more "FEATURE" symbols appear.

When three or more "FEATURE" symbols appear in the symbol display area 4, dedicated "Jilililili" sound (bell-ring like sound) is reproduced as a sound effect. The sound reproduction starts when all reels stop, and lasts three seconds until the increment starts after 30 frames elapse. During the reproduction of the bleep sound, the symbol animation, the display of the LINE WIN, and the increment display are not performed.

According to the embodiment of the present invention, as shown in FIG. 32, in the symbol display area 4 on the lower image display panel 141, a waiting time as long as 30 frames starts when three or more "FEATURE" symbols appear in the symbol display area 4 at the time of the stop of all reels. After the waiting time as long as 30 frames, as shown in FIG. 33, the "jilililili" sound indicated by a balloon 441 is reproduced for three seconds as the effect sound when three or more "FEATURE" symbols appear.

After the three seconds, as shown in FIG. 33, the effect of LINE WIN starts in the symbol display area 4 on the lower image display panel 141, and the symbol animation starts. Furthermore, the win signboard 421 is displayed in the image area 402 of the upper image display panel 131. On the win signboard 421, the increment display starts. Simultaneously, the increment display starts on the win meter 406 of the lower image display panel 141. Furthermore, the reproduction of increment sound starts. Then the processing shifts to the above-described flow of the win effect.

[Free Game Introduction Effect]

Figure 36:
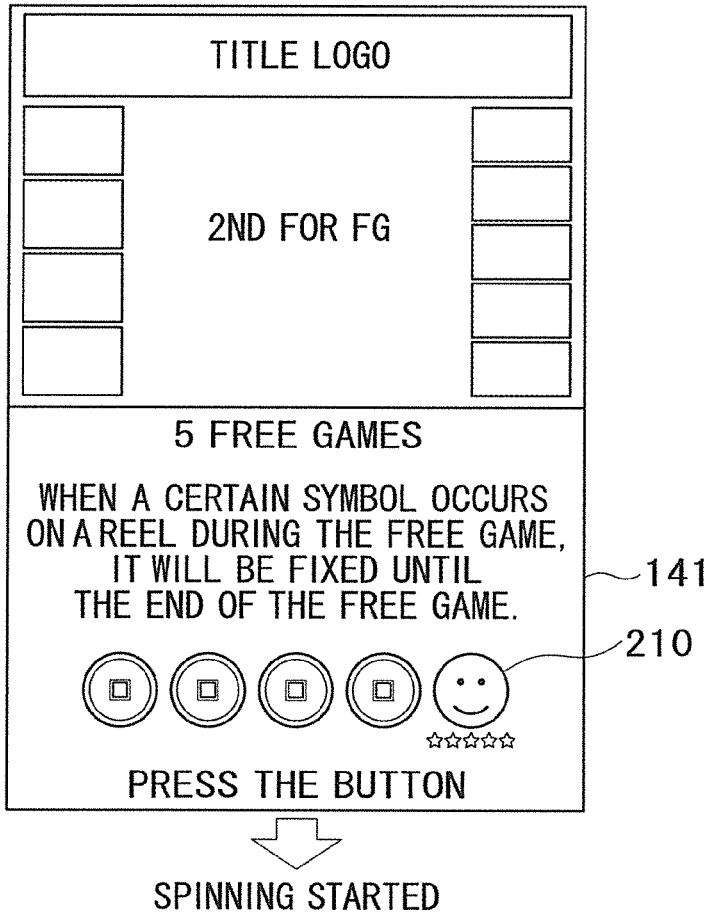
FIG. 36 shows a free game introduction effect in the slot machine related to the embodiment of the present invention.

Now, referring to FIG. 34 to FIG. 36, an effect at the time of making a transition to the free game of the slot machine 1 will be described.

Figure 34:
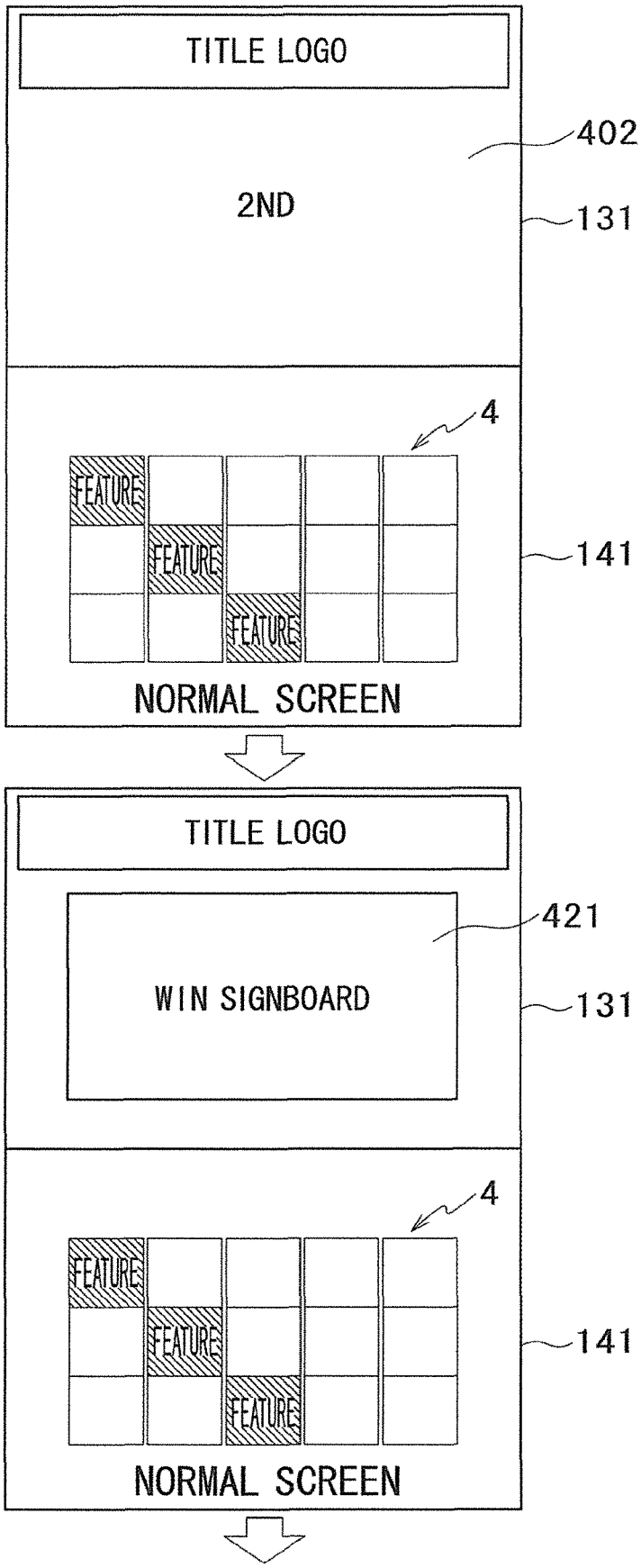
FIG. 34 shows a free game introduction effect in the slot machine related to the embodiment of the present invention.

As shown in FIG. 34, when three or more "FEATURE" symbols appear in the symbol display area 4 on the lower image display panel 141, as described above, the "jilililili" sound (bell-ring like sound) which is effect sound is reproduced. Subsequently, as shown in FIG. 34, the win signboard 421 is displayed in the image area 402 of the upper image display panel 131.

Then, as shown in FIG. 35, an effect in the above-described fix symbol random selection process of the S104 is displayed on the lower image display panel 141. Specifically, 5 coins 201 are displayed on the lower image display panel 141. These 5 coins 201 are randomly associated with any of the symbols of "MAN", "DRAGON", "FISH", "TURTLE", and "GOURD", respectively. Then, a message is displayed to the player, which reads "SELECT ONE COIN. WHEN A CERTAIN SYMBOL OCCURS ON A REEL DURING THE FREE GAME, IT WILL BE FIXED UNTIL THE END OF THE FREE GAME." When the player picks a coin 201 out of those displayed on the lower image display panel 141 through the touch panel 114, the symbol associated with the selected coin 201 is lighted to make it noticeable as a fix symbol, as shown in FIG. 35. It should be noted that symbols associated with the non-selected coins 201 are darkened and displayed in gray. Then, as shown in FIG. 36, the number of plays of the free game (5 FREE GAMES) is indicated on the lower image display panel 141 as shown in FIG. 36, and an operation of the spin button 49 is waited with displaying of text reading "PRESS THE BUTTON".

[Fix Effect of Fix Symbol in FREE GAME]

Now, referring to FIG. 37 to FIG. 38, a fix effect of a fix symbol 210 in the free game of the slot machine 1 will be described.

Figure 37:
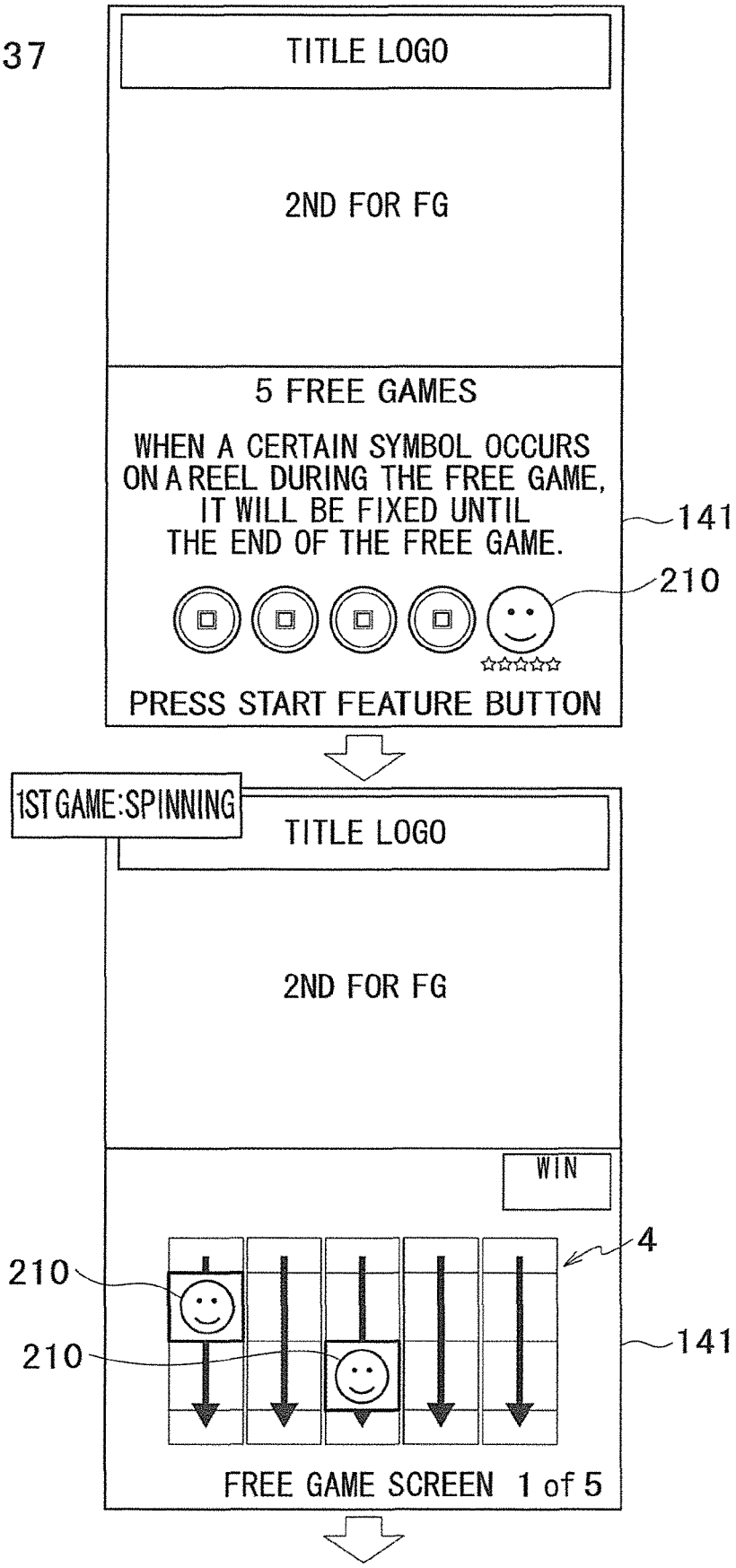
FIG. 37 shows a symbol fix effect for fix symbols during the free game, in the slot machine related to the embodiment of the present invention.
Figure 38:
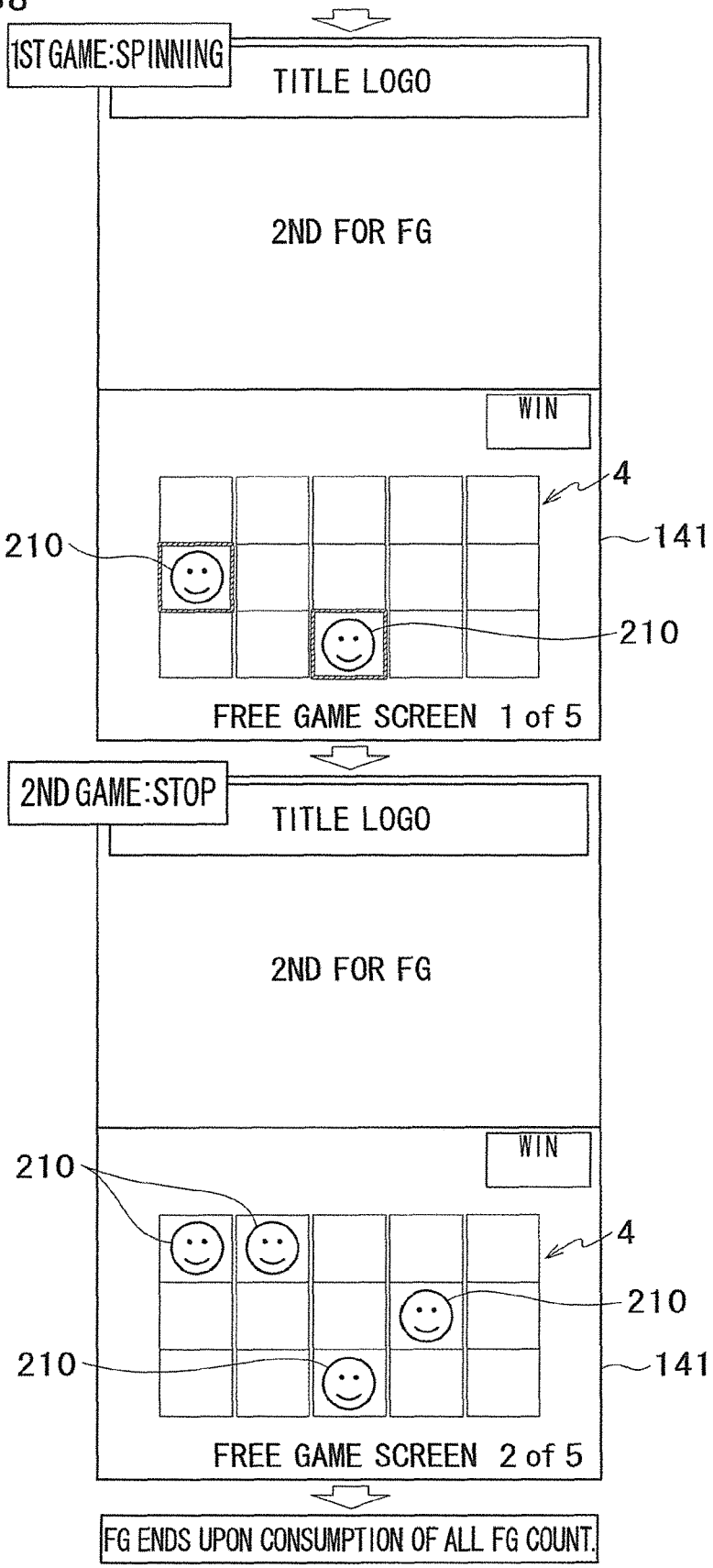
FIG. 38 shows a symbol fix effect for fix symbols during the free game, in the slot machine related to the embodiment of the present invention.

Then, as shown in FIG. 37, a fix symbol 210 is selected through the above-described fix symbol random selection process of the S104 and the free game is started. In the free game, the video reels 3 are scroll displayed, and during the scroll, the fix symbol 210 is given an effect so it is easily visible. After that, as shown in FIG. 38, symbols are rearranged in the symbol display area 4. In this case, when a fix symbol 210 is stopped in the result determination area activated by a ways bet button, the fix symbol 210 is fixed in that result determination area until the free game ends. Then, while the fix symbol 210 is fixed in the result determination area where it is stopped, the subsequent play of the free game is run, and symbols are rearranged in the symbol display area 4. In this case, when another fix symbol 210 is stopped as shown in FIG. 38, that other fix symbol 210 is further fixed in that result determination area until the free game ends. As described, when a fix symbol 210 is stopped in the result determination area activated by using a ways bet button, another fix symbol 210 may be accumulatively stopped in the result determination area in the free game repetitively run (until the free game is over). This facilitates establishing of a win (payout) by a combination including the fix symbol(s) 210.

[Effect when Free Game Ends]

Figure 39:
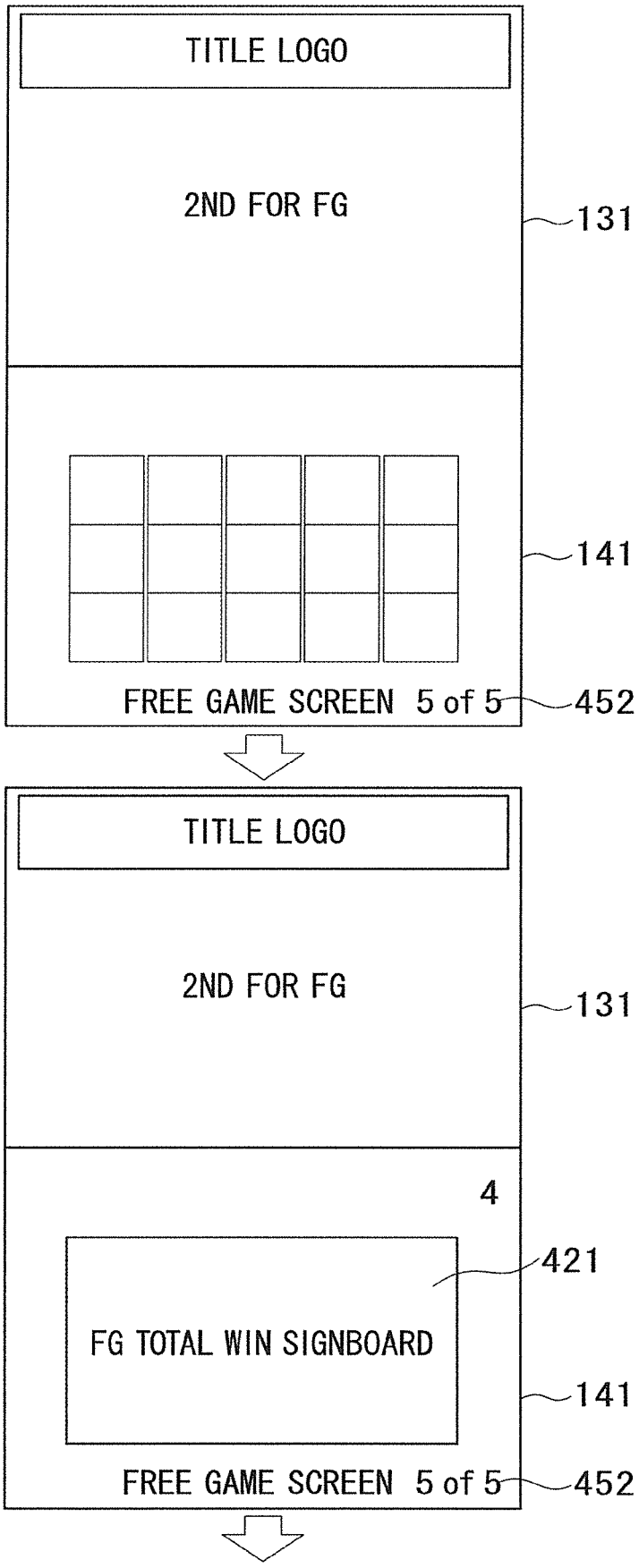
FIG. 39 shows an effect at the end of the free game in the slot machine related to the embodiment of the present invention.
Figure 40:
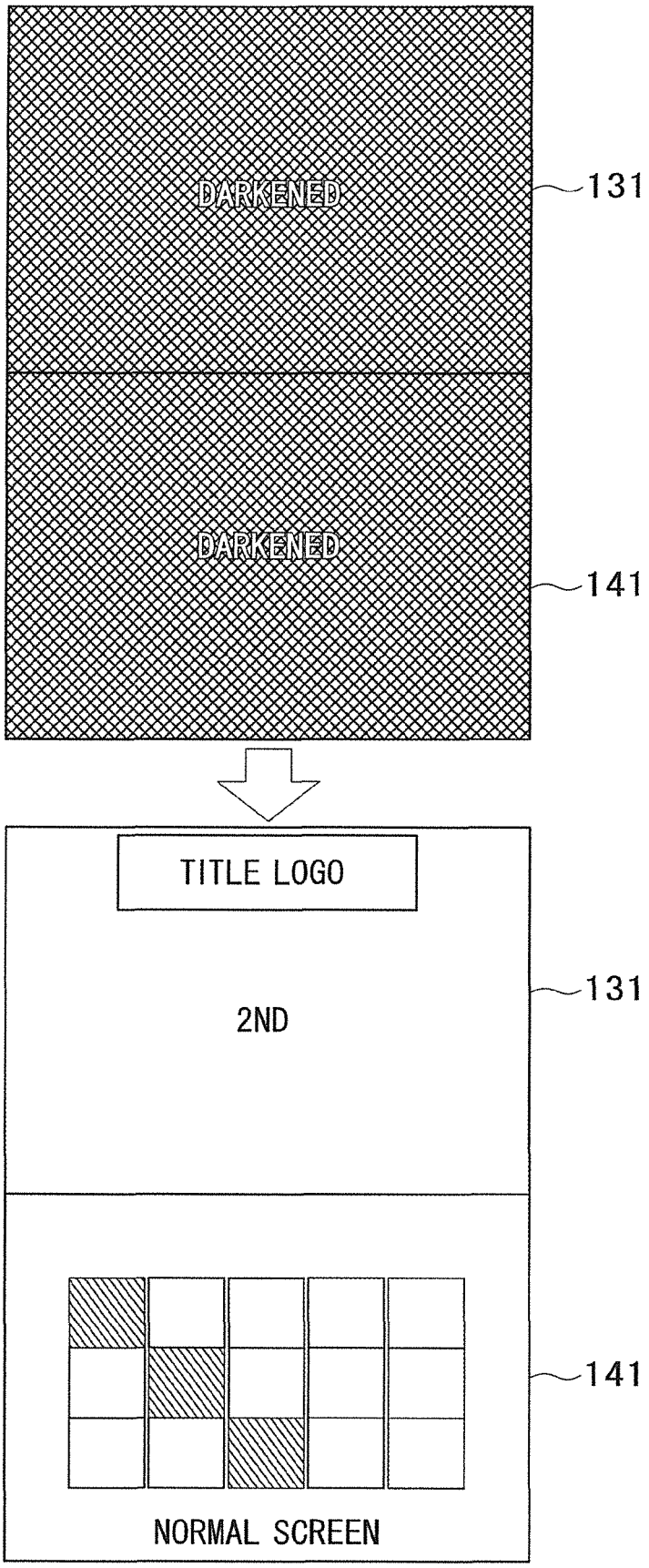
FIG. 40 shows an effect at the end of the free game in the slot machine related to the embodiment of the present invention.

The following describes an effect at the end of the free game in the slot machine 1, with reference to FIG. 39 to FIG. 40.

As shown in FIG. 39, when the last spinning finishes in the symbol display area 4 on the lower image display panel 141, the free game counter 452 on the lower image display panel 141 displays "5 of 5" which indicates that the free game has ended. Furthermore, the win signboard 421 is displayed on the lower image display panel 141. When the obtained credit is zero, the win signboard 421 is not displayed.

Thereafter, a dark change image is displayed as shown in FIG. 40. When the win signboard 421 disappears from the symbol display area 4 on the lower image display panel 141, the processing proceeds to the normal game screen.

[Re-Trigger Effect]

Figure 41:
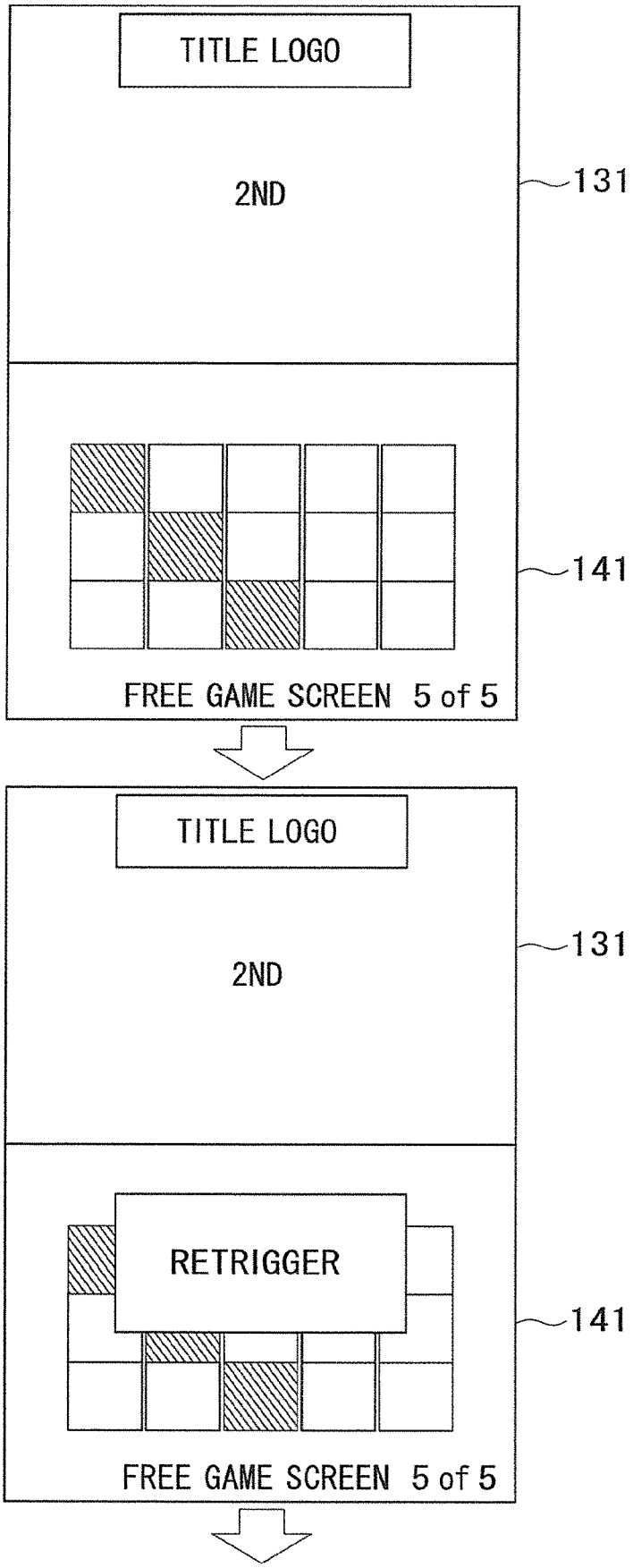
FIG. 41 shows a re-trigger effect in the slot machine related to the embodiment of the present invention.
Figure 42:
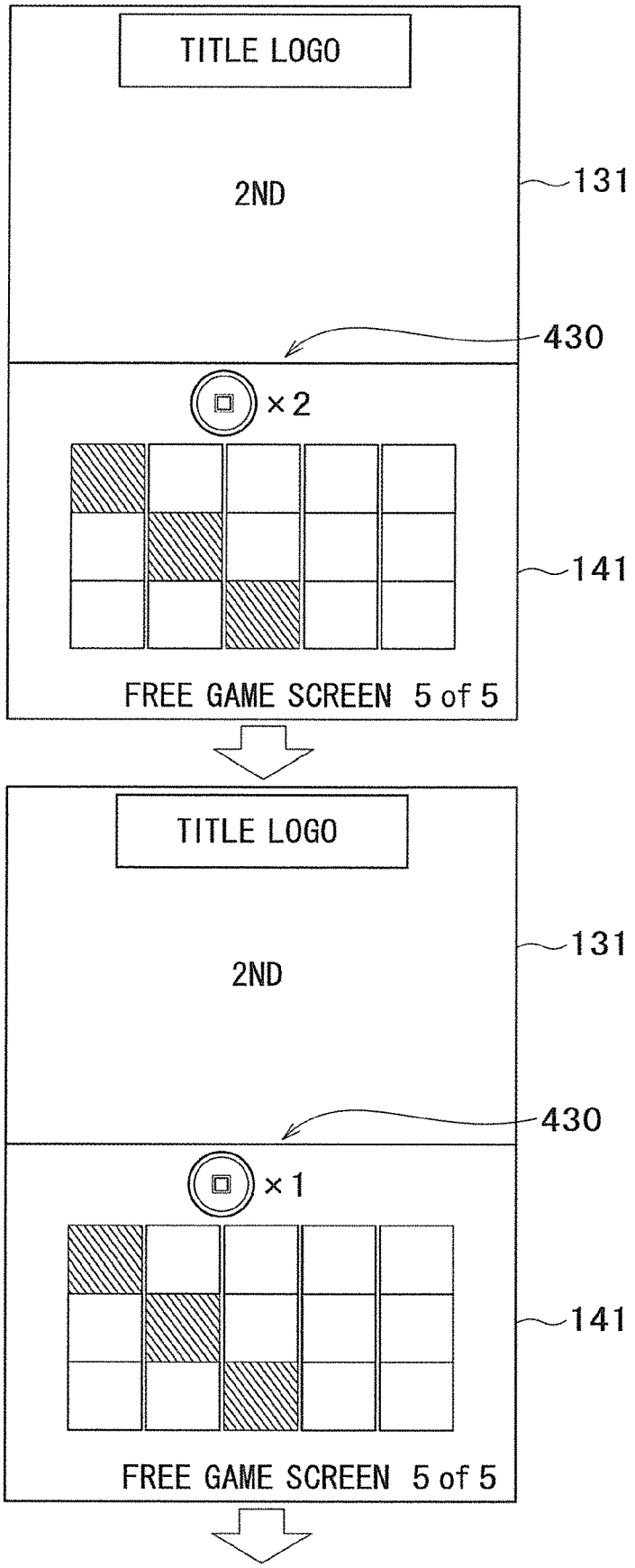
FIG. 42 shows a re-trigger effect in the slot machine related to the embodiment of the present invention.
Figure 43:
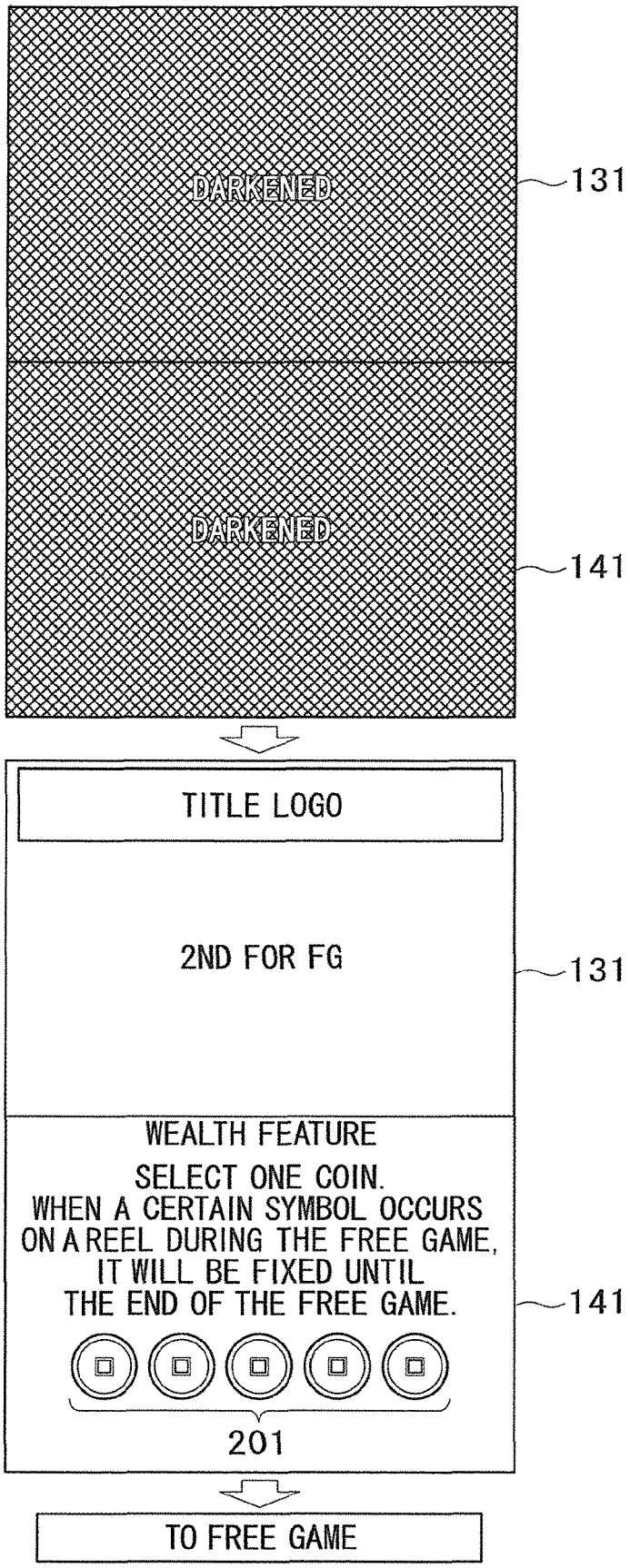
FIG. 43 shows a re-trigger effect in the slot machine related to the embodiment of the present invention.

Now, the re-trigger effect executed when the re-trigger is established in S111 will be described with reference to FIG. 41 and FIG. 44. FIG. 41 to FIG. 43 show the re-trigger effect in the slot machine of the embodiment of the present invention.

When the "FEATURE" symbol occurs in three or more consecutive positions through the 1st column area to the 5th column area, irrespective of the area activated by a ways bet button, a message reading "RETRIGGER" is displayed on the lower image display panel 141, as shown in FIG. 41. Then, a value of 1 as the number of additional set of the free game at the time of the re-trigger is added to the value on the feature stock counter 430 of the lower image display panel 141. For example, as shown in FIG. 42, when the re-trigger occurs during the free game and when the value on the feature stock counter 430 is 1, a value of 1 is added and 2 is displayed.

Then, when all the given plays of the free game are finished (when the value on the free game play counter is determined as to be 0 in the step S116), 1 is subtracted from the value on the feature stock counter 430. For example, as shown in FIG. 42, when the re-trigger occurs during the free game and when the value on the feature stock counter 430 is 2, a value of 1 is added and 2 is displayed. Thereafter, the "bleep sound" is reproduced as shown in FIG. 43.

Further, as shown in FIG. 43, five coins 201 are displayed on the lower image display panel 141, and an effect similar to the free game introduction effect is executed.

Figure 44:
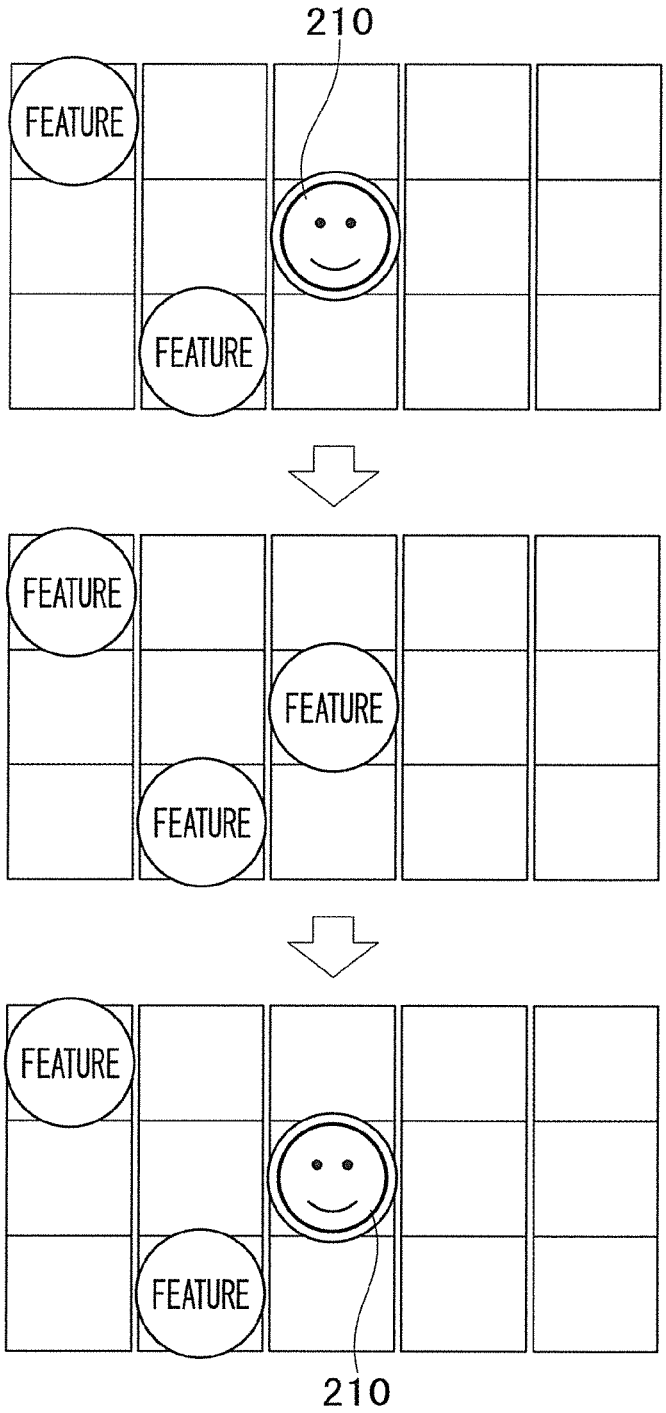
FIG. 44 shows a re-trigger effect in the slot machine related to the embodiment of the present invention.

It should be noted that, as shown in FIG. 44, if the "FEATURE" symbol stops under the fix symbol 210 and the re-trigger occurs, an effect sound is output and at the same time, the "FEATURE" symbol rearranged behind the fix symbol 210 is displayed in front of the fix symbol 210, and there is provided an animation effect associated with rearrangement of three or more "FEATURE" symbols. Then, the fix symbol 210 is again displayed in front of the "FEATURE" symbol. If a combination with the fix symbol 210 is formed at this point, a win effect is provided. After the above, the effect of displaying the "FEATURE" symbol in front of the fix symbol 210 and the effect of displaying the fix symbol 210 in front of the "FEATURE" symbol are repeated for a predetermined period.

[Win Effect: When Fix Symbol is Involved]

Figure 45:
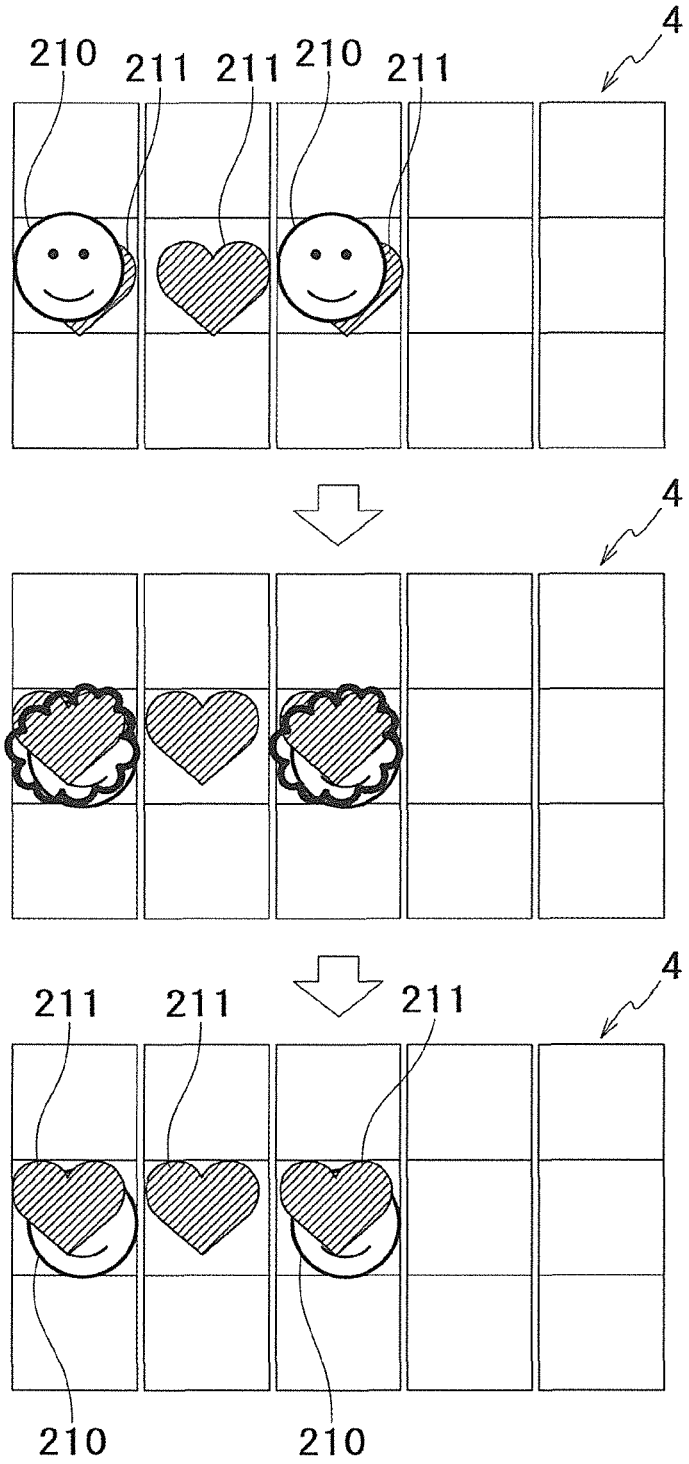
FIG. 45 is an explanatory diagram of a win effect at occasions involving a fix symbol, in the slot machine related to the embodiment of the present invention.

As shown in FIG. 45, in the free game, if there is no payout (no win) for a combination including the fix symbol 210 and there is a payout (win) for a combination with a symbol 211 rearranged behind the fix symbol 210, as the result of rearranging a plurality of symbols in the symbol display area 4, the symbol 211 rearranged behind the fix symbol 210 is displayed in front of the fix symbol 210 with a switching effect, and a win effect is executed. It should be noted that the fix symbol 210 for which no payout is awarded is kept behind the symbol 211 until the end of the win effect.

Figure 46:
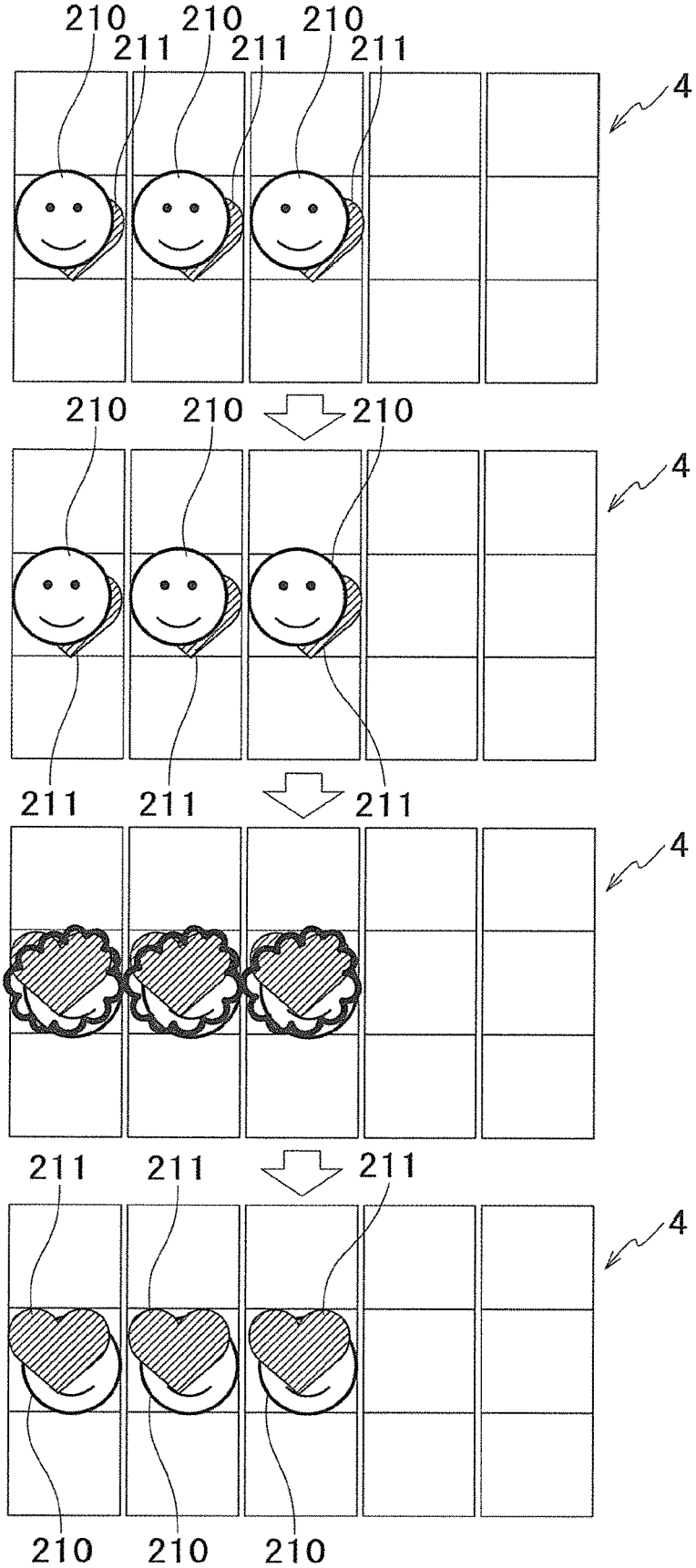
FIG. 46 is an explanatory diagram of a win effect at occasions involving a fix symbol, in the slot machine related to the embodiment of the present invention.

As shown in FIG. 46, in the free game, if there is a payout (win) for a combination including the fix symbol 210 and there is also a payout (win) for a combination with a symbol 211 rearranged behind the fix symbol 210, as the result of rearranging a plurality of symbols in the symbol display area 4, win effects are provided in a descending order of the payout amount. For example, if the win based on the combination including the fix symbol 210 results in a higher payout than that resulted by the combination including the symbol 211, the win effect for the combination with the fix symbol 210 is provided first, and then with the effect of switching over, the symbol 211 rearranged behind the fix symbol 210 is displayed in front of the fix symbol 210, and a win effect for the combination with the symbol 211 is executed.

Figure 47:
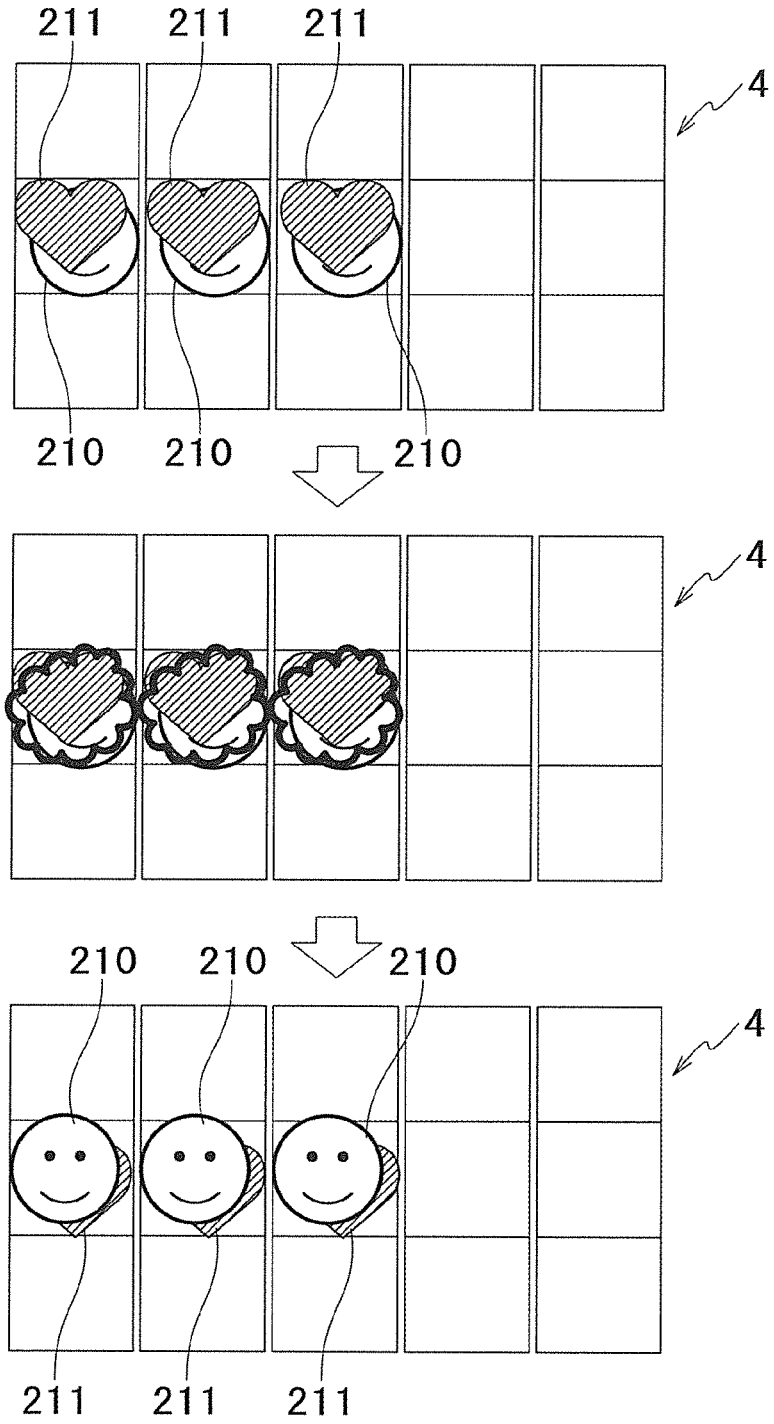
FIG. 47 is an explanatory diagram of a win effect at occasions involving a fix symbol, in the slot machine related to the embodiment of the present invention.

As shown in FIG. 47, in the free game, if there is a payout (win) for a combination including the fix symbol 210 and there is also a payout (win) for a combination with a symbol 211 rearranged behind the fix symbol 210, as the result of rearranging a plurality of symbols in the symbol display area 4, win effects are provided in a descending order of the payout amount. For example, if the win based on the combination including the fix symbol 210 results in a lower payout than that resulted by the combination including the symbol 211, the win effect for the combination with the symbol 211 is provided first, and then with the effect of switching over, the fix symbol 210 rearranged behind the symbol 211 is displayed in front of the symbol 211, and a win effect for the combination with the fix symbol 210 is executed.

Figure 48:
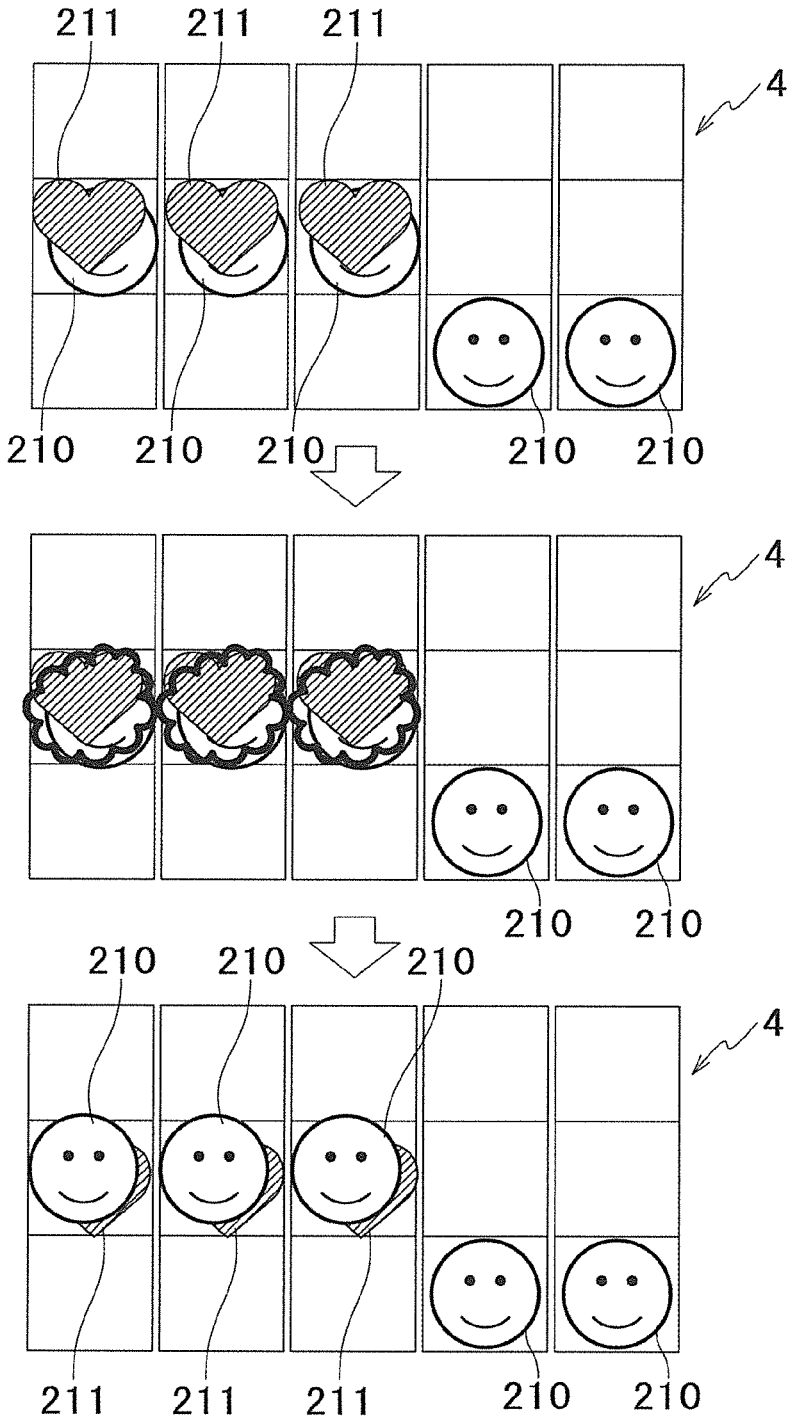
FIG. 48 is an explanatory diagram of a win effect at occasions involving a fix symbol, in the slot machine related to the embodiment of the present invention.

As shown in FIG. 48, in the free game, if there is a payout (win) for a combination including the fix symbol 210 and there is also a payout (win) for a combination with a symbol 211 rearranged behind the fix symbol 210, as the result of rearranging a plurality of symbols in the symbol display area 4, win effects are provided in a descending order of the payout amount. For example, if the win based on the combination including the fix symbol 210 results in a higher payout than that resulted by the combination including the symbol 211, the symbol 211 rearranged behind the fix symbol 210 is displayed in front of the fix symbol 210, and a win effect for the combination with the symbol 211 is executed. Then, with the switching over effect, the symbol 210 rearranged behind the fix symbol 211 is displayed in front of the fix symbol 211, and a win effect for the combination with the symbol 210 is executed.

As described, even if the fix symbol 210 is fixed, a combination for which a payout is awarded is preferentially displayed in the symbol display area 4.

Further, if a combination of symbols including the fix symbol 210 is a combination for which a payout is to be awarded, and if a combination of symbols including a symbol 211 rearranged in the position of the fix symbol 210 is a combination for which a payout is to be awarded, both of symbol combinations are displayed.

Further, traditionally, when a fix symbol 210 is fixed, a symbol 211 that is supposed to be stopped in the position of the fixed symbol 210 will be excluded in the subsequent unit games. In this structure, the player may miss a chance of winning a payout that could have been won if there was not the fix symbol 210. This could lessen the player's expectation for winning of a payout. Further, if a fix symbol 210 is fixed and a part of the symbol 211 rearranged behind the fixed symbol is visible, it could further disappoint the player for winning the payout.

In view of that, when the symbol 211 rearranged behind the fix symbol 210 is partially visible, that partially visible symbol 211 is also regarded as a symbol forming a combination of symbols subjected to awarding of a payout.

[Free Game Introduction Effect, when Feature Boost Function is on]

Figure 49:
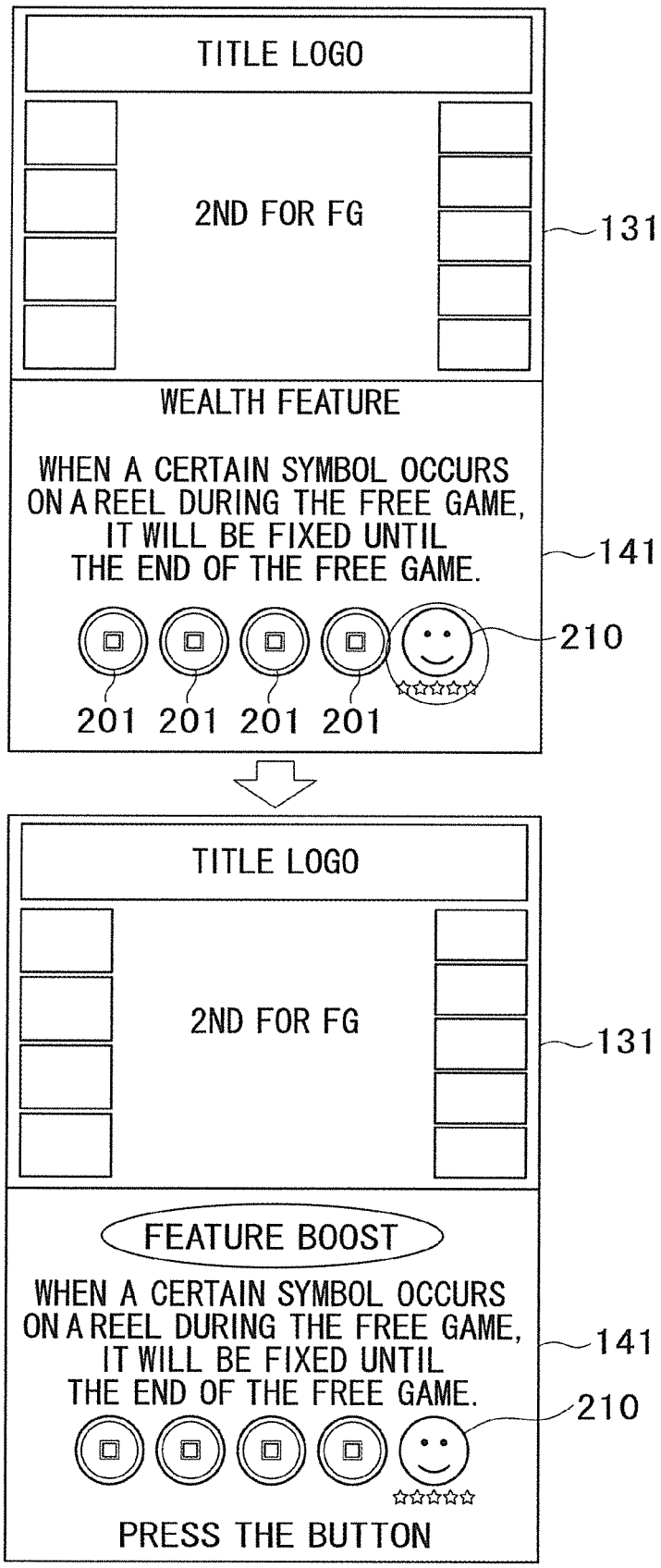
FIG. 49 is an explanatory diagram of an effect at a time of transition to the free game using a feature-boost function, in the slot machine related to the embodiment of the present invention.
Figure 50:
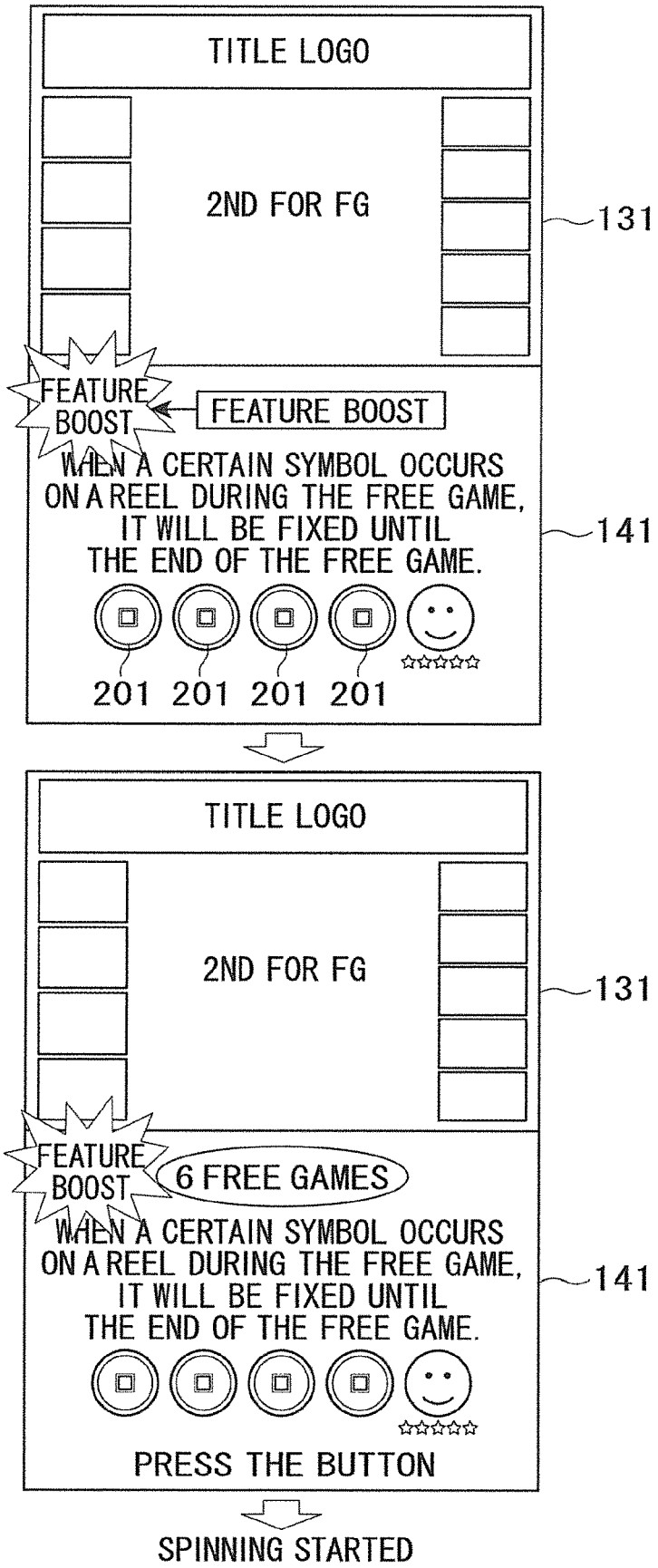
FIG. 50 is an explanatory diagram of an effect at a time of transition to the free game using a feature-boost function, in the slot machine related to the embodiment of the present invention.

Referring to FIG. 49 to FIG. 50, the following describes an effect at the time of transition to the free game, while the feature boost function is turned on.

The above described effect in the fix symbol random selection process of the step S104 is also displayed on the lower image display panel 141 when the feature boost function is turned on. Specifically, 5 coins 201 are displayed on the lower image display panel 141. These 5 coins 201 are randomly associated with any of the symbols of "MAN", "DRAGON", "FISH", "TURTLE", and "GOURD", respectively. Then, a message is displayed to the player, which reads "SELECT ONE COIN. WHEN A CERTAIN SYMBOL OCCURS ON A REEL DURING THE FREE GAME, IT WILL BE FIXED UNTIL THE END OF THE FREE GAME." When the player picks a coin 201 out of those displayed on the lower image display panel 141 through the touch panel 114, the symbol associated with the selected coin 201 is lighted to make it noticeable as a fix symbol 210, as shown in FIG. 49. It should be noted that symbols associated with the non-selected coins 201 are darkened and displayed in gray.

Then, as shown in FIG. 49, the logo reading "FEATURE BOOST" is displayed on the lower image display panel 141. After a while, the logo of "FEATURE BOOST" is shrunk in an animation effect, and the downsized logo of "FEATURE BOOST" moves to the left side of the lower image display panel 141, as shown in FIG. 50. Then, the number of plays of the free game (6 FREE GAMES) is indicated, and an operation of the spin button 49 is waited with displaying of text reading "PRESS THE BUTTON".

[Pick Game Introduction Effect]

The following describes an effect at the time of 15-choice pick game process, with reference to FIG. 51 to FIG. 58.

First, as shown in FIG. 51, a game character 220 appears on the lower image display panel 141 and an animation of laughing motion is played. Then, a signboard appears to show that transition to the 15-choice pick game has occurred.

Then, as shown in FIG. 51, 15 pouches 221 (choices) are displayed on the lower image display panel 141. The 15 pouches 221 are randomly associated with any of 15 jewels which include: 3 red jewels 231, 3 blue jewels 232, 3 green jewels 233, 3 amber jewels 234, and 3 purple jewels 235.

Next, as shown in FIG. 52, the lower image display panel 141 displays a signboard prompting the player to select a pouch 221. Further, amounts of payout associated with each of the 3 red jewels 231, the 3 blue jewels 232, the 3 green jewels 233, the 3 amber jewels 234, and the 3 purple jewels 235 are displayed.

Next, as shown in FIG. 52, there is provided an effect of moving the indication of the payout amounts of the 3 red jewels 231, the 3 blue jewels 232, the 3 green jewels 233, the 3 amber jewels 234, and the 3 purple jewels 235 to the indicators 241, 242, 243, 244, and 245.

Figure 53:
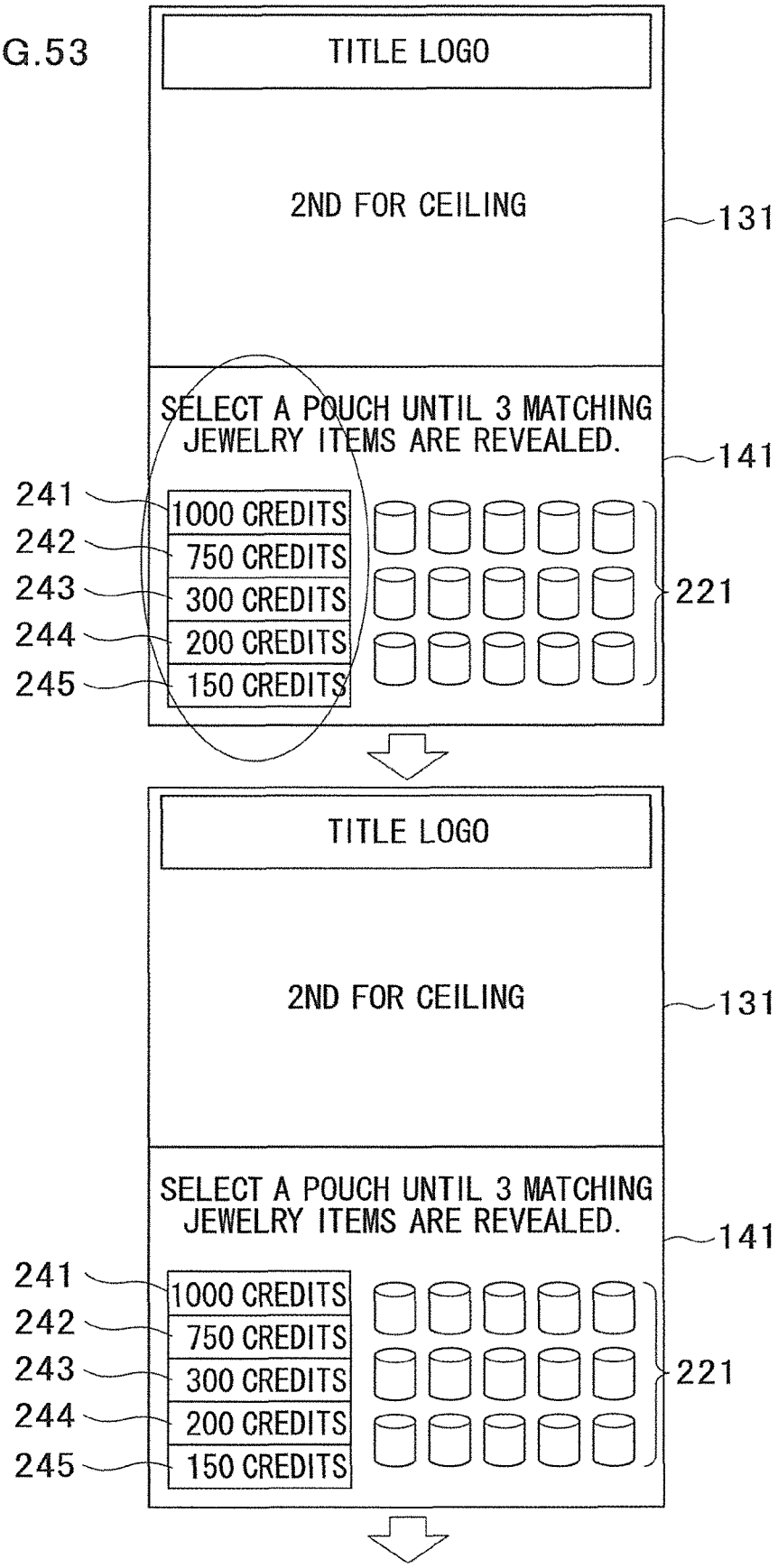
FIG. 53 is an explanatory diagram of a pick game introduction effect of the slot machine related to the embodiment of the present invention.
Figure 58:
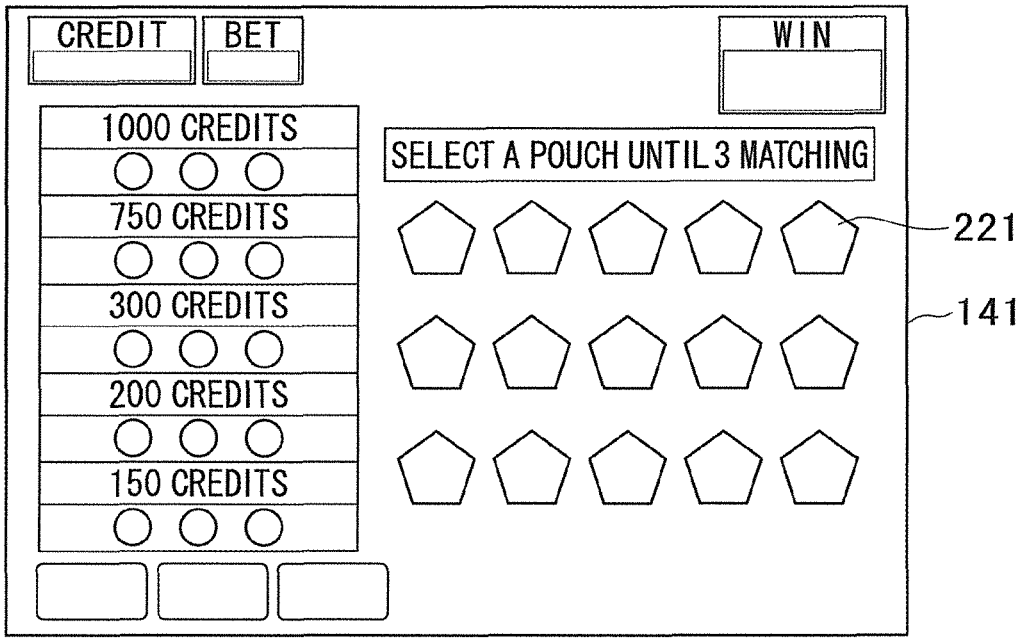
FIG. 58 is an explanatory diagram of a pick game introduction effect of the slot machine related to the embodiment of the present invention.

As shown in FIG. 53, when the payout amounts are indicated on the 5 indicators 241, 242, 243, 244, and 245, the signboard at the center disappears, and 15 pouches 221 are visible (see FIG. 58). It should be noted that, at this point, a message reading "SELECT A POUCH UNTIL 3 MATCHING JEWELRY ITEMS ARE REVEALED." is displayed in the upper part of the lower image display panel 141.

As shown in FIG. 54, operating the buttons on the control panel 30 allows displaying of a selection cursor for selecting the pouch 221 and moving of the selection cursor from a pouch 221 to another, sequentially from the number 1 to 15.

When the player selects one of the pouches 221, the jewel associated with the selected pouch 221 is displayed as shown in FIG. 54. For example, in FIG. 54, the pouch 221 of the number 7 is selected and an amber jewel 234 associated therewith is displayed.

As shown in FIG. 55, the selected jewel moves to and accommodated in the corresponding one of the indicators 241, 242, 243, 244, and 245. Selection of the pouch 221 is repeated, and the selected jewels are accommodated in the corresponding indicators 241, 242, 243, 244, and 245. When there is only one more to go before selecting three of any of the same kind of jewels, the tempo of the music (BGM) played during the 15-choice pick game process is played in a faster tempo.

As shown in FIG. 55, when the selected jewels are moved and accommodated in the corresponding indicators 241, 242, 243, 244, and 245, and three jewels of any of the same type are selected, the indicator corresponding to that jewel type is lighted to emphasize the type of jewel completed. For example, as shown in FIG. 56, when 3 amber jewels 234 are selected, the amber indicator 244 is lighted to emphasize that the amber jewels 234 are obtained. Further, after a few seconds after the lighting of the indicator, the jewels associated with non-selected pouches 221 are displayed. Then, as shown in FIG. 56, the win signboard 251 is displayed on the lower image display panel 141.

Figure 57:
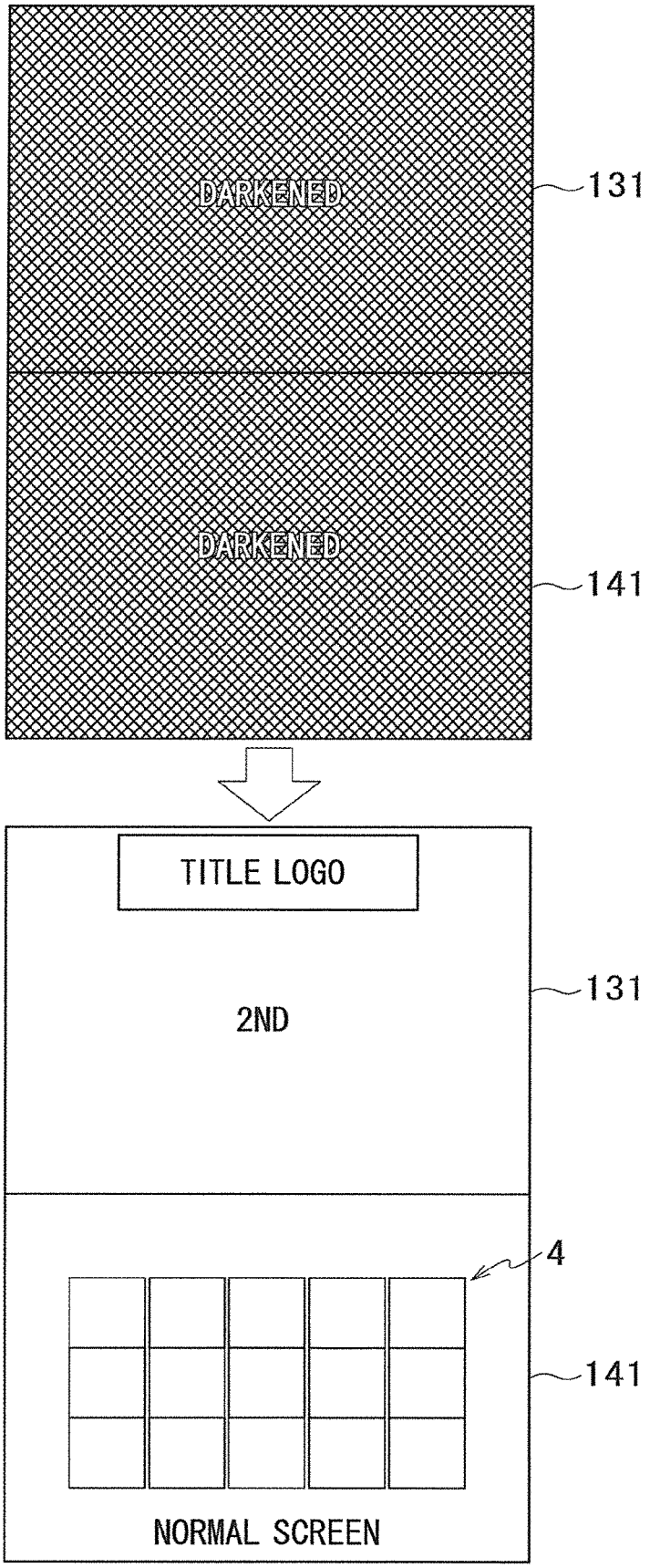
FIG. 57 is an explanatory diagram of a pick game introduction effect of the slot machine related to the embodiment of the present invention.

Thereafter, the "bleep sound" is reproduced as shown in FIG. 57. When the win signboard 251 disappears from the lower image display panel 141, the processing proceeds to the normal game screen.

[Button Prereading]

Now, button prereading in the slot machine 1 will be described with reference to FIG. 59. The button prereading is a function in the normal game to receive an input to a spin/max bet button for the next game even immediately before the end of the rotation of the reels, in order to smoothly start the next game.

Figure 59:
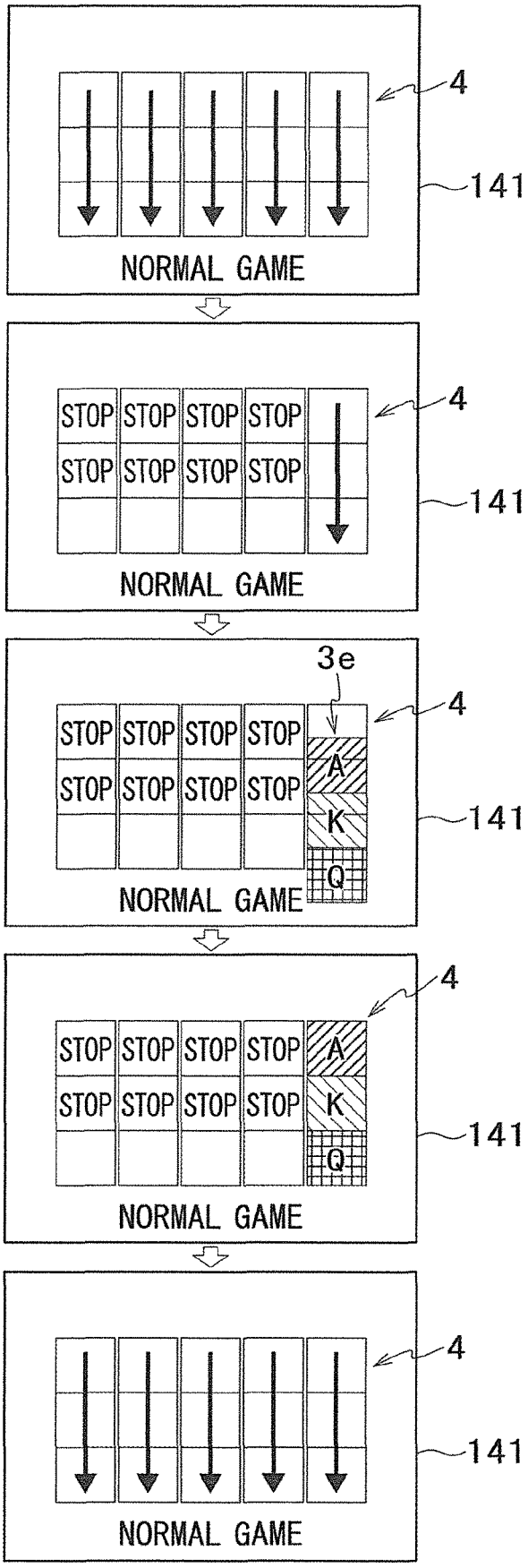
FIG. 59 shows button prereading specification in the slot machine related to the embodiment of the present invention.

To be more specific, as shown in FIG. 59, the rotation of the 4th reel stops. Thereafter, when the spin button 49 is continuously pressed while the 5th reel sinks at the maximum and rises to the surface, the spinning in the next game starts immediately after the stop of the 5th reel. It is noted that, while the spinning in the next game immediately starts, other effects and processes are not skipped.

The prereading function of prereading the pressing of the button is active only in a normal game in which no win occurs. The prereading function is inactive in a game in which a win occurs. By setting the AUDIT, the prereading function is activated or disabled. In other words, the priority is arranged as Setting>Hardware setting>Control panel. The prereading function is usually activated. The function is disabled in USA.

The button prereading function is active only when the remaining credit amount is sufficient to start the next game. For example, when a currently-selected bet is 50 whereas the remaining credit amount is 25, the spin prereading function is disabled. In the meanwhile, when a currently-selected bet is 50 whereas the remaining credit amount is 100, the spin prereading function is activated.

When the prereading is active, a corresponding button LED is turned on. When the prereading of the spinning is active, the spin button is illuminated.

(Button Prereading Process: Coexistence with Reel Skip Function)

Figure 60:
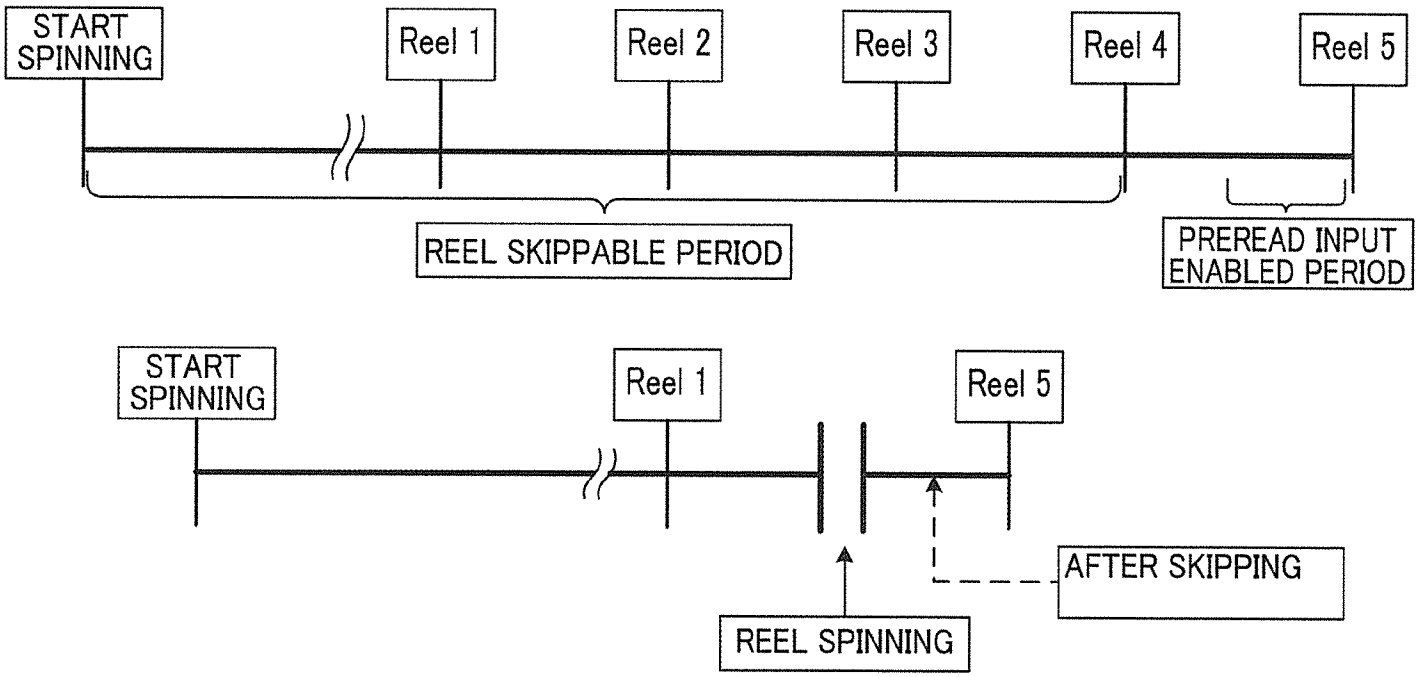
FIG. 60 shows button prereading specification in the slot machine related to the embodiment of the present invention.

As shown in FIG. 60, the button for the prereading function is used also for the reel skip. For this reason, a reel skippable time and a prereading input available time are independently provided. In the reel skippable time, the reel skip function is active. In the input available time, the prereading of the next game is active. As shown in FIG. 60, when the reel skip is executed in a game, the prereading function is disabled in that game. With this arrangement, even if the button mistakenly pressed twice to execute the skip function, the next game does not unexpectedly starts due to the execution of the spin button prereading function.

(Display Screen: Graph Display Screen)

Figure 61:
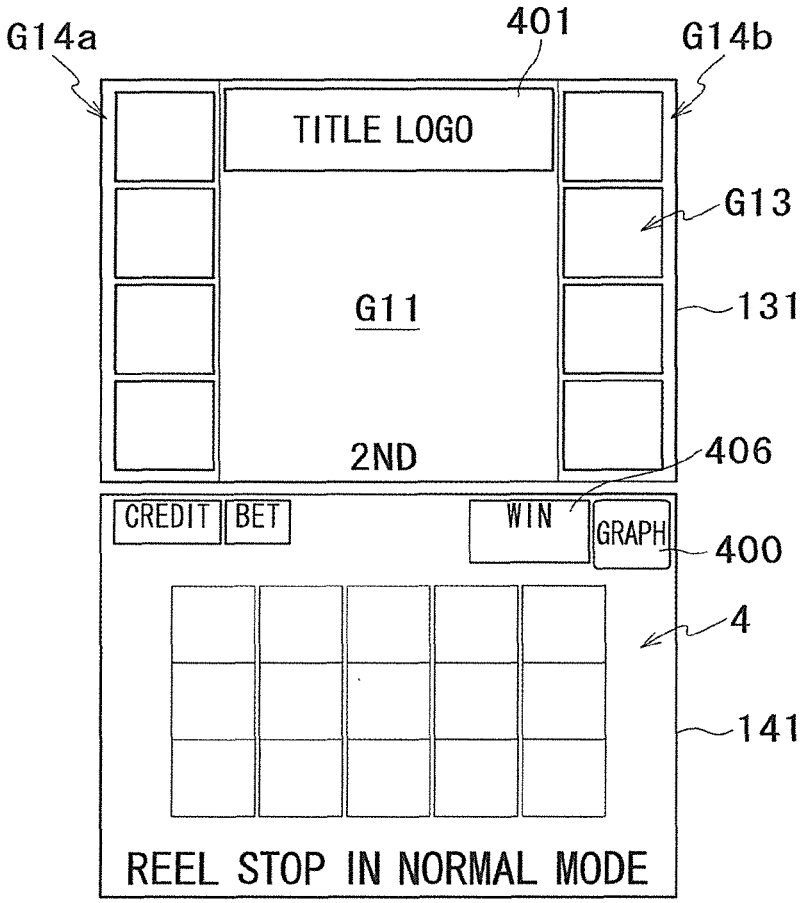
FIG. 61 is an explanatory diagram of a normal screen displayed on an upper image display panel of the slot machine related to Embodiment 2.

FIG. 61 is an explanatory diagram of display on the upper image display panel 131 and that on the lower image display panel 141. Specifically, the upper image display panel 131 is provided with a graph screen display portion G11, a title logo area 401 arranged in the upper middle of the graph screen display portion G11, door display portions G14*a* and G14*b* arranged on the left and right sides of the graph screen display portion G11, and a plurality of guidance display portions G13 arranged in the door display portions G14*a* and G14*b*. The guidance display portions G13 display wild symbols and payout tables.

Specifically, the graph screen display portion G11 indicates a transition of returns, the number of plays at the time of winning a feature, and amount of credits won at the time. The graph screen display portion G11 is switch over displaying of three types of graph images, by touching operation of the graph-switch button 400 while the reels on the normal screen are stopped. The three types of graph images are images of: a line-graph, a bar-graph, and a block-graph. In other words, the display is switched sequentially in an order of: the 0th page shown in FIG. 61 (normal screen (title logo screen)), the 1st page shown in FIG. 73 (line-graph G1), the 2nd page shown in FIG. 77 (bar-graph G2), the 3rd page shown in FIG. 80 (block-graph G3), and then back to the 0th page shown in FIG. 61 (normal screen (title logo screen)). It should be noted that the data used in the graph image is reset at a time of power outage and at a time of RAM clear accompanying resetting of the software.

Figure 69:
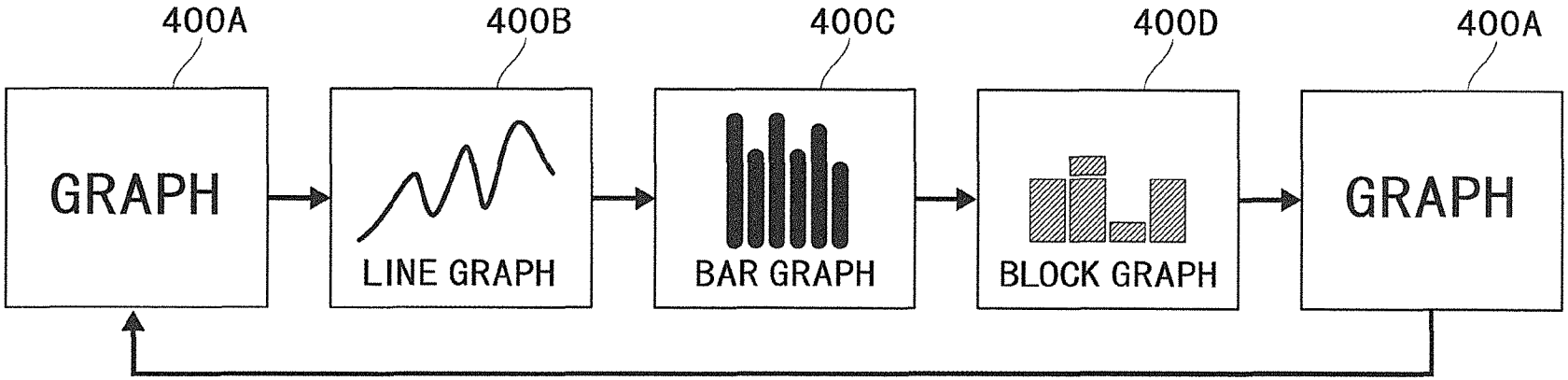
FIG. 69 is an explanatory diagram of a displayed screen when a graph-switch button is operated.

The graph-switch button 400 is arranged on the right side of the win meter 406 and allows switching over of the graph images by player's touch operations. Further, the graph-switch button 400 switches over its indication along with the switching of the graph images in the graph screen display portion G11. Specifically, as shown in FIG. 69, every time the graph-switch button 400 is touched by the player, its indication switches sequentially in an order of the 0th page (normal screen (title logo screen))→the 1st page (line-graph G1), →the 2nd page (bar-graph G2), →the 3rd page (block-graph G3), →and back to the 0th page (normal screen (title logo screen)). It should be noted that the graph-switch button 400 is active and enables touch operations thereon only when the reels are stopped at a time of the normal game, and is inactive and touch operations thereon are disabled during reel rotation or in the middle of the free game. It should be noted further that the brightness of the graph-switch button 400 in the inactive state is made darker than the graph-switch button 400 in the active state.

(Display Screen: Operations of Graph Display Screen)

The following describes the state of the display screen on the upper image display panel 131, when the graph-switch button 400 is touch-operated, with reference to FIG. 61 to FIG. 72.

Figure 62:
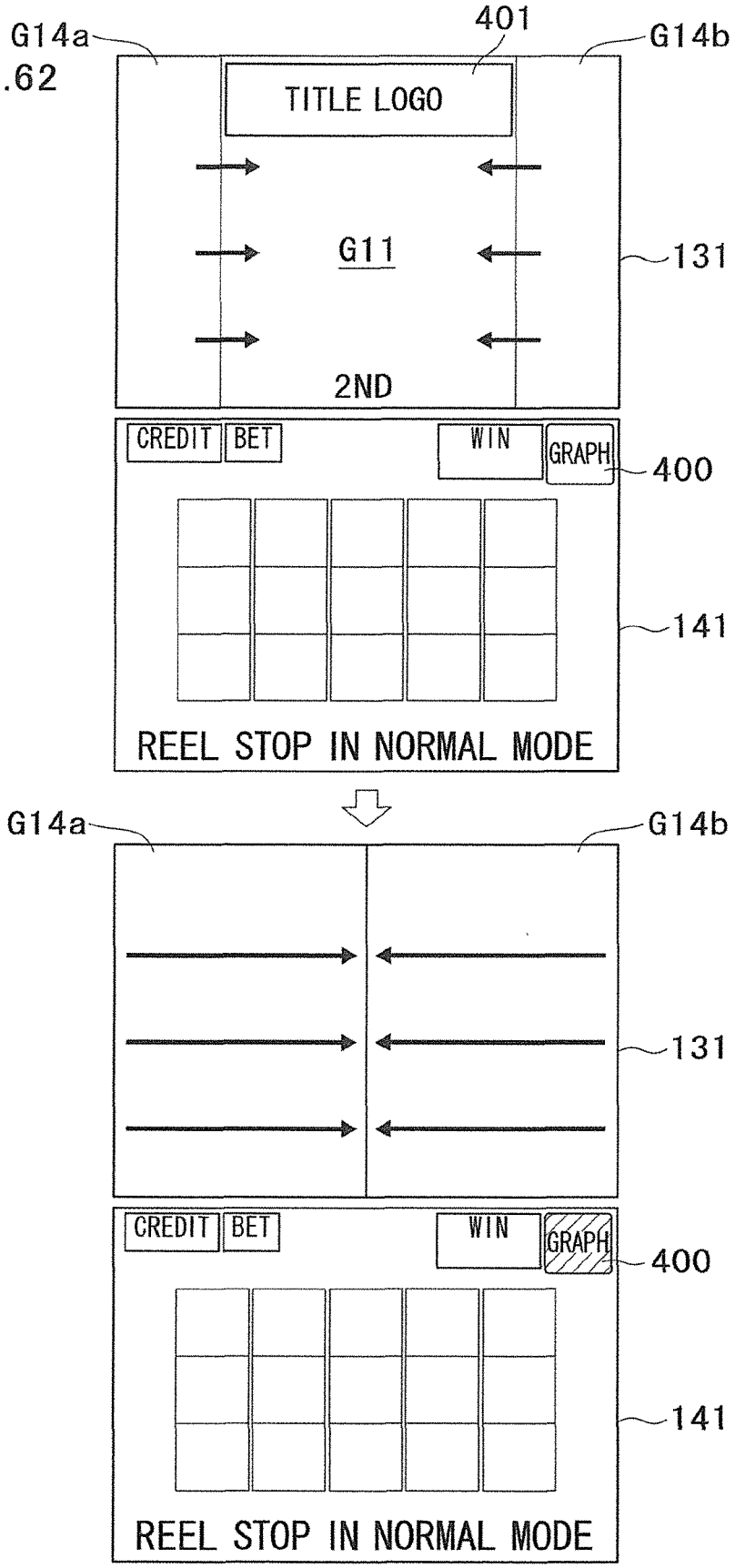
FIG. 62 is an explanatory diagram of a displayed screen when a graph-switch button is operated.

As shown in FIG. 61, the normal screen (title logo screen) is displayed on the upper image display panel 131. When the player touches to operate the graph-switch button 400 while the button is bright, the door display portions G14*a* and G14*b* expands inwardly their display areas, and simulate the situation that the graph screen display portion G11 and the title logo area 401 are hidden over the closed doors, as shown in FIG. 62. When the door display portions G14*a* and G14*b* simulate the closing doors, an effect sound of doors closing is output.

Figure 63:
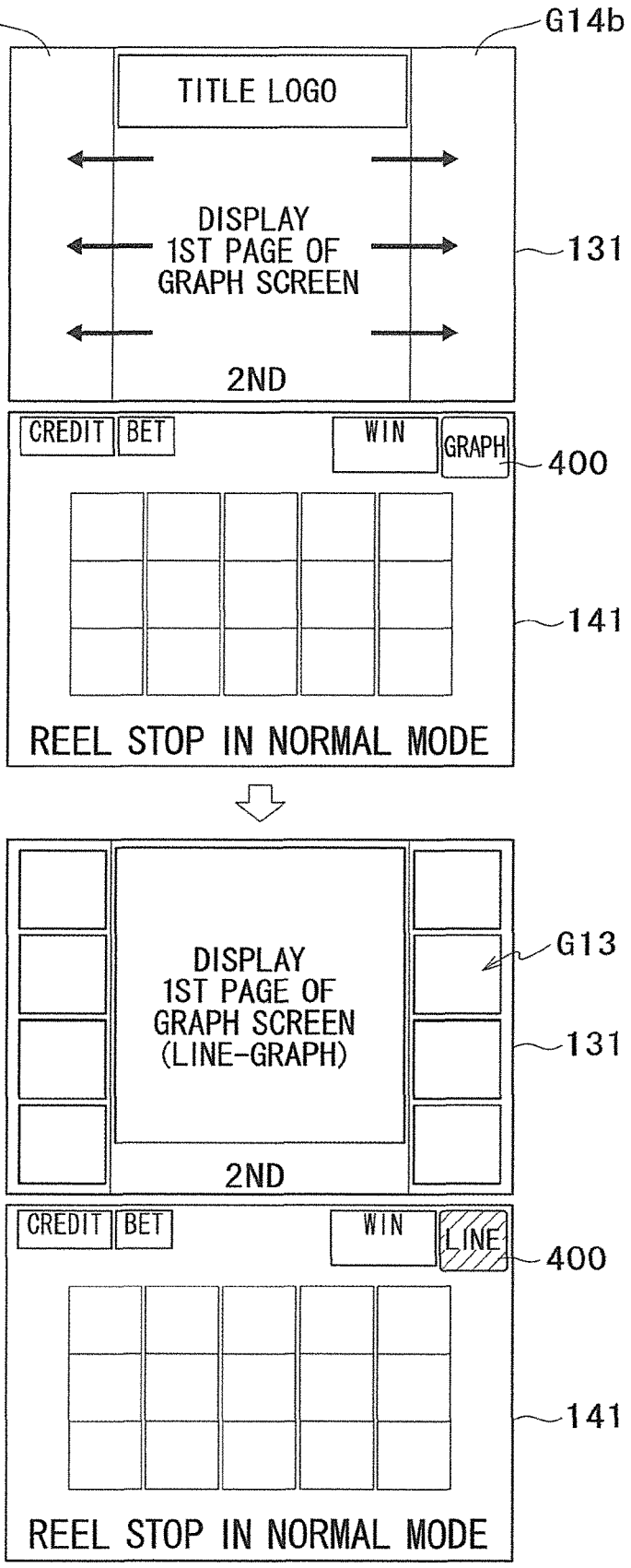
FIG. 63 is an explanatory diagram of a displayed screen when a graph-switch button is operated.

Immediately after that, there will be a video effect simulating the door display portions G14*a* and G14*b* open to the left and right, as shown in FIG. 63. The graph-switch button 400 at this time is in the inactive state and dimmed as compared to the graph-switch button 400 in the active state. Then, when the door display portions G14*a* and G14*b* are opened, a line-graph of the 1st page is displayed in the graph screen display portion G11. The graph-switch button 400 at this time is in the active state and made brighter as compared to the graph-switch button 400 in the inactive state. In the guidance display portion G13 are displayed a wild symbol and a payout tables.

Figure 64:
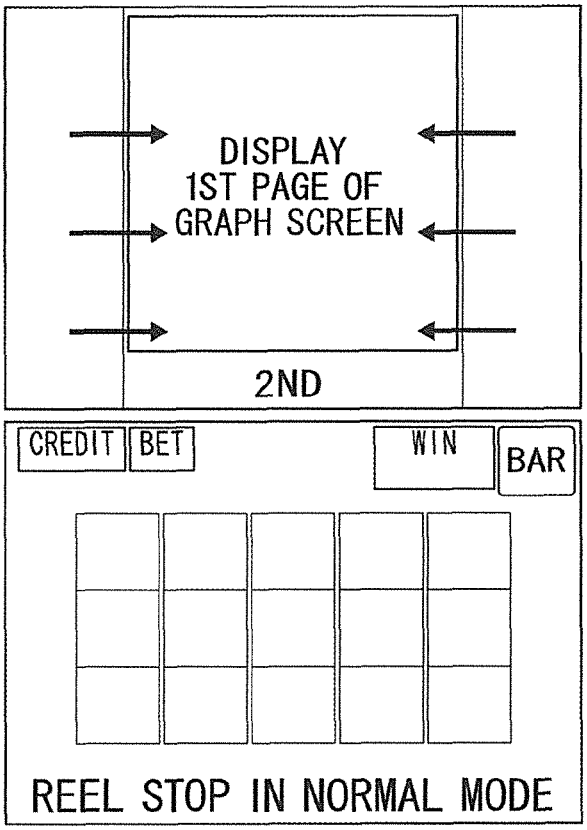
FIG. 64 is an explanatory diagram of a displayed screen when a graph-switch button is operated.

Further, as shown in FIG. 64, when the player touches to operate the graph-switch button 400 while the button is bright, the door display portions G14*a* and G14*b* expands inwardly their display areas, and simulate the situation that the line-graph displayed in the graph screen display portion G11 is hidden over the closed doors. Then, as shown in FIG. 65, when the door display portions G14*a* and G14*b* simulate the closing doors, an effect sound of doors closing is output.

Immediately after that, there will be a video effect simulating the door display portions G14*a* and G14*b* open to the left and right, as shown in FIG. 65. The graph-switch button 400 at this time is in the inactive state and dimmed as compared to the graph-switch button 400 in the active state. Then, when the door display portions G14*a* and G14*b* are opened, a bar-graph of the 2nd page is displayed in the graph screen display portion G11, as shown in FIG. 66. The graph-switch button 400 at this time is in the active state and made brighter as compared to the graph-switch button 400 in the inactive state. In the guidance display portion G13 are displayed a wild symbol and a payout tables.

Further, when the player touches to operate the graph-switch button 400 while the button is bright, the door display portions G14*a* and G14*b* expands inwardly their display areas, and simulate the situation that the bar-graph displayed in the graph screen display portion G11 is hidden over the closed doors. When the door display portions G14*a* and G14*b* simulate the closing doors, an effect sound of doors closing is output.

Immediately after that, there will be a video effect simulating the door display portions G14*a* and G14*b* open to the left and right. The graph-switch button 400 at this time is in the inactive state and dimmed as compared to the graph-switch button 400 in the active state. Then, when the door display portions G14*a* and G14*b* are opened, a block-graph of the 3rd page is displayed in the graph screen display portion G11, as shown in FIG. 66. The graph-switch button 400 at this time is in the active state and made brighter as compared to the graph-switch button 400 in the inactive state. In the guidance display portion G13 are displayed a wild symbol and a payout tables.

Further, as shown in FIG. 67, when the player touches to operate the graph-switch button 400 while the button is bright, the door display portions G14*a* and G14*b* expands inwardly their display areas, and simulate the situation that the block-graph displayed in the graph screen display portion G11 is hidden over the closed doors. Then, as shown in FIG. 67, when the door display portions G14*a* and G14*b* simulate the closing doors, an effect sound of doors closing is output.

Figure 68:
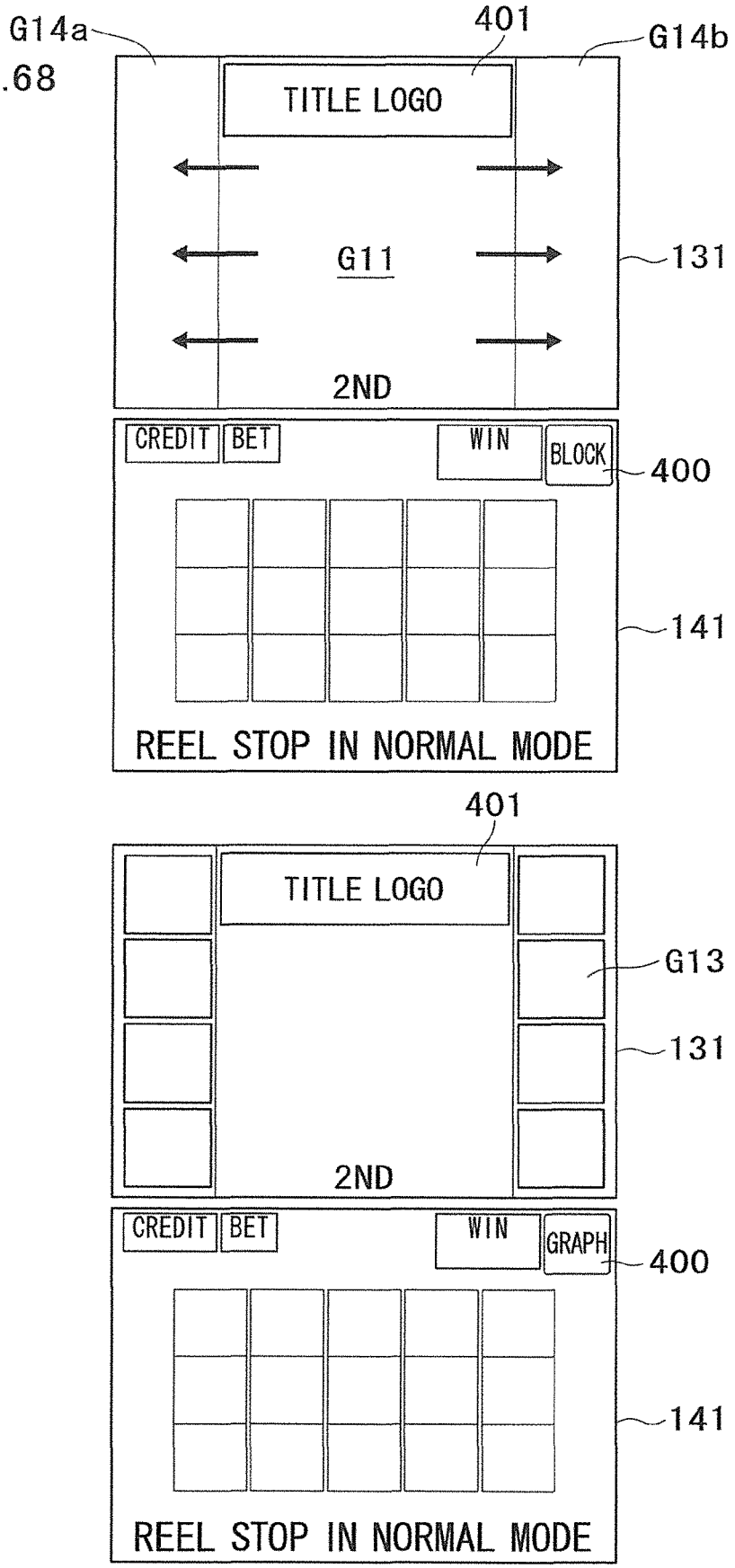
FIG. 68 is an explanatory diagram of a displayed screen when a graph-switch button is operated.

Immediately after that, there will be a video effect simulating the door display portions G14*a* and G14*b* open to the left and right, as shown in FIG. 68. The graph-switch button 400 at this time is in the inactive state and dimmed as compared to the graph-switch button 400 in the active state. Then, when the door display portions G14*a* and G14*b* are opened, the title logo area 401 of the normal screen is displayed in the graph screen display portion G11, as shown in FIG. 68. The graph-switch button 400 at this time is in the active state and made brighter as compared to the graph-switch button 400 in the inactive state. In the guidance display portion G13 are displayed a wild symbol and a payout tables.

By touching the graph-switch button 400, the display on the upper image display panel 131 is switched in the following sequence: the 0th page (normal screen (title logo screen)), →the 1st page (line-graph)→the 2nd page (bar-graph), →the 3rd page (block-graph), →back to the 0th page (normal screen (title logo screen)). At the same time, the graph-switch button 400 changes its graphics in a sequence of: a graph-switch button 400A corresponding to the 0th page (normal screen (title logo screen)), →a graph-switch button 400B corresponding to the line-graph on the 1st page, →a graph-switch button 400C corresponding to the bar-graph on the 2nd page, →a graph-switch button 400D corresponding to the block-graph on the 3rd page, →back to the graph-switch button 400A corresponding to the 0th page (normal screen (title logo screen)), as shown in FIG. 69. This way, the player is able to know what graph will be displayed next by touching the graph-switch button 400.

Figure 70:
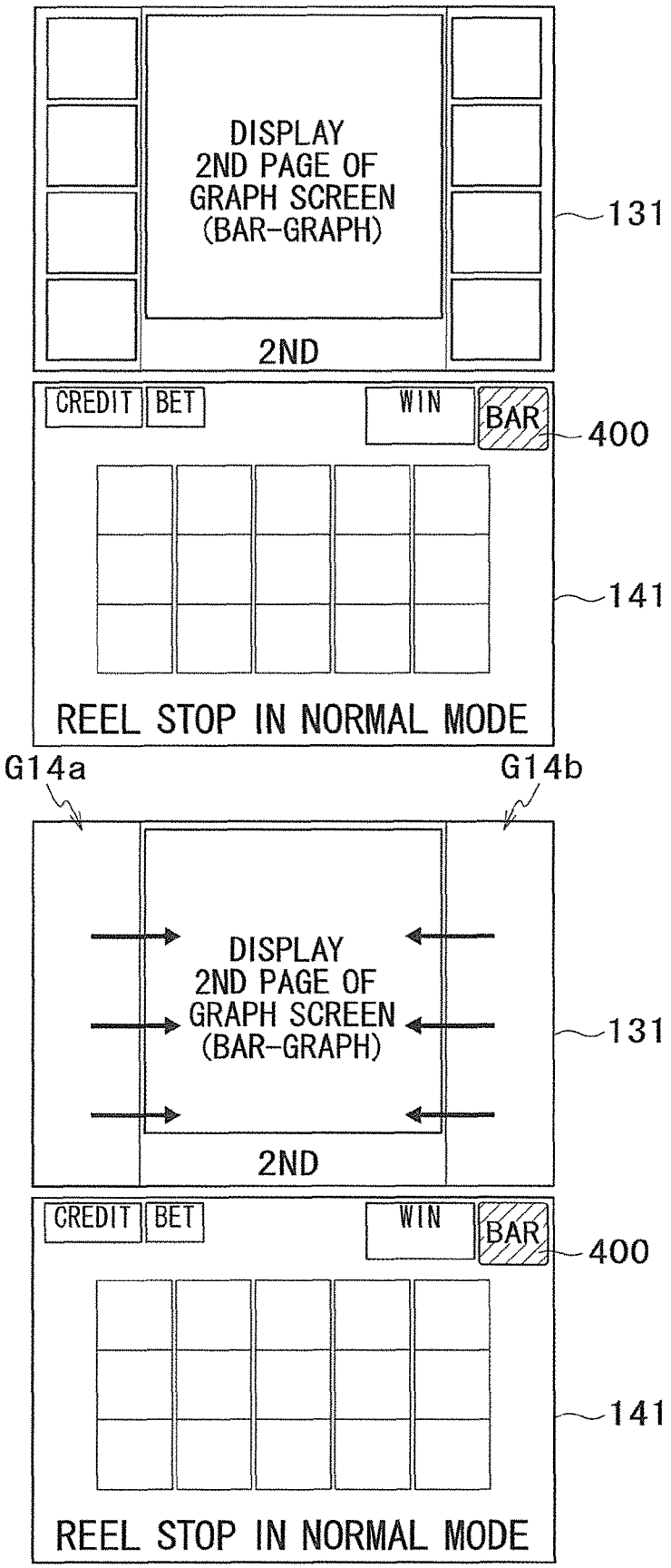
FIG. 70 is an explanatory diagram of a displayed screen when a graph-switch button is operated.
Figure 71:
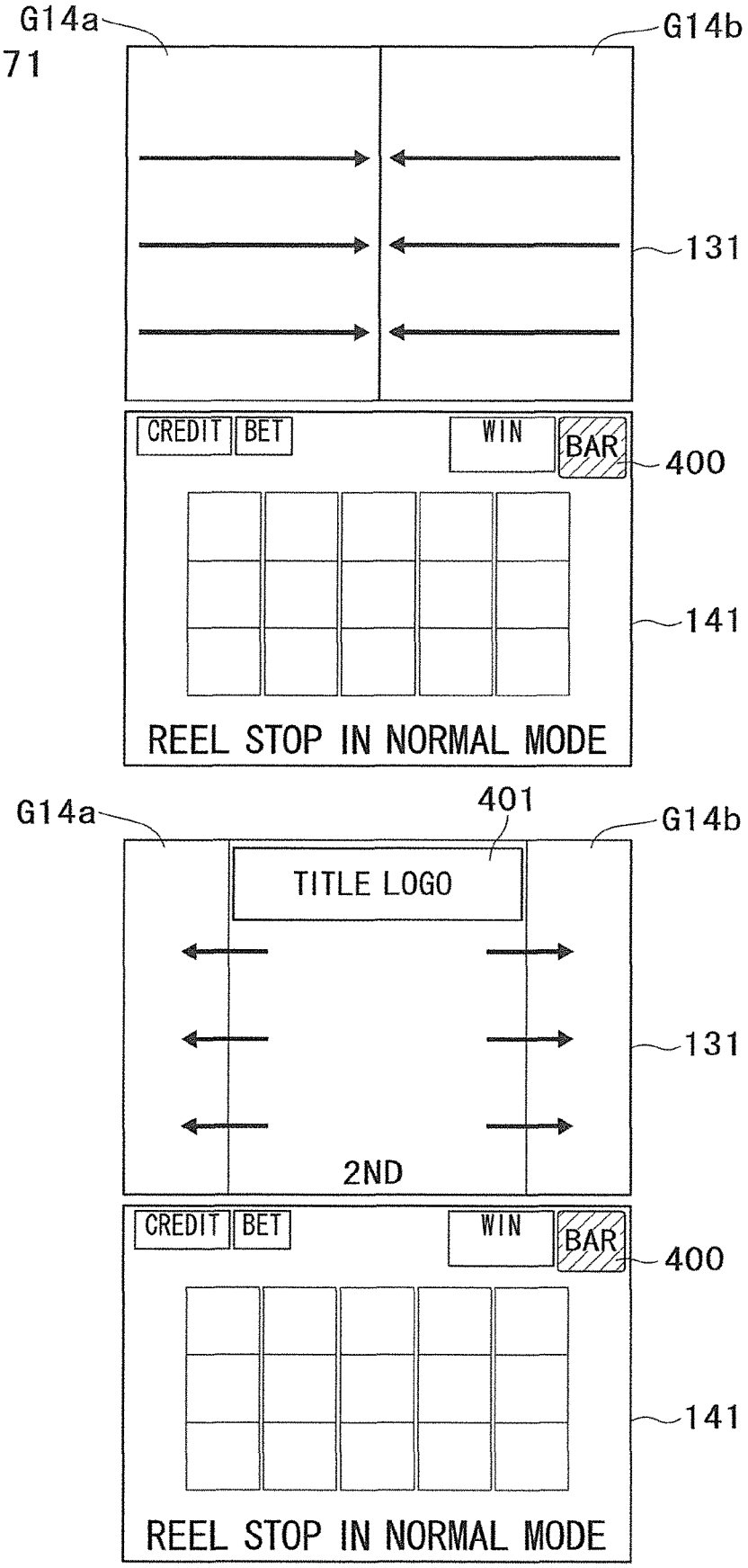
FIG. 71 is an explanatory diagram of a displayed screen when a graph-switch button is operated.

Further, for example, when the spin button 49 is pressed while the bar-graph on the 2nd page is displayed in the graph screen display portion G11 as shown in FIG. 70, the doors close and the bar-graph displayed in the graph screen display portion G11 is hidden over the closed doors, as shown in FIG. 71. When the door display portions G14*a* and G14*b* simulate the closing doors, an effect sound of doors closing is output.

Figure 72:
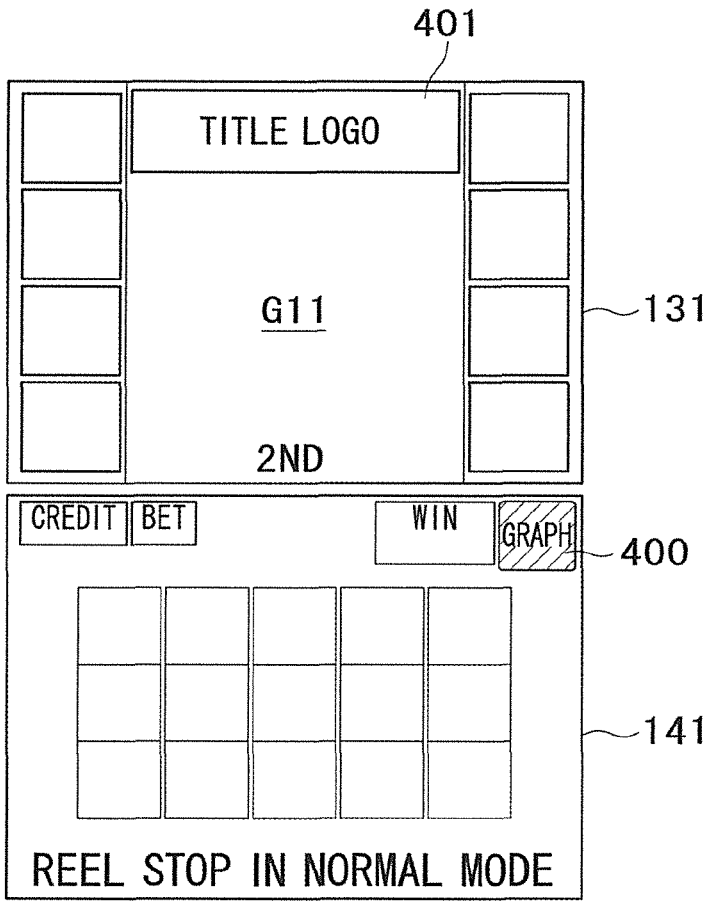
FIG. 72 is an explanatory diagram of a displayed screen when a graph-switch button is operated.

Immediately after that, there will be a video effect simulating the door display portions G14*a* and G14*b* open to the left and right, as shown in FIG. 71. The graph-switch button 400 at this time is in the inactive state and dimmed as compared to the graph-switch button 400 in the active state. Then, when the door display portions G14*a* and G14*b* are opened, the title logo area 401 of the normal screen is displayed in the graph screen display portion G11, as shown in FIG. 72. The graph-switch button 400 at this time is in the active state and made brighter as compared to the graph-switch button 400 in the inactive state. In the guidance display portion G13 are displayed a wild symbol and a payout tables.

(Display Screen: Line-Graph in Details)

Next, with reference to FIG. 73 to FIG. 76 the following describes the line-graph on the 1st page of the graph screen, which is switched by a touch-operation of the graph-switch button 400.

Figure 73:
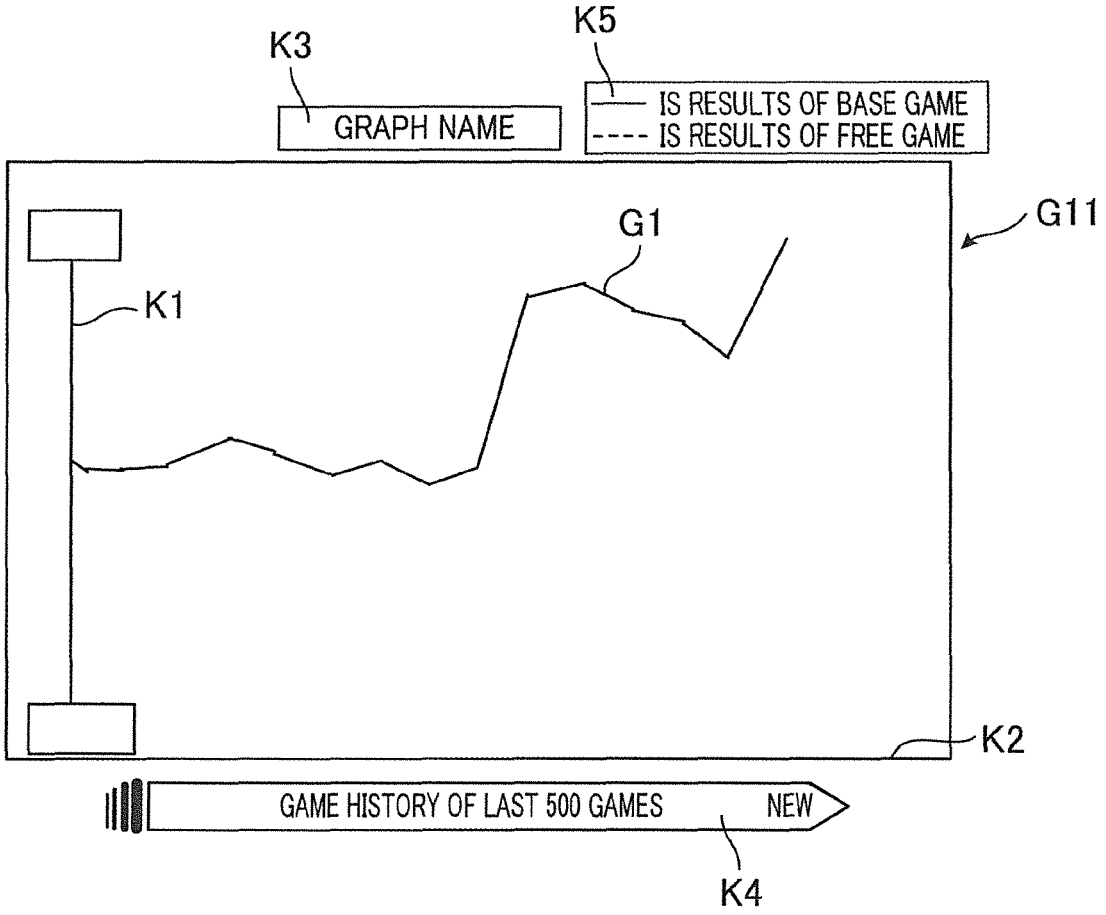
FIG. 73 is an explanatory diagram of a line-graph on a graph screen.

As shown in FIG. 73, in the upper part of the graph screen display portion G11, a graph name K3 is displayed. In the present embodiment, the indication will be "Graph showing Transition of Payout: Line-Graph" In the lower part of the graph screen display portion G11 is a label of the horizontal axis K4 reading "GAME HISTORY OF LAST 500 GAMES".

As shown in FIG. 73, the line-graph G1 is displayed in the graph screen display portion G11 of the upper image display panel 131. The vertical axis K1 of this line-graph indicates the payout rate calculated by dividing the total payout in a unit game by the total bet amount. The points indicating the payout rate initially include: a point of 150 corresponding to ×150 at the top, and a point of −150 corresponding to ×−150 at the bottom. When an interval of a scale to the another is set to ×0.2 of the payout rate, the vertical axis is able to indicate a range from ×−30 to ×30. When the interval is set to ×1 of the payout rate, the vertical axis is able to indicate a range of ×−150 to 150. Further, a digit in a decimal place of the payout rate is rounded off to indicate the payout rate as an integer. The values plotted on the line-graph are each a value resulting from subtracting an amount corresponding to ×1 from the integer obtained by rounding off the payout rate. When the free game takes place, a slightly larger mark is plotted.

Further, the horizontal axis K2 indicates a cumulative number of plays of the normal game a player or players has/have played. The right end of the horizontal axis is given a space to indicate the play of the normal game currently taking place, and 500 plays of the game are initially indicated on the horizontal axis. In other words, the last 500 plays of the game are indicated (the left end of the horizontal axis indicates the payout rate of a play which is 500 plays before the current play of the game).

For example, it is supposed that 15 credits are bet as the total bet amount to start the normal game, and a payout of 100 credits are awarded as the result of the normal game. In this case, the payout rate is 100/15≈6.7. After rounding off the decimal place, 1 is subtracted to result in 6. If the value of the payout rate in the previous play is plotted at the position of ×10, the payout rate of the current play is added: i.e., 10+6. Therefore, the current payout rate is plotted at the position of ×16. Then, the plot at the position of ×10 in the previous play and the plot of the payout rate of the current play at the position of ×16 are connected by a straight line. This way, the line-graph G1 is updated. The payout rate of the total win including the free game is indicated by a dotted line.

On the upper right of the graph screen display portion G11 is a graph information space K5. In the space, there is an indication that the black straight line in the graph indicates the payout rate related to the results of the normal game. Further, there is an indication that the dotted line in the graph indicates the payout rate related to the total win including the free game.

(Display Screen: Display of Scales in Line-Graph)

The upper and lower limit values of the vertical axis K1 shift according to the payout rate. Specifically, the points of the upper limit value and the lower limit value are shifted, as follows. Namely, with the points before the shift as the references, the points are shifted to values resulting from adding the value of the current payout rate to the points before the shift.

Figure 74:
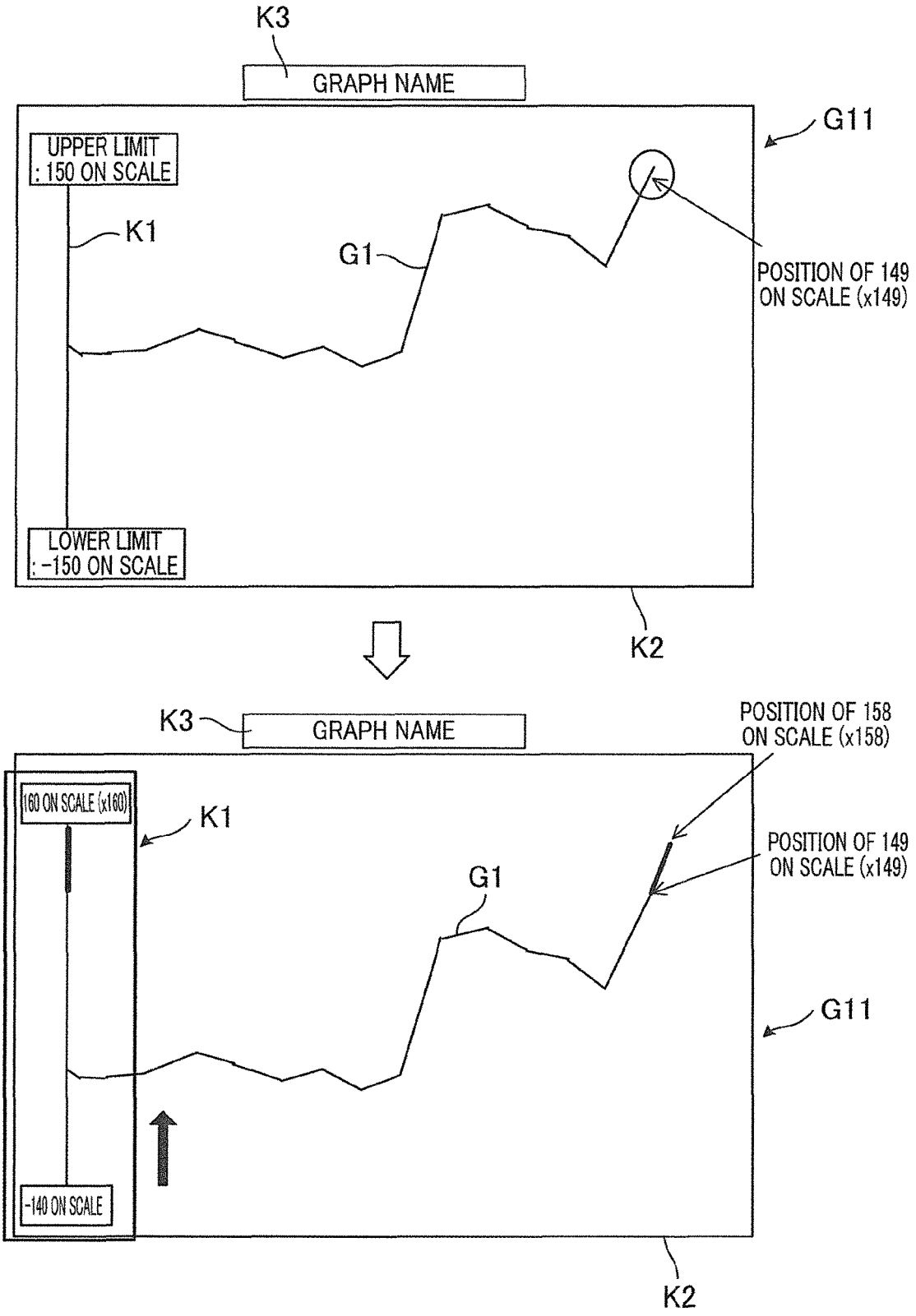
FIG. 74 is an explanatory diagram of a line-graph on a graph screen.

For example, as shown in FIG. 74, suppose the points indicating the payout rates has a point of 150 corresponding to the ×150 at the top and a point of −150 corresponding to ×−150 at the bottom. Then, a play of the normal game results in a payout rate of 9.86. In this case, a value of 10 resulting from rounding off the decimal digits of the payout rate is added to the upper limit value and the lower limit value. As the results, as shown in FIG. 74, the points indicating the payout rate include: a point of 160 corresponding to ×160 at the top and a point of −140 corresponding to −140 at the bottom. Then, as shown in FIG. 74, suppose the payout rate resulting in a play of the normal game is 9.86, and the value of the payout rate of the previous play is plotted at the point of 149. In this case, the payout rate of the current play is added so that 149+9, and the current payout rate is plotted at the point of ×158. Then, the point of ×149 which is the payout rate of the previous play and the point of ×158 which is the previous payout rate+the current payout rate are connected by a straight line and updated on the line-graph G1.

Further, when the payout rate of the current play is 0 or lower, the upper limit value and the lower limit value of the vertical axis K1 are shifted to the values resulting from subtracting 1 from each of the upper limit values and the lower limit values before the shift, respectively.

Figure 75:
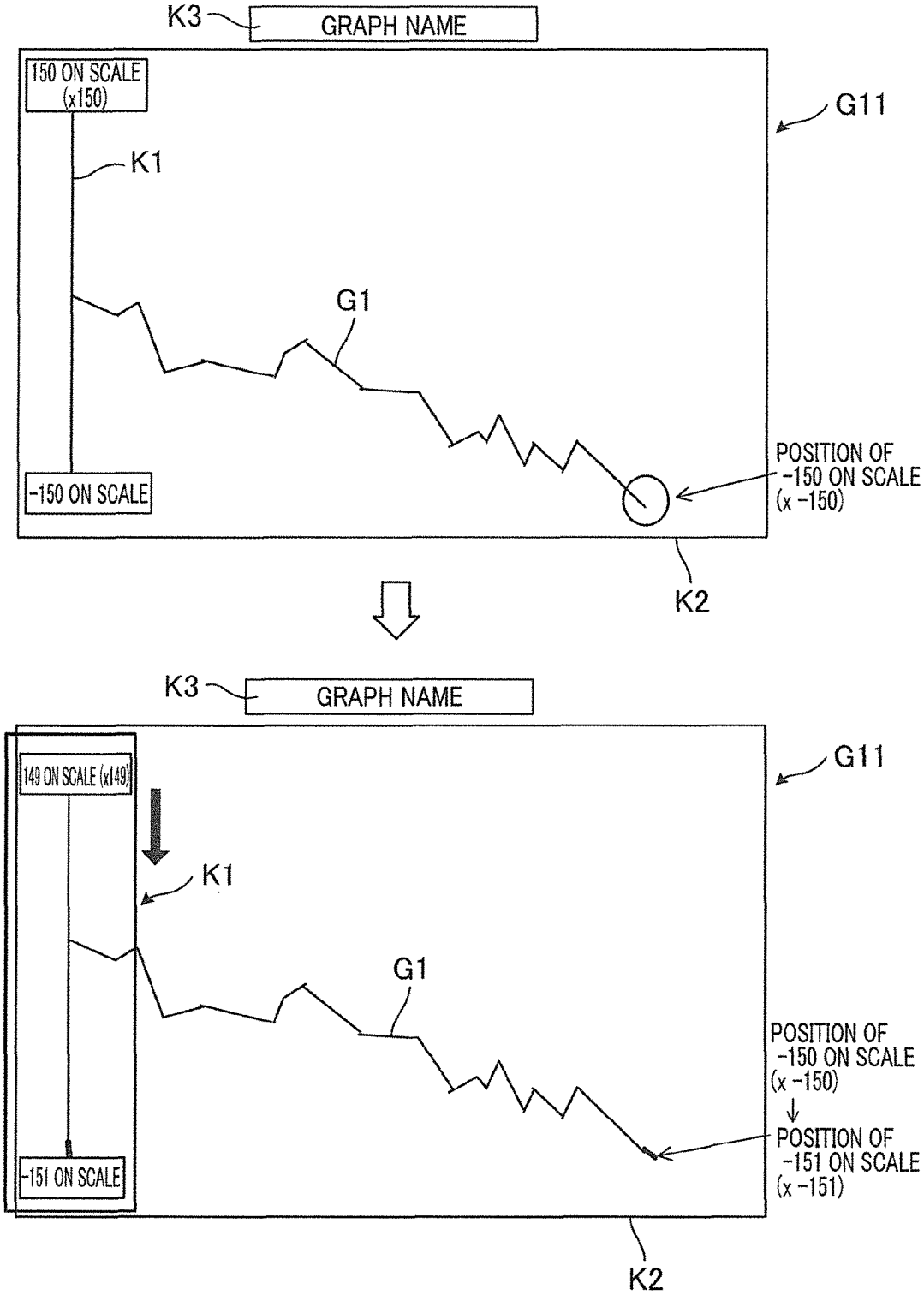
FIG. 75 is an explanatory diagram of a line-graph on a graph screen.

For example, as shown in FIG. 75, suppose the points indicating the payout rates has a point of 150 corresponding to the ×150 at the top and a point of −150 corresponding to ×−150 at the bottom. Then, a play of the normal game results in a payout rate of 0. In this case, a value of 1 is subtracted from the upper limit value and the lower limit value. As the results, as shown in FIG. 75, the points indicating the payout rate include: a point of 149 corresponding to ×149 at the top and a point of −151 corresponding to −151 at the bottom. Then, as shown in FIG. 75, suppose the payout rate resulting in a play of the normal game is 0, and the value of the payout rate of the previous play is plotted at the point of −150. In this case, the payout rate of the current play is added (i.e., 1 is subtracted as described above) so that (−150)+(−1), and the current payout rate is plotted at the point of ×−151. Then, the point of ×−150 which is the payout rate of the previous play and the point of ×−151 which is the previous payout rate+the current payout rate are connected by a straight line and updated on the line-graph G1.

Figure 76:
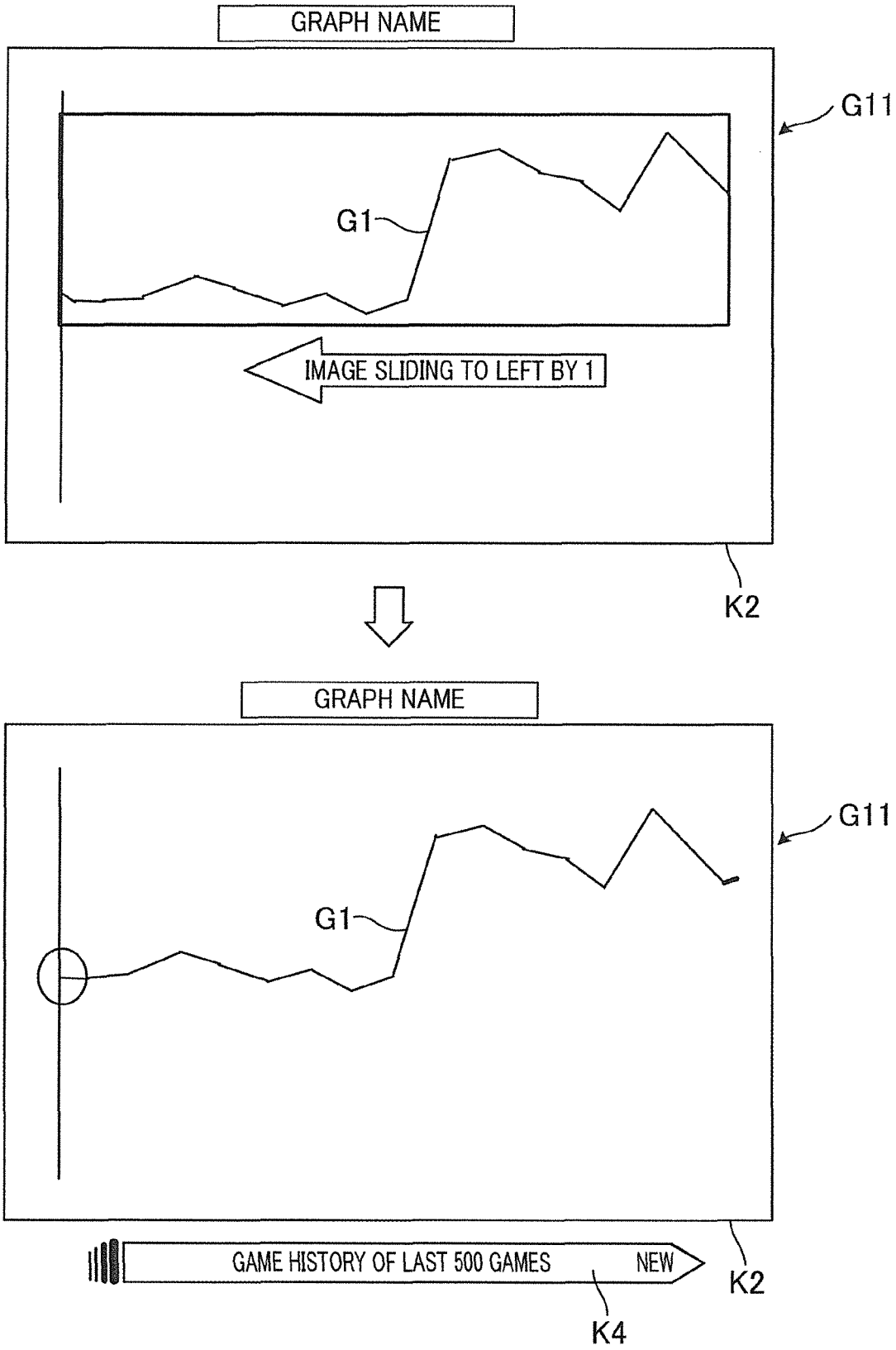
FIG. 76 is an explanatory diagram of a line-graph on a graph screen.

Further, as shown in FIG. 76, the line-graph G1 is updated every time a play of the normal game is run, and shifts to the left by 1 point.

(Display Screen: Bar-Graph in Details)

Figure 77:
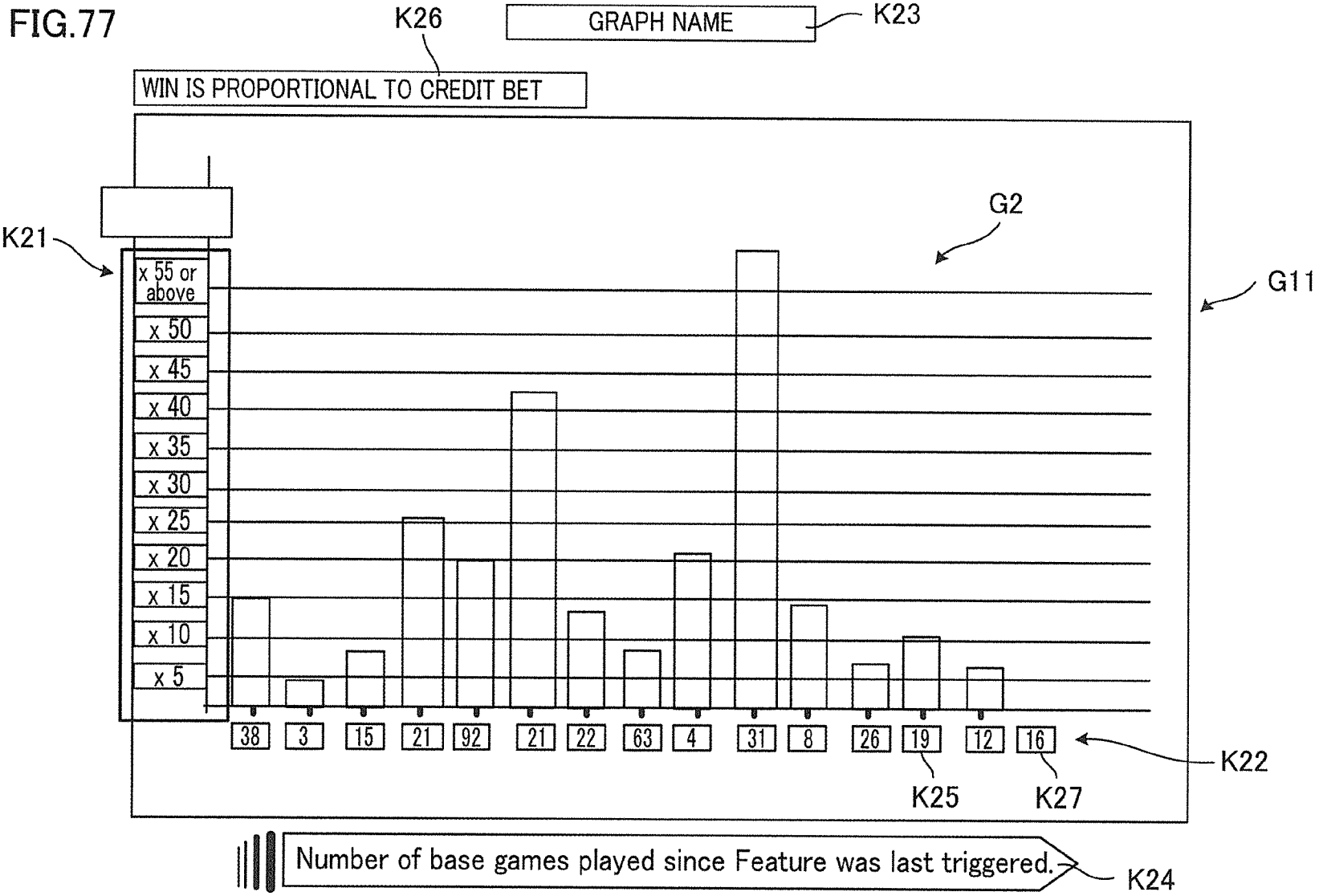
FIG. 77 is an explanatory diagram of a bar-graph on a graph screen.
Figure 78:
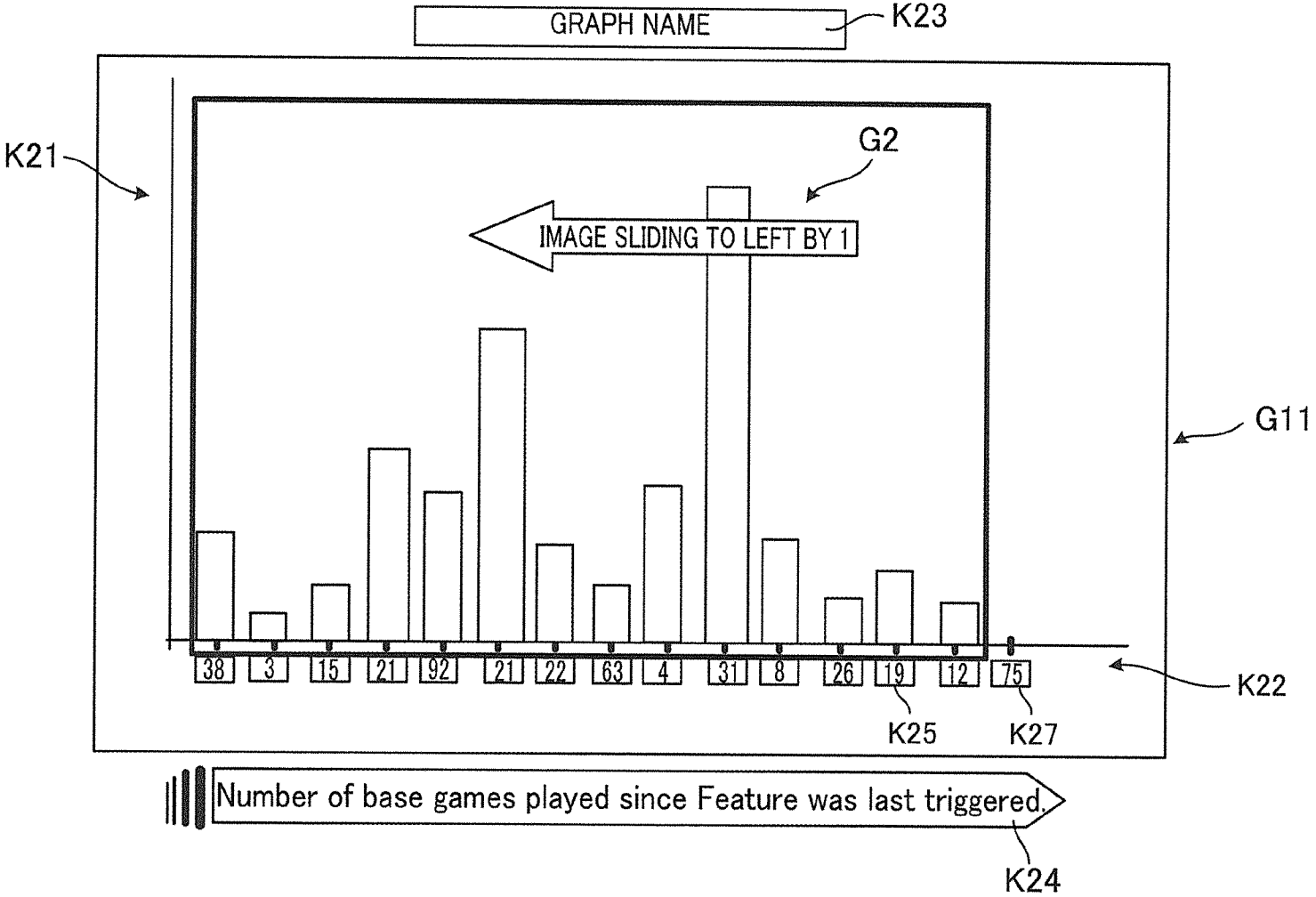
FIG. 78 is an explanatory diagram of a bar-graph on a graph screen.
Figure 79:
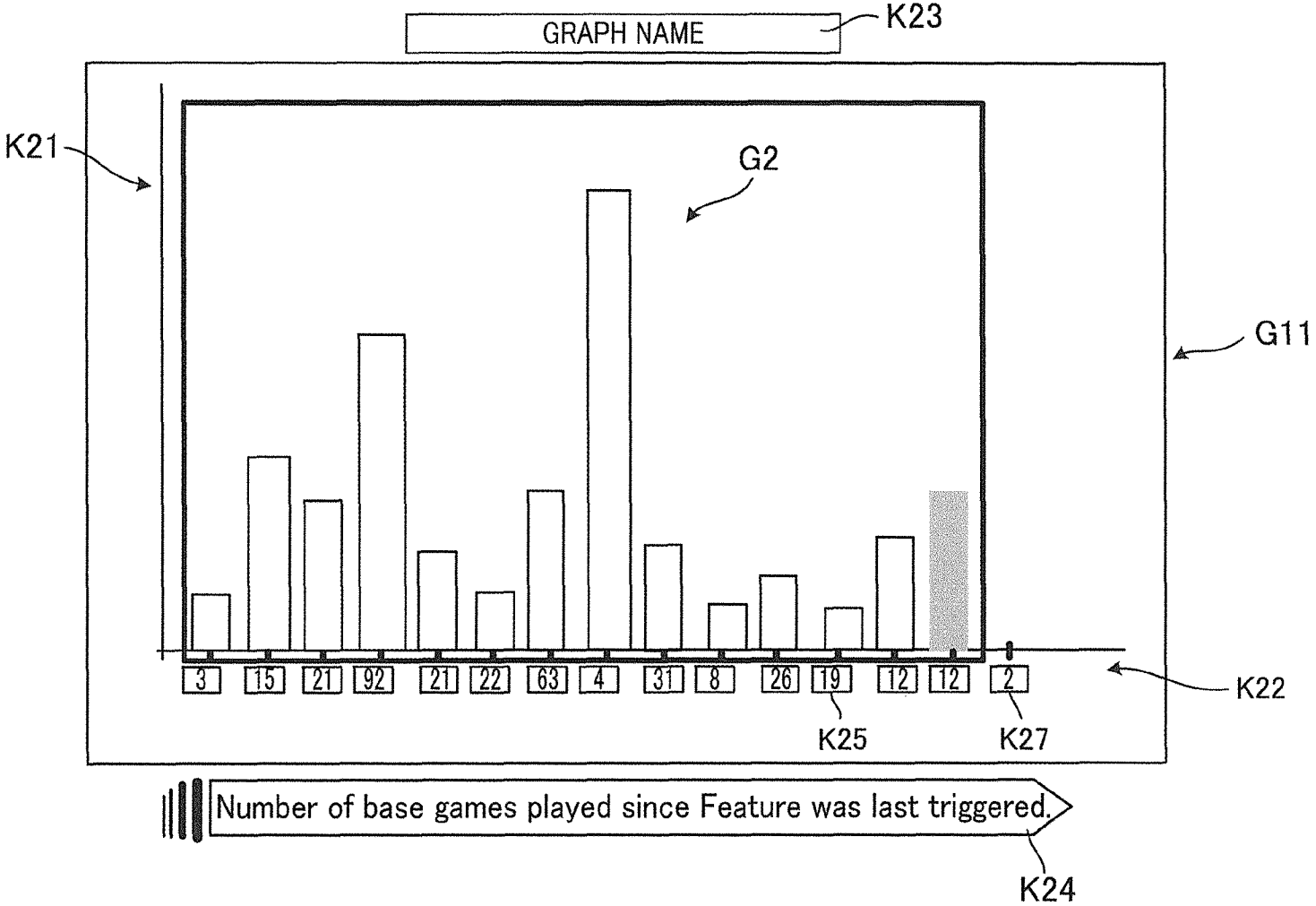
FIG. 79 is an explanatory diagram of a bar-graph on a graph screen.

Next, with reference to FIG. 77 to FIG. 79 the following describes the bar-graph on the 2 page of the graph screen, which is switched by a touch-operation of the graph-switch button 400.

As shown in FIG. 77, in the upper part of the graph screen display portion G11, a graph name K23 is displayed. In the present embodiment, the indication will be "Total win graph of Free game: bar-graph". In the lower part of the graph screen display portion G11 is a label of the horizontal axis K24 reading "Number of base games played since Feature was last triggered". Further, in the upper left of the graph screen display portion G11, there is a display field K26. In the present embodiment, the indication will be "win is proportional to the credits bet".

As shown in FIG. 77, the bar-graph G2 is displayed in the graph screen display portion G11 of the upper image display panel 131. The vertical axis K21 of this bar-graph G2 indicates the payout rate resulting from a calculation of the total payout obtained in all the plays of the free game, when the free game is run, divided by the total bet amount. There are points indicating payout rates, up to ×55. Further, to facilitate confirmation of the payout rate, horizontal lines are given to the payout rate.

Further, the "total win in the free game" of a player indicated by the horizontal axis K22 covers 15 plays including the current play. A box K25 under each bar indicating the "total win in the free game" indicates the number of plays of the normal game run from the last triggered free game or from the end of the last 15-choice pick game till the 15-choice pick game is newly triggered. It should be noted that the rightmost box K27 indicates the cumulative total of the plays of the normal game run from the last triggered free game or from the end of the last 15-choice pick game till the current time.

Further, as shown in FIG. 78 and FIG. 79, the bar-graph G2 is updated every time the right to play the free game is awarded, and shifts to the left by 1 point.

(Display Screen: Block-Graph in Details)

Figure 80:
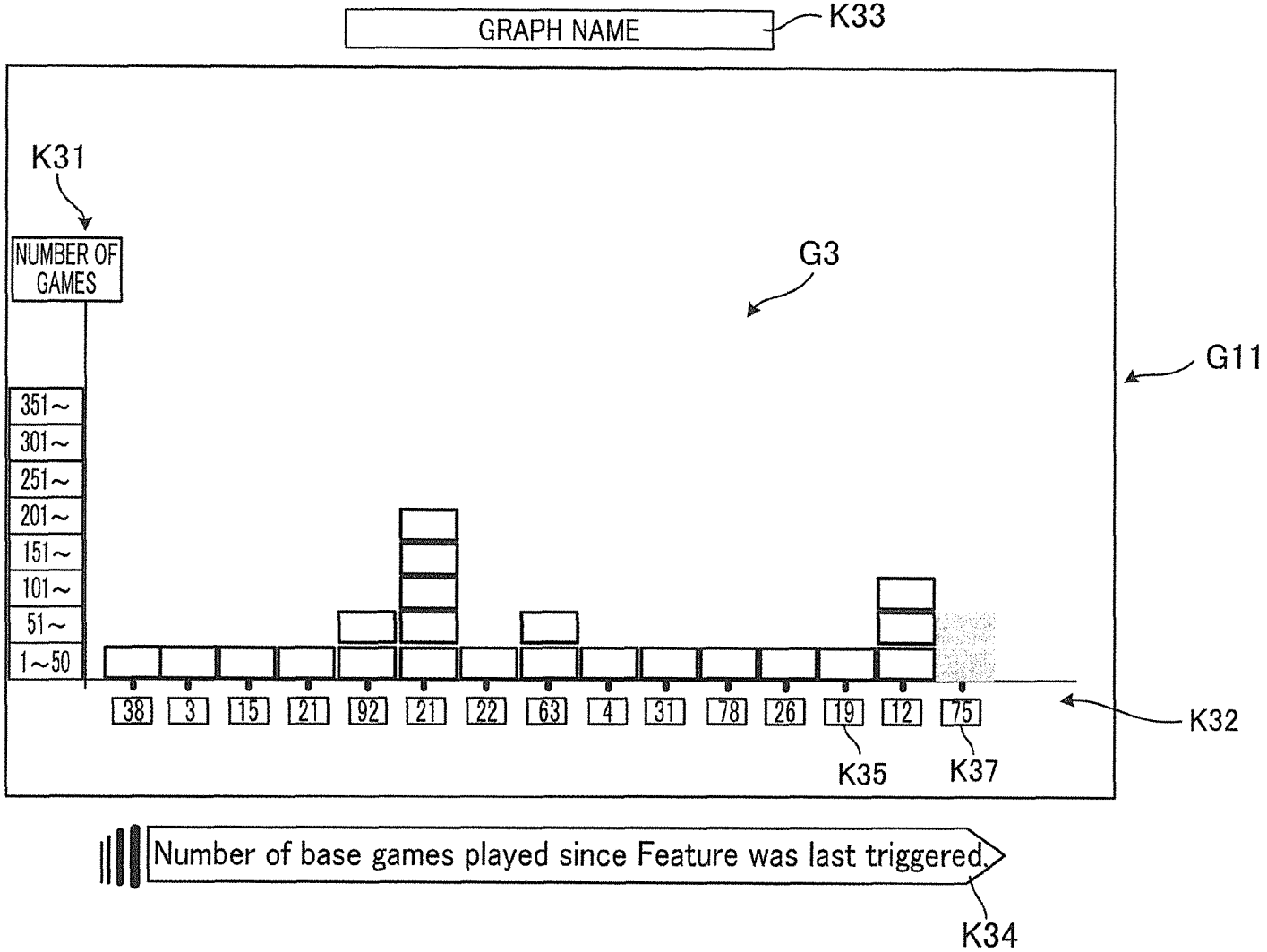
FIG. 80 is an explanatory diagram of a block-graph on a graph screen.
Figure 81:
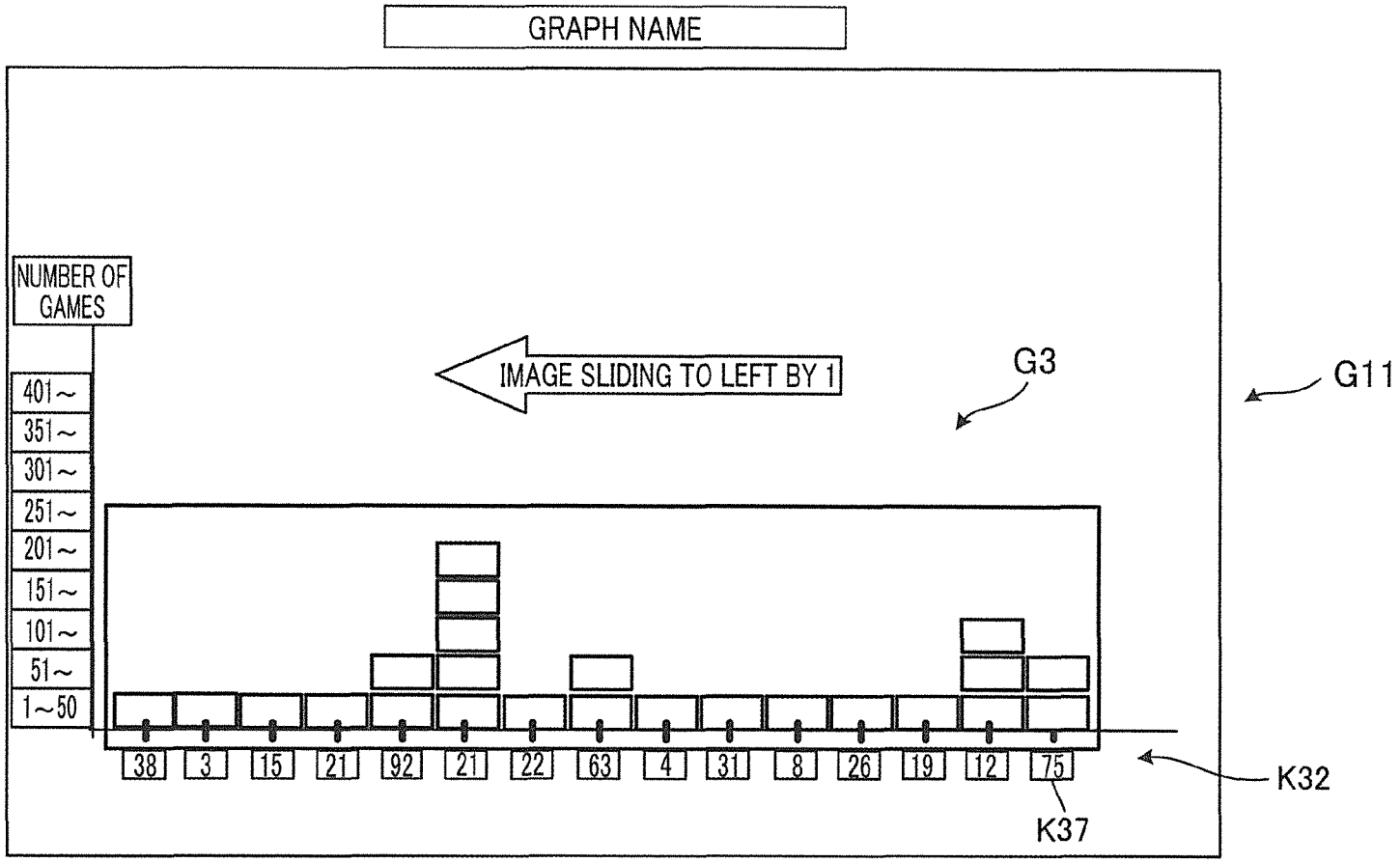
FIG. 81 is an explanatory diagram of a block-graph on a graph screen.
Figure 82:
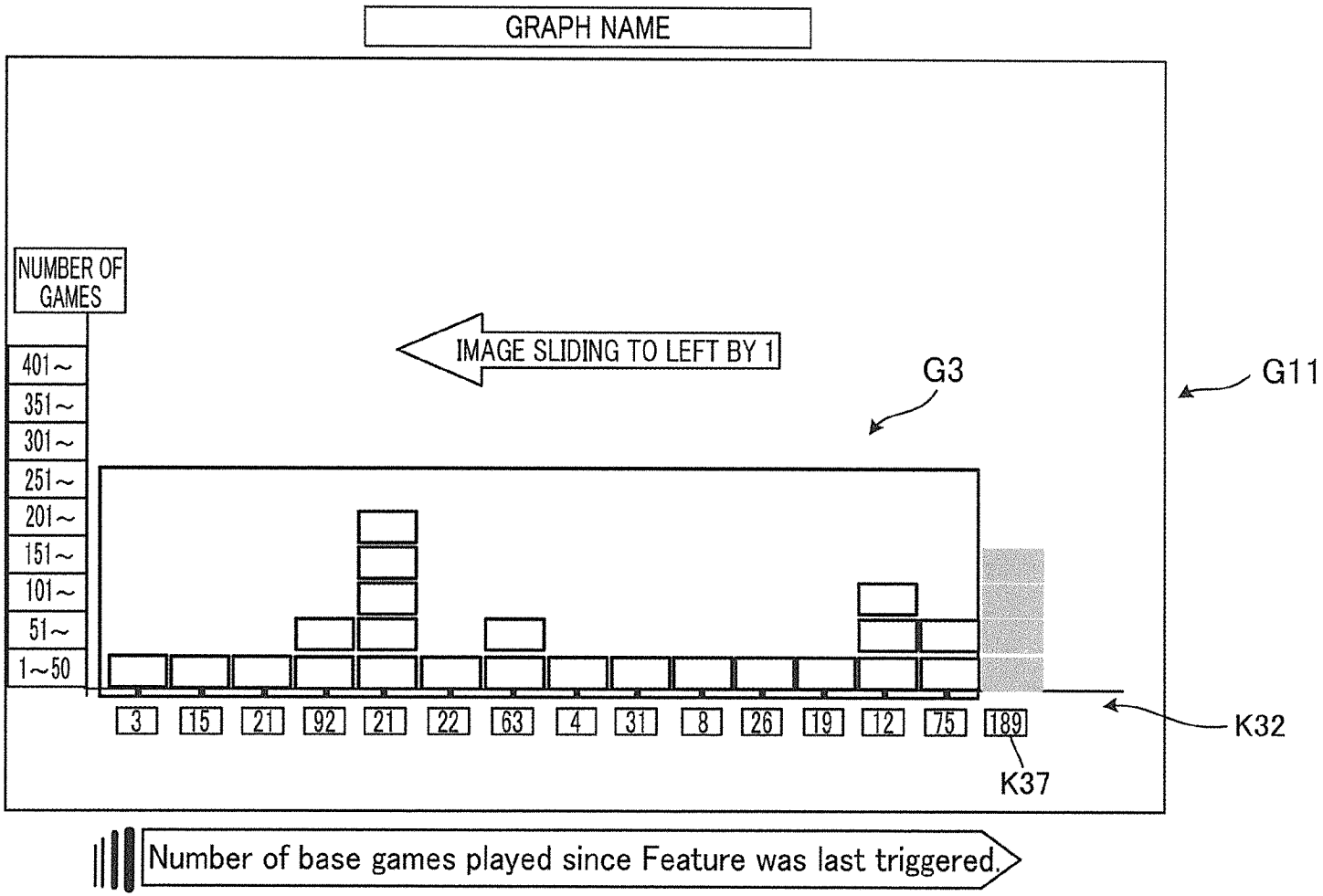
FIG. 82 is an explanatory diagram of a block-graph on a graph screen.

Next, with reference to FIG. 80 to FIG. 82 the following describes the block-graph on the 3rd page of the graph screen, which is switched by a touch-operation of the graph-switch button 400.

As shown in FIG. 80, in the upper part of the graph screen display portion G11, a graph name K33 is displayed. In the present embodiment, the indication will be "Game Play Graph when Winning Free Game: Block-Graph". In the lower part of the graph screen display portion G11 is a label of the horizontal axis K34 reading "Number of base games played since Feature was last triggered".

As shown in FIG. 80, the block-graph G3 is displayed in the graph screen display portion G11 of the upper image display panel 131. The vertical axis K31 in the block-graph G3 indicates the number of plays of the normal game run from the last triggered free game until the free game is newly triggered. The points on the vertical axis indicates 9 steps, each of which step represents 50 plays of the game.

Further, the number of plays of the free game played by a player indicated by the horizontal axis K32 covers 15 plays including the current play. A box K35 under each column of the block-graph G3 indicates the number of plays of the normal game run from the last triggered free game or from the end of the last 15-choice pick game till the 15-choice pick game is newly triggered. It should be noted that the rightmost box K37 indicates the cumulative total of the plays of the normal game run from the last triggered free game or from the end of the last 15-choice pick game till the current time. The rightmost box K37, since it indicates the current value, is displayed in a different color from that of the other boxes K35 so as to make it noticeable to the player.

Further, as shown in FIG. 81 and FIG. 82, the value in the box K37 is incremented by 1 every time a play of the normal game is run. Further, the block-graph G3 is updated every time a right to play the free game is awarded, and shifts to the left by 1 point. Then, the value in the new rightmost box K37 by the horizontal axis K32 is incremented by 1 every time a play of the normal game is run.

(Setting of Audit for Switching Graph Screen: Audit)

Figure 84:
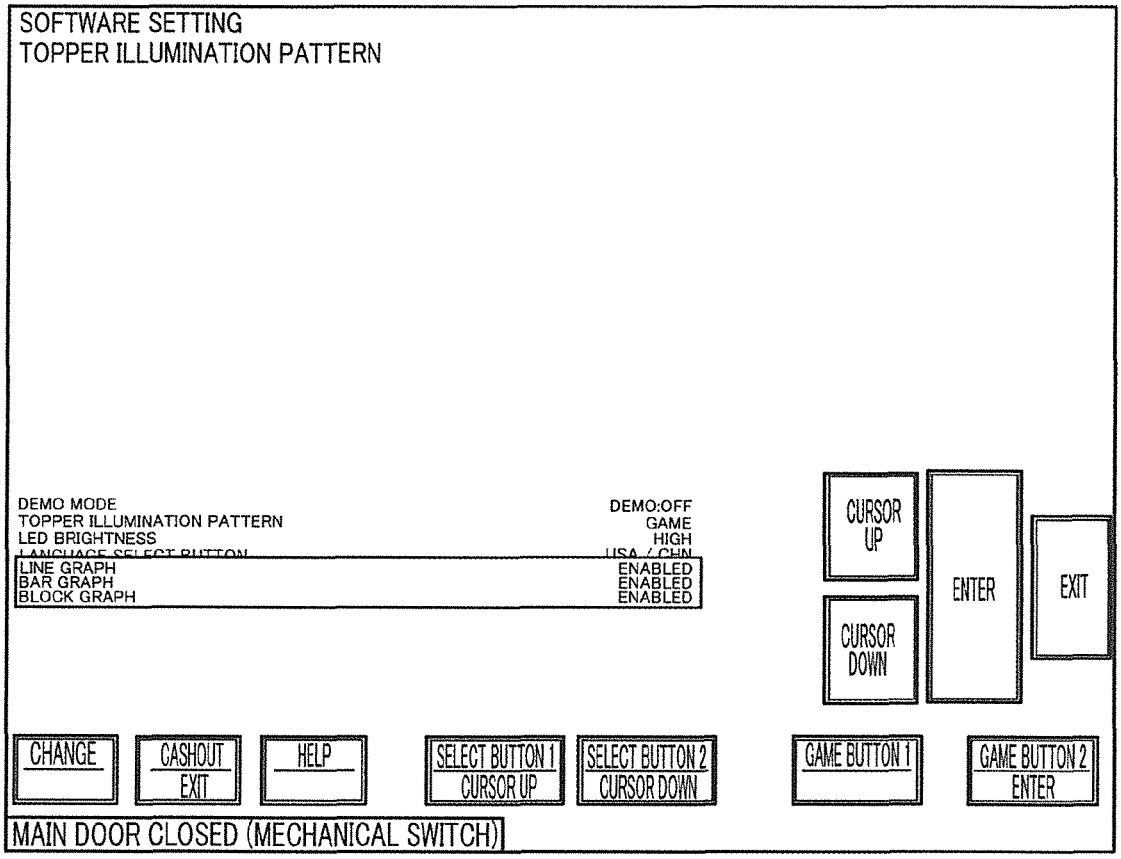
FIG. 84 is an explanatory diagram of the specification of switching an active and inactive states of the graph screen based on an AUDIT setting.

In the present embodiment, the line-graph G1, the bar-graph G2, and the block-graph G3 displayed on the graph screen display portion G11 are switchable to active or inactive state in Audit setting (see FIG. 84). Specifically, as shown in FIG. 83, whether to display or not display the line-graph G1, the bar-graph G2, and the block-graph G3 is set by selecting "Disabled" or "Enabled" in the setting for "LINE GRAPH" for the line-graph, "BAR-GRAPH" for the bar-graph, and "BLOCK GRAPH" for the block-graph displayed in the "SOFTWARE SETTING" of the AUDIT.

With the above-described structure, when there is a payout, the main CPU 71 calculates the ratio of the payout relative to the amount of bet, and indicates it in the graph screen display portion G11. This enables the player to easily understand how much he/she won or lost.

Further, since the ratio of the total payout relative to the total amount bet is indicated for each unit game, the player is more easily understand how much he/she won or lost.

In cases where the normal game is played while repeating the unit game, changes in the payout rate is displayed in the form of a graph image in the graph screen display portion G11. This facilitates grasping of the tendency of the payout of the game.

Further, the change in the payout rate is shown as the line-graph G1 or the bar-graph G2 in the graph screen display portion G11. By switching the graph between the line-graph G1 and the bar-graph G2, the player is able to grasp the tendency of the payout of the game from different viewpoints.

Further, by looking at the start of the free game shown in the form of a mark image M311 in the graph image, the tendency in the payout after transition from the normal game to the free game is easily understood.

Further, different ways of indication in the line-graph G1 allows distinguishing the normal game (solid line) from the free game (dotted line). Therefore, the difference in the tendency of the payout between the normal game and the free game is easily understood.

Further, through the setting of AUDIT, one of or both the line-graph G1 and the bar-graph G2 are set to be enabled or disabled. This enables setting of displaying of graph images suitable for the type of game and the conditions under which the slot machine 1 is set up.

[Win Meter Information Display]

Figure 85:
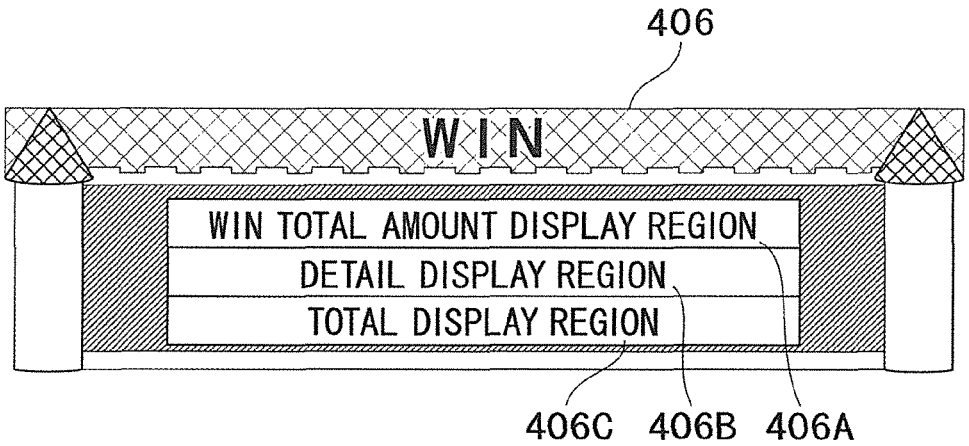
FIG. 85 shows a win meter information display of the slot machine related to the embodiment of the present invention.

Now, win meter information display of the slot machine 1 will be described with reference to FIG. 85. FIG. 85 illustrates the win meter information display of the slot machine of the embodiment of the present invention.

As shown in FIG. 85, a win meter 406 is provided with a win total amount display region 406A, a detail display region 406B, and a total display region 406C.

The win total amount display region 406 displays a win credit and a money amount. Increment display is performed based on a win increment speed sheet, when performed. More specifically, the win total amount display region 406A displays a credit amount obtained in the current game cycle (or in the previous game cycle). When a credit is obtained more than once in one game cycle, the credit is added each time it is obtained. For example, when the free game is triggered in the normal game and the player obtains a normal win 20 and a bonus win 100, the image display is incremented from "0" to "120". Thereafter, when the player obtains a payout amount of 200 in the free game, the increment display is conducted from 120 to 320. 0 is displayed either when the next game cycle starts or when lost in GAMBLE. In the meanwhile, when a win is achieved in GAMBLE, no increment is carried out and the displayed amount is immediately doubled.

The detail display region 406 relates to a win in the normal game and the free game. After the 5th reel stops, the win credit is displayed. When more than one payout simultaneously occurs, the line payouts are displayed one by one at intervals of 0.5 second. The payouts are serially displayed in an ascending order of the payout amount, and the smallest payout is again displayed after the largest payout is displayed. In other words, the detail display region 406 displays the details of the credit obtained by the spinning in this time. When there are plural elements (e.g., another line or scatter), the elements are switched at intervals of 0.5 second.

The total display region 406C displays the total credits of the detail display region 406 when the increment in the win total amount display region 406A is completed. The region is not displayed until the increment in the win total amount display region 406A is completed. In other words, the detail display region 406C displays the details of the credit obtained by the spinning in this time. In this regard, the total credits are displayed after the increment in the win total amount display region 406A is finished.

[Gamble Specification]

Now, the GAMBLE specification in the slot machine 1 will be described with reference to FIG. 86 to FIG. 92. Each of FIG. 86 to FIG. 92 illustrates GAMBLE specification in the slot machine of the embodiment of the present invention.

Figure 86:
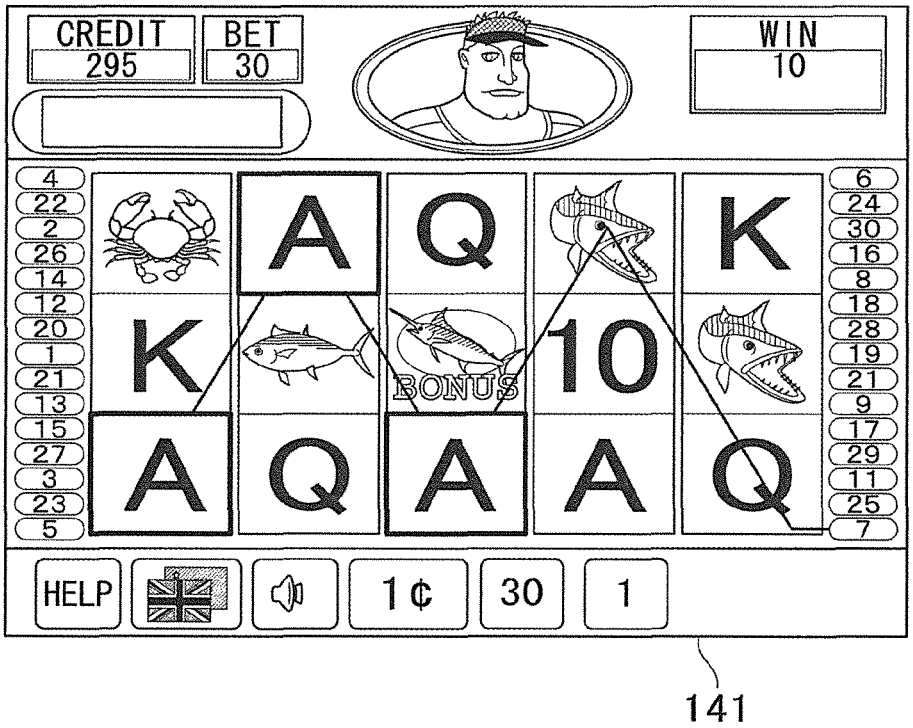
FIG. 86 shows GAMBLE specification of the slot machine related to the embodiment of the present invention.
Figure 87:
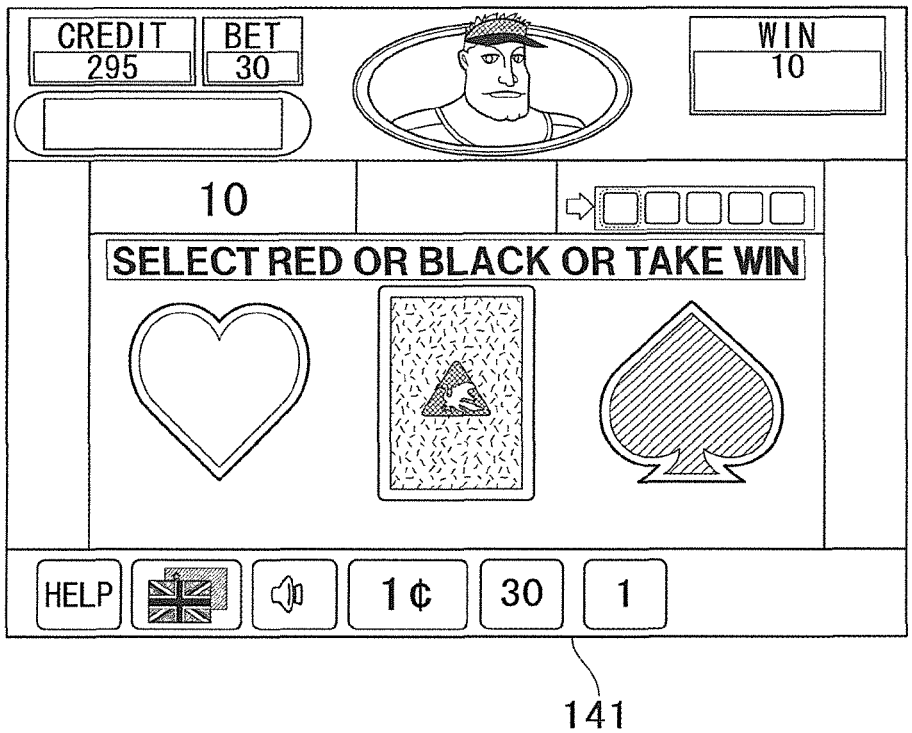
FIG. 87 shows GAMBLE specification of the slot machine related to the embodiment of the present invention.

To begin with, when a winning (WIN) is achieved, the lower image display panel 141 shown in FIG. 86 is changed to the lower image display panel 141 shown in FIG. 87. In other words, a gamble screen is displayed whereas the message "PLAY ON, GAMBLE or TAKE WIN" is deleted from the lower image display panel 141. In the meanwhile, a message "SELECT RED OR BLACK OR TAKE WIN" is displayed on the lower image display panel 141.

Figure 88:
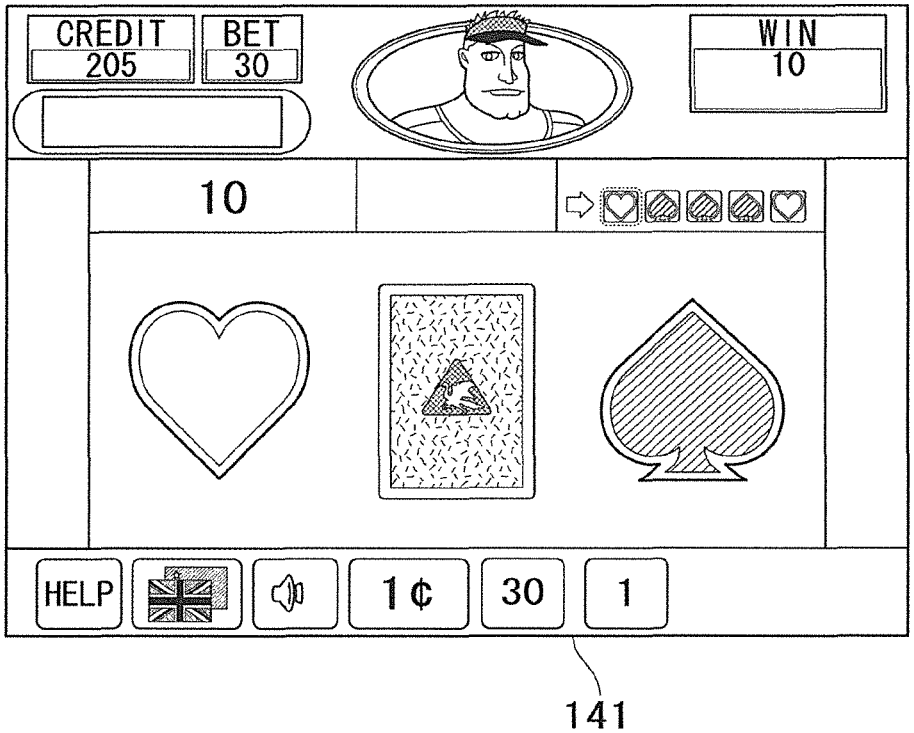
FIG. 88 shows GAMBLE specification of the slot machine related to the embodiment of the present invention.

Subsequently, on the lower image display panel 141 shown in FIG. 88, a betted amount is displayed on the lower image display panel 141 as "GAMBLE AMOUNT". The player selects "RED" or "BLACK". When the player succeeds in the selection, the lower image display panel 141 is changed to the later-described lower image display panel 141 shown in FIG. 91. In the meanwhile, when the player fails in the selection, the lower image display panel 141 is changed to the lower image display panel 141 shown in FIG. 89. When the player selects "TAKE WIN", the amount of win is immediately added to the credits on the lower image display panel 141 and the idle state returns.

Figure 89:
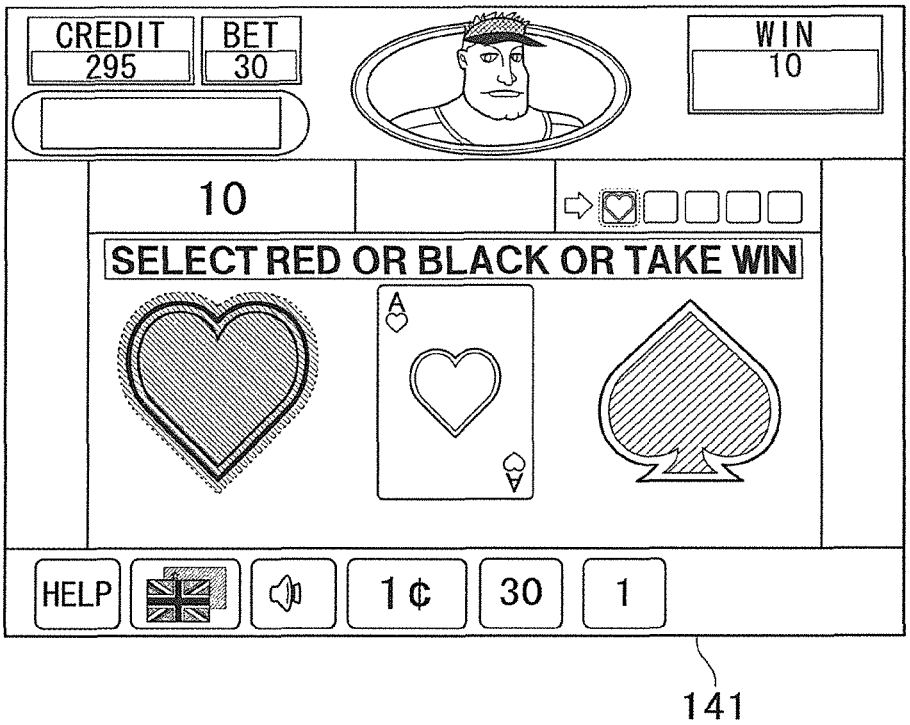
FIG. 89 shows GAMBLE specification of the slot machine related to the embodiment of the present invention.
Figure 90:
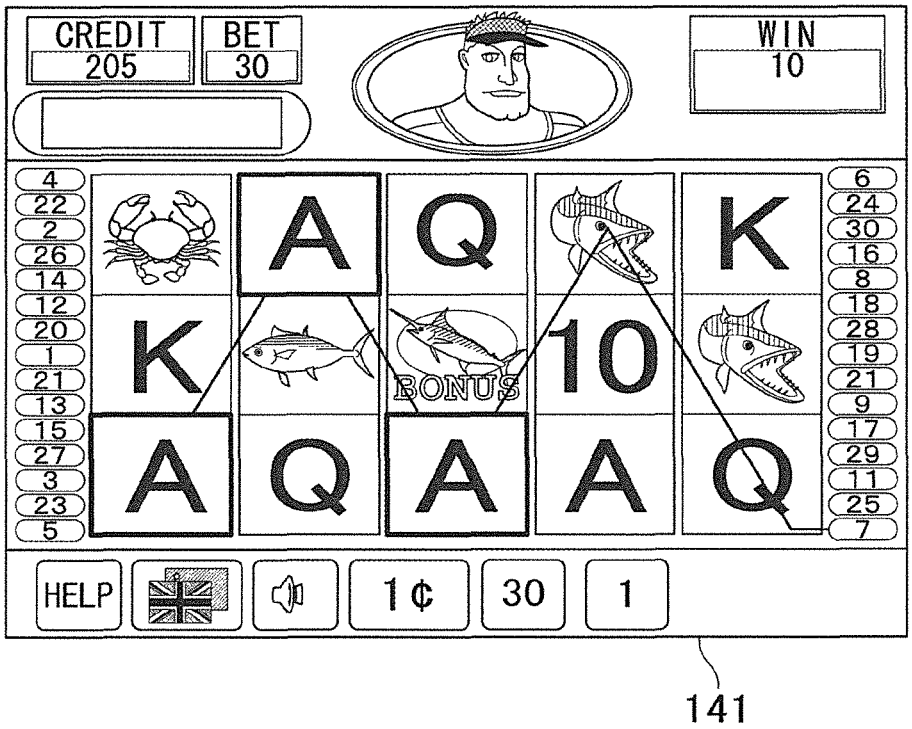
FIG. 90 shows GAMBLE specification of the slot machine related to the embodiment of the present invention.

When the player fails in the selection, the option ("RED" or "BLACK") which is not selected is darkened on the lower image display panel 141 shown in FIG. 89. On the lower image display panel 141 shown in FIG. 89, the history of card selection is immediately displayed at the leftmost part of the "GAMBLE HISTORY". When there is previous history of card selection, that previous history is moved to the immediate right. The trace of the movement is not illustrated in animation, and hence the history is rewritten at once. Furthermore, the result of the central card is immediately displayed. At this stage, however, neither the win meter nor the gamble amount meter changes. Then failure sound is reproduced, and after 1.2 seconds elapse after the sound reproduction, the screen is switched to a main game screen as indicated by the lower image display panel 141 shown in FIG. 90. At the same time as the switching to the main game screen, "0" is displayed on the win meter.

Figure 91:
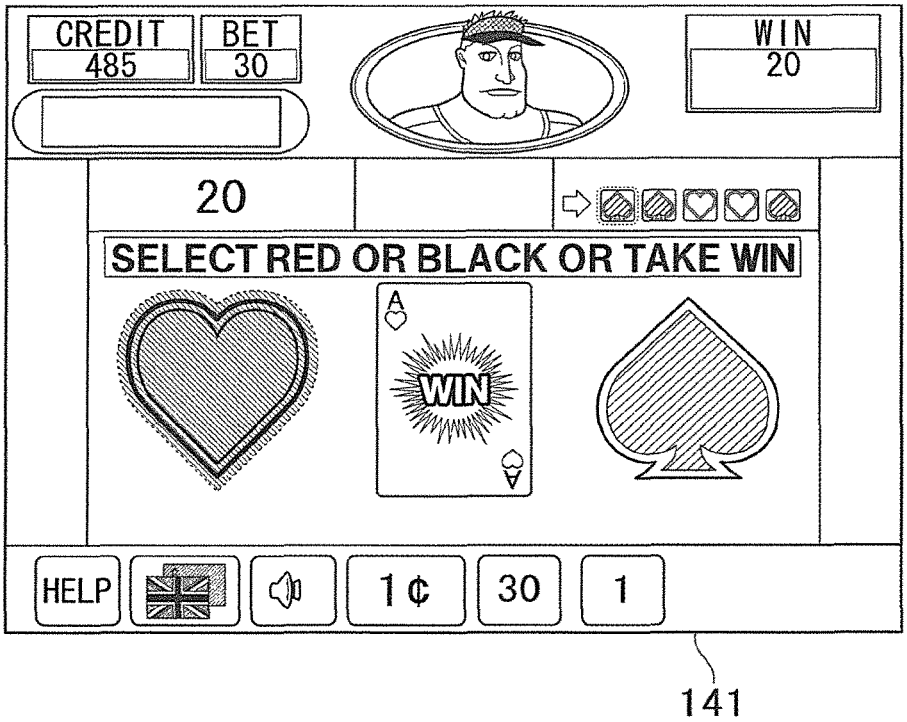
FIG. 91 shows GAMBLE specification of the slot machine related to the embodiment of the present invention.
Figure 92:
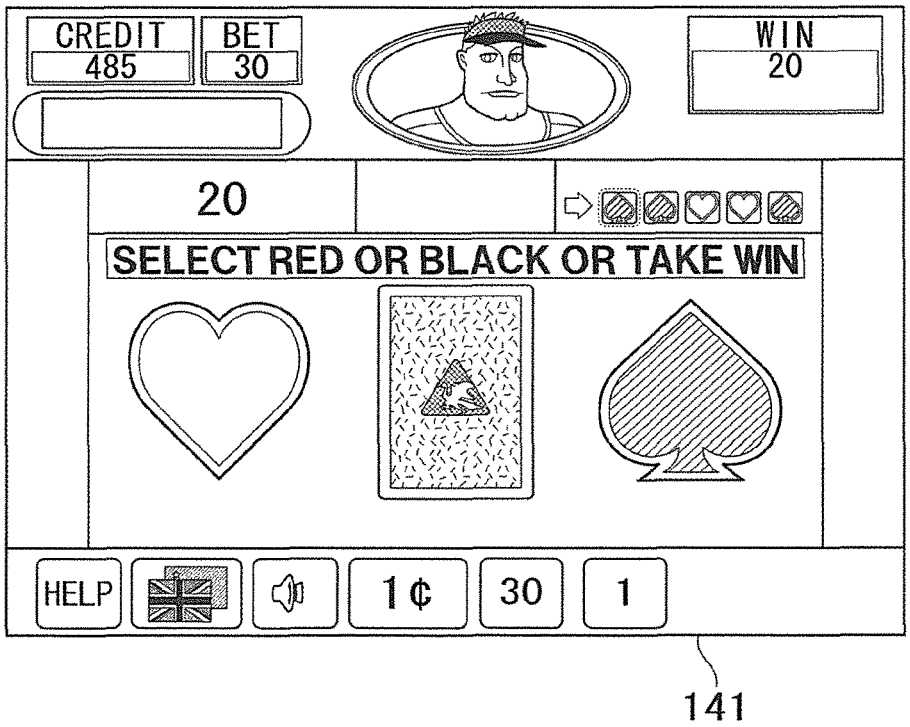
FIG. 92 shows GAMBLE specification of the slot machine related to the embodiment of the present invention.

When the player succeeds in the selection, the option ("RED" or "BLACK") which is not selected is darkened on the lower image display panel 141 shown in FIG. 91. On the lower image display panel 141 shown in FIG. 91, the history of card selection is immediately displayed at the leftmost part of the "GAMBLE HISTORY". When there is previous history of card selection, that previous history is moved to the immediate right. The trace of the movement is not illustrated in animation, and hence the history is rewritten at once. Furthermore, as the central card, a normal card and a card with a win text are alternately displayed for each frame, and success sound is reproduced for 1.2 seconds. To the win meter, the amount increased by the result of GAMBLE is immediately added. At this stage, however, neither the win meter nor the gamble amount meter changes.

When GAMBLE is played until reaching the upper limit number of times, the value of win is added to the credit at once and the idle state returns. In the meanwhile, the number of times of playing the GAMBLE has not reached the upper limit, the lower image display panel 141 is changed to the lower image display panel 141 shown in FIG. 92. On the lower image display panel 141 shown in FIG. 92, the central card is overturned. Thereafter, the lower image display panel 141 is changed to the lower image display panel 141 shown in FIG. 88.

[RESIDUAL GAMBLE]

Figure 93:
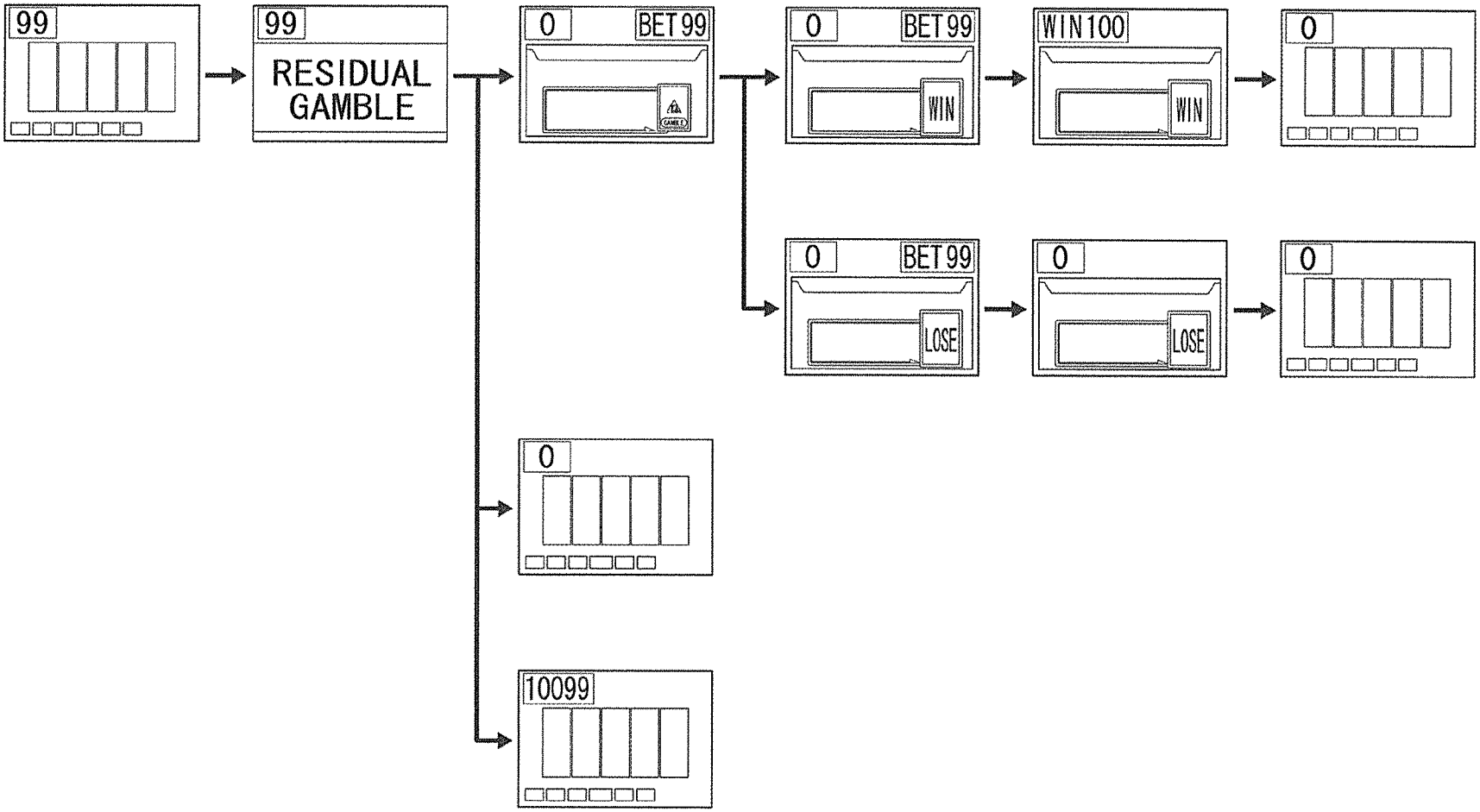
FIG. 93 shows RESIDUAL GAMBLE of the slot machine related to the embodiment of the present invention.
Figure 95:
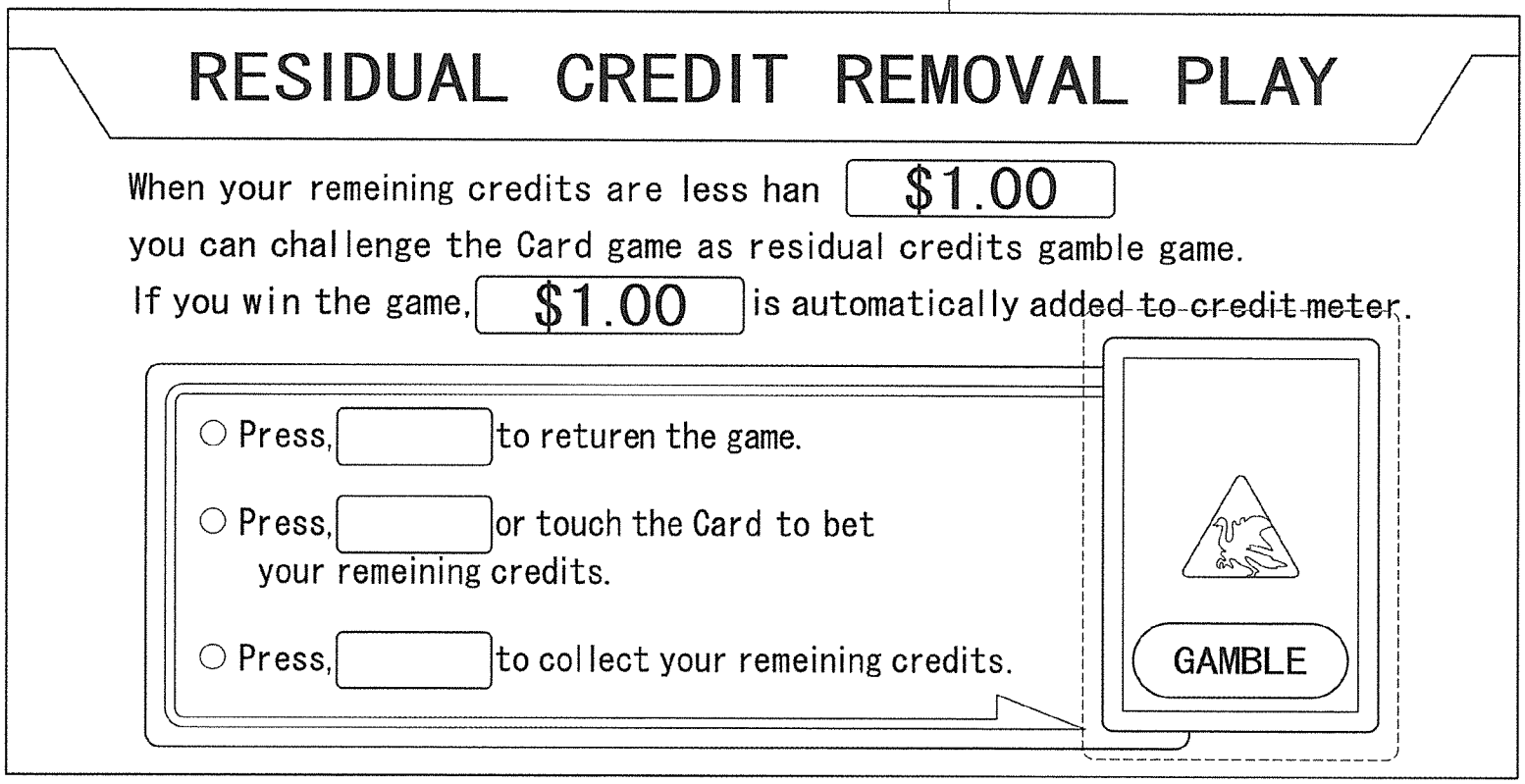
FIG. 95 shows RESIDUAL GAMBLE of the slot machine related to the embodiment of the present invention.

Now, RESIDUAL GAMBLE of the slot machine 1 will be described with reference to FIG. 93 to FIG. 95. Each of FIG. 93 to FIG. 95 illustrates RESIDUAL GAMBLE in the slot machine of the embodiment of the present invention. RESIDUAL GAMBLE is executed in line with the flow shown in FIG. 93, by using a table shown in FIG. 94. In this connection, in a stage in the RESIDUAL GAMBLE, an image 501 shown in FIG. 95 is displayed on the lower image display panel 141.

[System Font Display Region]

Figure 96:
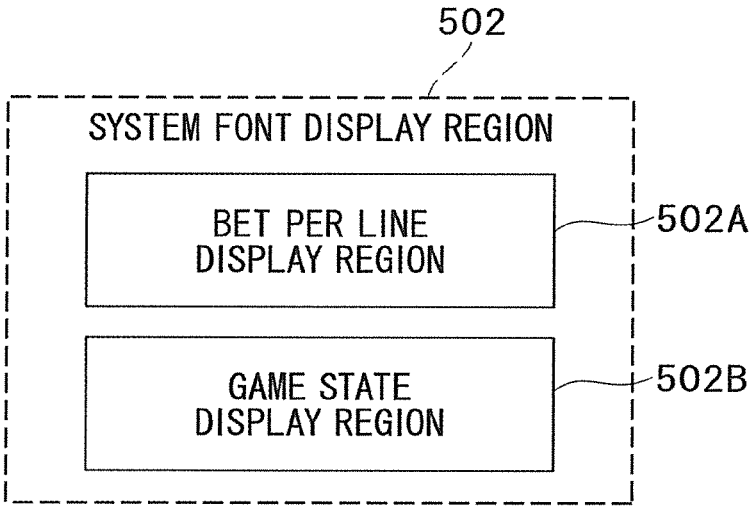
FIG. 96 shows a system font display region of the slot machine of the embodiment of the present invention.

Now, a system font display region of slot machine 1 will be described with reference to FIG. 96. FIG. 96 shows a system font display region of the slot machine of the embodiment of the present invention. The system font display region 502 shown in FIG. 96 is provided with a bet per line display region 502A and a game state display region 502B. The system font display region 502 is provided in the bet information and game state display region 407 on the lower image display panel 141.

[HELP Specification]

Figure 97:
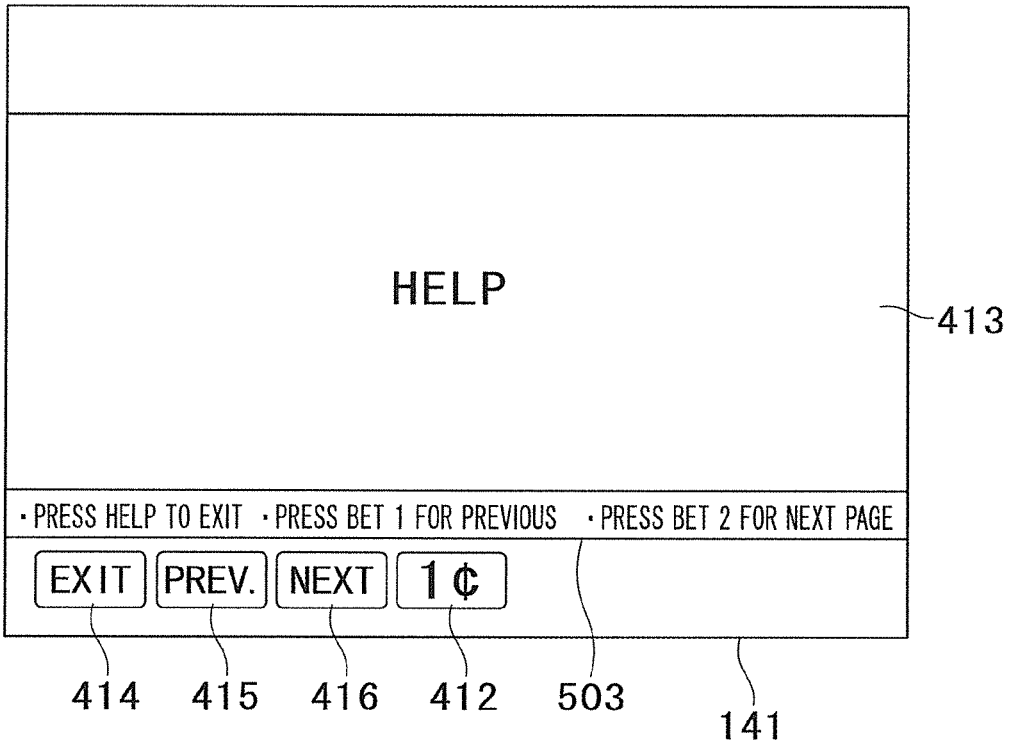
FIG. 97 shows HELP specification of the slot machine related to the embodiment of the present invention.
Figure 99A:
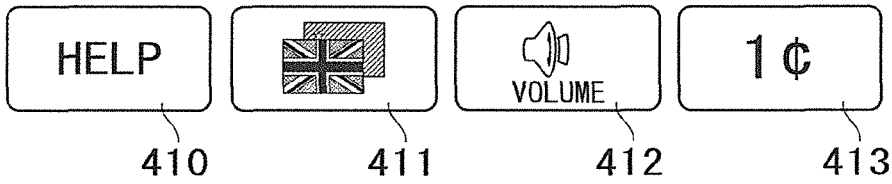
FIG. 99A shows arrangement of screen touch buttons of the slot machine related to the embodiment of the present invention.
Figure 99B:
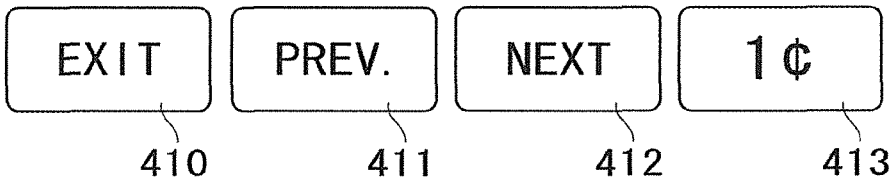
FIG. 99B shows arrangement of screen touch buttons of the slot machine related to the embodiment of the present invention.
Figure 99C:
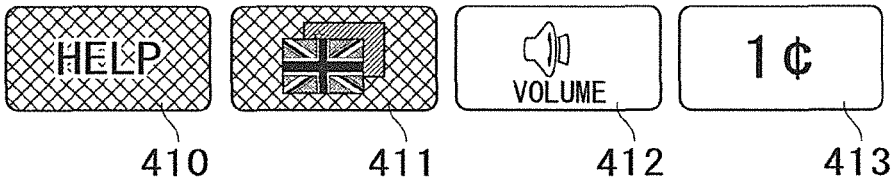
FIG. 99C shows arrangement of screen touch buttons of the slot machine related to the embodiment of the present invention.
Figure 99D:
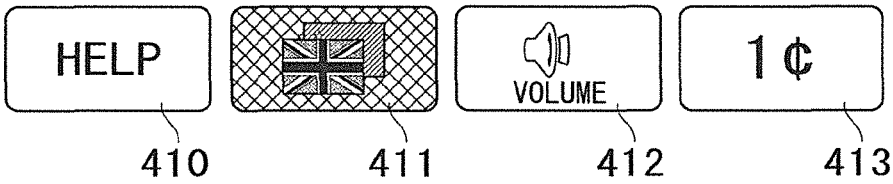
FIG. 99D shows arrangement of screen touch buttons of the slot machine related to the embodiment of the present invention.
Figure 100A:
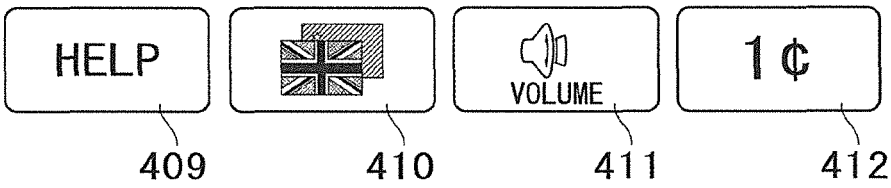
FIG. 100A shows arrangement of screen touch buttons of the slot machine related to the embodiment of the present invention.
Figure 100B:
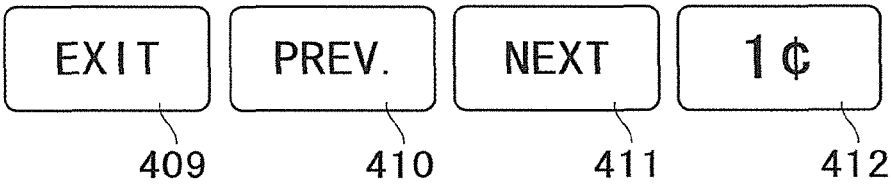
FIG. 100B shows arrangement of screen touch buttons of the slot machine related to the embodiment of the present invention.
Figure 100C:
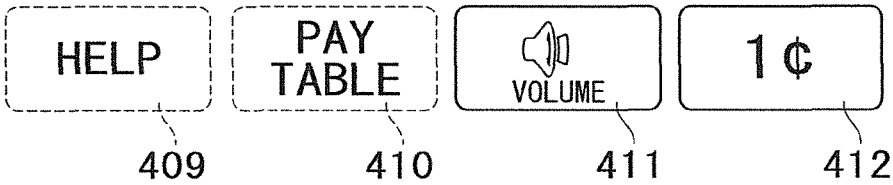
FIG. 100C shows arrangement of screen touch buttons of the slot machine related to the embodiment of the present invention.
Figure 100D:
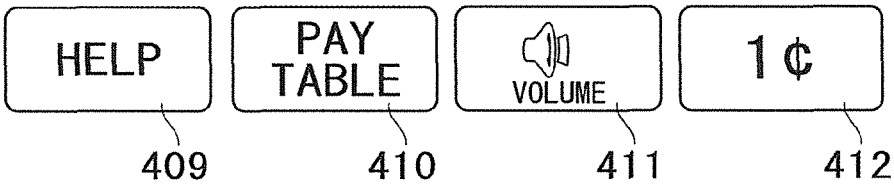
FIG. 100D shows arrangement of screen touch buttons of the slot machine related to the embodiment of the present invention.

Now, the HELP specification in the slot machine 1 will be described with reference to FIG. 97 to FIG. 98. FIG. 97 and FIG. 98 explain HELP specification in the slot machine of the embodiment of the present invention. As shown in FIG. 97, on the lower image display panel 141 in HELP specification, a help screen 413 and a message region 503 are provided, and an EXIT touch button 414, a PREV. touch button 415, a NEXT touch button 416, and a denomination indicator 412 are displayed.

The message region 503 is displayed with system fonts. This region is linked with the control panel 30 or the control panel 460. For this reason, when another pattern is used and the number is changed, the image display on the region is changed to the correct one in accordance with the change.

As indicated in the table shown in FIG. 98, when the player touches or presses the EXIT touch button 414 or the help button on the control panel, the lower image display panel 141 in HELP specification is changed to the normal screen. When the player touches or presses the PREV. touch button 415 or a BET×1 button on the control panel, the lower image display panel 141 in HELP specification is changed to the preceding HELP page. When the player touches or presses the NEXT touch button 416 or a BET×2 button on the control panel, the lower image display panel 141 in HELP specification proceeds to the next HELP page.

[Layout of Screen Touch Buttons]

Now, the following will describe the layout of the screen touch buttons in the slot machine 1, with reference to FIG. 99 to FIG. 101. FIG. 99 to FIG. 101 show arrangement of screen touch buttons of the slot machine related to the embodiment of the present invention.

FIG. 99(*a*) shows the layout of the screen touch buttons during IDLE. FIG. 99(*b*) shows the layout of the screen touch buttons during HELP. FIG. 99(*c*) shows the layout of the screen touch buttons while the game is in progress. FIG. 99(*d*) is the layout of the screen touch buttons in the state of GAMBLE or TAKE WIN. FIG. 100(*a*) shows the layout of the screen touch buttons in IDLE (language switching disabled). FIG. 100(*b*) shows the layout of the screen touch buttons in HELP (language switching disabled). FIG. 100(*c*) shows the layout of the screen touch buttons during the game (language switching disabled). FIG. 100(*d*) shows the layout of the screen touch buttons in the state of GAMBLE or TAKE WIN (language switching disabled).

In the layout of the screen touch buttons in the slot machine 1, a help touch button 409, a language switching touch button 410, a sound volume switching touch button 411*a*, a denomination indicator 412, an EXIT touch button 414, a PREV. touch button 415, or NEXT touch button 416 is provided. In particular, when the language switching is disabled and the game is in progress or the state is in GAMBLE or TAKE WIN, as shown in FIG. 100, a paytable touch button 504 is provided. These touch buttons are active when turned on and inactive when turned off as shown in FIG. 101.

[Sound Volume Switching Touch Button]

Figure 102:
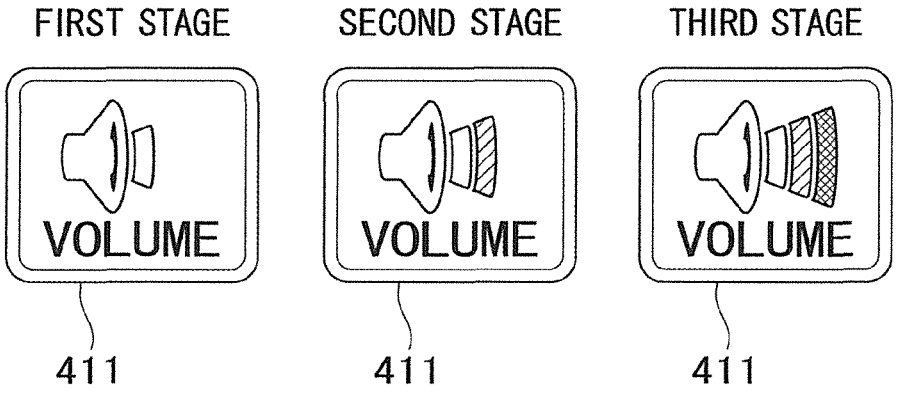
FIG. 102 shows a sound volume switching touch button of the slot machine of the embodiment of the present invention.
Figure 103:
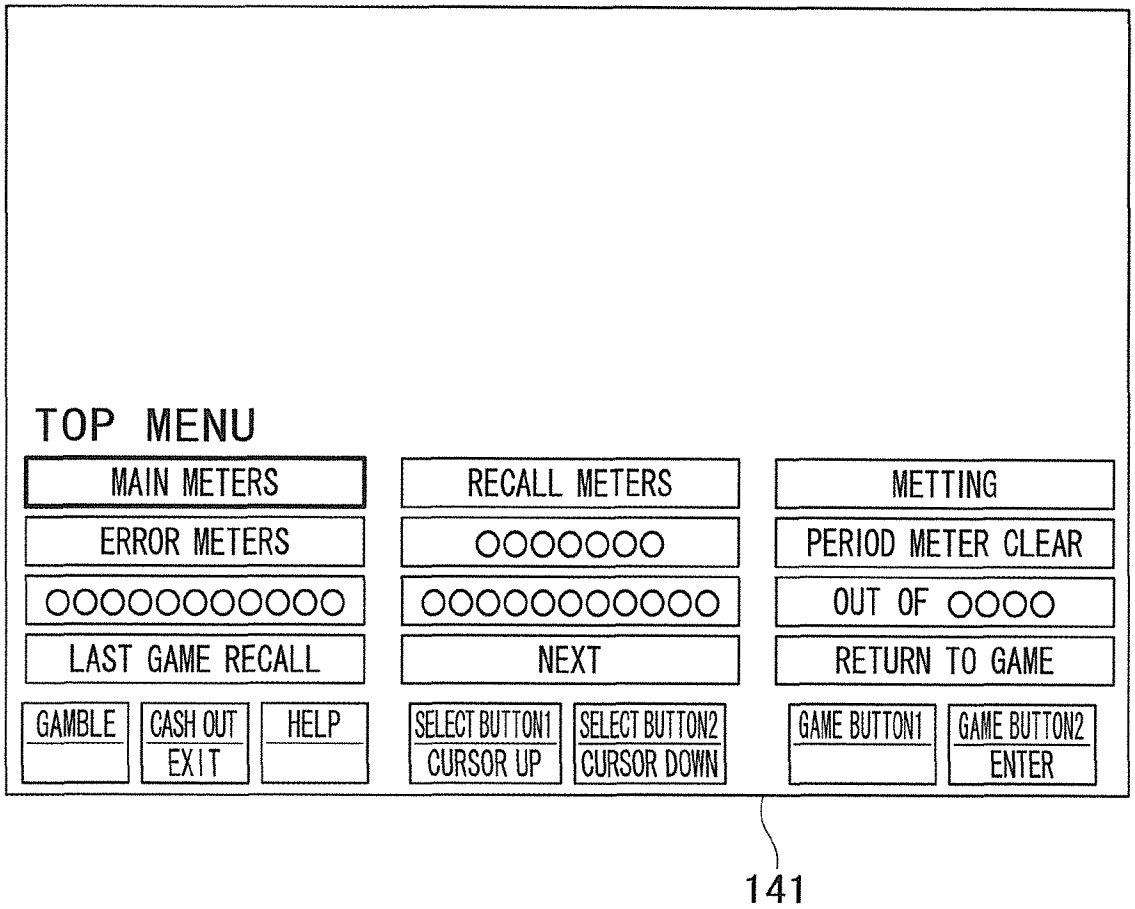
FIG. 103 shows AUDIT national flag switch setting in the slot machine of the embodiment of the present invention.
Figure 104:
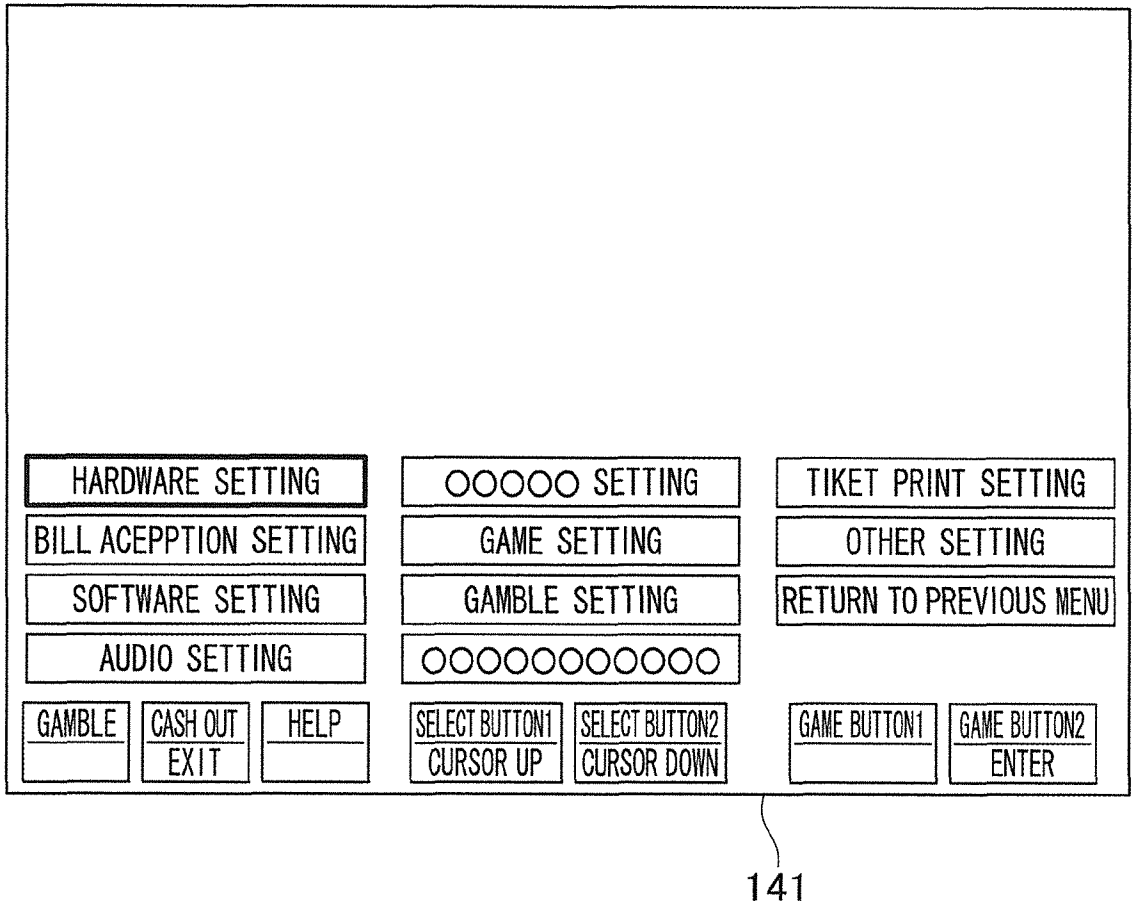
FIG. 104 shows AUDIT national flag switch setting in the slot machine of the embodiment of the present invention.
Figure 105:
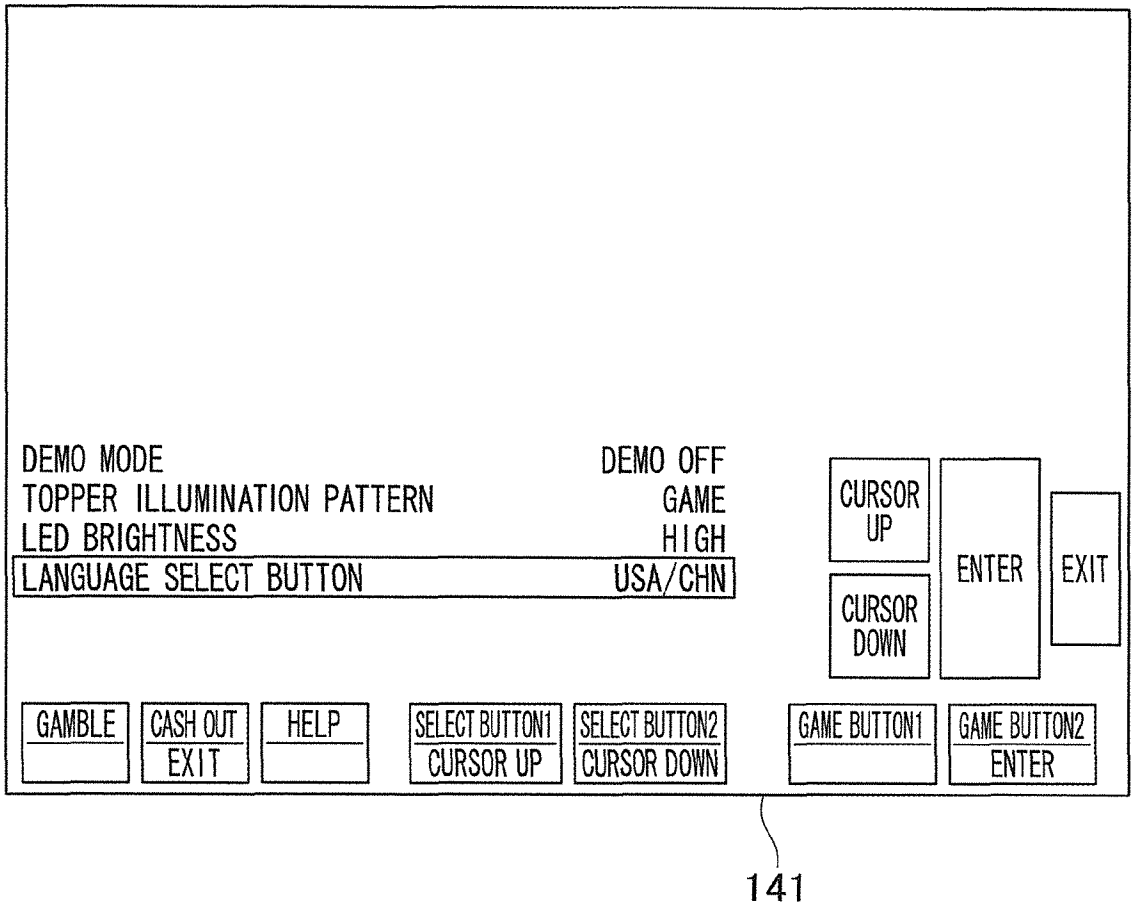
FIG. 105 shows AUDIT national flag switch setting in the slot machine of the embodiment of the present invention.
Figure 106:
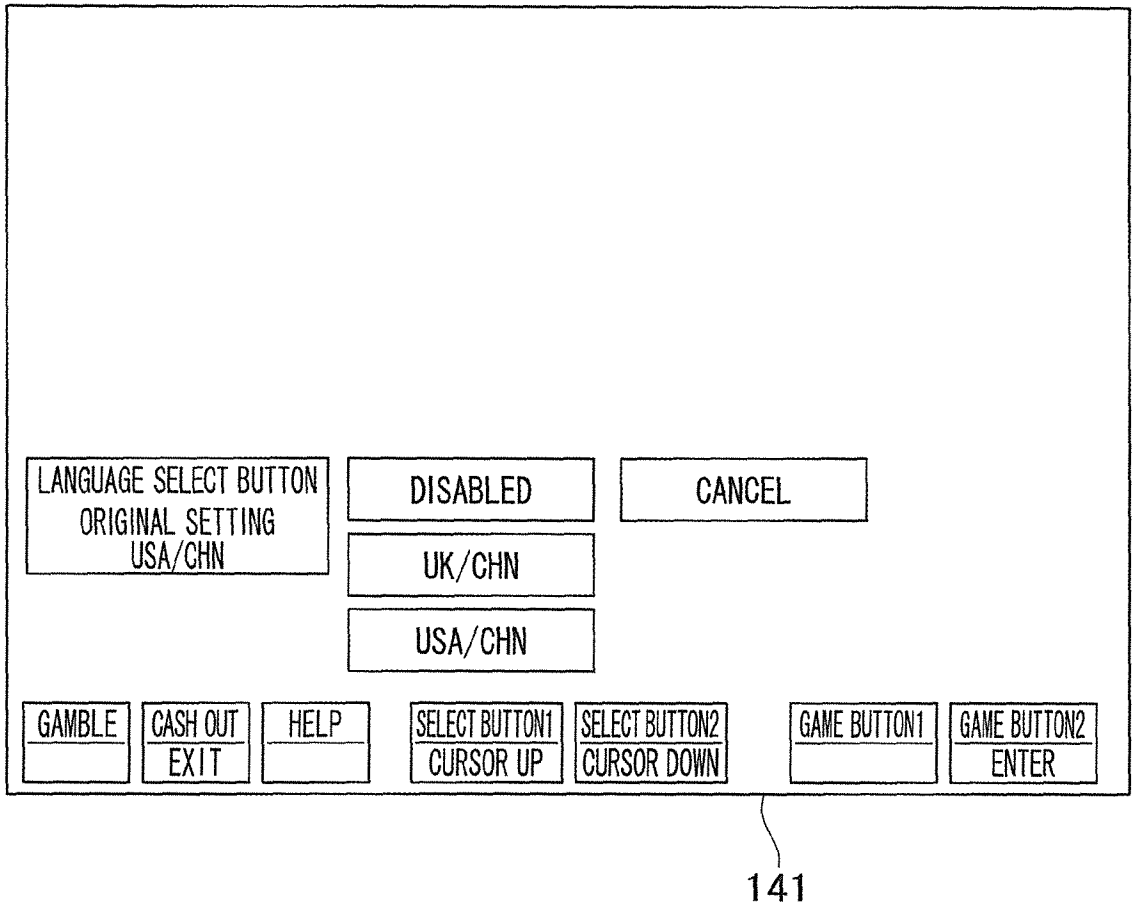
FIG. 106 shows AUDIT national flag switch setting in the slot machine of the embodiment of the present invention.

Now, referring to FIG. 102, the following will describe the sound volume switching touch button 411 of the slot machine 1. FIG. 102 illustrates the sound volume switching touch button of the slot machine of the embodiment of the present invention. As shown in FIG. 102, the sound volume switching touch button 411 is used for selecting one of the first-stage minimum volume, second-stage intermediate volume, and third-stage maximum volume. The sound volume is set at the first-stage minimum volume in the initial setting. Each time the player touches the sound volume switching touch button 411, the sound volume is changed to the second-stage intermediate volume, to the third-stage maximum volume, to the first-stage minimum volume, and to the second-stage intermediate volume, in a looped manner.

[AUDIT National Flag Switch Setting]

Now, referring to FIG. 103 to FIG. 106, AUDIT national flag switch setting of the slot machine 1 will be described. Each of FIG. 103 to FIG. 106 shows the AUDIT national flag switch setting in the slot machine of the embodiment of the present invention. On the lower image display panel 141 shown in FIG. 103 to FIG. 106, the AUDIT national flag switch setting of the slot machine of the embodiment of the present invention makes it possible to specify, by the AUDIT MENU, the "national flag" displayed on the language switching touch button 410 when switching the language. The "national flag" displayed on the language switching touch button 410 is one of the national flags, of U.S.A., U.K., and China.

(Overview of Invention of P14-0823)

The invention of P14-0823 relates to a gaming machine that yields a rescue award, when a game continues without awarding of any benefit.

Traditionally, in a facility where gaming machines such as slot machines and the like are set up, games are played by betting various types of gaming medium such as a credit and the like in the slot machines. In each slot machine are set a plurality of result determination areas (areas for which determination of winning or loss is carried out) on which a bet is placeable, and a benefit (payout) is awarded based on the number of result determination areas on which a bet is placed, the value of bet credit, and the game result.

Further, amongst the slot machines are those configured to perform an awarding (rescue) to the player, when the number of plays resulting no benefit reaches a predetermined number. For example, a constant amount of payout is awarded when the number of plays of the game resulting in no benefit reaches a predetermined value (so-called ceiling number).

It however may lead to unfairness if the rescue is conducted in the same manner, no matter the bets are placed only on a few result determination areas or on many result determination areas.

In view of the above, it is an object of the present invention to provide a gaming machine configured to yield a rescue award according to the number of result determination areas on which the player has placed a bet, when games without any benefit are continued.

An aspect of the present invention is a gaming machine, comprising: an input device that allows selection of any one or more result determination areas out of a plurality of result determination areas;

a display device configured to indicate a game result by rearranging a plurality of symbols in the one or more selected result determination areas;

a storage unit configured to store a counter that keeps track of the game count which is incremented upon start of the game, for each of the plurality of winning areas, store a threshold game count for a special game awarding a payout, for each of the plurality of winning areas, and store a special game basic payout table determination table in which the plurality of winning areas are associated with a plurality of special game basic payout tables; and a controller programmed to execute the processes of:

(1a) receiving a selection of the result determination areas through the input device, (1b) incrementing the game count on the counter corresponding to the winning area selected in the step (1a), upon start of the game, (1c) determining whether the game count on the counter has reached the threshold game count, and awards a special game trigger when the game count is determined as to have reached the threshold game count, (1d) determining a special game basic payout table to be referred to in the special game, based on the winning area corresponding to the counter whose value has reached to the threshold game count in the step (1c) and the special game basic payout table determination table, and (1e) when the special game is run, awarding a payout based on the special game basic payout table determined in the step (1d).

In the structure, the plurality of result determination areas are associated with the plurality of special game basic payout tables in the special game basic payout table determination table.

Therefore, it is possible to adjust an expectation value for the payout by the relation between each of the result determination areas to be selected by the player and the special game basic payout table to be the reference for the payout in the special game. As such, it is possible to set the expectation value for the payout of the special game according to the result determination areas selected by the player, and ensure the fairness of the payouts in the special game.

The above aspect of the present invention is adapted so that in the game, transition to the special game occurs when a predetermined condition is satisfied, and the controller is configured to perform the following steps of:

(1f) running the game, and when the predetermined condition is satisfied as the result of the game, determines the special game basic payout table to be referred to in the special game, based on the winning area selected in the step (1a) and the special game basic payout table determination table, and (1g) when the predetermined condition is satisfied and transition to the special game occurs, awarding a payout based on the special game basic payout table determined in the step (1f).

With the structure, it is possible to use the special game basic payout table determination table as a table for determining the special game basic payout table used in the special game having been transited as the result of satisfying the predetermined condition in the game, and as a table for determining the special game basic payout table used in the special game transited when the game play count on the counter reaches the threshold game play count.

Further, another aspect of the present invention is a gaming machine, comprising: a result determination area input device that allows selection of any one or more result determination areas out of a plurality of result determination areas;

a display device configured to indicate a game result by rearranging a plurality of symbols in the one or more selected result determination areas;

a credit type input device that enables betting of any of a plurality of credit types of different credit values;

a storage unit configured to store a total counter that keeps track of the game count which is incremented upon start of the game, for each of the plurality of winning areas, stores a credit type counter for each credit type, which keeps track of the game count incremented upon start of the game for each winning area, store a threshold game count for the special game trigger of a special game awarding a payout, for each of the plurality of winning areas, and store a plurality of payout rate random determination tables each of which is for determining the payout rate; and a controller configured to award a benefit based on the credit bet and the combination of a plurality of symbols rearranged in the selected result determination area, and to execute the following processes of:

(2a) receiving a selection of the result determination areas through the result determination area input device and receiving a bet of any of the credit types through the credit type input device;

(2b) incrementing the game count on the total counter corresponding to the winning area selected in the step (2a), upon start of the game, (2c) incrementing the game count on the credit type counter corresponding to the winning area selected in the step (2a) and to the credit type of the bet placed, upon start of the game, (2d) determining whether the game count on the total counter has reached the threshold game count, and when the game count is determined as to have reached the threshold game count, calculating random determination probabilities, based on the percentage of the credit types in the threshold game count, and creates a payout rate random determination table determination table in which the calculated random determination probabilities are associated with the plurality of payout rate random determination tables;

(2e) executing a payout rate random determination table random determination for determining the payout rate random determination table, based on the payout rate random determination table determination table created in the step (2d);

(2f) executing payout rate random determination for determining the payout rate based on the payout rate random determination table determined in the step (2e); and (2g) referring to the payout rate determined in the step (2f), at a time of awarding a payout in the special game.

With the above structure, the payout rate random determination table determination table is created according to the usage counts of each of the credit types at a time the value of the total counter reaches the threshold game play count. Then, based on the payout rate random determination table determination table created, the payout rate random determination table is determined, and random determination is executed for determining the payout rate in the special game based on the payout rate random determination having been determined. In this payout rate random determination, there is executed a random determination corresponding to the usage counts of each of the credit types at a time the game count reaches the threshold game count. That is, the usage count of each credit type at a time the value of the total counter reaches the threshold game play count affects determination of the payout rate in the special game. Therefore, each bet placed until the value of the total counter reaches the threshold game play count is not wasted, which ensures the fairness in the special game.

Further, another aspect of the present invention is a control method of a gaming machine, comprising: an input device that allows selection of any one or more result determination areas out of a plurality of result determination areas;

a display device configured to indicate a game result by rearranging a plurality of symbols in the one or more selected result determination areas;

a storage unit configured to store a counter that keeps track of the game count which is incremented upon start of the game, for each of the plurality of winning areas, store a threshold game count for a special game awarding a payout, for each of the plurality of winning areas, and store a special game basic payout table determination table in which the plurality of winning areas are associated with a plurality of special game basic payout tables; and a controller, the method comprising the controller-executed steps of:

(1a) receiving a selection of the winning areas through the input device, (1b) incrementing the game count on the counter corresponding to the winning area selected in the step (1a), upon start of the game, and (1c) determining whether the game count on the counter has reached the threshold game count, and awards a special game trigger when the game count is determined as to have reached the threshold game count, (1d) determining a special game basic payout table to be referred to in the special game, based on the winning area corresponding to the counter whose value has reached to the threshold game count in the step (1c) and the special game basic payout table determination table, and (1e) when the special game is run, awarding a payout based on the special game basic payout table determined in the step (1d).

In the method, the plurality of result determination areas are associated with the plurality of special game basic payout tables in the special game basic payout table determination table. Therefore, it is possible to adjust an expectation value for the payout by the relation between each of the result determination areas to be selected by the player and the special game basic payout table to be the reference for the payout in the special game. As such, it is possible to set the expectation value for the payout of the special game according to the result determination areas selected by the player, and ensure the fairness of the payouts in the special game.

The above structures provide a gaming machine configured to yield a rescue award according to the number of result determination areas on which the player has placed a bet, when games without any benefit are continued.

(Overview of Invention of P14-0826)

The invention of P14-0826 relates to a gaming machine configured to display a game result by rearranging a plurality of types of symbols aligned on a plurality of video reels.

As an example of a gaming machine that awards a payout to the player according to a win of the game, there have traditionally been slot machines each of which having a plurality of reels having on their outer circumferential surfaces a plurality of symbols. In any of the above slot machines, a predetermined operation by the player starts a unit game, scroll reels displayed on a display so that a plurality of symbols on the outer circumferential surfaces of the reels are scroll displayed. Then, after elapse of a predetermined period, all the reels are stopped and the symbols on the reels are partially displayed on the display. Then, according to a combination of the displayed symbols, a payout is awarded, and the unit game is ended.

Among the above slot machines, there is a slot machine configured to disable scrolling of a predetermined symbol in a subsequent unit game, based on a predetermined condition, so that the predetermined symbol is kept displayed (fix-displayed) on the display. Since such a slot machine keeps displaying the predetermined symbol on the display, a combination of symbols containing that predetermined symbol is easily formed. This contributes to a higher expectation of the player for winning of a payout.

However, fixing the predetermined symbol in the subsequent unit game leads to exclusion of a symbol which was supposed to be stopped in the first place in the position where the predetermined symbol is fixed, in the subsequent unit game. That is, the player may miss a chance of winning a payout that could have been won if there was not the fixed symbol. This could lessen the player's expectation for winning of a payout.

In view of this, it is an object to provide a gaming machine in which a symbol to be rearranged in the first place in the position where the predetermined type of symbol is fixed is regarded as a symbol forming a combination of symbols subjected to awarding of a payout.

An aspect of the present invention is a gaming machine, comprising: a display device configured to display a game result by rearranging a plurality of types of symbols aligned on a plurality of video reels;

a storage unit configured to store a payout table in which a plurality of symbol combinations and a plurality of payouts are associated; and a controller programmed to execute the processes of:

(1A) running a game and rearrange the plurality of symbols aligned on a plurality of video reels on the display device;

(1B) determining and awarding a payout, referring to a combination of the symbols rearranged on the display device and the payout table;

(1C) determining whether or not the symbols rearranged include a predetermined type of symbol, and if the symbols include the predetermined type of symbol, fixing the predetermined type of symbol on the display device until the game is run a predetermined number of times;

(1D) running the game again and rearrange the plurality of symbols aligned on the plurality of video reels on the display device;

(1E) determining and awarding a payout, referring to a combination of the symbols rearranged on the display device in the step (1D) and the symbol fixed in the step (1C), and the payout table;

(1F) if the symbol fixed in the step (1C) and a symbol rearranged in the step (1D) in the position of the symbol fixed in the step (1C) overlap with each other in the combination of symbols for which the payout is to be awarded as the result of the step (1E), a combination of symbols including the symbol fixed in the step (1C) and a combination of symbols including the symbol overlapped with the symbol fixed in the step (1C) are both subjected to awarding of a payout and are displayed.

(1G) repeating the step (1C) to (1F) until the predetermined number of plays of the game are consumed.

With the above structure, a predetermined type of symbol is accumulatively fixed, in the process of running a game a predetermined number of times. This facilitates formation of a combination including the predetermined type of symbol. Further, although the predetermined type of symbol is fixed, a symbol to be rearranged in the first place in the position where the predetermined type of symbol is fixed, as the result of rearranging a plurality of types of symbols aligned on the plurality of video reels, will be regarded as a symbol forming a combination of symbols subjected to awarding of a payout.

The gaming machine of the above aspect of the present invention is adapted so that:

the controller in the step (1F), if a combination of symbols including the symbol fixed in the step (1C) is not a combination for which a payout is to be awarded and if a combination of symbols including a symbol to be rearranged in the step (1D) in the position of the symbol fixed in the step (1C) is a combination for which a payout is to be awarded, the controller displays the symbol to be rearranged in the step (1D) in the position of the symbol fixed in the step (1C) in front of the symbol fixed in the step (1C).

The above structure most preferentially displays on the display device a combination of symbols for which a payout is to be awarded.

The gaming machine of the above aspect of the present invention is adapted so that:

in the step (1F), if a combination of symbols including the symbol fixed in the step (1F) is a combination for which a payout is to be awarded, and if a combination of symbols including a symbol to be rearranged in the step (1D) in the position of the symbol fixed in the step (1C) is a combination for which a payout is to be awarded, the controller alternately displays on the display device the combination of symbols including the symbol fixed in the step (1C), and a combination of symbols including the symbol to be rearranged in the step (1D) in the position of the symbol fixed in the step (1C).

In the above structure, if a combination of symbols including the symbol fixed in the step (1F) is a combination for which a payout is to be awarded, and if a combination of symbols including a symbol to be rearranged in the step (1D) in the position of the symbol fixed in the step (1C) is a combination for which a payout is to be awarded, both of symbol combinations are displayed.

The gaming machine of the above aspect of the present invention is adapted so that in the step (1F), a symbol rearranged behind the symbol fixed is partially visible.

Traditionally, when a symbol is fixed, a symbol that is supposed to be stopped in the position of the fixed symbol will be excluded in the subsequent unit games. In this structure, the player may miss a chance of winning a payout that could have been won if there was not the fixed symbol. This could lessen the player's expectation for winning of a payout.

Further, if a symbol is fixed and a part of symbol rearranged behind the fixed symbol is visible, it could further disappoint the player.

Further, although the predetermined type of symbol is fixed, a symbol to be rearranged in the first place in the position where the predetermined type of symbol is fixed, as the result of rearranging a plurality of types of symbols aligned on the plurality of video reels, will be regarded as a symbol forming a combination of symbols subjected to awarding of a payout.

An aspect of the present invention is a method of controlling a gaming machine, comprising:

a display device configured to display a game result by rearranging a plurality of types of symbols aligned on a plurality of video reels;

a storage unit configured to store a payout table in which a plurality of symbol combinations and a plurality of payouts are associated; and a controller, the method comprising the controller-executed steps of:

(1A) running a game and rearrange the plurality of symbols aligned on a plurality of video reels on the display device;

(1B) determining and awarding a payout, referring to a combination of the symbols rearranged on the display device and the payout table;

(1C) determining whether or not the symbols rearranged include a predetermined type of symbol, and if the symbols include the predetermined type of symbol, fixing the predetermined type of symbol on the display device until a predetermined number of plays of the game are consumed;

(1D) running a game and rearrange the plurality of symbols aligned on a plurality of video reels on the display device;

(1E) determining and awarding a payout, referring to a combination of the symbols rearranged on the display device in the step (1D) and the symbol fixed in the step (1C), and the payout table;

(1F) if the symbol fixed in the step (1C) and a symbol rearranged in the step (1D) in the position of the symbol fixed in the step (1C) overlap with each other in the combination of symbols for which the payout is to be awarded as the result of the step (1E), displaying and subjecting to awarding of a payout both a combination of symbols including the symbol fixed in the step (1C) and a combination of symbols including the symbol overlapped with the symbol fixed in the step (1C); and (1G) repeating the step (1C) to (1F) until the predetermined number of plays of the game are consumed.

With the above method, a predetermined type of symbol is accumulatively fixed, in the process of running a game a predetermined number of times. This facilitates formation of a combination including the predetermined type of symbol. Further, although the predetermined type of symbol is fixed, a symbol to be rearranged in the first place in the position where the predetermined type of symbol is fixed, as the result of rearranging a plurality of types of symbols aligned on the plurality of video reels, will be regarded as a symbol forming a combination of symbols subjected to awarding of a payout.

Further, there is provided a gaming machine in which a symbol to be rearranged in the first place in the position where the predetermined type of symbol is fixed is regarded as a symbol forming a combination of symbols subjected to awarding of a payout.

(Overview of Invention of P14-0827)

The invention of P14-0827 relates to a gaming machine configured to display a game result by rearranging a plurality of types of symbols aligned on a plurality of video reels.

As an example of a gaming machine that awards a payout to the player according to a win of the game, there have traditionally been slot machines each of which having a plurality of reels having on their outer circumferential surfaces a plurality of symbols. In any of the above slot machines, a predetermined operation by the player starts a unit game, scroll reels displayed on a display so that a plurality of symbols on the outer circumferential surfaces of the reels are scroll displayed. Then, after elapse of a predetermined period, all the reels are stopped and the symbols on the reels are partially displayed on the display. Then, according to a combination of the displayed symbols, a payout is awarded, and the unit game is terminated.

Among the above slot machines, there is a slot machine configured to disable scrolling of a predetermined symbol in a subsequent unit game, based on a predetermined condition, so that the predetermined symbol is fixed (fix-displayed) on the display. Since such a slot machine keeps displaying the predetermined symbol on the display, a combination of symbols containing that predetermined symbol is easily formed. This contributes to a higher expectation of the player for winning of a payout.

However, in some cases, only fixing the predetermined symbol in the subsequent unit game may fall short for sufficiently satisfying the player's expectation for winning of a payout.

In view of the above, it is an object to provide a gaming machine configured to fix-display a predetermined symbol on the display and provide sufficient period for formation of a combination of symbols including the predetermined symbol, thereby enhancing the player's expectation for winning of a payout.

An aspect of the present invention is a gaming machine, comprising: a display device configured to display a game result of a normal game and a game result of a free game to which transition occurs from the normal game, by rearranging a plurality of types of symbols aligned on a plurality of video reels;

a storage unit configured to store a payout table in which a plurality of symbol combinations and a plurality of payouts are associated; and a controller programmed to execute the processes of:

(1A) when the predetermined condition is satisfied as a result of the normal game, awarding a predetermined number of plays of a free game;

(1B) selecting any one or more symbols out of the plurality of types of symbols by means of random selection;

(1C) running the free game and rearrange the plurality of symbols aligned on a plurality of video reels on the display device;

(1D) determining and awarding a payout, referring to a combination of the symbols rearranged on the display device and the payout table;

(1E) determining whether or not the symbols rearranged include the one or more symbols selected in the step (1B), and if the symbols include the one or more symbols selected, fixing each of the one or more symbols selected on the display device until the game is run a predetermined number of times;

(1F) running the free game again and rearrange the plurality of symbols aligned on the plurality of video reels on the display device;

(1G) determining and awarding a payout, referring to a combination of the symbols rearranged on the display device in the step (1D) and the symbol fixed in the step (1E), and the payout table; and (1H) repeating the steps (1E) to (1G) until the free game is run a predetermined number of times.

With the above structure, the one or more symbols randomly selected are accumulatively fixed, in the process of running a game a predetermined number of times. This facilitates formation of a combination including the one or more randomly selected symbols.

The gaming machine of the above aspect of the present invention may further comprise:

an input device that allows selection of any one or more result determination areas out of a plurality of result determination areas, wherein the controller executes a process of receiving a selection of a result determination area out of the result determination areas through the input device during the normal game, in the step (1E), executes a process of determining whether or not the selected result determination area includes the one or more symbols selected in the step (1B), and if the selected result determination area includes the one or more symbols selected, fixing the one or more symbols selected in the selected result determination area until a predetermined number of plays of the free game are consumed; and in the step (1G), executing a process of determining and awarding a payout, referring to a combination of the symbols including symbols rearranged in the selected result determination area and symbols fixed in the result determination area, and the payout table.

With the above structure, the one or more symbols randomly selected are accumulatively fixed only in the selected result determination area. This facilitates, according to the result determination area selected, formation of a combination including the one or more randomly selected symbols. Further, the one or more randomly selected symbols are not fixed in the non-selected result determination areas, which makes it possible to avoid giving an unnecessary expectation feeling to the player.

The gaming machine of the above aspect of the present invention may further comprise:

an additional bet device configured to enable placement of an additional bet which leads to awarding of a predetermined number of free games in addition to the foregoing predetermined number of free games, if a predetermined condition is satisfied as the result of the normal game.

wherein the controller further executes a process of receiving an additional bet through the additional bet device during the normal game, and executes in the step (1A) a process of awarding the predetermined number of free games in addition to the foregoing predetermined number of free games, if the predetermined condition is satisfied as the result of the normal game.

In the above structure, placing an additional bet by using the additional bet device may lead to an increase in the number of free games awarded when the predetermined condition is satisfied as the result of the normal game. With the above structure, the one or more symbols randomly selected are accumulatively fixed, in the process of running a game an increased number of times. This further facilitates formation of a combination including the one or more randomly selected symbols.

An aspect of the present invention is a method of controlling a gaming machine comprising: a display device configured to display a game result of a normal game and a game result of a free game to which transition occurs from the normal game, by rearranging a plurality of types of symbols aligned on a plurality of video reels;

a storage unit configured to store a payout table in which a plurality of symbol combinations and a plurality of payouts are associated; and a controller, the method comprising the controller-executed steps of:

(1A) awarding a predetermined number of free games when a predetermined condition is satisfied as a result of the normal game;

(1B) selecting any one or more symbols out of the plurality of types of symbols by means of random selection;

(1C) running a free game and rearranging the plurality of symbols aligned on a plurality of video reels on the display device;

(1D) determining and awarding a payout, referring to a combination of the symbols rearranged on the display device and the payout table;

(1E) determining whether or not the symbols rearranged include the one or more symbols selected in the step (1B), and if the symbols include the one or more symbols selected, fixing each of the one or more symbols selected on the display device until the game is run a predetermined number of times;

(1F) running the free game again and rearrange the plurality of symbols aligned on the plurality of video reels on the display device;

(1G) determining and awarding a payout, referring to a combination of the symbols rearranged on the display device in the step (1D) and the symbol fixed in the step (1E), and the payout table; and (1H) repeating the steps (1E) to (1G) until the free game is run a predetermined number of times.

With the above method, the one or more symbols randomly selected are accumulatively fixed, in the process of running a game a predetermined number of times. This facilitates formation of a combination including the one or more randomly selected symbols.

There is provided a gaming machine configured to fix-display a predetermined symbol on the display and provide sufficient period for formation of a combination of symbols including the predetermined symbol, thereby enhancing the player's expectation for winning of a payout.

[Other Notes]

Further, the detailed description above is mainly focused on characteristics of the present invention to for the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A gaming machine, comprising: an input device that allows selection of any one or more result determination areas out of a plurality of result determination areas;

a display device configured to indicate a game result by rearranging a plurality of symbols in the one or more selected result determination areas;

a storage unit configured to store a counter that keeps track of a game play count which is incremented upon start of a game, for each of the plurality of result determination areas, store a threshold game play count for a special game awarding a payout, for each of the plurality of result determination areas, and store a special game basic payout table determination table in which the plurality of result determination areas are associated with a plurality of special game basic payout tables; and a controller programmed to execute the processes of:

(1a) receiving a selection of the result determination areas through the input device, (1b) incrementing the game play count on the counter corresponding to the result determination area selected in the step (1 a), upon start of the game, (1c) determining whether the game play count on the counter has reached the threshold game play count, and awards a special game trigger when the game play count is determined as to have reached the threshold game play count, (1d) determining a special game basic payout table to be referred to in the special game, based on the result determination area corresponding to the counter whose value has reached to the threshold game play count in the step (1c) and the special game basic payout table determination table, and (1e) when the special game is run, awarding a payout based on the special game basic payout table determined in the step (1d).

2. The gaming machine according to claim 1, wherein, in the game, transition to the special game occurs when a predetermined condition is satisfied, and the controller is configured to perform the following steps of:

(1f) running the game, and when the predetermined condition is satisfied as the result of the game, determines the special game basic payout table to be referred to in the special game, based on the result determination area selected in the step (1a) and the special game basic payout table determination table, and (1g) when the predetermined condition is satisfied and transition to the special game occurs, awarding a payout based on the special game basic payout table determined in the step (1f).

3. A gaming machine, comprising: an input device that allows selection of any one or more result determination areas out of a plurality of result determination areas;

a display device configured to indicate a game result by rearranging a plurality of symbols in the one or more selected result determination areas;

a storage unit configured to store a counter that keeps track of a game play count which is incremented upon start of a game, for each of the plurality of result determination areas, store a threshold game play count for a special game awarding a payout, for each of the plurality of result determination areas, and store a special game basic payout table determination table in which the plurality of result determination areas are associated with a plurality of special game basic payout tables; and a controller, the method comprising the controller-executed steps of:

(1a) receiving a selection of the result determination areas through the input device, (1b) incrementing the game play count on the counter corresponding to the result determination area selected in the step (1 a), upon start of the game, and (1c) determining whether the game play count on the counter has reached the threshold game play count, and awards a special game trigger when the game play count is determined as to have reached the threshold game play count, (1d) determining a special game basic payout table to be referred to in the special game, based on the result determination area corresponding to the counter whose value has reached to the threshold game play count in the step (1c) and the special game basic payout table determination table, and (1e) when the special game is run, awarding a payout based on the special game basic payout table determined in the step (1d).

* * * * *